US008205356B2

(12) United States Patent
Ellis

(10) Patent No.: US 8,205,356 B2
(45) **Date of Patent: *Jun. 26, 2012**

(54) DEVICES WITH INTERNAL FLEXIBILITY SIPES, INCLUDING SIPED CHAMBERS FOR FOOTWEAR

(75) Inventor: Frampton E. Ellis, Jasper, FL (US)

(73) Assignee: Frampton E. Ellis, Jasper, FL (US)

( * ) Notice: Subject to any disclaimer, the term of this patent is extended or adjusted under 35 U.S.C. 154(b) by 745 days.

This patent is subject to a terminal disclaimer.

(21) Appl. No.: 11/719,637

(22) PCT Filed: Nov. 21, 2005

(86) PCT No.: PCT/US2005/042341

§ 371 (c)(1), (2), (4) Date: May 17, 2007

(87) PCT Pub. No.: WO2006/058013

PCT Pub. Date: Jun. 1, 2006

(65) Prior Publication Data

US 2009/0199429 A1 Aug. 13, 2009

Related U.S. Application Data

(60) Provisional application No. 60/629,384, filed on Nov. 22, 2004, provisional application No. 60/629,385, filed on Nov. 22, 2004, provisional application No. 60/629,523, filed on Nov. 22, 2004, provisional application No. 60/633,664, filed on Dec. 6, 2004, provisional application No. 60/634,781, filed on Dec. 9, 2004, provisional application No. 60/634,782, filed on Dec. 9, 2004, provisional application No. 60/672,407, filed on Apr. 18, 2005, provisional application No. 60/677,538, filed on May 4, 2005, provisional application No. 60/679,182, filed on May 9, 2005, provisional application No. 60/700,179, filed on Jul. 18, 2005.

(51) Int. Cl.
*A43B 13/20* (2006.01)

(52) U.S. Cl. ..... 36/29; 36/35 B

(58) Field of Classification Search ..... 36/29, 35 B, 36/153, 154, 25 R, 30 R
See application file for complete search history.

(56) References Cited

U.S. PATENT DOCUMENTS 193,914 A 8/1877 Berry
(Continued)

FOREIGN PATENT DOCUMENTS

AU 200963 5/1958
(Continued)

OTHER PUBLICATIONS

European Search Report EP-05825112.5-2318 (Jul. 14, 2010).
(Continued)

*Primary Examiner* — Ted Kavanaugh
(74) *Attorney, Agent, or Firm* — Knoble Yoshida & Dunleavy, LLC

(57) ABSTRACT

The present invention attempts to replicate in footwear, orthotics, and other products the naturally effective anatomical structures like a bare foot that provide superior flexibility, cushioning, and stable support compared to existing products. More specifically, the invention relates to a device for such products including a unitary internal sipe component, said internal sipe providing increased flexibility for said device. Even more specifically, the invention relates to footwear, orthotic or other products with an outer chamber and at least one inner chamber inside the outer chamber; the outer chamber and the inner chamber being separated at least in part by an internal sips; and the internal sipe providing increased flexibility, cushioning, and stability.

39 Claims, 116 Drawing Sheets

U.S. PATENT DOCUMENTS

| | | | | | |
|---|---|---|---|---|---|
| 280,791 | A | | 7/1883 | Brooks | |
| 288,127 | A | | 11/1883 | Shepard | |
| 500,385 | A | | 6/1893 | Hall | |
| 532,429 | A | | 1/1895 | Rogers | |
| 584,373 | A | | 6/1897 | Kuhn | |
| 1,283,335 | A | | 10/1918 | Shillcock | |
| 1,289,106 | A | | 12/1918 | Bullock | |
| D55,115 | S | | 5/1920 | Barney | |
| 1,458,446 | A | | 6/1923 | Schaeffer | |
| 1,622,860 | A | | 3/1927 | Cutler | |
| 1,639,381 | A | | 8/1927 | Manelas | |
| 1,701,260 | A | | 2/1929 | Fischer | |
| 1,735,986 | A | | 11/1929 | Wray | |
| 1,853,034 | A | | 4/1932 | Bradley | |
| 2,004,906 | A | * | 6/1935 | Simister | 36/29 |
| 2,120,987 | A | | 6/1938 | Murray | |
| 2,147,197 | A | | 2/1939 | Glidden | |
| 2,155,166 | A | | 4/1939 | Kraft | |
| 2,162,912 | A | | 6/1939 | Craver | |
| 2,170,652 | A | | 8/1939 | Brennan | |
| 2,179,942 | A | | 11/1939 | Lyne | |
| D119,894 | S | | 4/1940 | Sherman | |
| 2,201,300 | A | | 5/1940 | Prue | |
| 2,206,860 | A | | 7/1940 | Sperry | |
| D122,131 | S | | 8/1940 | Sannar | |
| D128,817 | S | | 8/1941 | Esterson | |
| 2,251,468 | A | | 8/1941 | Smith | |
| 2,328,242 | A | | 8/1943 | Witherill | |
| 2,345,831 | A | | 4/1944 | Pierson | |
| 2,433,329 | A | | 12/1947 | Adler et al. | |
| 2,434,770 | A | | 1/1948 | Lutey | |
| 2,470,200 | A | | 5/1949 | Wallach | |
| 2,546,827 | A | * | 3/1951 | Lavinthal | 36/154 |
| 2,627,676 | A | | 2/1953 | Hack | |
| 2,718,715 | A | | 9/1955 | Spilman | |
| 2,762,134 | A | * | 9/1956 | Town | 36/153 |
| 2,814,133 | A | | 11/1957 | Herbst | |
| 3,005,272 | A | | 10/1961 | Shelare et al. | |
| 3,087,261 | A | | 4/1963 | Russell | |
| 3,100,354 | A | | 8/1963 | Lombard et al. | |
| 3,110,971 | A | | 11/1963 | Chang | |
| 3,204,678 | A | * | 9/1965 | Worcester | 383/3 |
| 3,253,355 | A | | 5/1966 | Menken | |
| 3,305,947 | A | | 2/1967 | Kalsoy | |
| 3,308,560 | A | | 3/1967 | Jones | |
| 3,416,174 | A | | 12/1968 | Novitske | |
| 3,469,576 | A | * | 9/1969 | Everts et al. | 36/154 |
| 3,512,274 | A | | 5/1970 | McGrath | |
| 3,535,799 | A | | 10/1970 | Onituska | |
| 3,806,974 | A | | 4/1974 | DiPaolo | |
| 3,824,716 | A | | 7/1974 | DiPaolo | |
| 3,834,046 | A | | 9/1974 | Fowler | |
| 3,863,366 | A | | 2/1975 | Auberry et al. | |
| 3,958,291 | A | | 5/1976 | Spier | |
| 3,964,181 | A | | 6/1976 | Holcombe, Jr. | |
| 3,997,984 | A | | 12/1976 | Hayward | |
| 4,003,145 | A | | 1/1977 | Liebscher et al. | |
| 4,030,213 | A | | 6/1977 | Daswick | |
| 4,043,058 | A | | 8/1977 | Hollister et al. | |
| 4,059,910 | A | | 11/1977 | Bryden | |
| 4,068,395 | A | | 1/1978 | Senter | |
| 4,083,125 | A | | 4/1978 | Benseler et al. | |
| 4,096,649 | A | | 6/1978 | Saurwein | |
| 4,098,011 | A | | 7/1978 | Bowerman et al. | |
| 4,128,950 | A | | 12/1978 | Bowerman et al. | |
| 4,128,951 | A | | 12/1978 | Transill | |
| 4,141,158 | A | | 2/1979 | Benseler et al. | |
| 4,145,785 | A | | 3/1979 | Lacey | |
| 4,149,324 | A | | 4/1979 | Lesser et al. | |
| 4,161,828 | A | | 7/1979 | Benseler et al. | |
| 4,161,829 | A | | 7/1979 | Wayser | |
| 4,170,078 | A | | 10/1979 | Moss | |
| 4,183,156 | A | | 1/1980 | Rudy | |
| 4,194,310 | A | | 3/1980 | Bowerman | |
| D256,180 | S | | 8/1980 | Turner | |
| D256,400 | S | | 8/1980 | Famolare, Jr. | |
| 4,217,705 | A | | 8/1980 | Donzis | |
| 4,219,945 | A | | 9/1980 | Rudy | |
| 4,223,457 | A | | 9/1980 | Borgeas | |
| 4,227,320 | A | | 10/1980 | Borgeas | |
| 4,235,026 | A | | 11/1980 | Plagenhoef | |
| 4,237,627 | A | | 12/1980 | Turner | |
| 4,240,214 | A | | 12/1980 | Sigle et al. | |
| 4,241,523 | A | | 12/1980 | Daswick | |
| 4,245,406 | A | | 1/1981 | Landay | |
| 4,250,638 | A | | 2/1981 | Linnemann | |
| 4,258,480 | A | | 3/1981 | Famolare, Jr. | |
| 4,259,792 | A | | 4/1981 | Halberstadt | |
| 4,262,433 | A | | 4/1981 | Hagg et al. | |
| 4,263,728 | A | | 4/1981 | Frecentese | |
| 4,266,349 | A | | 5/1981 | Schmohl | |
| 4,268,980 | A | | 5/1981 | Gudas | |
| 4,271,606 | A | | 6/1981 | Rudy | |
| 4,272,858 | A | | 6/1981 | Hlustik | |
| 4,274,211 | A | | 6/1981 | Funck | |
| 4,297,797 | A | | 11/1981 | Meyers | |
| 4,302,892 | A | | 12/1981 | Adamik | |
| 4,305,212 | A | | 12/1981 | Coomer | |
| 4,308,671 | A | | 1/1982 | Bretschneider | |
| 4,309,832 | A | | 1/1982 | Hunt | |
| 4,316,332 | A | | 2/1982 | Giese et al. | |
| 4,316,335 | A | | 2/1982 | Giese et al. | |
| 4,319,412 | A | | 3/1982 | Muller et al. | |
| D264,017 | S | | 4/1982 | Turner | |
| 4,322,895 | A | | 4/1982 | Hockerson | |
| D265,019 | S | | 6/1982 | Vermonet | |
| 4,335,529 | A | | 6/1982 | Badalamenti | |
| 4,340,626 | A | | 7/1982 | Rudy | |
| 4,342,161 | A | | 8/1982 | Schmohl | |
| 4,348,821 | A | | 9/1982 | Daswick | |
| 4,354,319 | A | | 10/1982 | Block et al. | |
| 4,361,971 | A | | 12/1982 | Bowerman | |
| 4,366,634 | A | | 1/1983 | Giese et al. | |
| 4,370,817 | A | | 2/1983 | Ratanangsu | |
| 4,372,059 | A | | 2/1983 | Ambrose | |
| 4,398,357 | A | | 8/1983 | Batra | |
| 4,399,620 | A | | 8/1983 | Funck | |
| D272,294 | S | | 1/1984 | Watanabe | |
| 4,449,306 | A | | 5/1984 | Cavanagh | |
| 4,451,994 | A | | 6/1984 | Fowler | |
| 4,454,662 | A | | 6/1984 | Stubblefield | |
| 4,455,765 | A | | 6/1984 | Sjöswärd | |
| 4,455,767 | A | | 6/1984 | Bergmans | |
| 4,468,870 | A | | 9/1984 | Sternberg | |
| 4,484,397 | A | | 11/1984 | Curley, Jr. | |
| 4,494,321 | A | | 1/1985 | Lawlor | |
| 4,505,055 | A | | 3/1985 | Bergmans | |
| 4,506,462 | A | | 3/1985 | Cavanagh | |
| 4,521,979 | A | | 6/1985 | Blaser | |
| 4,527,345 | A | | 7/1985 | Lopez | |
| D280,568 | S | | 9/1985 | Stubblefield | |
| 4,542,598 | A | | 9/1985 | Misevich et al. | |
| 4,546,559 | A | | 10/1985 | Dassler | |
| 4,547,979 | A | | 10/1985 | Harada | |
| 4,557,059 | A | | 12/1985 | Misevich et al. | |
| 4,559,723 | A | | 12/1985 | Hamy et al. | |
| 4,559,724 | A | | 12/1985 | Norton | |
| 4,561,195 | A | | 12/1985 | Onoda et al. | |
| 4,570,362 | A | | 2/1986 | Vermonet | |
| 4,577,417 | A | | 3/1986 | Cole | |
| 4,578,882 | A | | 4/1986 | Talarico, II | |
| 4,580,359 | A | | 4/1986 | Kurrash et al. | |
| 4,624,061 | A | | 11/1986 | Wezel et al. | |
| 4,624,062 | A | | 11/1986 | Autry et al. | |
| 4,638,577 | A | | 1/1987 | Riggs | |
| 4,641,438 | A | | 2/1987 | Laird et al. | |
| 4,642,917 | A | | 2/1987 | Ungar | |
| 4,651,445 | A | | 3/1987 | Hannibal | |
| D289,341 | S | | 4/1987 | Turner | |
| 4,654,983 | A | | 4/1987 | Graham | |
| 4,667,423 | A | | 5/1987 | Autry | |
| 4,670,995 | A | | 6/1987 | Huang | |
| 4,676,010 | A | | 6/1987 | Cheskin | |
| 4,694,591 | A | | 9/1987 | Banich et al. | |
| 4,697,361 | A | | 10/1987 | Ganter et al. | |
| D293,275 | S | | 12/1987 | Bua | |
| 4,715,133 | A | | 12/1987 | Hartjes et al. | |

4,724,622 A 2/1988 Mills
D294,425 S 3/1988 Le
4,727,660 A 3/1988 Bernhard
4,730,402 A 3/1988 Norton et al.
4,731,939 A 3/1988 Parracho et al.
4,747,220 A 5/1988 Autry et al.
D296,149 S 6/1988 Diaz
D296,152 S 6/1988 Selbiger
4,748,753 A 6/1988 Ju
4,754,561 A 7/1988 DuFour
4,756,098 A 7/1988 Boggia
4,757,620 A 7/1988 Tiitola
4,759,136 A 7/1988 Stewart et al.
4,768,295 A 9/1988 Ito
4,769,926 A 9/1988 Meyers
4,777,738 A 10/1988 Giese
D298,684 S 11/1988 Pitchford
4,783,910 A 11/1988 Boys
4,785,557 A 11/1988 Kelley et al.
4,817,304 A 4/1989 Parker et al.
4,827,631 A 5/1989 Thorton
4,833,795 A 5/1989 Diaz
4,837,949 A 6/1989 Dufour
D302,900 S 8/1989 Kolman et al.
4,854,057 A 8/1989 Misevich et al.
4,858,340 A 8/1989 Pasternak
4,864,737 A 9/1989 Marrello
4,866,861 A 9/1989 Noone
4,876,807 A 10/1989 Tiitola et al.
4,890,398 A 1/1990 Thomasson
4,894,932 A 1/1990 Harada
4,894,933 A 1/1990 Tonkel et al.
4,897,936 A 2/1990 Fuerst
4,906,502 A 3/1990 Rudy
4,922,631 A 5/1990 Anderie
4,934,070 A 6/1990 Mauger
4,934,073 A 6/1990 Robinson
D310,131 S 8/1990 Hase
D310,132 S 8/1990 Hase
4,947,560 A 8/1990 Fuerst et al.
4,949,476 A 8/1990 Anderie
D310,906 S 10/1990 Hase
4,982,737 A 1/1991 Guttmann
4,989,349 A 2/1991 Ellis, III
D315,634 S 3/1991 Yung-Mao
5,010,662 A 4/1991 Dabuzhsky et al.
5,012,597 A 5/1991 Thomasson
5,014,449 A 5/1991 Richard et al.
5,024,007 A 6/1991 DuFour
5,025,573 A 6/1991 Giese et al.
5,048,203 A 9/1991 Kling
D320,302 S 10/1991 Kiyosawa
2,052,130 A 10/1991 Barry et al.
5,052,130 A 10/1991 Barry
5,067,255 A 11/1991 Hutcheson et al.
5,077,916 A 1/1992 Beneteau
5,079,856 A 1/1992 Truelsen
5,092,060 A 3/1992 Frachey et al.
D327,164 S 6/1992 Hatfield
D327,165 S 6/1992 Hatfield
5,131,173 A 7/1992 Anderie
D328,968 S 9/1992 Tinker
D329,528 S 9/1992 Hatfield
D329,739 S 9/1992 Hatfield
D330,972 S 11/1992 Hatfield et al.
D332,344 S 1/1993 Hatfield et al.
D332,692 S 1/1993 Hatfield et al.
5,191,727 A 3/1993 Barry et al.
5,199,191 A * 4/1993 Moumdjian ..... 36/28
5,224,280 A 7/1993 Preman et al.
5,224,810 A 7/1993 Pitkin
5,237,758 A 8/1993 Zachman
5,247,742 A 9/1993 Kilgore et al.
D347,105 S 5/1994 Johnson
5,317,819 A 6/1994 Ellis, III
5,325,614 A 7/1994 Rosen et al.
5,343,639 A 9/1994 Kilgore
5,353,459 A 10/1994 Potter
5,353,523 A 10/1994 Kilgore
5,369,896 A 12/1994 Frachey et al.
D372,114 S 7/1996 Turner et al.
5,543,194 A 8/1996 Rudy
5,544,429 A 8/1996 Ellis, III
5,555,584 A 9/1996 Moore, III et al.
5,572,805 A 11/1996 Giese et al.
D388,594 S 1/1998 Turner et al.
5,813,141 A * 9/1998 Cho ..... 36/29
5,813,142 A 9/1998 Demon
D409,362 S 5/1999 Turner et al.
D409,826 S 5/1999 Turner et al.
D410,138 S 5/1999 Turner et al.
5,909,948 A 6/1999 Ellis, III
5,930,918 A 8/1999 Healy et al.
5,976,451 A 11/1999 Skaja et al.
5,979,078 A * 11/1999 McLaughlin ..... 36/29
5,987,781 A 11/1999 Pavesi et al.
6,023,857 A 2/2000 Vizy et al.
6,092,305 A * 7/2000 Troy et al. ..... 36/3 B
6,115,941 A 9/2000 Ellis, III
6,115,945 A 9/2000 Ellis, III
6,163,982 A 12/2000 Ellis, III
D444,293 S 7/2001 Turner et al.
6,253,466 B1 7/2001 Harmon-Weiss et al.
6,295,744 B1 10/2001 Ellis, III
6,308,439 B1 10/2001 Ellis
D450,916 S 11/2001 Turner et al.
6,314,662 B1 11/2001 Ellis
6,360,453 B1 3/2002 Ellis
6,374,514 B1 * 4/2002 Swigart ..... 36/35 B
6,391,405 B1 5/2002 Bonk et al.
6,487,795 B1 12/2002 Ellis
6,537,639 B1 3/2003 Huang
6,584,706 B1 7/2003 Ellis
6,589,614 B2 * 7/2003 Stubblefield et al. ..... 428/34.1
6,591,519 B1 7/2003 Ellis
6,629,376 B1 10/2003 Ellis
6,662,470 B2 12/2003 Ellis
6,668,470 B2 12/2003 Ellis
6,675,498 B1 1/2004 Ellis
6,675,499 B2 1/2004 Ellis
6,708,424 B1 3/2004 Ellis
6,729,046 B2 5/2004 Ellis
6,763,616 B2 7/2004 Ellis, III
6,789,331 B1 9/2004 Ellis
6,810,606 B1 11/2004 Ellis, III
D500,585 S 1/2005 Wahoske et al.
6,837,951 B2 1/2005 Rapaport
6,845,573 B2 1/2005 Litchfield et al.
6,846,534 B2 1/2005 Bonk et al.
6,851,204 B2 2/2005 Aveni et al.
6,918,197 B2 7/2005 Ellis
6,946,050 B2 9/2005 Dojan et al.
6,971,193 B1 12/2005 Potter et al.
6,976,321 B1 * 12/2005 Lakic ..... 36/29
6,990,755 B2 1/2006 Hatfield et al.
7,076,890 B2 7/2006 Grove et al.
7,086,179 B2 8/2006 Dojan et al.
7,093,379 B2 8/2006 Ellis
7,127,834 B2 10/2006 Ellis
7,132,032 B2 11/2006 Tawney et al.
7,140,129 B2 11/2006 Newson et al.
7,168,185 B2 1/2007 Ellis
7,168,188 B2 1/2007 Auger et al.
7,174,658 B2 2/2007 Ellis
7,194,826 B2 3/2007 Ungari
7,546,699 B2 6/2009 Ellis, III
2002/0007571 A1 1/2002 Ellis, III
2003/0046830 A1 3/2003 Ellis, III
2003/0096899 A1 5/2003 Pearce
2005/0039346 A1 2/2005 Thomas et al.
2005/0076536 A1 4/2005 Hatfield et al.
2005/0144808 A1 7/2005 Vito et al.
2005/0262739 A1 12/2005 McDonald et al.
2006/0137221 A1 6/2006 Dojan et al.
2006/0179683 A1 8/2006 Weiss et al.
2006/0230636 A1 10/2006 Kokstis et al.
2006/0248749 A1 11/2006 Ellis
2007/0084081 A1 4/2007 Fallon

| | | | |
|---|---|---|---|
| 2007/0094896 | A1 | 5/2007 | Hatfield et al. |
| 2008/0083140 | A1 | 4/2008 | Ellis |
| 2008/0086916 | A1 | 4/2008 | Ellis |
| 2009/0183387 | A1 | 7/2009 | Ellis |
| 2009/0199429 | A1 | 8/2009 | Ellis, III |

FOREIGN PATENT DOCUMENTS

| | | | |
|---|---|---|---|
| CA | 1138194 | | 12/1982 |
| CA | 1176458 | | 10/1984 |
| DE | 23257 | | 5/1956 |
| DE | 1888119 | | 12/1963 |
| DE | 1918131 | | 6/1965 |
| DE | 1918132 | | 6/1965 |
| DE | 1287477 | | 1/1969 |
| DE | 1290844 | | 3/1969 |
| DE | 2036062 | | 7/1970 |
| DE | 1948620 | | 5/1971 |
| DE | 1685293 | | 7/1971 |
| DE | 1685260 | | 10/1971 |
| DE | 2045430 | | 3/1972 |
| DE | 2522127 | | 11/1976 |
| DE | 2525613 | | 12/1976 |
| DE | 2602310 | | 7/1977 |
| DE | 2613312 | | 10/1977 |
| DE | 2706645 | | 8/1978 |
| DE | 2654116 | | 1/1979 |
| DE | 2737765 | | 3/1979 |
| DE | 2805426 | | 8/1979 |
| DE | 3021936 | | 4/1981 |
| DE | 3024587 | A1 | 1/1982 |
| DE | 8219616.8 | | 9/1982 |
| DE | 3113295 | | 10/1982 |
| DE | 3245182 | | 5/1983 |
| DE | 3317462 | | 10/1983 |
| DE | 8431831.7 | | 12/1984 |
| DE | 3347343 | | 7/1985 |
| DE | 8530136.1 | | 2/1988 |
| DE | 3629245 | | 3/1988 |
| EP | 0048965 | | 4/1982 |
| EP | 0083449 | A1 | 12/1982 |
| EP | 0130816 | | 1/1985 |
| EP | 0185781 | | 7/1986 |
| EP | 0207063 | | 10/1986 |
| EP | 0206511 | | 12/1986 |
| EP | 0213257 | | 3/1987 |
| EP | 0215974 | | 4/1987 |
| EP | 0238995 | | 9/1987 |
| EP | 0260777 | | 3/1988 |
| EP | 0301331 | | 2/1989 |
| EP | 0329391 | | 8/1989 |
| EP | 0410087 | | 1/1991 |
| EP | 0697825 | | 2/1996 |
| EP | 0910964 | | 4/1999 |
| EP | 1068460 | | 1/2001 |
| EP | 1374808 | | 1/2004 |
| EP | 1414322 | A1 | 5/2004 |
| EP | 1480534 | | 12/2004 |
| EP | 1529457 | A1 * | 5/2005 |
| FR | 602501 | | 3/1926 |
| FR | 925961 | | 9/1947 |
| FR | 1004472 | | 3/1952 |
| FR | 1245672 | | 10/1960 |
| FR | 1323455 | | 2/1963 |
| FR | 2006270 | | 11/1972 |
| FR | 2261721 | | 9/1975 |
| FR | 2511850 | | 3/1983 |
| FR | 2622411 | | 5/1989 |
| GB | 9591 | | 0/1913 |
| GB | 16143 | | 0/1892 |
| GB | 764956 | | 1/1957 |
| GB | 792034 | A | 3/1958 |
| GB | 807305 | | 1/1959 |
| GB | 1504615 | | 3/1978 |
| GB | 2 023 405 | | 1/1980 |
| GB | 2 039 717 | | 8/1980 |
| GB | 2076633 | | 12/1981 |
| GB | 2133668 | | 8/1984 |
| GB | 2 136 670 | | 9/1984 |
| JP | 39-15597 | | 8/1964 |
| JP | 45-5154 | | 3/1970 |
| JP | 50-71132 | | 11/1975 |
| JP | 57-139333 | | 8/1982 |
| JP | 59-23525 | | 7/1984 |
| JP | 61-55810 | | 4/1986 |
| JP | 1129505 | | 6/1986 |
| JP | 61-167810 | | 10/1986 |
| JP | 1-195803 | | 8/1989 |
| JP | 2136505 | | 5/1990 |
| JP | 2279103 | | 11/1990 |
| JP | 3-85102 | | 4/1991 |
| JP | 3086101 | | 4/1991 |
| JP | 4-279102 | | 10/1992 |
| JP | 5-123204 | | 5/1993 |
| NZ | 189890 | | 9/1981 |
| WO | WO 87/07480 | | 12/1987 |
| WO | WO 87/07481 | | 12/1987 |
| WO | WO 88/08263 | | 11/1988 |
| WO | WO 89/06500 | | 7/1989 |
| WO | WO 90/00358 | | 1/1990 |
| WO | WO 91/00698 | | 1/1991 |
| WO | WO 91/03180 | | 3/1991 |
| WO | WO 91/04683 | | 4/1991 |
| WO | WO 91/05491 | | 5/1991 |
| WO | WO 91/10377 | | 7/1991 |
| WO | WO 91/11124 | | 8/1991 |
| WO | WO 91/11924 | | 8/1991 |
| WO | WO 91/19429 | | 12/1991 |
| WO | WO 92/07483 | | 5/1992 |
| WO | WO 92/18024 | | 10/1992 |
| WO | WO 93/13928 | | 7/1993 |
| WO | WO 94/03080 | | 2/1994 |
| WO | WO 97/00029 | | 1/1997 |
| WO | WO 00/54616 | | 9/2000 |
| WO | WO 00/64293 | | 11/2000 |
| WO | WO 00/70981 | | 11/2000 |
| WO | WO 01/80678 | | 11/2001 |
| WO | WO 02/09547 | | 2/2002 |
| WO | WO 2005/115190 | | 12/2005 |
| WO | WO 2005/117628 | | 12/2005 |
| WO | WO 2005/117629 | | 12/2005 |
| WO | WO 2006/113212 | | 10/2006 |
| WO | WO 2006/124116 | | 11/2006 |
| WO | WO 2007/024523 | | 3/2007 |

OTHER PUBLICATIONS

Examiner's Comments, European Search Report EP-05825112.5-2318 (Jul. 14, 2010).
adidas Catalog 1986.
adidas Catalog 1988.
adidas Catalog 1989.
adidas Catalog 1990.
adidas Catalog 1991.
adidas Catalog, Spring 1987.
adidas' Second Supplemental Responses to Interrogatory No. 1.
adidas shoe, Model "Buffalo" 1985.
adidas shoe, Model "London", 1986.
adidas shoe, Model "Marathon 86" 1985.
adidas shoe, Model "Skin Racer", 1988.
adidas shoe, Model "Tokio H" 1985.
adidas shoe, Model "Torsion Grand Slam Indoor," 1989.
adidas shoe, Model <<Boston Super>> 1985.
adidas shoe, Model <<Fire>> 1985.
adidas shoe, Model <<Indoor Pro>> 1987.
adidas shoe, Model <<Kingscup Indoor>>, 1986.
adidas shoe, Model <<Marathon>> 1986.
adidas shoe, Model <<Questar>>, 1986.
adidas shoe, Model <<Tauern>> 1986.
adidas shoe, Model <<Tennis Comfort>>, 1988.
adidas shoe, Model <<Torsion Special HI>> 1989.
adidas shoe, Model <<Torsion ZX9020S>> 1989.
adidas shoe, <<Model Water Competition>> 1980.
adidas shoe, Model, <<Indoor Pro>> 1987.
adidas Spring Catalog 1989.
Areblad et al. <<Three-Dimensional Measurement of Rearfoot Motion During Running>> *Journal of Biomechanics*, vol. 23, vol. 9, pp. 933-940 (1990).

AVIA Catalog 1986.
Avia Fall Catalog, 1988.
Brooks Catalog 1986.
Cavanagh et al., "Biomechanics of Distance Running," Human Kinetics Books, pp. 155-164, 1990.
Clark Shoe Designed by Sven Coomer 1991.
Fineagan, "Comparison of the Effects of a Running Shoe and a Racing Flat on the Lower Extremity Biochemical Alignment of Runners," *Journal of the American Physical Therapy Association*, vol. 68, No. 5, p. 806 (1988).
Fixx, *The Complete Book of Running*, pp. 134-137, 1977.
Footwear Journal, Nike Advertisement, Aug. 1987.
Footwear News, vol. 44, No. 37, Nike Advertisement (1988).
Footwear News, Special Supplement, Feb. 8, 1988.
Footwear News, vol. 45, No. 5, Nike Advertisement 1989.
Frederick, *Sports Shoes and Playing Surfaces, Biomechanical Properties*, Entire Book, 1984.
Johnson et al., <<A Biomechanical Approach to the Design of Football Boots>>, *Journal of Biomechanics*, vol. 9, pp. 581-585 (1976).
Komi et al., "Interaction Between Man and Shoe in Running: Considerations for More Comprehensive Measurement Approach," *International Journal of Sports Medicine*, vol. 8, pp. 196-202 1987.
Kronos Catalog, 1988.
K-Swiss Catalog, Fall 1991.
Leuthi et al., <<Influence of Shoe Construction on Lower Extremity Kinematics and Load During Lateral Movements in Tennis>>, *International Journal of Sport Biomechanics*, vol. 2, pp. 166-174, 1986.
Nawoczenski et al., <<Effect of Rocker Sole Design on Plantar Forefoot Pressures>> *Journal of the American Podiatric Medical Association*, vol. 79, No. 9, pp. 455-460, 1988.
Nigg et al., "Biomechanical Aspects of Sport Shoes and Playing Surfaces," Proceedings of the International Symposium on Biomechanical Aspects of Sport Shoes and Playing Surfaces, 1983.
Nigg et al., "Influence of Heel Flare and Midsole Constructions on Pronation" *International Journal of Sport Biomechanics*, vol. 4, No. 3, pp. 205-219 (1987).
Nigg et al., <<The Influence of Lateral Heel Flare of Running Shoes on Pronation and Impact Forces>>, *Medicine and Science in Sports and Exercise*, vol. 19, No. 3, pp. 294-302, 1987.
Nigg et al., *Biomechanics of Running Shoes*, entire book, 1986.
Nigg, <<Biomechanical Analysis of Ankle and foot Movement>> *Medicine and Sport Science*, vol. 23, pp. 22-29 1987.
Nike Catalog, Footwear Fall, 1988.
Nike Fall Catalog 1987, pp. 50-51.
Nike Shoe, men's cross-training Model "Air Trainer SC" 1989.
Nike shoe, men's cross-training Model <<Air Trainer TW>> 1989.
Nike shoe, Model "Air Force" #1978, 1988.
Nike shoe, Model "Air" #1553, 1988.
Nike shoe, Model <<Air Flow>> #718, 1988.
Nike shoe, Model <<Air Revolution>> #15075, 1988.
Nike shoe, Model <<Air>>, #13213, 1988.
Nike shoe, Model <<Air>>, #4183, 1988.
Nike shoe, Model <<High Jump 88>>, 1988.
Nike shoe, Model <<Leather Cortex®>>, 1988.
Nike shoe, Model <<Zoom Street Leather>> 1988.
Nike Spring Catalog 1989 pp. 62-63.
Palamarchuk et al., "In shoe Casting Technique for Specialized Sport Shoes," *Journal of the American Podiatric Medical Association*, vol. 79, No. 9, pp. 462-465, 1989.
Prince Cross-Sport 1989.
Puma basketball shoe, *The Complete Handbook of Athletic Footwear*, pp. 315, 1987.
Romika Catalog, Summer 1978.
Runner's World, "Shoe Review" Nov. 1988 pp. 46-74.
Runner's World, "Spring Shoe Survey," pp. 45-74, 1989.
Runner's World, Apr. 1988.
Runner's World, Oct. 1986.
Saucony Spot-bilt Catalog 1988.
Saucony Spot-bilt Catalog Supplement, Spring 1985.
Saucony Spot-bilt shoe, *The Complete Handbook of Athletic Footwear*, pp. 332,1987.
Segesser et al., "Surfing Shoe," *The Shoe in Sport*, 1989, (Translation of a book published in Germany in 1987), pp. 106-110.
Sporting Goods Business, Aug. 1987.
Sports Illustrated, Nike Advertisement, Aug. 8, 1988.
Sports Illustrated, Special Preview Issue, The Summer Olympics <<Seoul '88>> Reebok Advertisement.
*The Complete Handbook of Athletic Footwear*, Entire Boook, 1987.
Vagenas et al., "Evaluation of Rearfoot Asymmetries in Running with Worn and New Running Shoes," *International Journal of Sport Biomechanics*, vol. 4, No. 3, pp. 220-230 (1988).
Valiant et al., <<A Study of Landing from a Jump:Implications for the Design of a Basketball Shoe>>, *Scientific Program of IC International Congress of Biomechanics*, 1983.
Williams et al., <<The Mechanics of Foot Action During the Golf Swing and Implications for Shoe Design>>, *Medicine and Science in Sports and Exercise*, vol. 15, No. 3, pp. 247-255, 1983.
World Professional Squash Association Pro Tour Program, 1982-1983.
Williams, Walking on Air, *Case Alumnus*, vol. LXVII, No. 6, Fall 1989, pp. 4-8.
Brooks advertisement in *Runner's World* etc., Jun. 1989, pp. 56+.
Cavanaugh et al., Biological Aspects of Modeling Shoe/Foot Interaction During Running, *Sports Shoes and Playing Surfaces*, 1984, pp. 24-25, 32-35, 46.
Blechschmidt, The Structure of the Calcaneal Padding, *Foot & Ankle* vol. 2, No. 5, Mar. 1982, pp. 260-283.
Cavanaugh "The Running Shoe Book," ©1980, pp. 176-180, Anderson World, Inc., Mountain View, CA.
Executive Summary with Seven Figures, 1993.
German Description of adidas badminton shoe, pre-1989(?), 1 page.
The Reebok Lineup, Fall 1987, 2 pages.
Related US specification available upon request: U.S. Appl. No. 09/908,688, filed Jul. 20, 2001.
Related US specification available upon request: U.S. Appl. No. 08/477,640, filed Jun. 7, 1995.
Related US specification available upon request: U.S. Appl. No. 09/648,792, filed Aug. 28, 2000.
Related US specification available upon request: U.S. Appl. No. 08/376,661, filed Jan. 23, 1995.
Related US specification available upon request: U.S. Appl. No. 09/710,952, filed Nov. 14, 2000.
Related US specification available upon request: U.S. Appl. No. 09/780,450, filed Feb. 12, 2001.
Related US specification available upon request: U.S. Appl. No. 09/790,626, filed Feb. 23, 2001.
Related US specification available upon request: U.S. Appl. No. 09/734,905, filed Dec. 13, 2000.
Related US specification available upon request: U.S. Appl. No. 09/785,200, filed Feb. 20, 2001.
Related US specification available upon request: U.S. Appl. No. 09/907,598, filed Jul. 19, 2001.
Related US specification available upon request: U.S. Appl. No. 09/794,943, filed Oct. 12, 2001.
Related US specification available upon request: U.S. Appl. No. 09/974,786, filed Oct. 12, 2001.
Related US specification avaiable upon request: U.S. Appl. No. 08/452,490, filed May 30, 1995.
Related US specification available upon request: U.S. Appl. No. 08/473,974, filed Jun. 7, 1995.
Related US specification available upon request: U.S. Appl. No. 08/482,838, filed Jun. 7, 1995.
Related US specification available upon request: U.S. Appl. No. 08/033,468, filed Mar. 18, 1993.
Related US specification available upon request: U.S. Appl. No. 08/462,531, filed Jun. 5, 1995.
Related US specification available upon request: U.S. Appl. No. 08/473,212, filed Jun. 7, 1995.
Related US application available upon request: U.S. Appl. No. 11/831,645, filed Jul. 31, 2007.
Related US application available upon request: U.S. Appl. No. 11/738,947, filed Apr. 23, 2007.
Related US application available upon request: U.S. Appl. No. 11/179,887, filed Jul. 12, 2005.

Related US application available upon request: U.S. Appl. No. 11/282,665, filed Nov. 21, 2005.
Related US application available upon request: U.S. Appl. No. 11/190,087, filed Jul. 26, 2005.
Related US application available upon request: U.S. Appl. No. 11/831,597, filed Jul. 31, 2007.

* cited by examiner

UNLOADED, UPRIGHT

LOADED MODERATELY, UPRIGHT

LOADED HEAVILY, UPRIGHT

LOADED HEAVILY, 20° LATERAL TILT

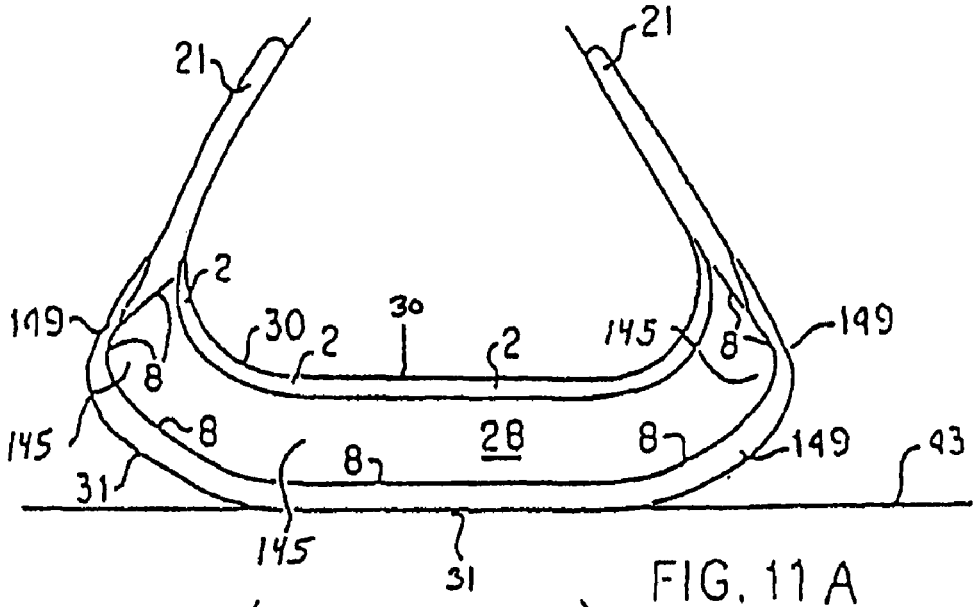
FIG. 11 A
FIG. 11Q
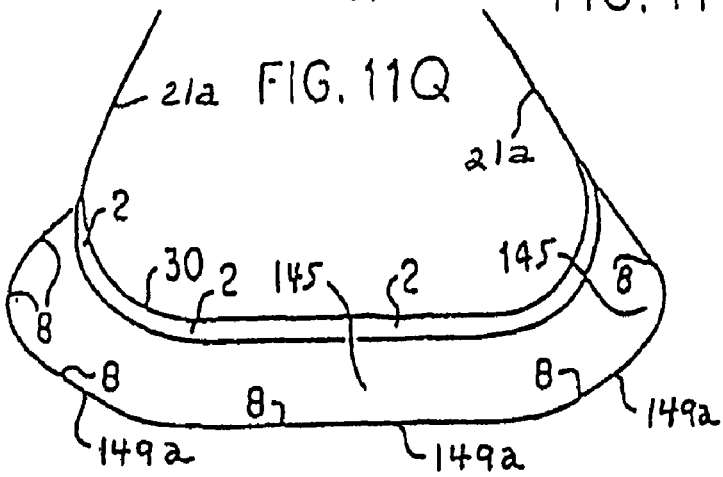
FIG. 11R
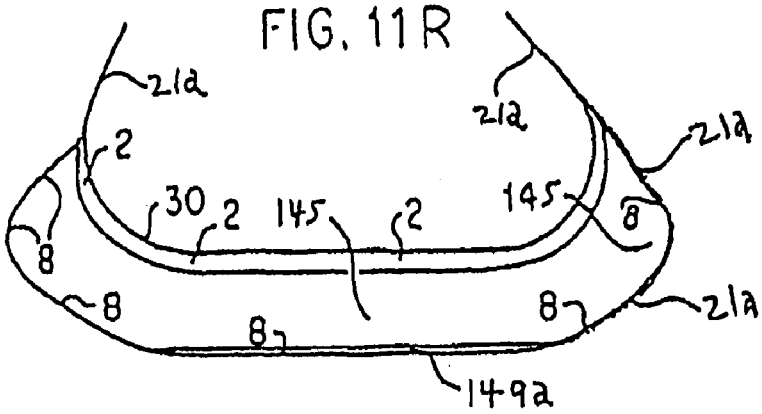

FIG. 11B
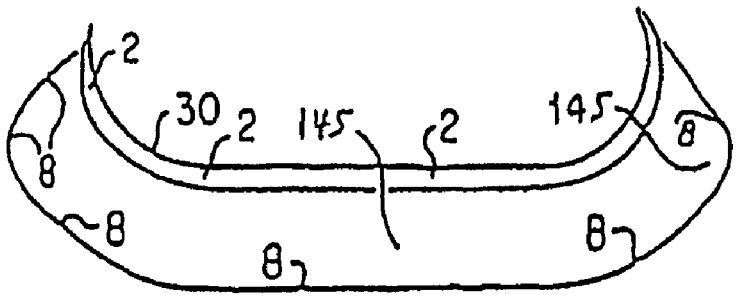
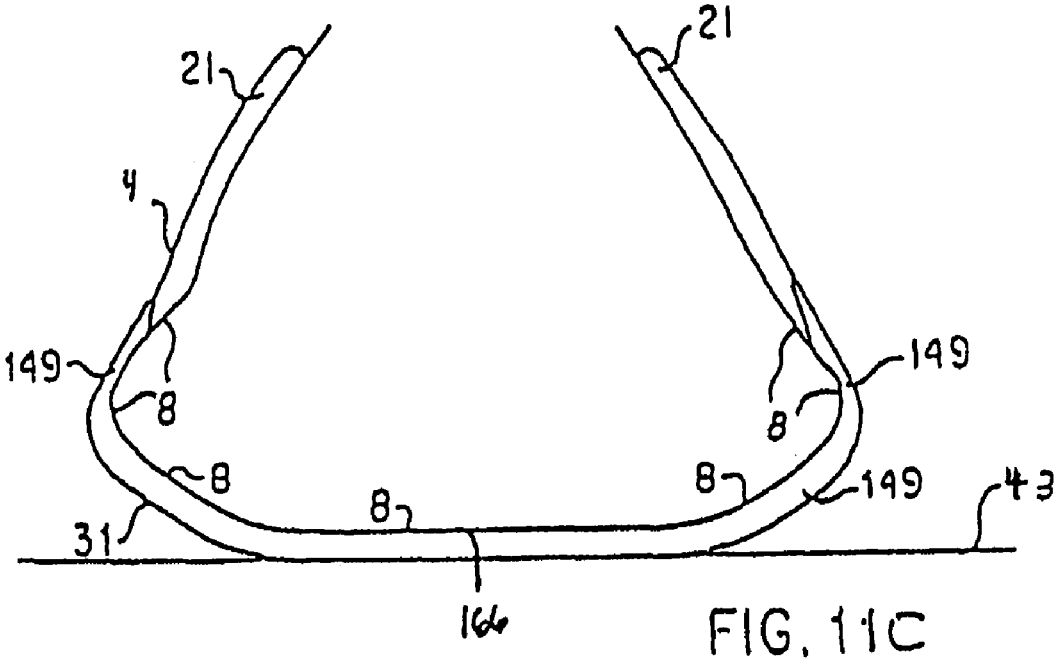
FIG. 11C

FIG. 11D
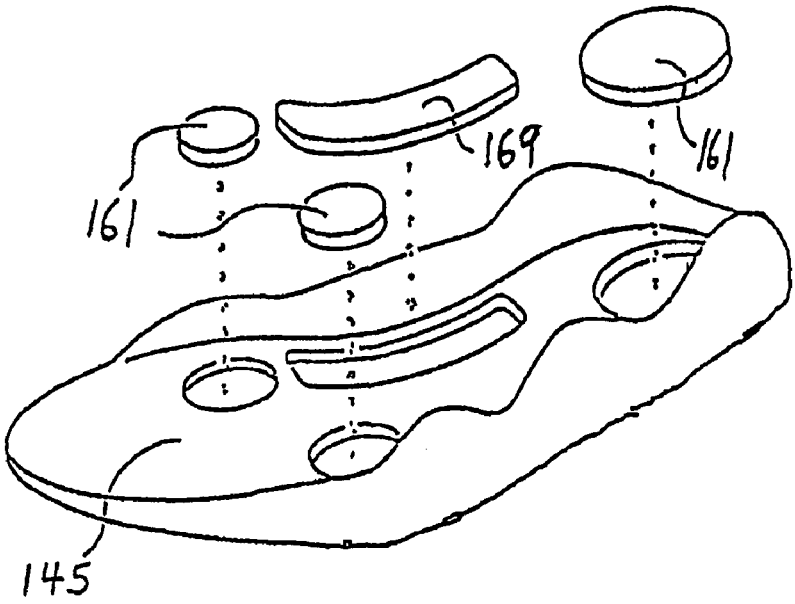
FIG. 11E
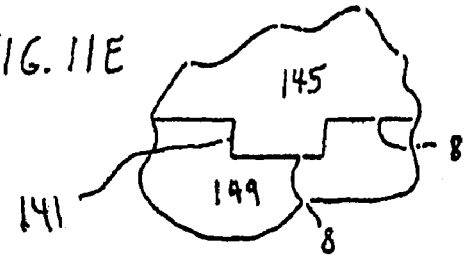
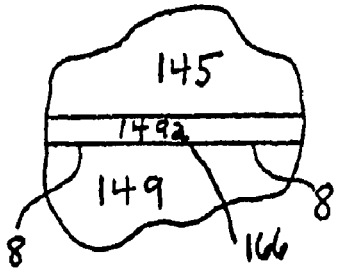
FIG. 11S
FIG. 11F
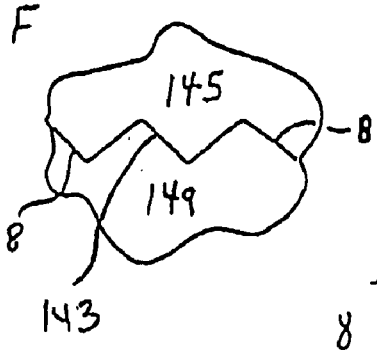
Fig 11V
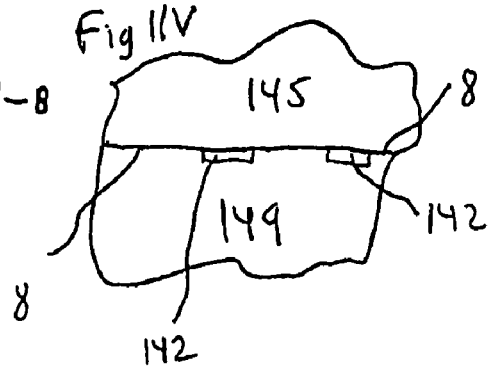

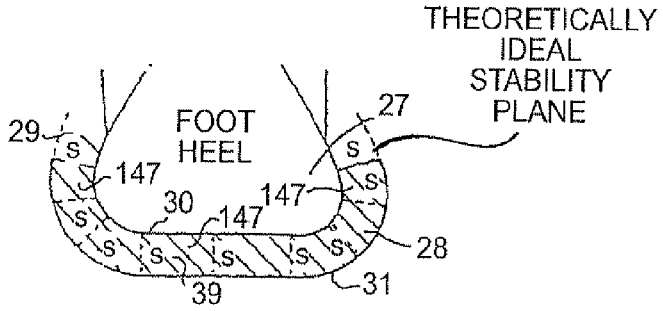
FIG. 29
FIG. 30A
FIG. 30
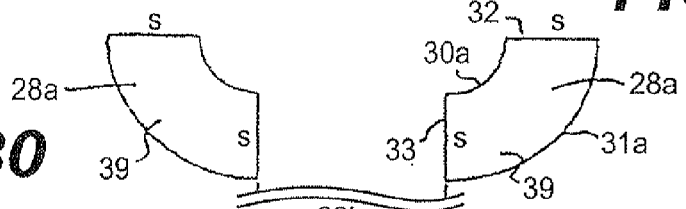
FIG. 30B
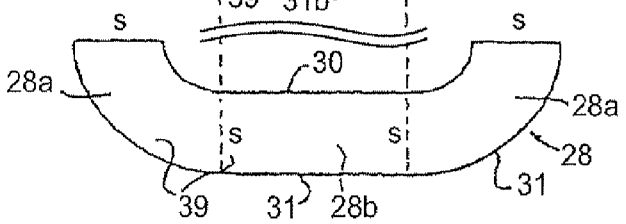
FIG. 30C
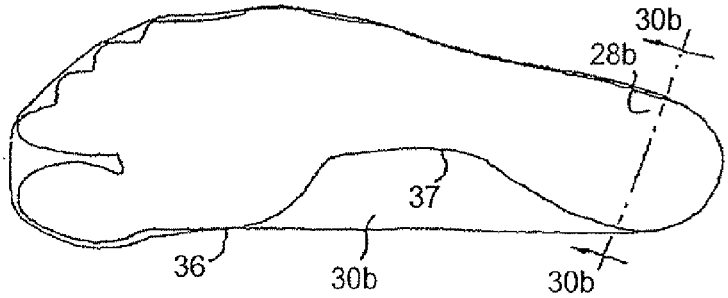
FIG. 30D FIG. 31
FIG. 31A
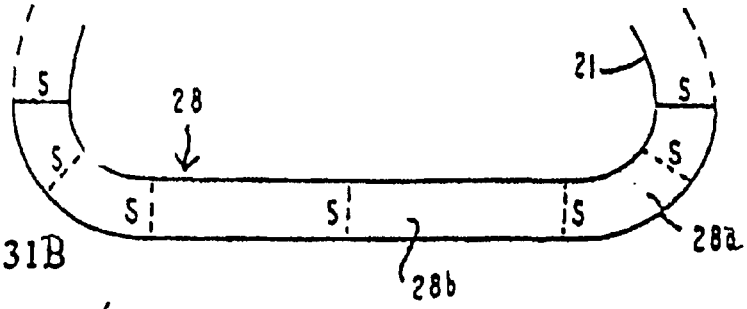
FIG. 31B
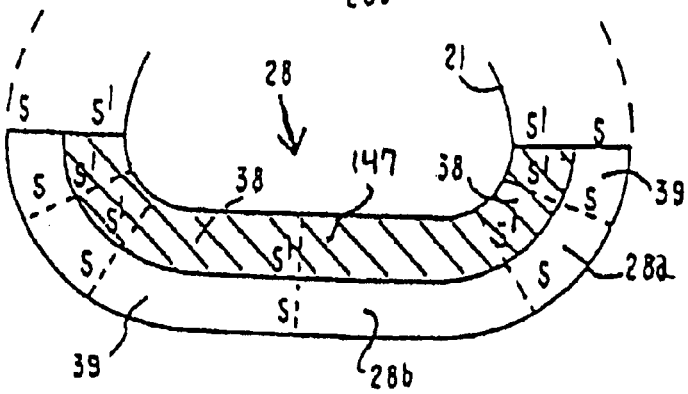
FIG. 32
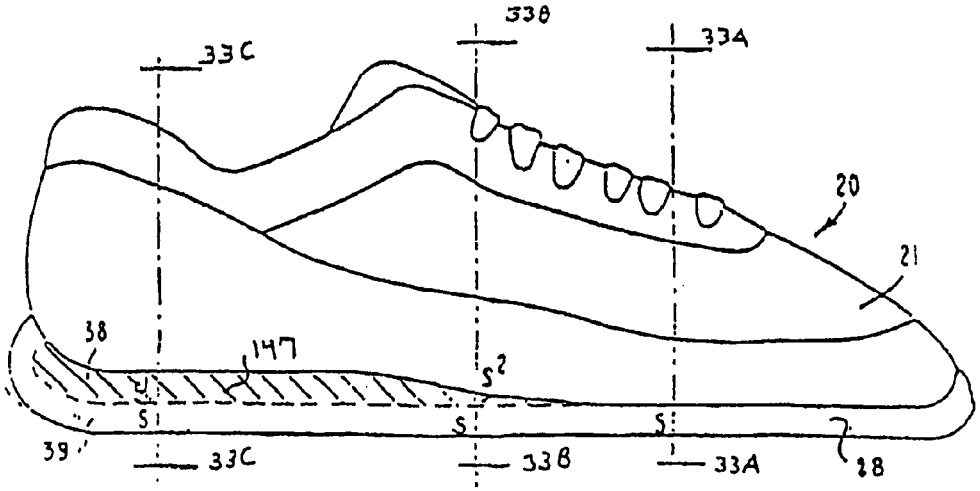

FIG. 33A
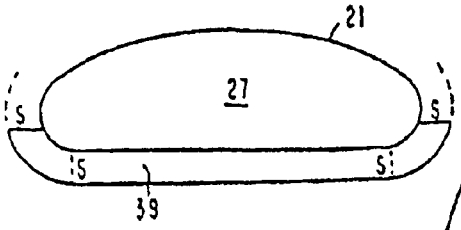
FIG. 33B
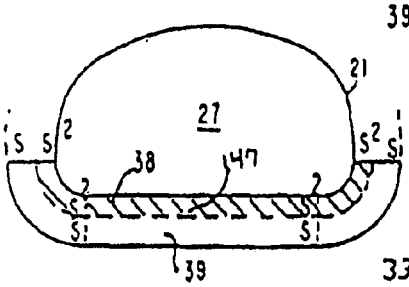
FIG. 33C
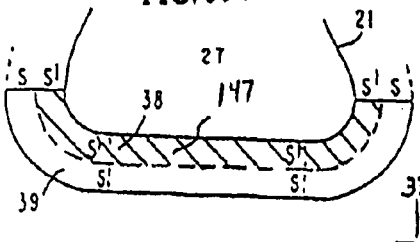
FIG. 33
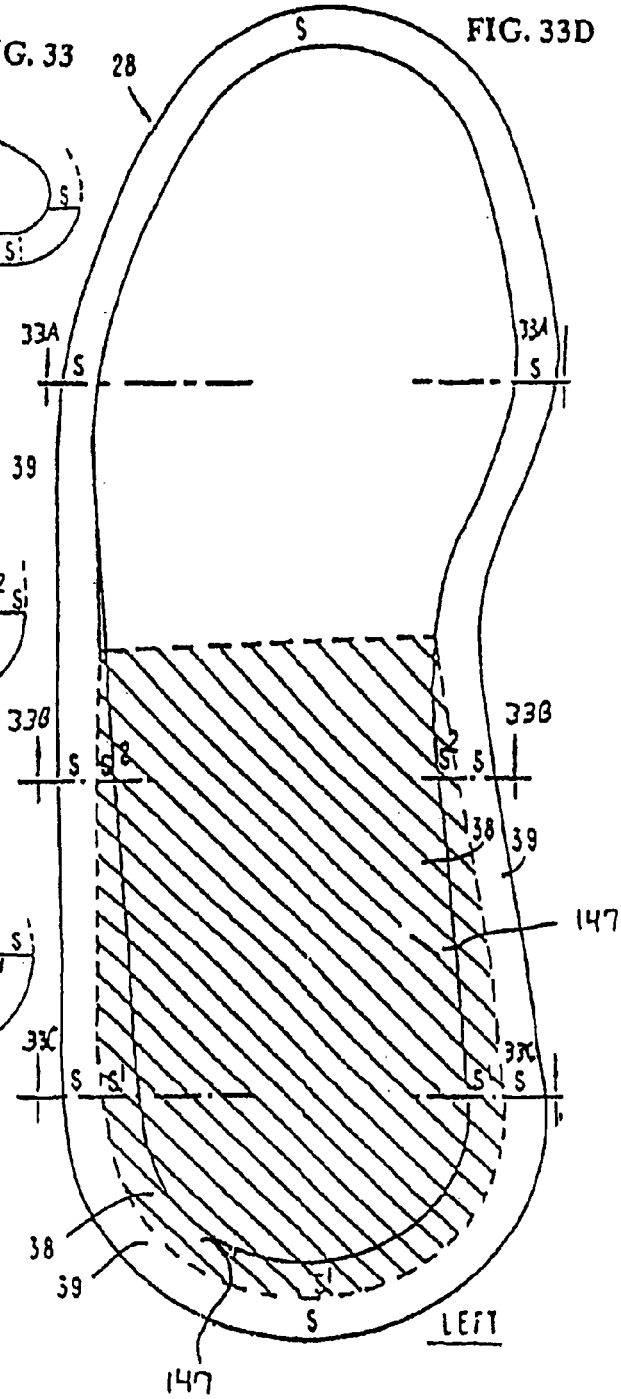
FIG. 33D FIG. 34A
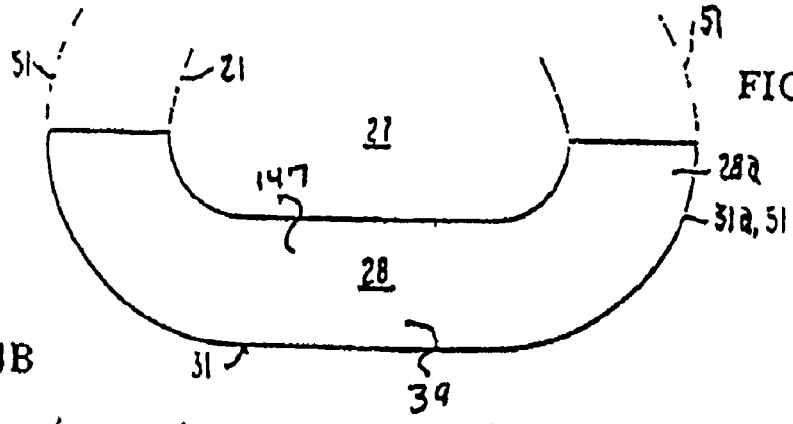
FIG. 34
FIG. 34B
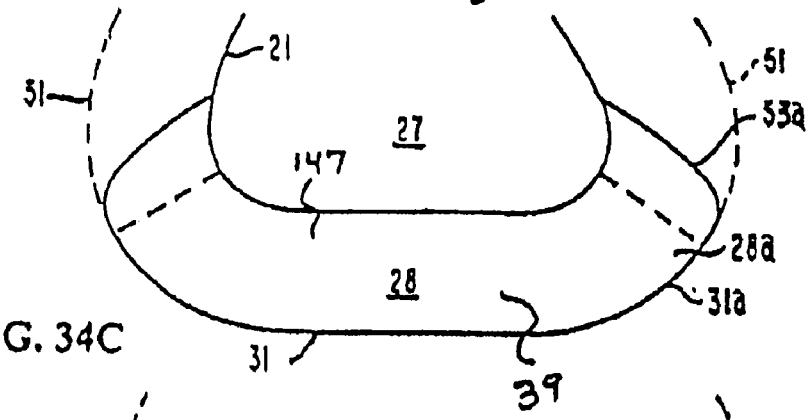
FIG. 34C
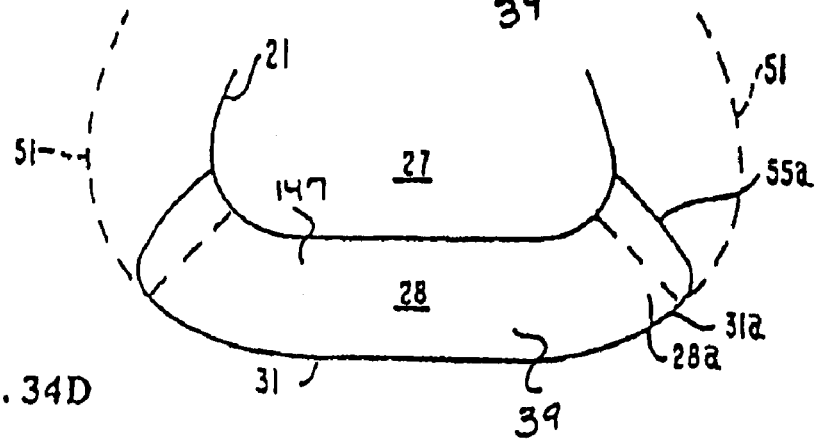
FIG. 34D
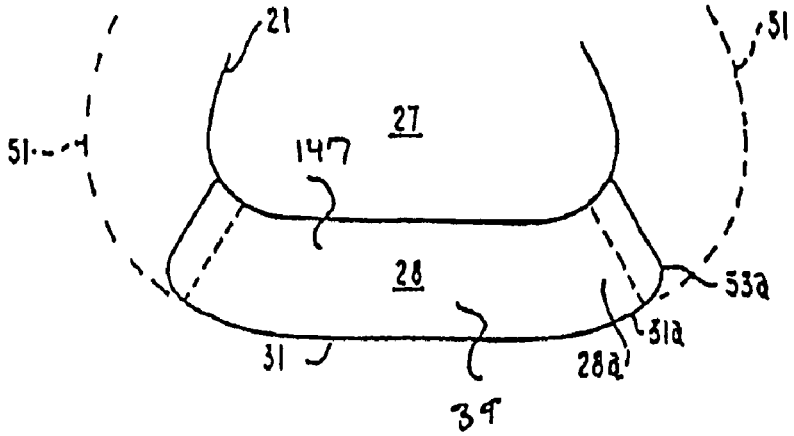

FIG. 35
FIG. 35A
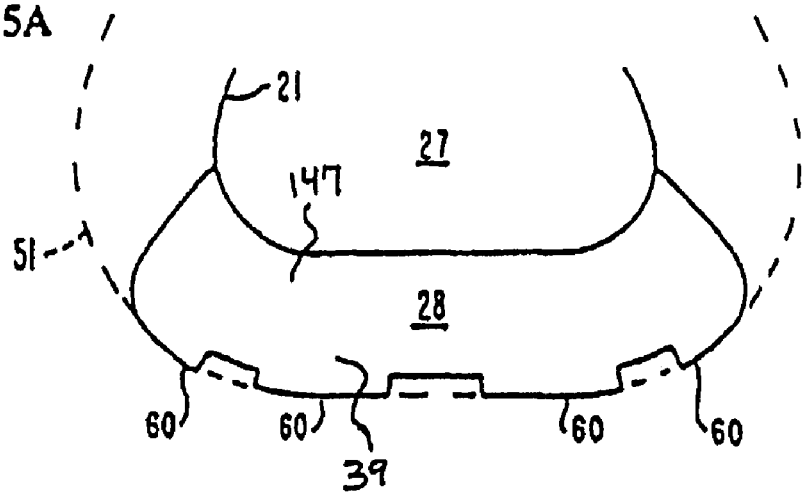
FIG. 35B
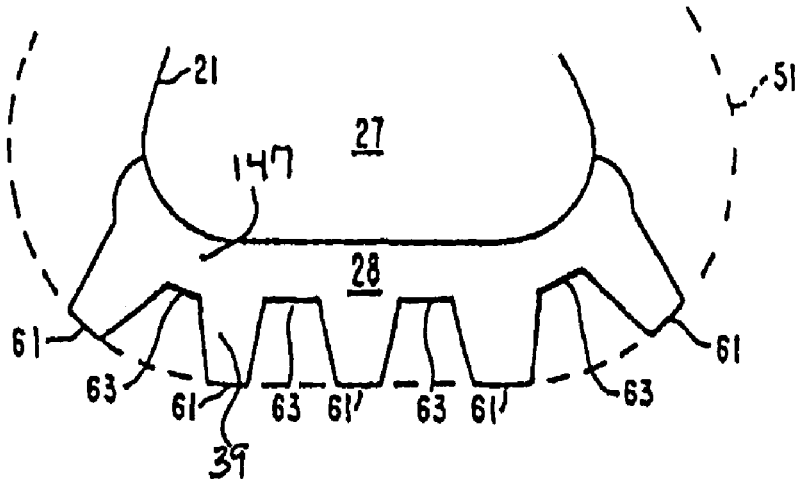
FIG. 35C
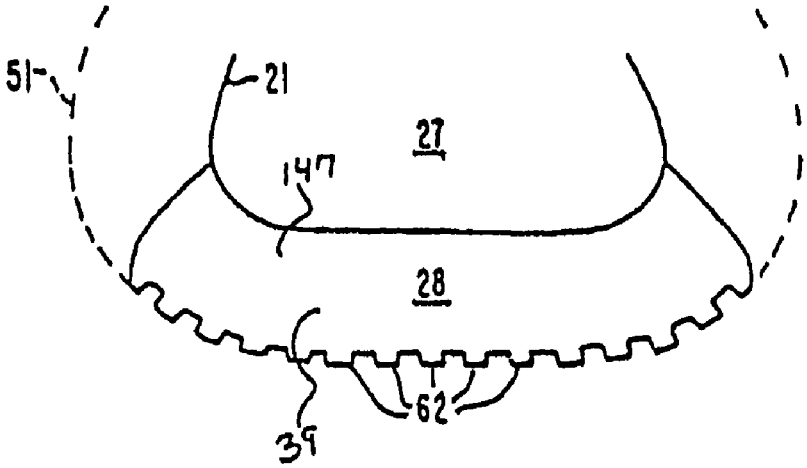

FIG. 38A
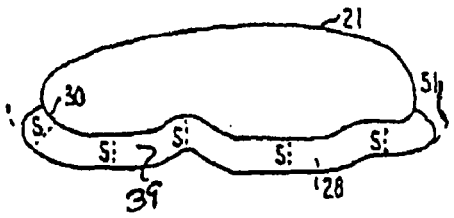
FIG. 38
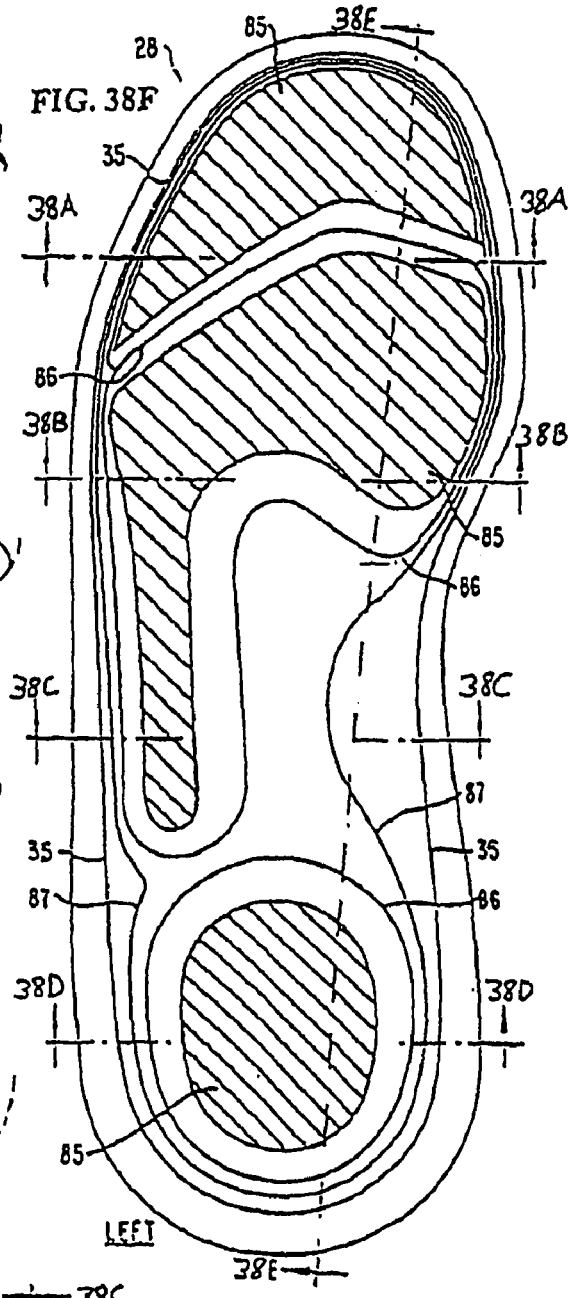
FIG. 38F
FIG. 38B
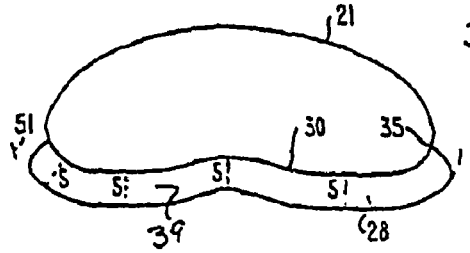
FIG. 38C
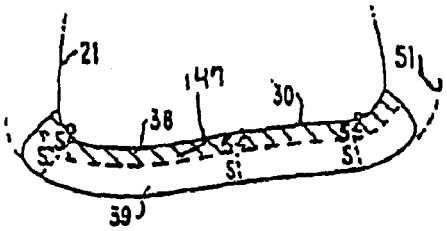
FIG. 38D
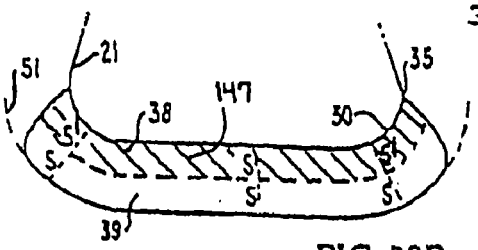
FIG. 38E
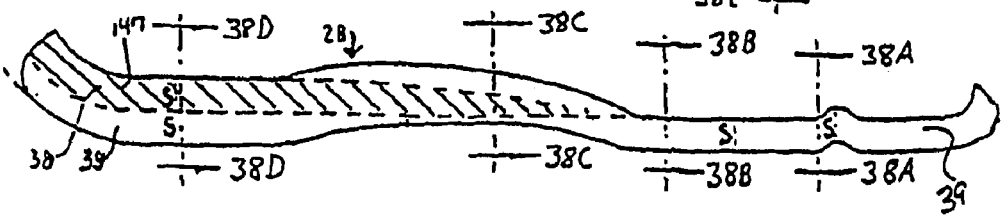

FIG. 39A
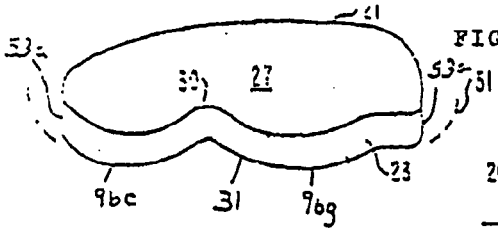
FIG. 39
FIG. 40
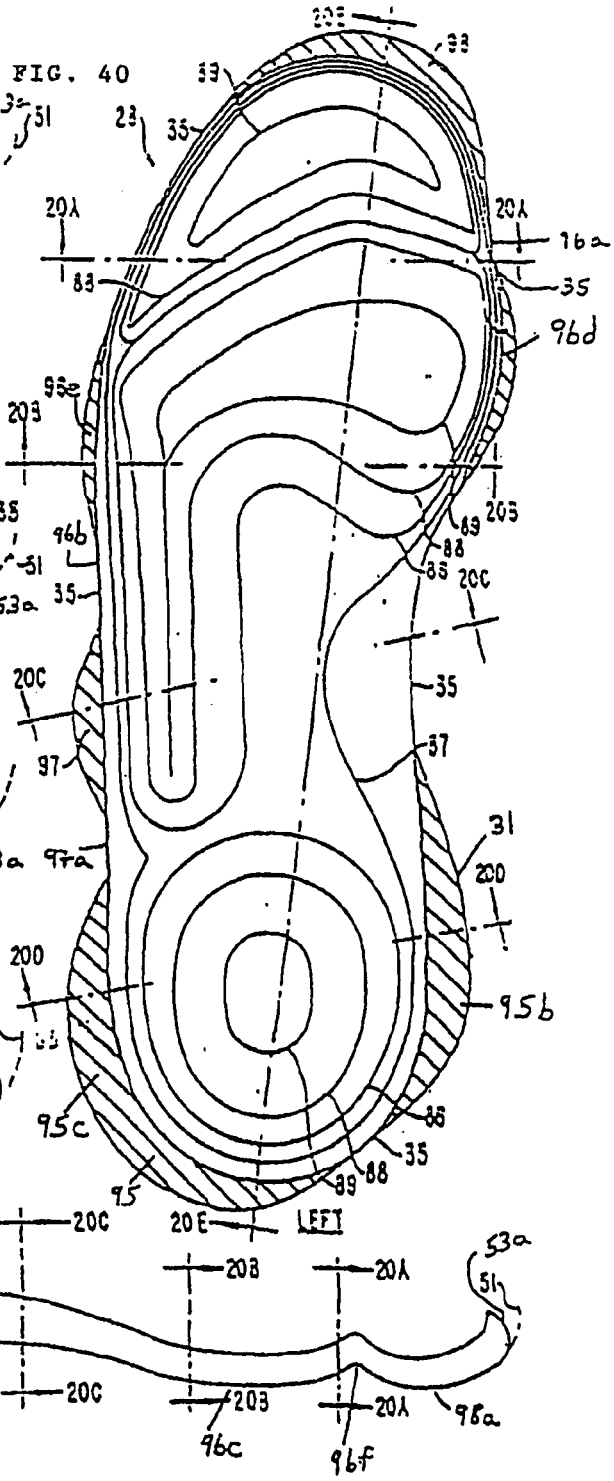
FIG. 39B
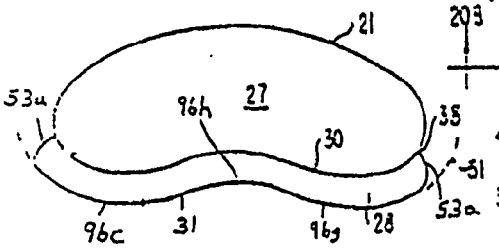
FIG. 39C
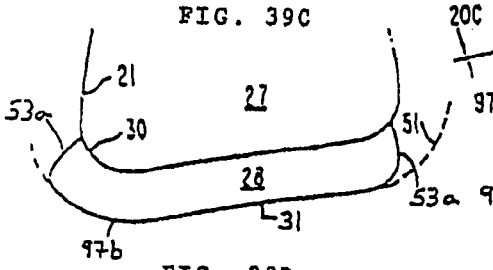
FIG. 39D
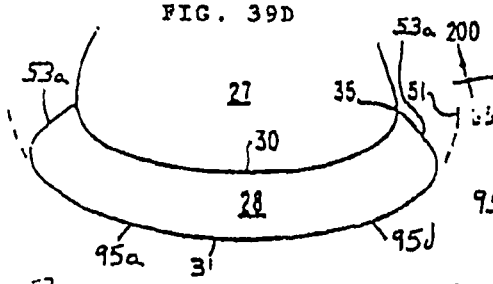
FIG. 39E
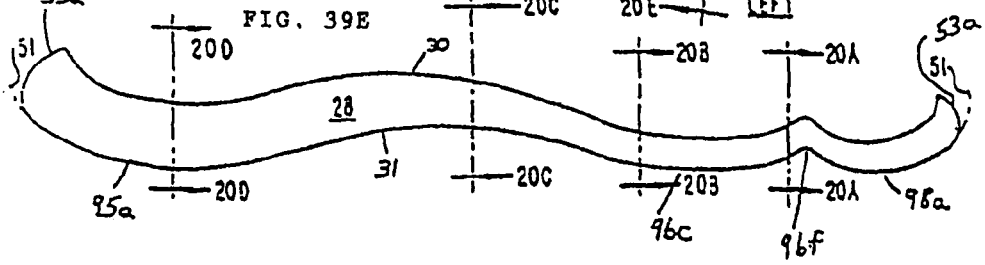

FIG. 41
FIG. 41A
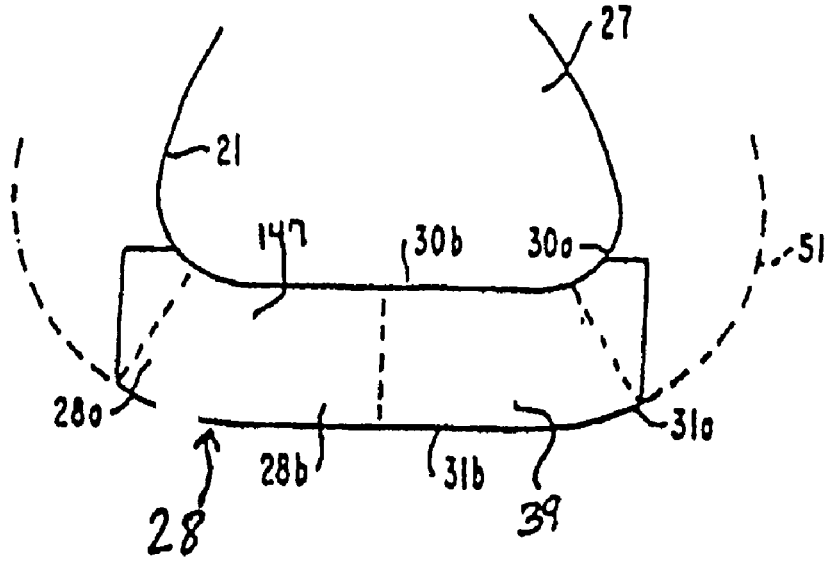
FIG. 41B
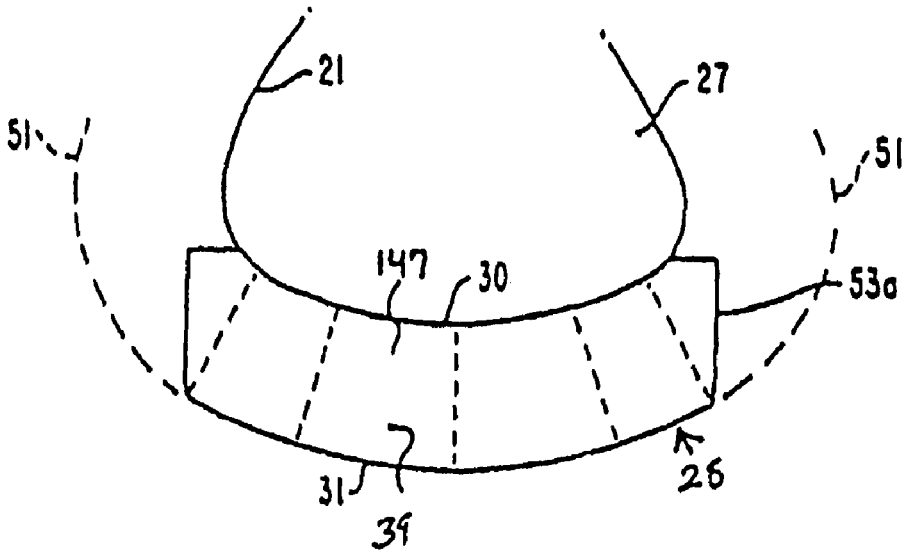

FIG. 49A
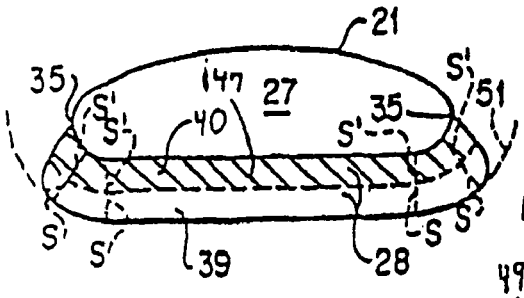
FIG. 49B
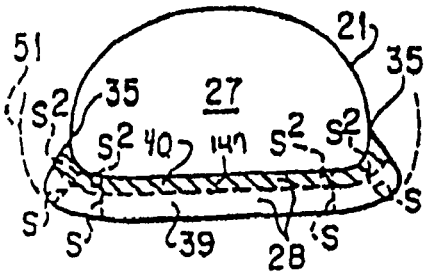
FIG. 49C
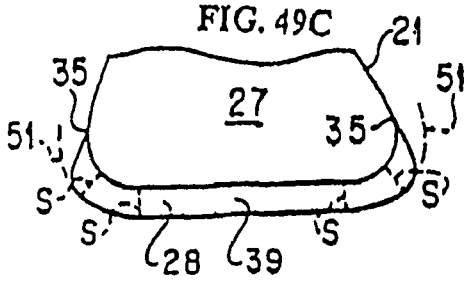
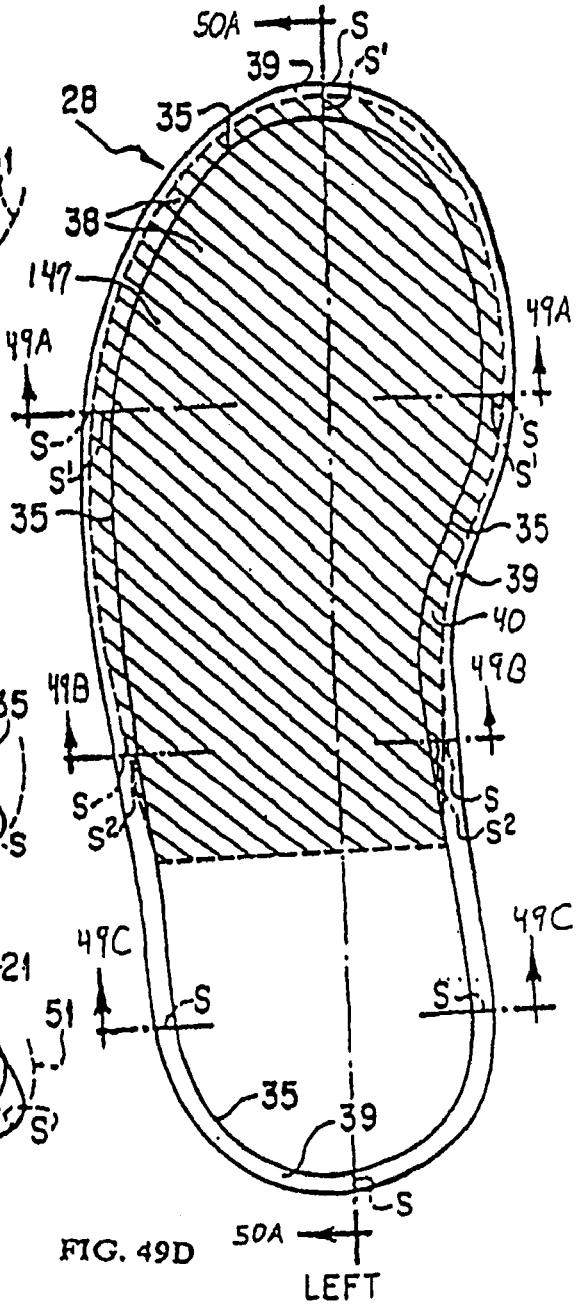
FIG. 49D

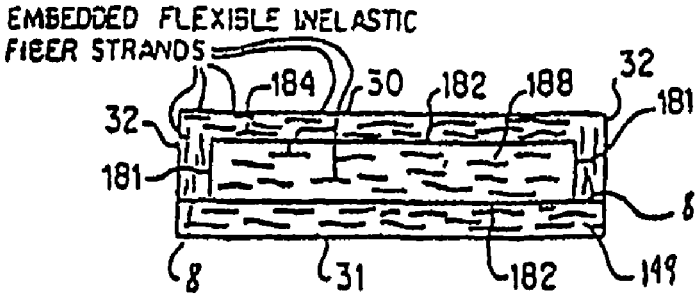
FIG. 60B
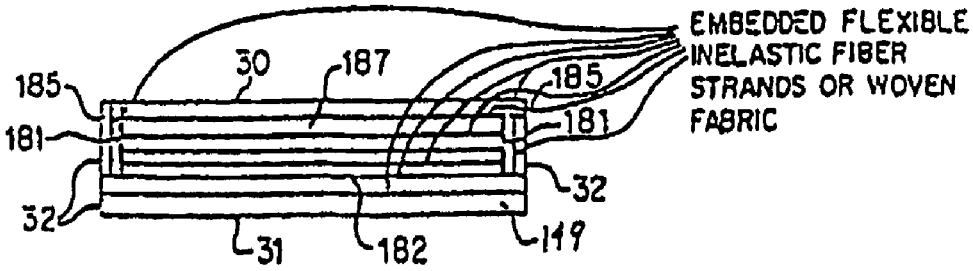
FIG. 60C
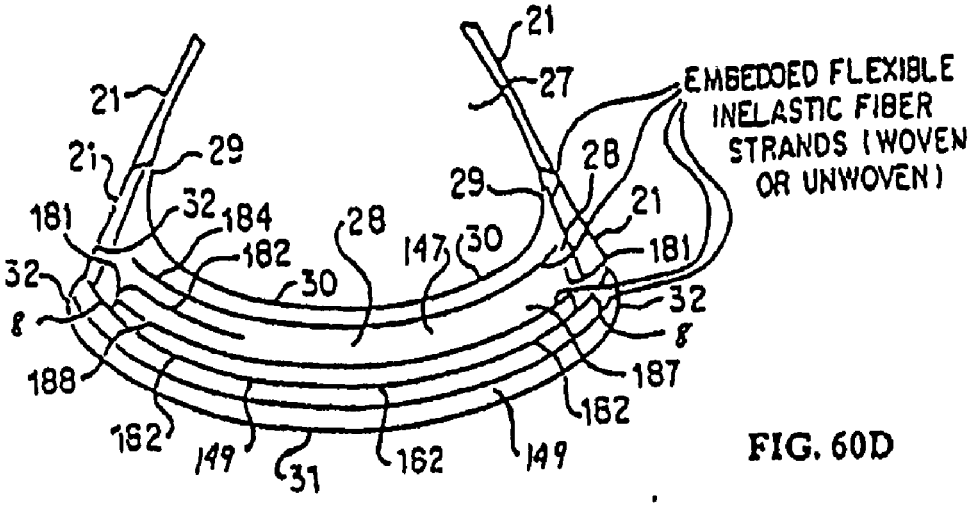
FIG. 60D
FIG. 60E
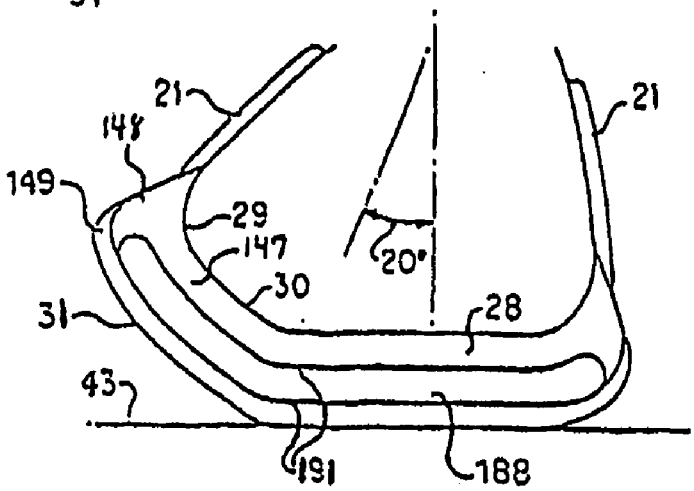

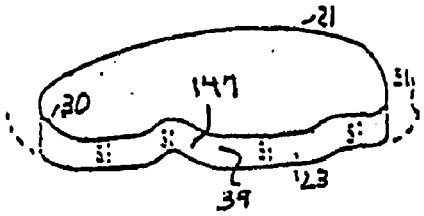
FIG. 66A
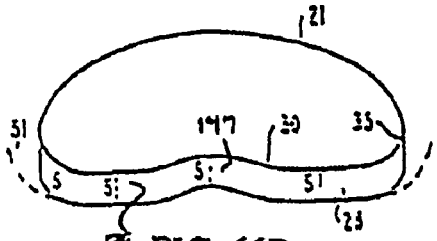
FIG. 66B
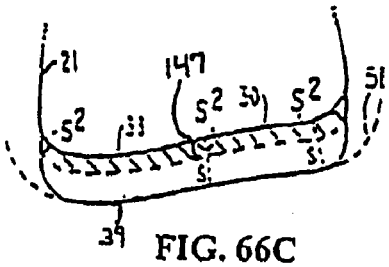
FIG. 66C
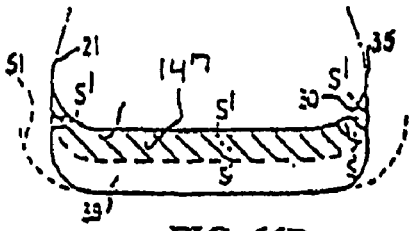
FIG. 66D
FIG. 66F
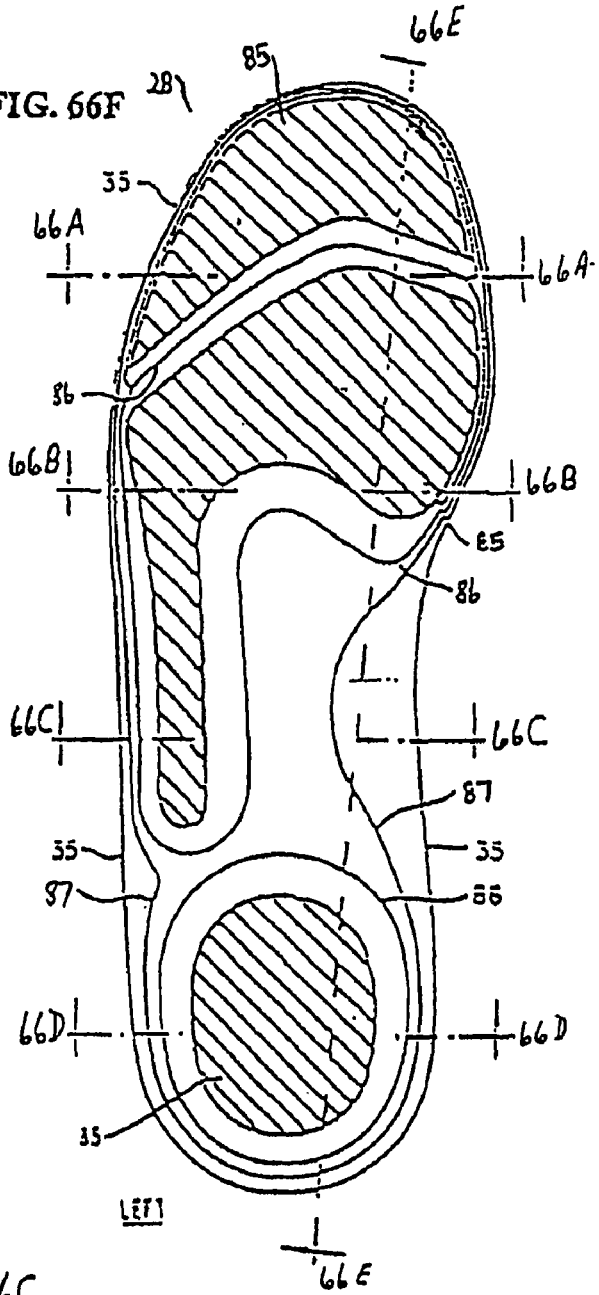
FIG. 66E
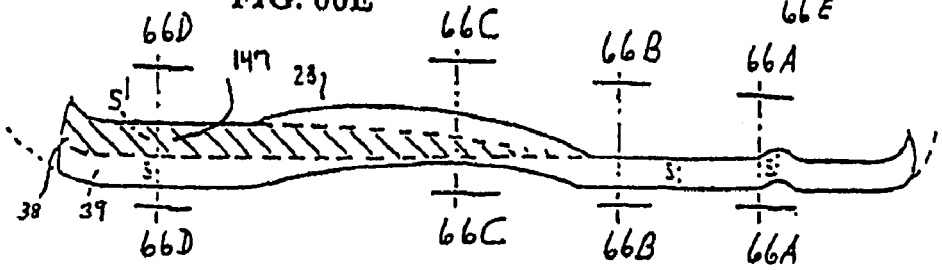

FIG. 68
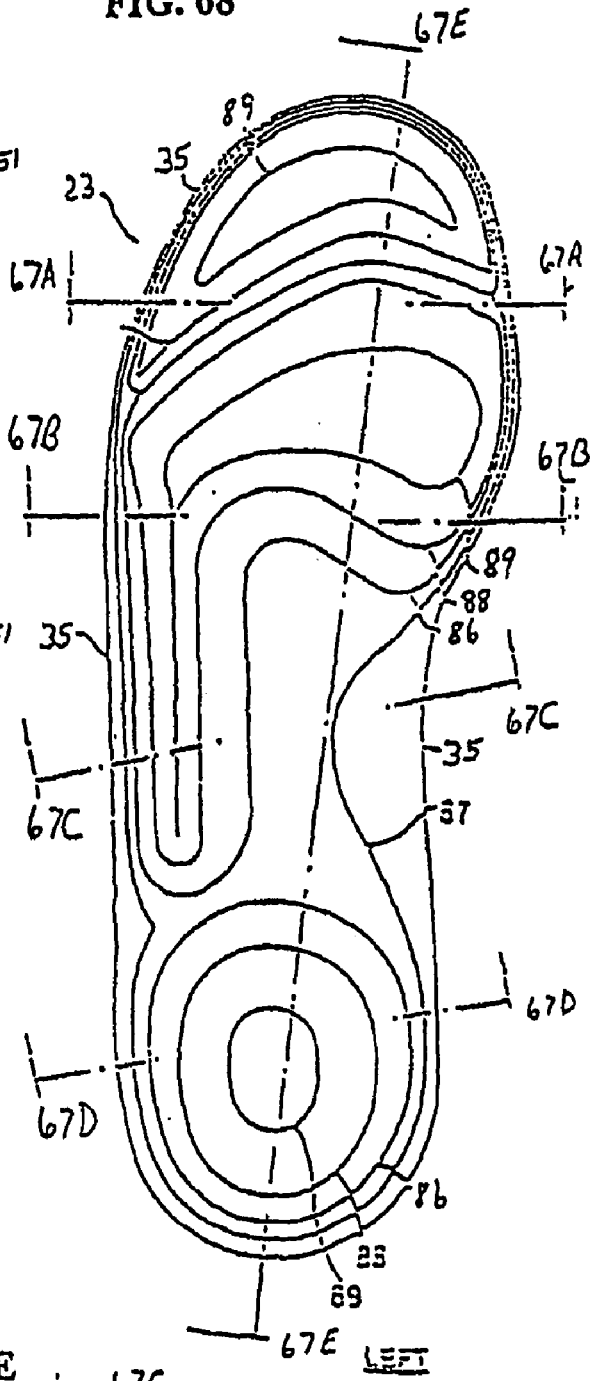
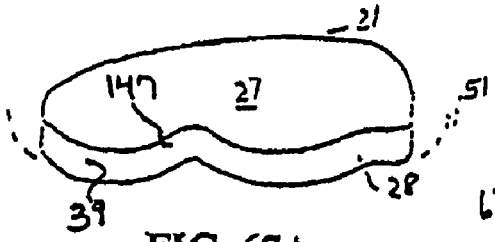
FIG. 67A
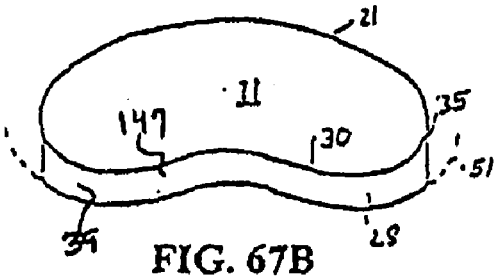
FIG. 67B
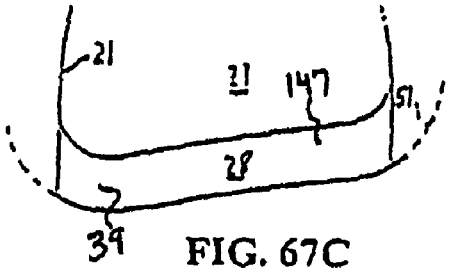
FIG. 67C
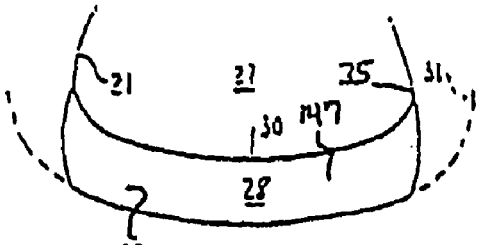
FIG. 67D
FIG. 67E
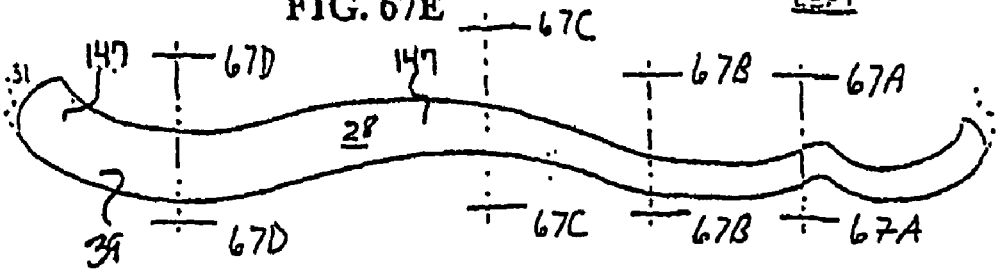

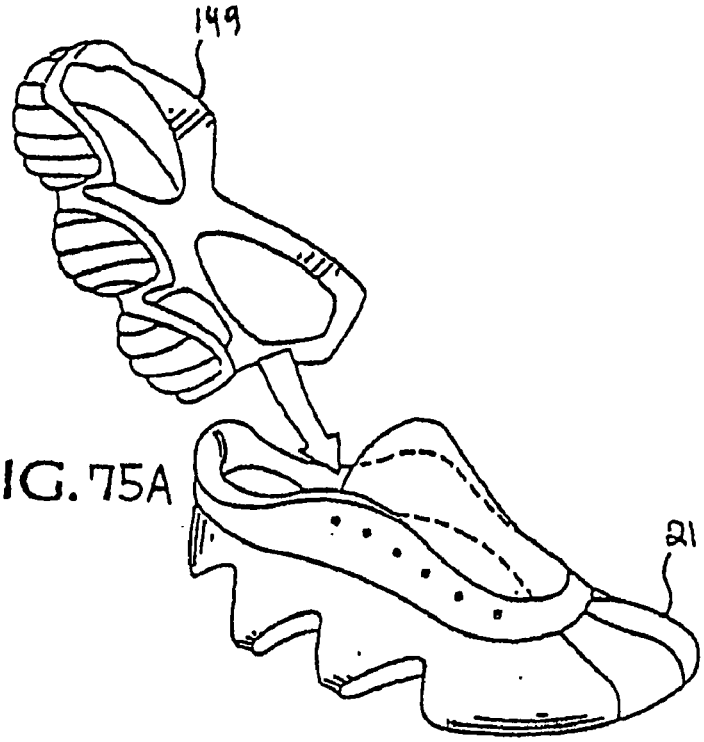
FIG. 75A
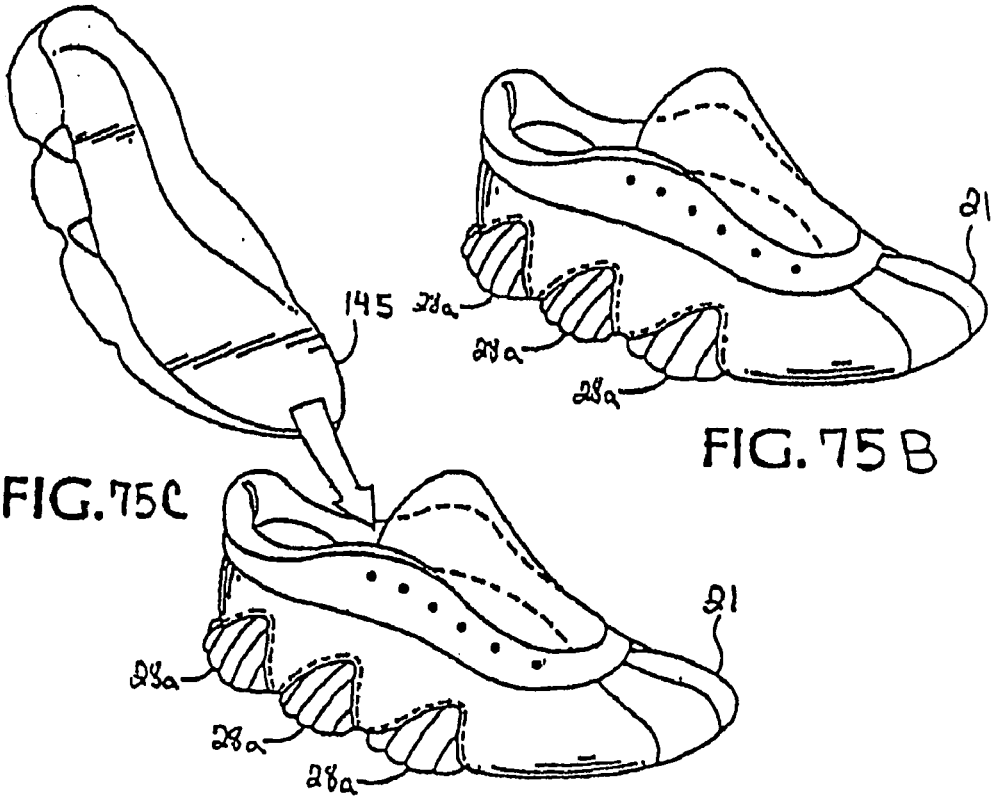
FIG. 75B
FIG. 75C

Fig. 108C
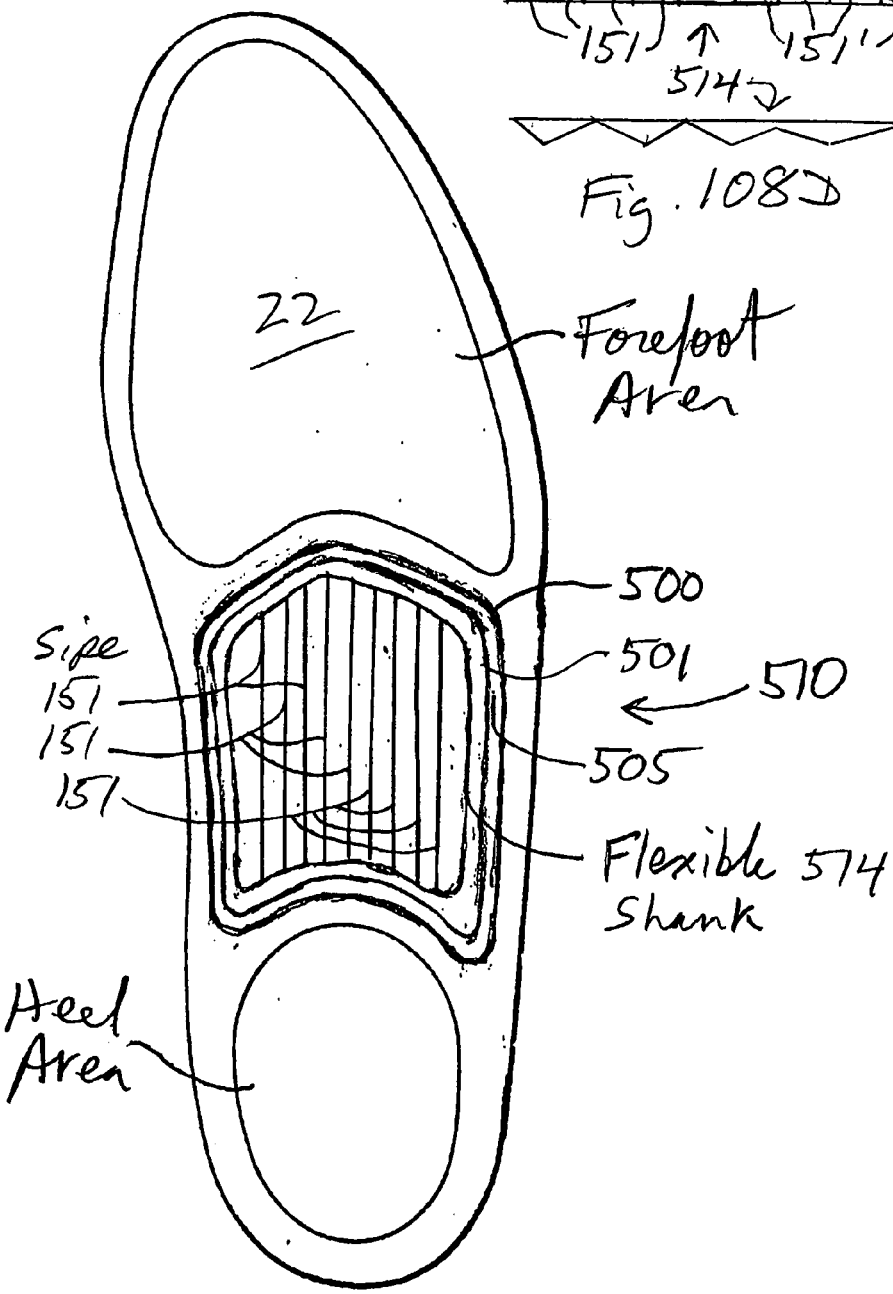
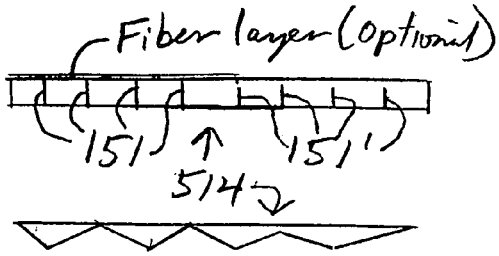
Fig. 108D

Cross Section Thru Radius (Frontal Plane Cross Section)

Fig. 113A, Prior Art
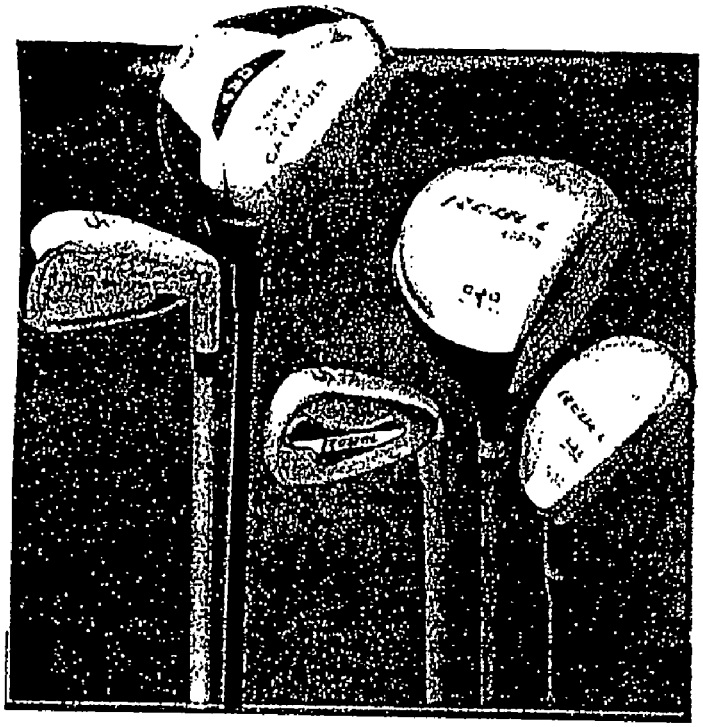
Fig. 113B
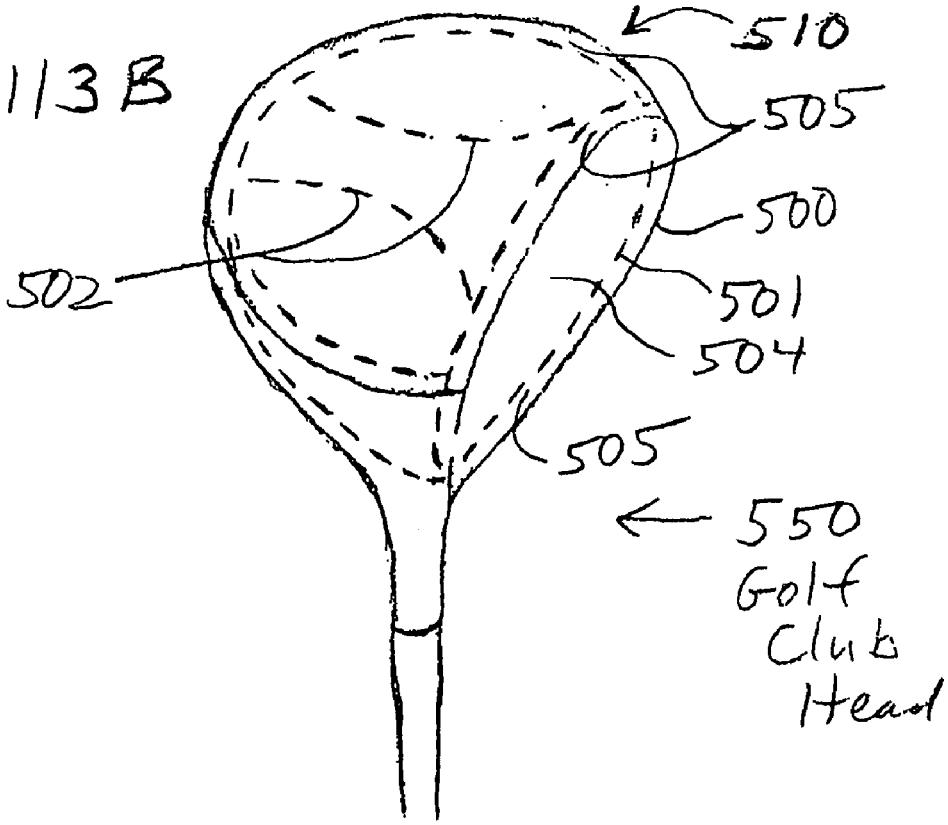

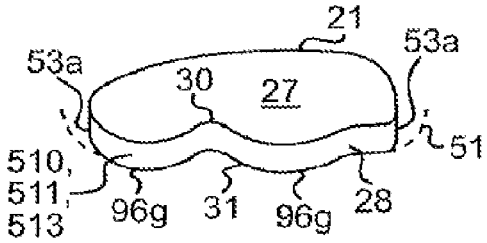
FIG. 115A
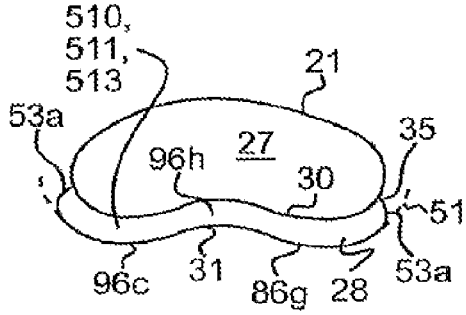
FIG. 115B
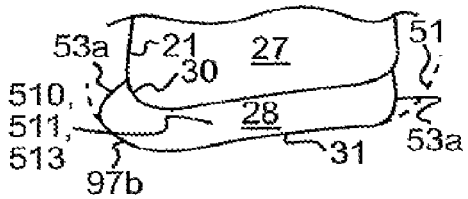
FIG. 115C
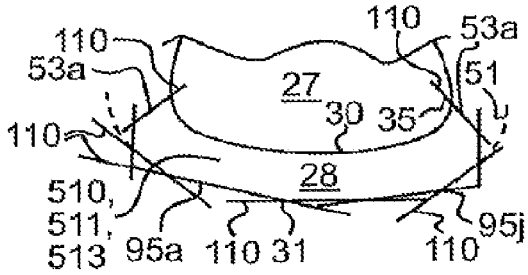
FIG. 115D
FIG. 115E
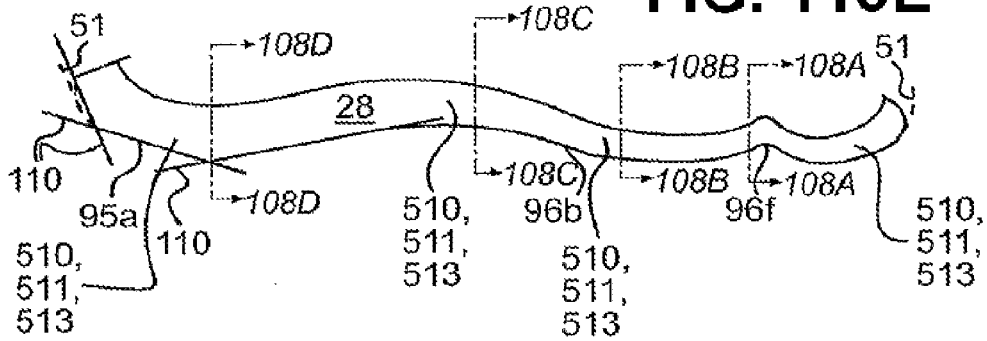

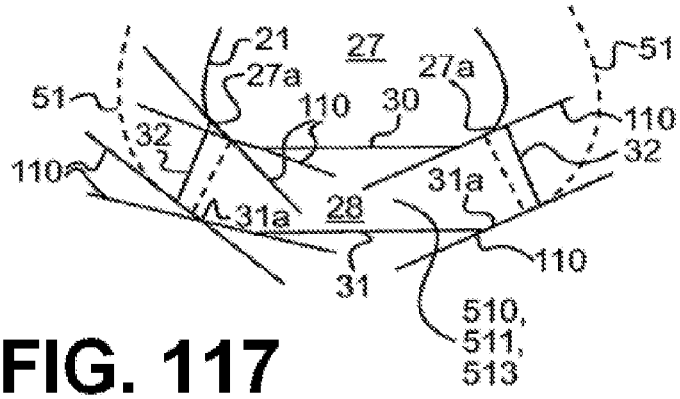
FIG. 117
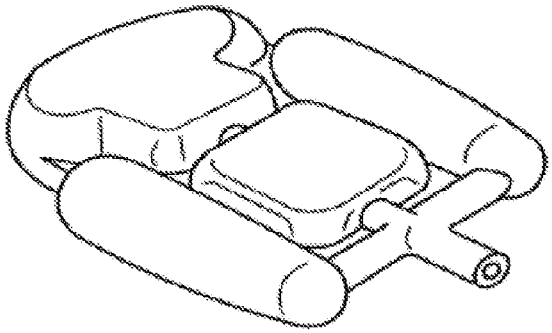
FIG. 119
FIG. 120
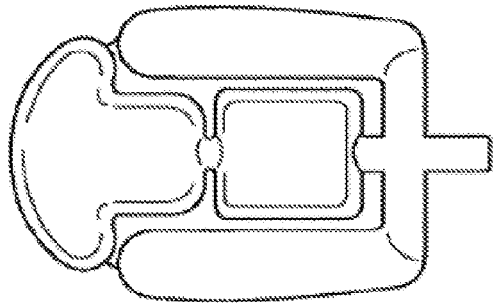

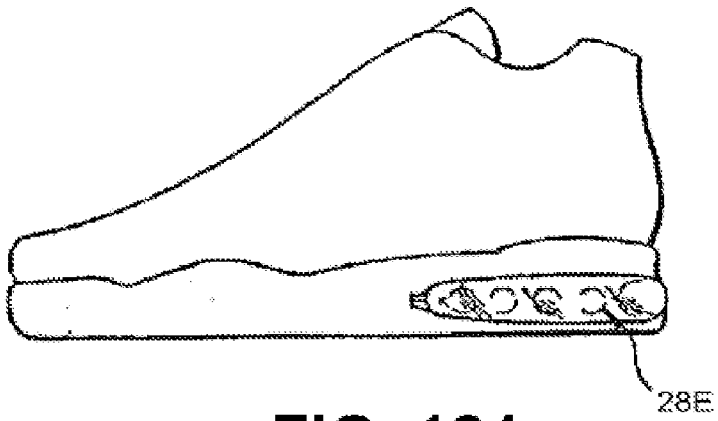
FIG. 121
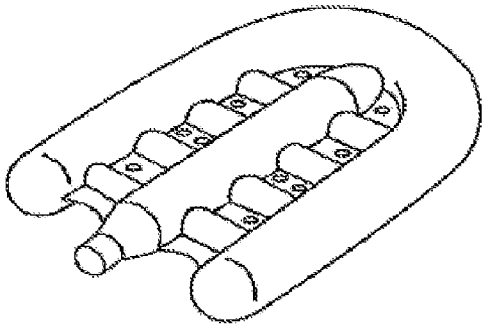
FIG. 122
FIG. 123
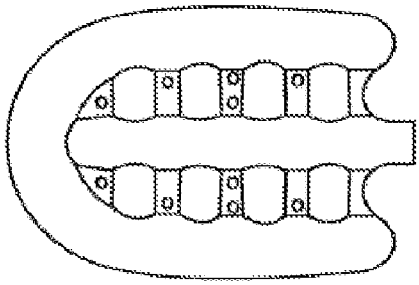

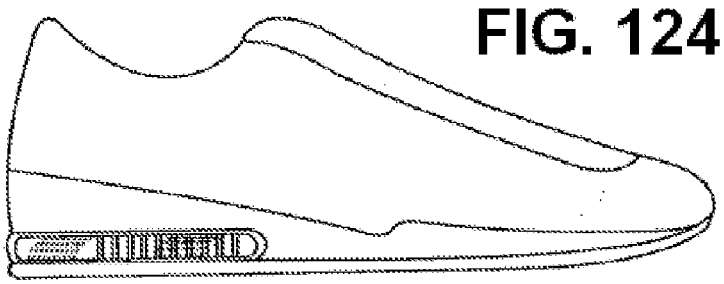
FIG. 124
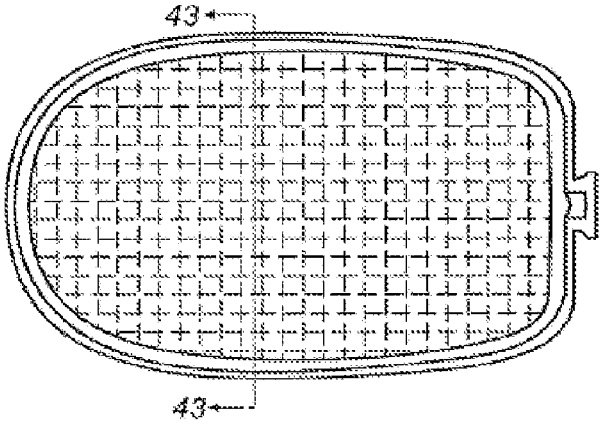
FIG. 125
FIG. 126
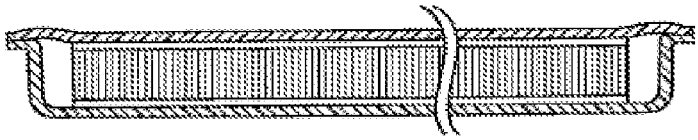

DEVICES WITH INTERNAL FLEXIBILITY SIPES, INCLUDING SIPED CHAMBERS FOR FOOTWEAR

BACKGROUND OF THE INVENTION

1. Field of the Invention

The invention relates to all forms of footwear, including street and athletic, as well as any other products benefiting from increased flexibility, better resistance to shock and shear forces, and stable support. More particularly, the invention incorporates devices as a unitary integral component with at least one internal (or mostly internal) sipe, including slits or channels or grooves and any other shape, including geometrically regular or non-regular, such as anthropomorphic shapes, into a large variety of products including footwear using materials known in the art or their current or future equivalent. Still more particularly, the unitary internal sipe component provides improved flexibility to products utilizing them, as well as improved cushioning to absorb shock and/or shear forces, while also improving stability of support, and therefore the siped devices can be used in any existing product that provides or utilizes cushioning. These products include footwear and orthotics; athletic, occupational and medical equipment and apparel; padding or cushioning, such as for equipment and furniture; balls; tires; and any other structural or support elements in a mechanical, architectural or any other device. Still more particularly, the integral component with at least one sipe can include a media such as a lubricant or glue of any useful characteristic such as viscosity or any material, including a magnetorheological fluid.

The invention further relates to at least one chamber or compartment or bladder surrounded, partially or completely, by at least one internal (or mostly internal) sipe for use in any footwear soles or uppers, or orthotic soles or uppers, and for other flexibility, cushioning, and support uses in athletic equipment like helmets and apparel including protective padding and guards, as well as medical protective equipment and apparel, and other uses, such as protective flooring, improved furniture cushioning, balls and tires for wheels, and many other uses.

The internal sipe integral component invention further can be usefully combined with the applicant's prior footwear inventions described in this application, including removable midsole structures and orthotics and chambers with controlled variable pressure, including control by computer.

2. Brief Description of the Prior Art

Existing devices are generally much less flexible than would be optimal, especially products for human (or animal) users, whose non-skeletal anatomical structures like bare foot soles generally remain flexible even under significant pressure, whereas the products interfacing directly with them are often much more rigid.

Taking footwear soles as one example, cushioning elements like gas bladders or chambers or compartments are typically fixed directly in other midsole foam plastic material to form a structure that is much more rigid than the sole of the human wearer's bare foot. As a result, the support and cushioning of the bare foot are seriously degraded when shod in existing footwear, since the relatively rigid shoe sole drastically alters by obstructing the way in which the bare foot would otherwise interact with the ground underneath a wearer. The natural interface is interrupted.

The use of external sipes—that is, sipes in the form of slits or channels that are open to an outside surface, particularly a ground-contracting surface—to provide flexibility in footwear soles has been fully described by the applicant in prior applications, including the examples shown in FIGS. 55A-55C, 56, 57, and 73A-73D. Such external sipes principally provide flexibility to the footwear sole by providing the capability of the opposing surfaces of the sipe to separate easily from each other. External sipes are structurally unlike natural anatomical structures (since to be effective, they must be much deeper than surface skin texture like finger prints, the closest anatomical analogy), however, and tend to introduce significant instability by creating excessive shoe sole edge weakness adjacent the sipes, while also collecting debris in the sipes, both seriously reducing their performance. In addition, the optimal pattern and depth of such sipes is difficult to ascertain directly and tends to be a trial and error process guided by guessing, rather than the much easier procedure of following the design of the anatomical structure with which it is intended to interface to create natural flexibility.

The use of a integral component with internal sipes in footwear soles like those described in this application overcome the problems of external sipes noted above and are naturally more optimal as well, since they more closely parallel structurally the anatomical structures of the wearer's bare foot sole. As one example, simply enveloping the outer surface of existing cushioning devices like gas bladders or foamed plastic EVA or PU with a new outer layer of material that is unattached (or at least partially unattached) thereby creates an internal sipe between the inner surface of the new compartment and the outer surface of the existing bladder/midsole component, allowing the two surfaces to move relative to each other rather than being fixed to each other. Especially in the common form of a slit structure seen in many example embodiments, the flexibility of the internal sipe is provided by this relative motion between opposing surfaces that in many the example embodiments are fully in contact with each other, again in contract to the separating surfaces of external sipes; such surface contact is, of course, exclusive of any internal sipe media, which can be used as an additional enhancement, in contrast to the flexibility-obstructing debris often clogging external sipes. As a result, the footwear sole in which at least one integral internal sipe component is incorporated becomes much more flexible, much more like the wearer's bare foot sole itself, so that foot sole can interact with the ground naturally. The resulting footwear sole with internal sipes has improved, natural flexibility, improved cushioning from shock and shear forces, and better, more natural stable support.

A limited use of internal sipes has also been described by the applicant in prior applications, including the examples shown in FIGS. 12A-12D, 60A-60E, and 70-71, which are generally unglued portions coinciding with lamination layer boundaries, such as between bottomsole and midsole layers. This approach requires completely new and somewhat difficult approaches in the assembly of the footwear sole during manufacture, as well as significantly greater potential for problems of layer separation (especially bottom sole) since the inherent reduction in gluing surfaces makes the remaining gluing surfaces critical and under increased load; significantly increased positional accuracy in the application of glue is required. Also, the use of lubricating media (and the potential control thereof, including by microprocessor) is also more difficult, since the sipe is formed by existing parts and is not discretely enclosed with the new outer layer to contain the media, as it is in the new invention described in this application.

In contrast, the new invention of this application is a discrete device in the form of an integral component that can easily be inserted as a single simple step into the footwear sole during the manufacturing process or, alternatively, inserted in one single simple step by a wearer (into the upper portion of a midsole insert, for example, much like inserting an insole into an shoe), for whom the new extra layer provides buffering protection for the wearer from direct, potentially abrasive contact with a cushioning component (forming a portion of the inner, foot sole-contacting surface of the shoe sole, for example).

In addition, the new invention allows easier and more effective containment of a lubricating media (including media with special capabilities, like magnetorheological fluid) within the integral internal sipe, so that the relative motion between inner surfaces of the sipe can be controlled by that media (and, alternatively, by direct computer control); it avoids the need for the use of closed-cell midsole materials or a special impermeable layer applied to the footwear sole material to prevent the sipe media from leaking away.

Accordingly, it is a general object of one or more embodiments of the invention to elaborate upon the application of the use of a device in the form of an integral component with one or more internal sipes to improve the flexibility, cushioning, and stability of footwear and other products.

It is still another object of one or more embodiments of the invention to provide footwear having an integral component with at least one internal (or mostly internal) sipes, including slits or channels or grooves and any other shape, including geometrically regular or non-regular, such as anthropomorphic shapes, to improve flexibility, cushioning and stability. It is still another object of one or more embodiments of the invention to include an integral device with one or more internal sipes that include a media such as a lubricant or glue of any useful characteristic such as viscosity or any material, including a magnetorheological fluid.

It is another object of one or more embodiments of the invention to create a shoe sole with flexibility, support and cushioning that is provided by siped chambers or compartments or bladders in the footwear sole or upper or orthotics. The compartments or chambers or bladders are surrounded, partially or completely, by at least one internal (or mostly internal) sipe for use in any footwear soles or uppers, or orthotic soles or uppers, and for other flexibility, cushioning, and stability uses in athletic equipment like helmets and apparel including protective padding and guards, as well as medical protective equipment and apparel, and other uses, such as protective flooring, improved furniture cushioning, balls and tires for wheels, and many other uses.

It is another object of one or more embodiments of the invention to create footwear, orthotic or other products with at least one outer chamber; at least one inner chamber inside the outer chamber; the outer chamber and the inner chamber being separated at least in part by an internal sipe; at least a portion of an inner surface of the outer chamber forming at least a portion of an inner surface of the internal sipe; and the internal sipe providing increased flexibility, cushioning, and stability for the footwear, orthotic or other product.

A further object of one or more embodiments of the invention is to combine the integral component with at least one internal sipe with the applicant's prior footwear inventions described in this application, including removable midsole structures and orthotics and chambers with controlled variable pressure, including control by computer.

These and other objects of the invention will become apparent from the summary and detailed description of the invention, which follow, taken with the accompanying drawings.

SUMMARY OF THE INVENTION

In one aspect the present invention attempts, as closely as possible, to replicate the naturally effective structures of the bare foot that provide flexibility, cushioning, and stable support. More specifically, the invention relates to a device for a footwear sole or upper or both, or an orthotic or orthotic upper or both, or other, non-footwear devices, including a unitary internal sipe component, said internal sipe providing increased flexibility for said device. More specifically, the invention relates to an integral component with at least one sipe with a media such as a lubricant or glue of any useful characteristic such as viscosity or any material, including a magnetorheological fluid.

Even more specifically, the invention relates to footwear or orthotics or other products with at least one compartment or chamber or bladder surrounded, partially or completely, by at least one internal (or mostly internal) sipe for use in any footwear soles or uppers, or orthotic soles or uppers, and for other flexibility, cushioning, and stability uses. Even more specifically, the invention relates to footwear, orthotic or other products with at least one outer chamber; at least one inner chamber inside the outer chamber; the outer chamber and the inner chamber being separated at least in part by an internal sipe; at least a portion of an inner surface of the outer chamber forming at least a portion of an inner surface of the internal sipe; and the internal sipe providing increased flexibility, cushioning, and stability for the footwear, orthotic or other product.

These and other features of the invention will become apparent from the detailed description of the invention that follows.

BRIEF DESCRIPTION OF THE DRAWINGS

FIGS. 83-127 are new with this application.

FIG. 1 is a perspective view of a prior art conventional athletic shoe to which the present invention is applicable.

FIG. 8A is an unloaded and upright barefoot heel.

FIG. 8B is a heel moderately loaded by full body weight and upright.

FIG. 8C is a heavily loaded heel at peak landing force while running and upright.

FIG. 8D is heavily loaded heel shown tilted out laterally by about 20 degrees, the maximum tilt for the heel.

FIG. 10A shows a quartered section of a shoe sole with a structure comprising elements corresponding to the calcaneus with fat pad chambers below it.

FIG. 10B shows a horizontal plane close-up of the inner structures of an individual chamber of a shoe sole.

FIG. 10C shows a horizontal section of a shoe sole with a structure corresponding to the whorl arrangement off fat pads underneath the calcaneus.

FIGS. 11A-11B are frontal plane cross-sectional views showing different variations of removable midsole inserts in accordance with the present invention.

FIG. 11C shows a shoe sole with the removable midsole insert removed.

FIG. 11D is an exploded view of an embodiment of a removable midsole insert in accordance with the present invention.

FIG. 11E is a cross-sectional view showing a snap-fit arrangement for releasably securing the removable midsole insert.

FIG. 11F is a cross-sectional view of an embodiment that employs interlocking geometries for releasably securing the removable midsole insert of the present invention.

FIG. 11M-11O are frontal plane cross-sectional views showing three variations of mid sole sections with one or more pressure controlled encapsulated midsole sections and a control system such as a microprocessor.

FIGS. 11Q and 11R are frontal plane cross-sectional views showing two variations of the removable midsole insert with a thin outer sole layer.

FIG. 11S shows the interface between the bottomsole and the secondary bottomsole.

FIG. 11V shows an embodiment of the present invention that employs mechanical fasteners to releasably secure the removable midsole insert in place.

FIG. 29 is a frontal plane cross-section showing a shoe sole of uniform thickness that conforms to the natural shape of the human foot.

FIGS. 30A-30D show a load-bearing flat component of a shoe sole and a naturally rounded side component as well as a preferred horizontal periphery of the flat load-bearing portion of the shoe sole.

FIGS. 31A-31B are diagrammatic sketches showing a rounded side sole design according to the invention with variable heel lift.

FIG. 32 is a side view of a stable rounded shoe sole according to the invention.

FIG. 33A is a cross-sectional view of the forefoot portion of a shoe sole taken along line 33A of FIGS. 32 and 33D.

FIG. 33B is a cross-sectional view taken along line 33B of FIGS. 32 and 33D.

FIG. 33C is a cross-sectional view of the heel portion taken along line 33C in FIGS. 32 and 33D. FIG. 33D is a top view of the shoe sole shown in FIG. 32

FIGS. 34A-34D are frontal plane cross-sectional views of a shoe sole according to the invention showing a theoretically ideal stability plane and truncations of the sole side contoured to reduce shoe bulk.

FIGS. 35A-35C show a contoured sole design according to the invention when applied to various tread and cleat patterns.

FIGS. 38A-38F show a design with naturally rounded sides extended to other structural contours underneath the load-bearing foot such as the main longitudinal arch.

FIGS. 39A-39E illustrate a fully contoured shoe sole design extended to the bottom of the entire non-load bearing foot.

FIG. 40 shows a fully contoured shoe sole design abbreviated along the sides to only essential structural support and propulsion elements.

FIGS. 41A-41B illustrate a street shoe with a correctly contoured sole according to the invention and side edges perpendicular to the ground.

FIG. 49A-D shows the theoretically ideal stability plane concept applied to a negative heel shoe sole that is less thick in the heel area than in the rest of the shoe sole, such as a shoe sole comprising a forefoot lift.

FIG. 49A is a frontal plane cross-sectional view of the forefoot portion taken along line 49A of FIG. 49D.

FIG. 49B is a frontal plane cross-sectional view taken along line 49B of FIG. 49D.

FIG. 49C is a frontal plane cross-sectional view of the heel along line 49C of FIG. 49D.

FIG. 49D is a top view of the shoe sole with a thicker forefoot section shown with cross-hatching.

FIG. 51A is a frontal plane cross-sectional view of the forefoot portion taken along line 51A of FIG. 5ID.

FIG. 51B is a frontal plane cross-sectional view taken along line 51B of FIG. 51D.

FIG. 51C is a frontal plane cross-sectional view taken along the heel along line 51C in FIG. 51D.

FIG. 51D is a top view of the shoe sole with sides that are abbreviated to essential structural support elements shown hatched.

FIG. 53A shows the foot upright with its sole flat on the ground.

FIG. 53B shows the foot tilted out 20 degrees to about its normal limit.

FIG. 53C shows a conventional shoe sole of the same size when tilted out 20 degrees to the same position as FIG. 53B. The right foot and shoe are shown.

FIG. 55 shows a shoe sole with a lateral stability sipe in the form of a vertical slit.

FIGS. 60A-D show the use of embedded flexible inelastic fiber or fiber strands, woven or unwoven, in various embodiments similar those shown in FIGS. 58A-D.

FIG. 60E shows a frontal plane cross-section of a fibrous capsule shell 191 that directly envelops the surface of the encapsulated midsole section 188.

FIG. 64 shows an upper surface between complementary and parallel to the flat ground and a lower surface of the rounded shoe sole side that is not in contact with the ground.

FIGS. 66A-66F show a shoe sole without rounded stability sides.

FIGS. 67A-67E and 68 also show a shoe sole without rounded stability sides.

FIG. 75 shows, in FIGS. 75A-75C, a method, known from the prior art, for assembling the midsole shoe sole structure of the present invention.

FIG. 78 illustrates, in FIGS. 78A-78E, the design and manufacturing methods of the present invention using a series of frontal plane cross-sections of shoe soles.

FIG. 79 shows a method of establishing the radial shoe sole thickness using a line perpendicular to a line tangent to a point on the upper or lower surface of the shoe sole.

FIG. 80 shows a circle radius method of establishing the shoe sole thickness.

FIG. 81 is a diagram of another method of measuring shoe sole thickness.

FIG. 82 illustrates an embodiment wherein the stability sides are determined geometrically as a section of a ring.

FIG. 83A-86A show a frontal or sagittal plane cross section view of an example of a device 510 such as a flexible insert with a siped compartment or chamber or bladder.

FIGS. 83B shows a horizontal plane view of a device 510 example.

FIGS. 87A-88A show a frontal or sagittal plane cross section view of an example of a device 510 such as a flexible insert with two siped compartments or chambers or bladders or combination.

FIG. 89 shows, in a frontal plane cross section in the heel area, a shoe and shoe sole including a single siped compartment 510.

Figure 89:
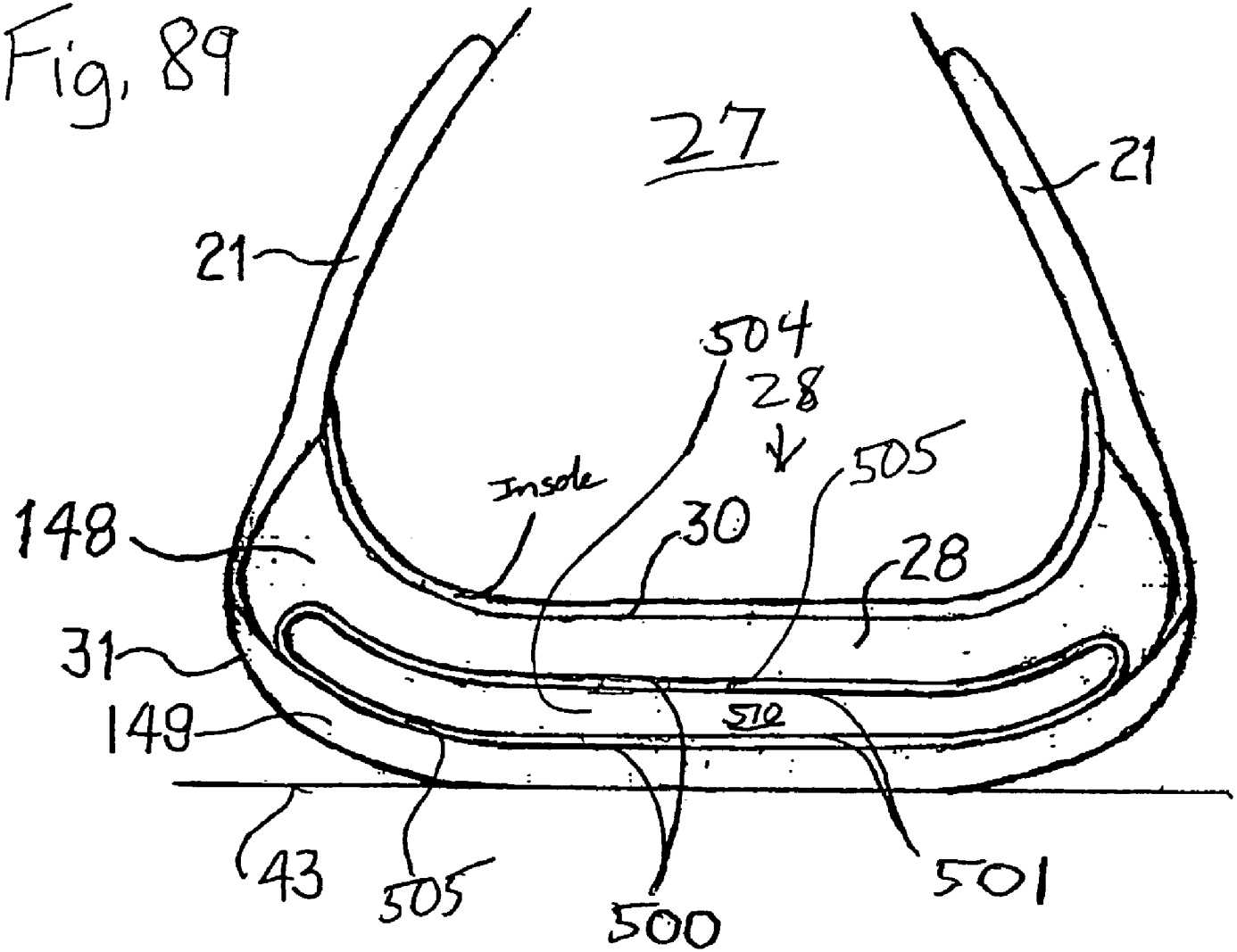
Figure 90:
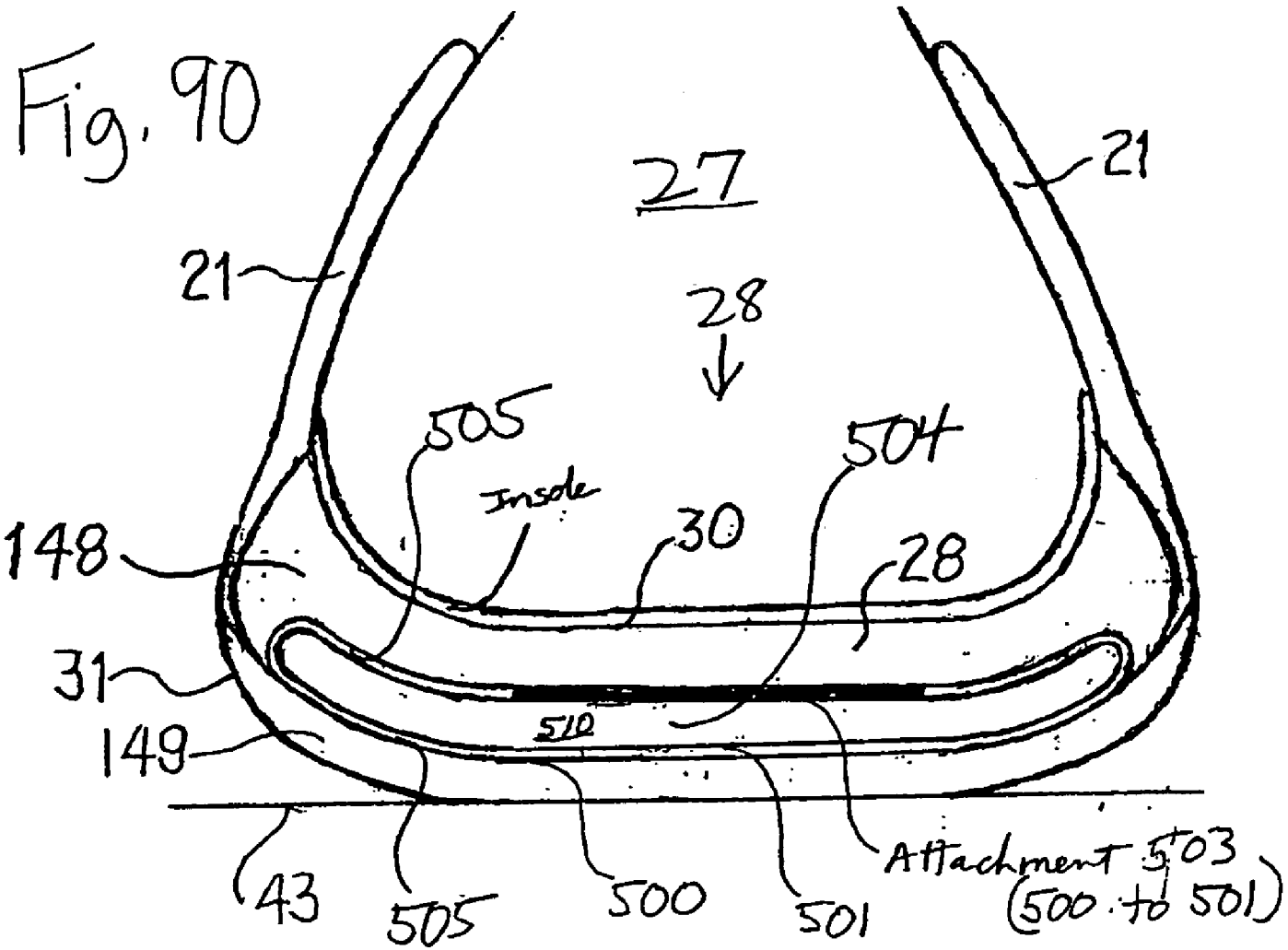

FIG. 90 shows a similar embodiment and view to that shown in FIG. 89, including also an attachment 503 between 500 and 501.

Figure 91:
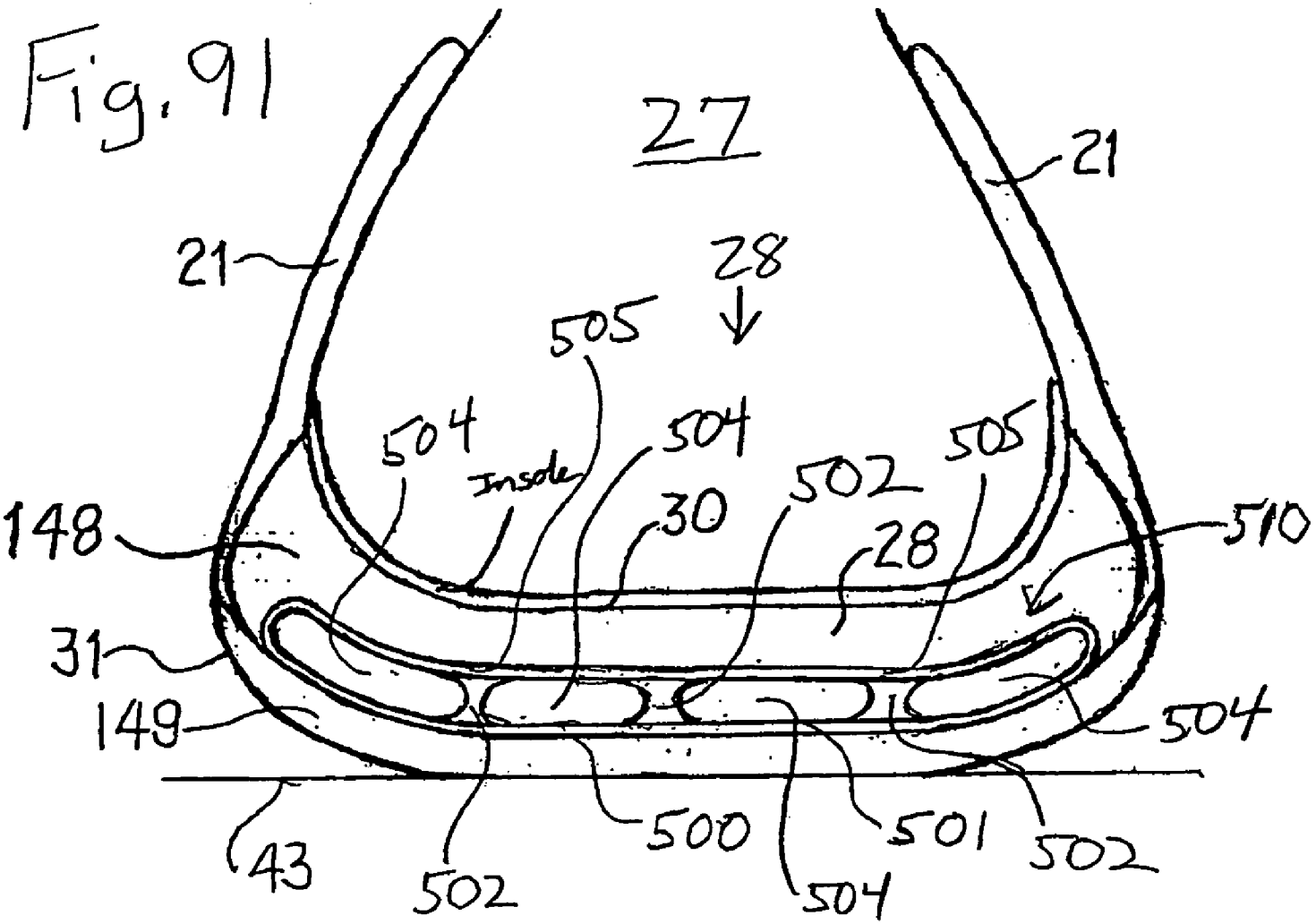

FIG. 91 shows a similar embodiment and view to that shown in FIG. 89, including also an inner compartment/chamber 501 with a number of inner compartment structural elements 502.

Figure 92:
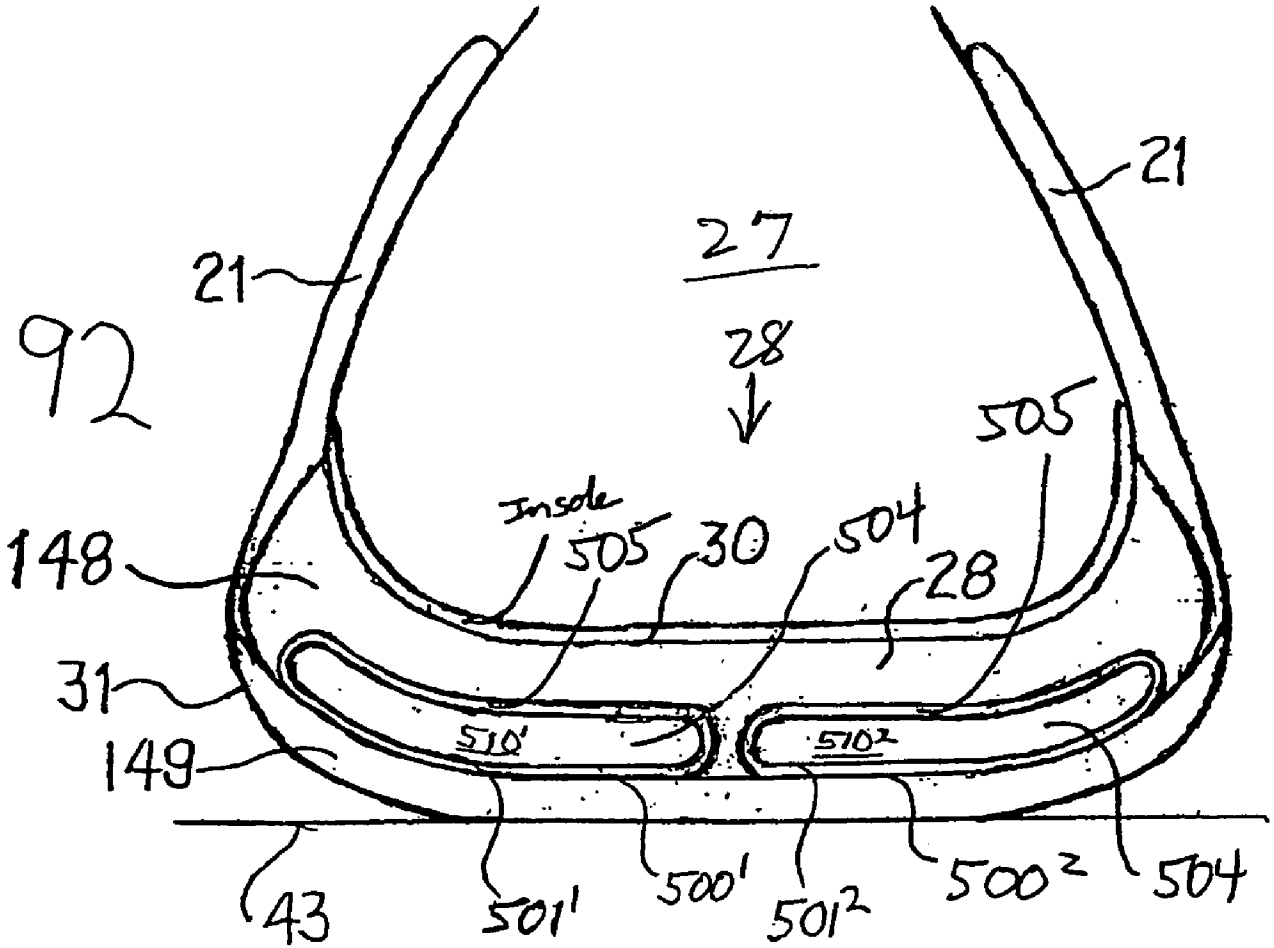

FIG. 92 shows a similar embodiment and view to that shown in FIG. 89, including also more than one siped compartment 510.

Figure 93:
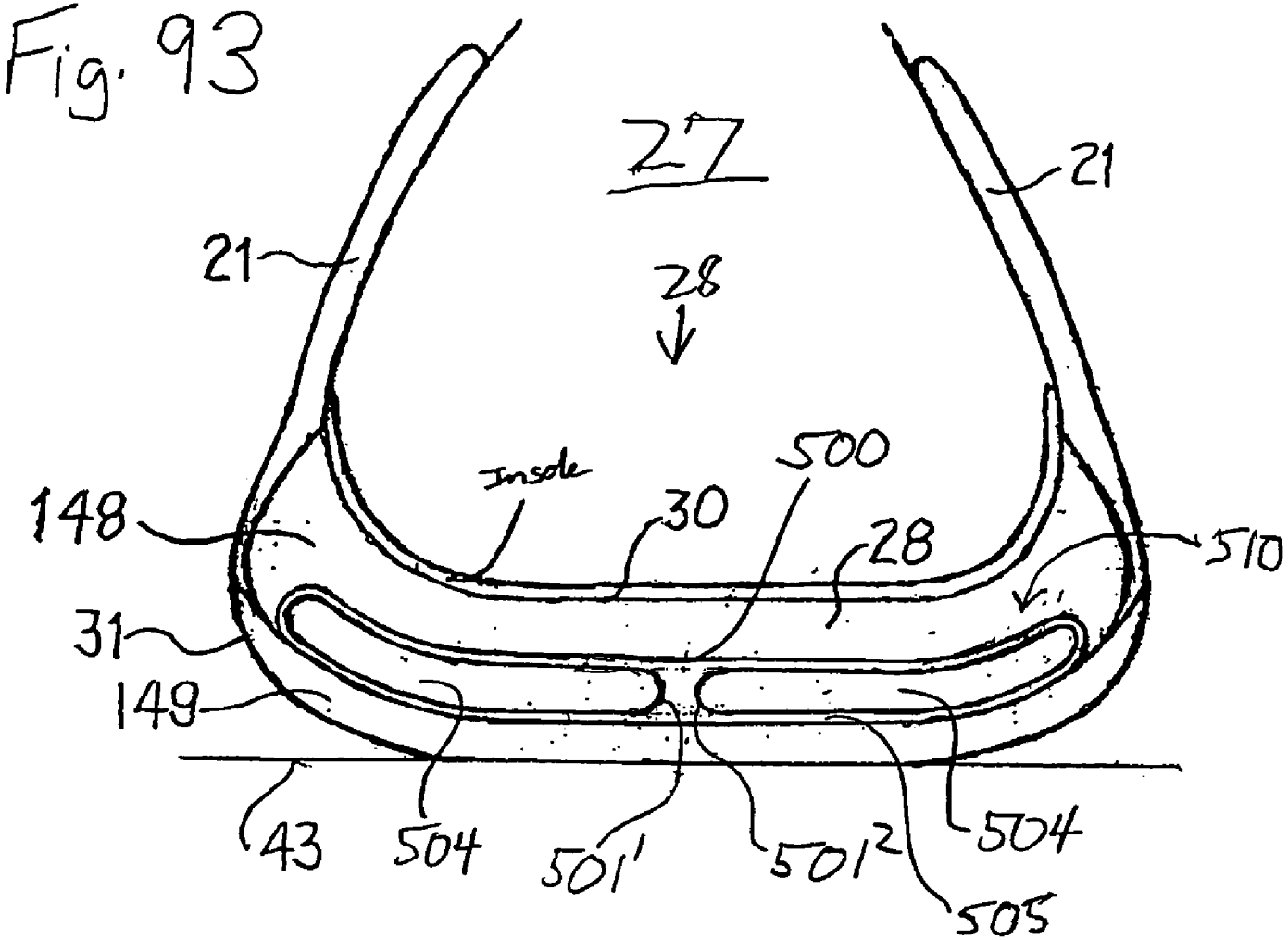
Figure 94:
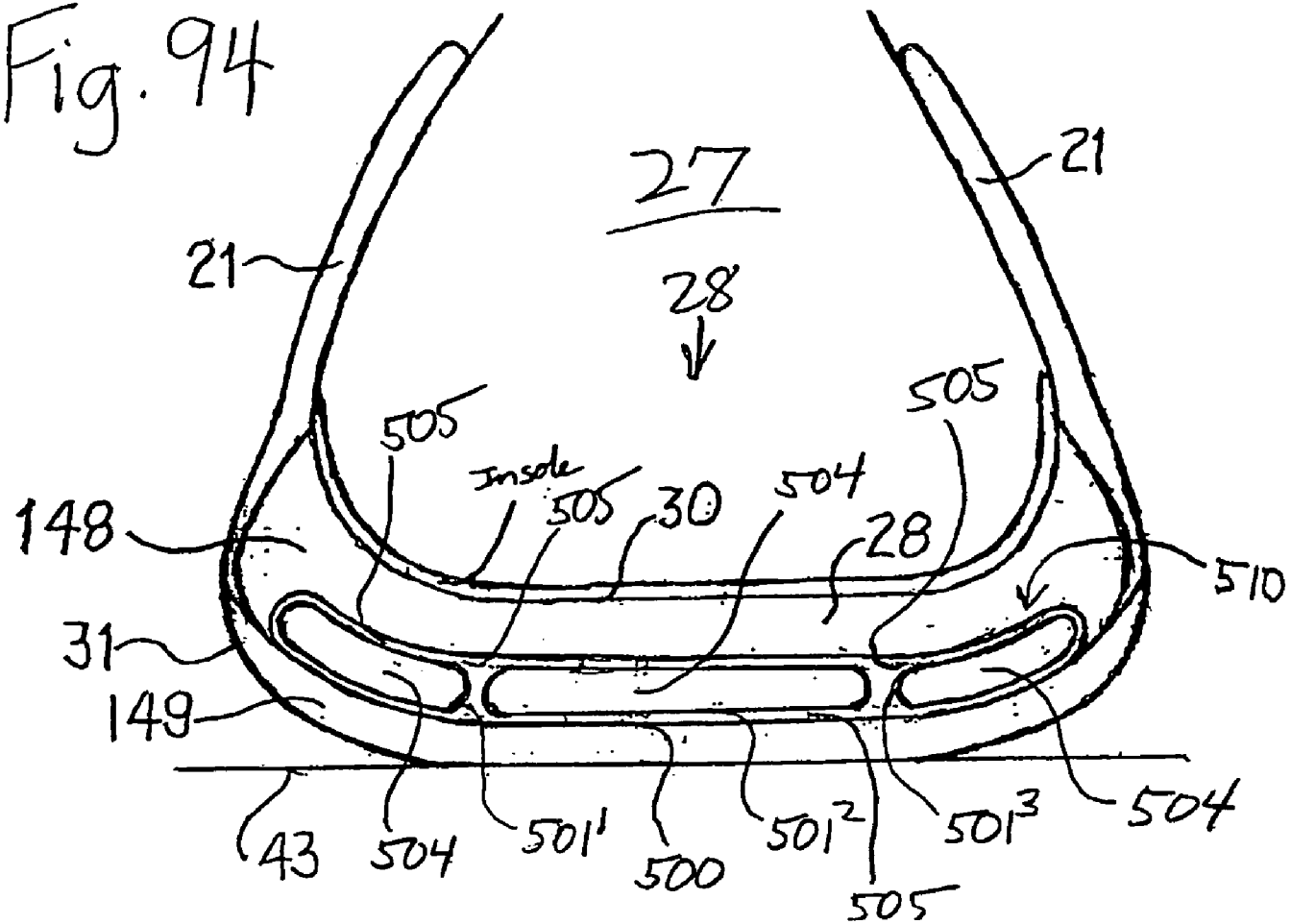

FIGS. 93 and 94 show a similar embodiment and view to that shown in FIG. 89, including also more than one inner compartments 501 in an outer compartment 500.

Figure 95:
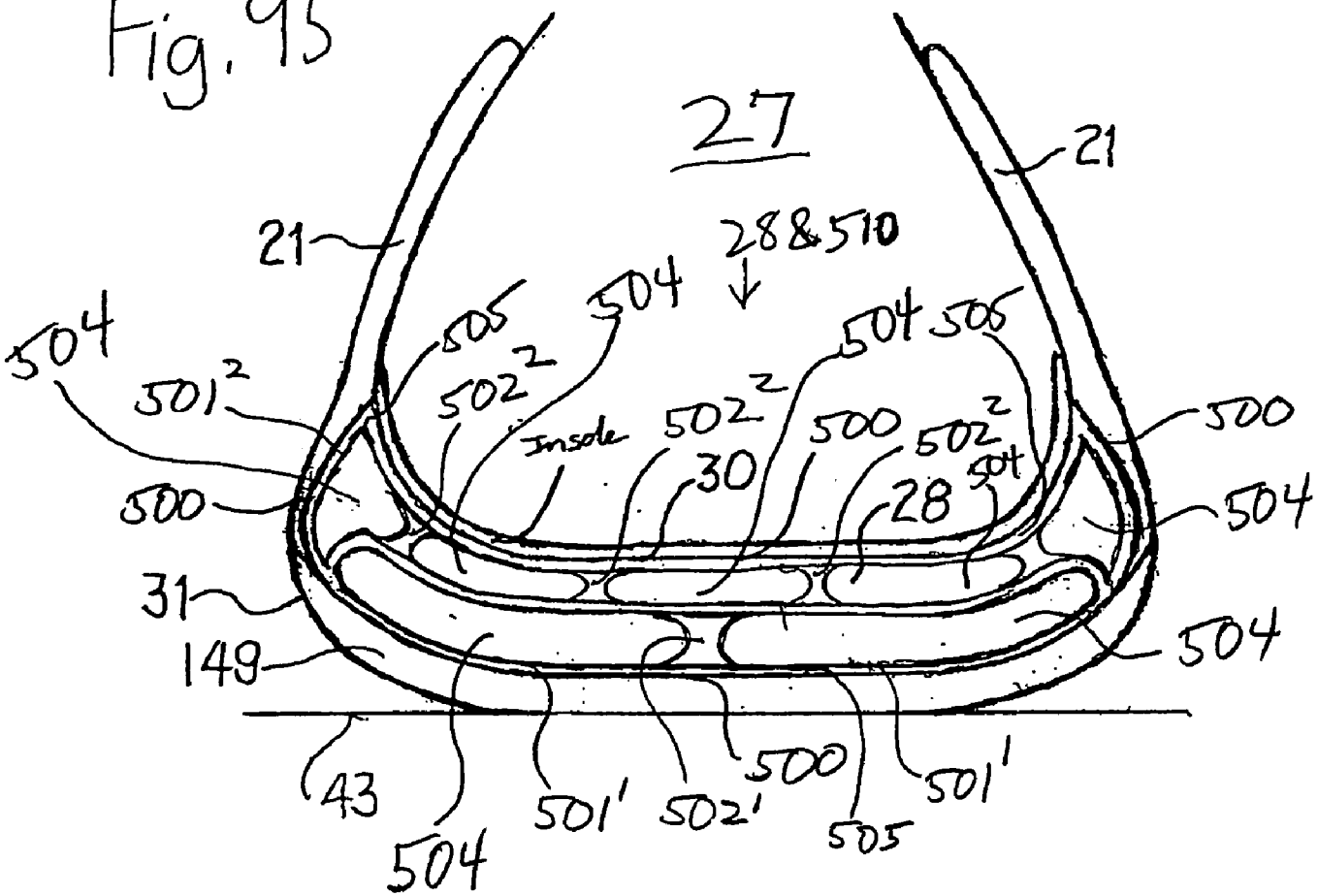
Figure 96:
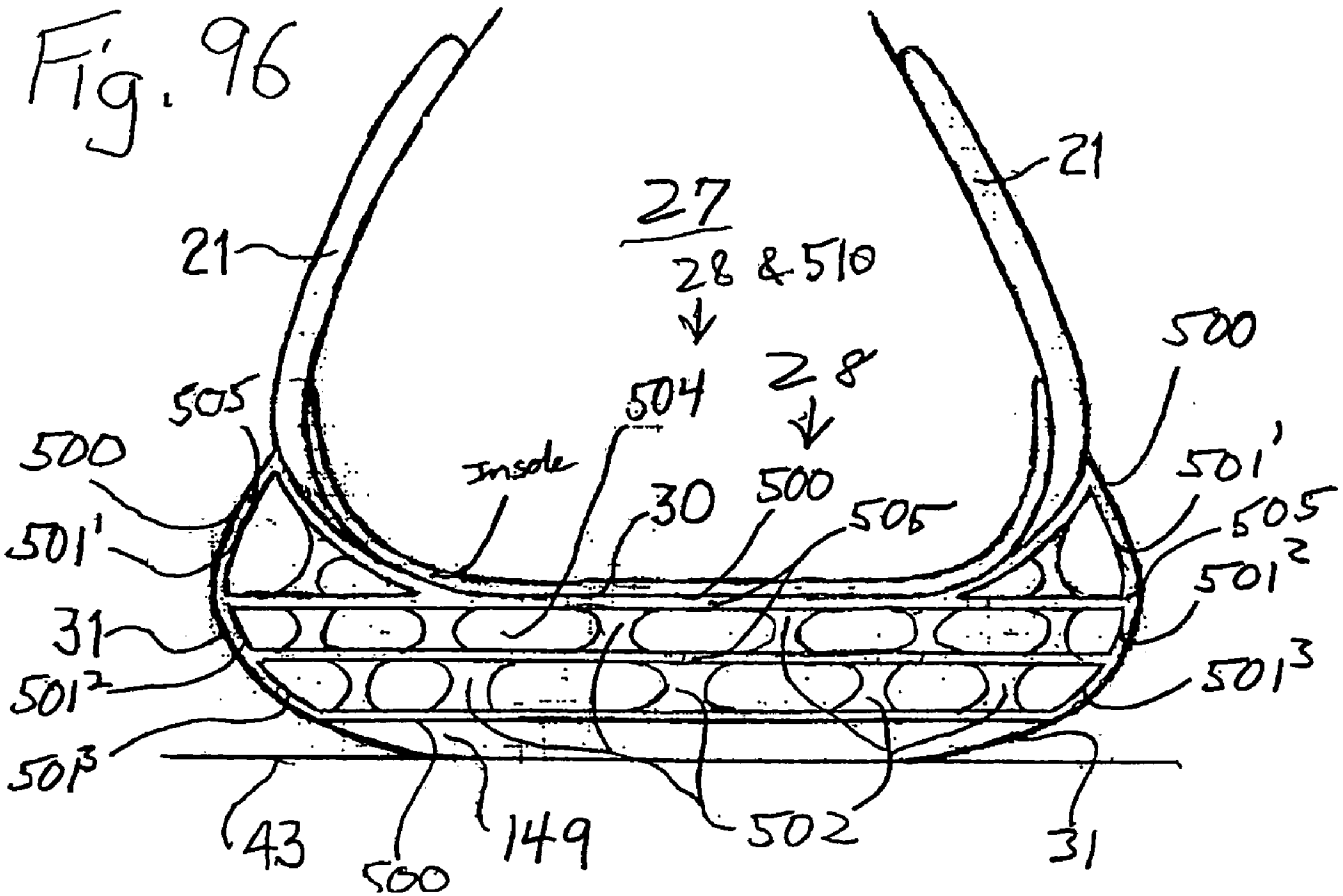

FIGS. 95 and 96 show similar embodiments and views to that shown in FIG. 89, but wherein the outer compartment/chamber/bladder 500 forms substantially all of the midsole portion of the footwear sole (exclusive of the outer sole).

Figure 11J:
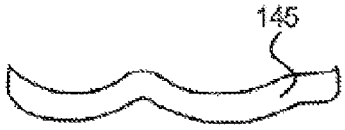
FIGS. 11H-11J show other frontal plane sections of the removable midsole insert along the lines in FIG. 11L.
Figure 11I:
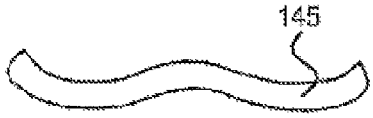
Figure 11H:
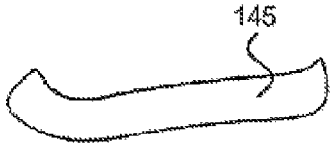
Figure 11G:
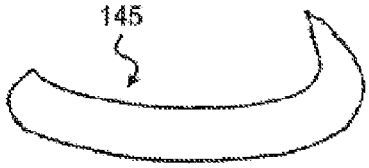
FIG. 11G is a frontal plane cross-section of a forefoot section removable midsole formed with an asymmetric side height.
Figure 11L:
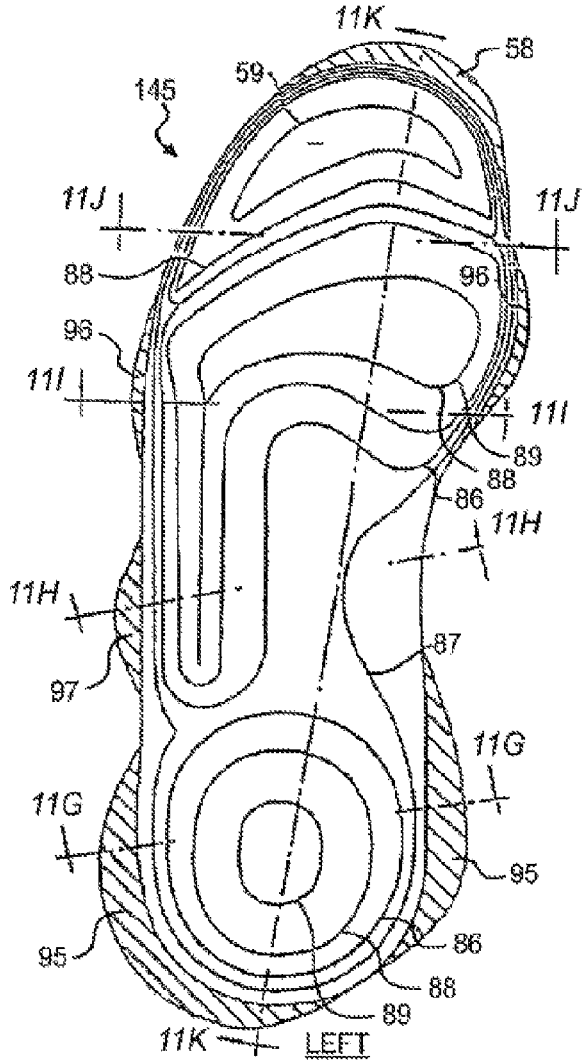
FIG. 11L shows a horizontal plane top view of the shoe sole of FIGS. 11G-11K.
Figure 11K:
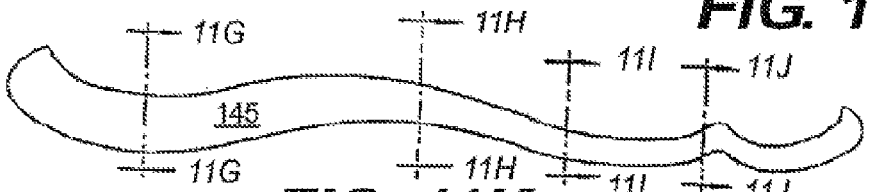
FIG. 11K shows a sagittal plane section of the shoe sole of FIGS. 11G-11I and 11L.
Figure 11M:
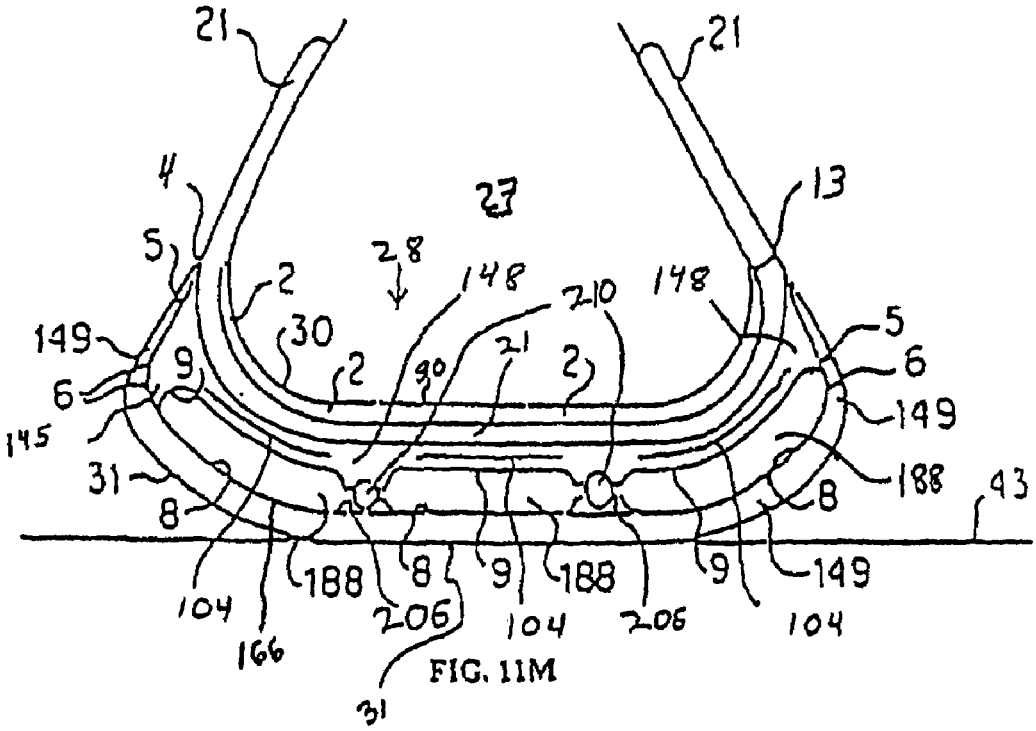
Figure 11N:
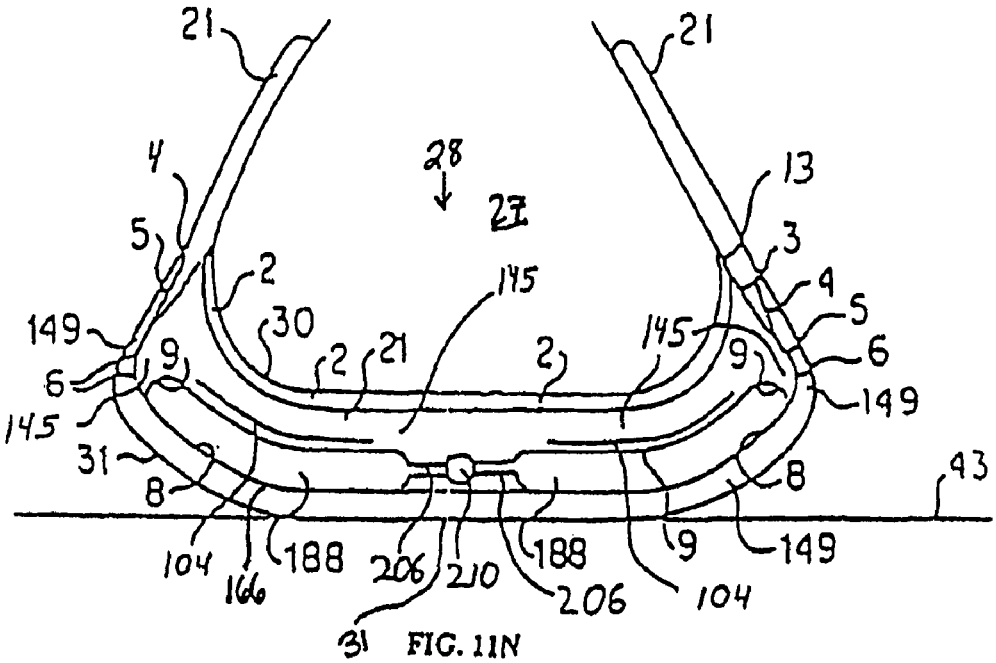
Figure 97:
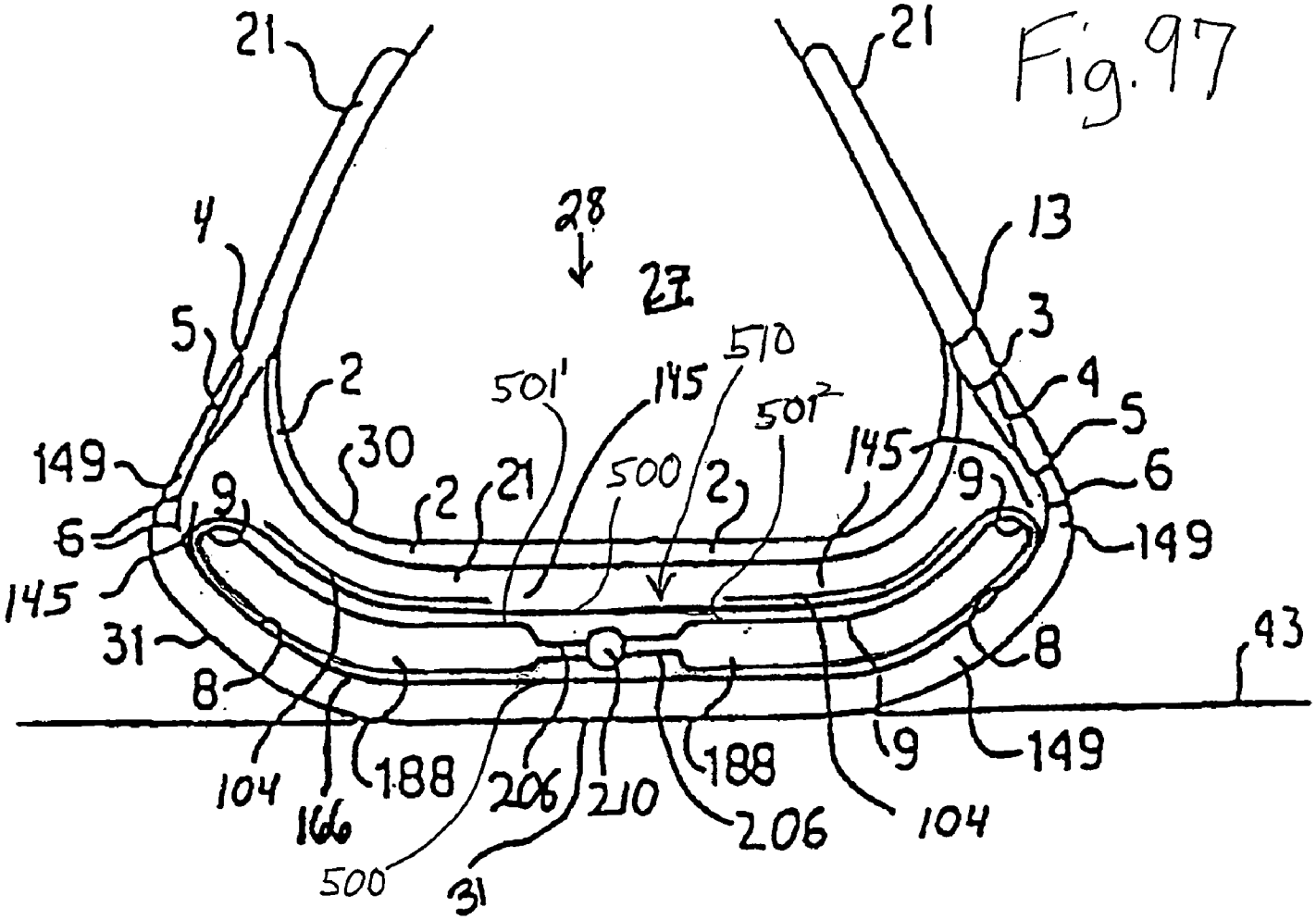

FIG. 97 shows a similar embodiment and view to that shown in FIG. 89, but also including the features of FIG. 11N, with the siped compartment/chamber/bladder 510 applied to it.

Figure 98:
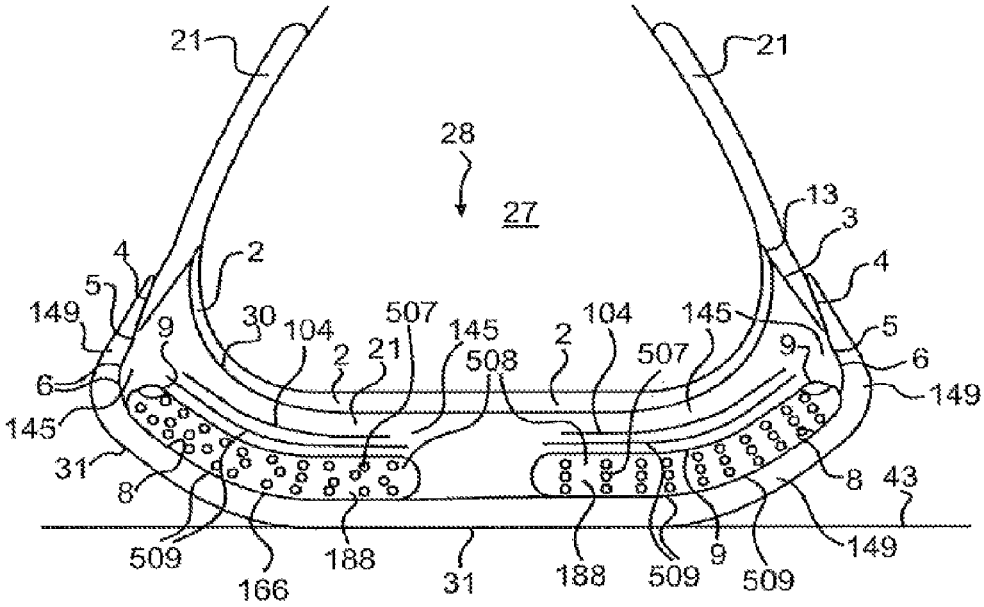

FIG. 98 shows a somewhat similar embodiment and view to that shown in FIG. 92, but including an electromagnetic shock absorption system in each chamber, which are without sipes.

Figure 99A:
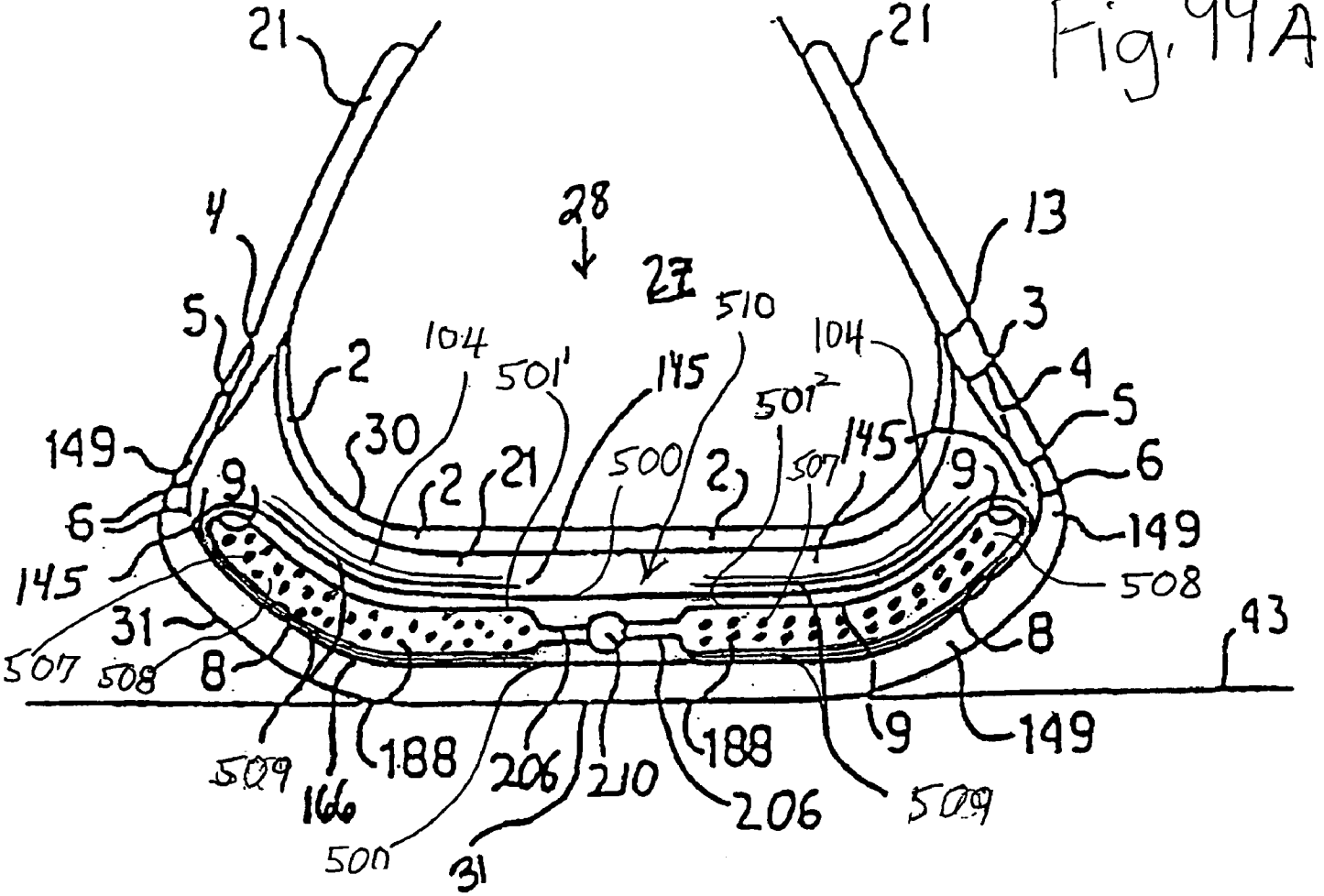
Figure 99B:
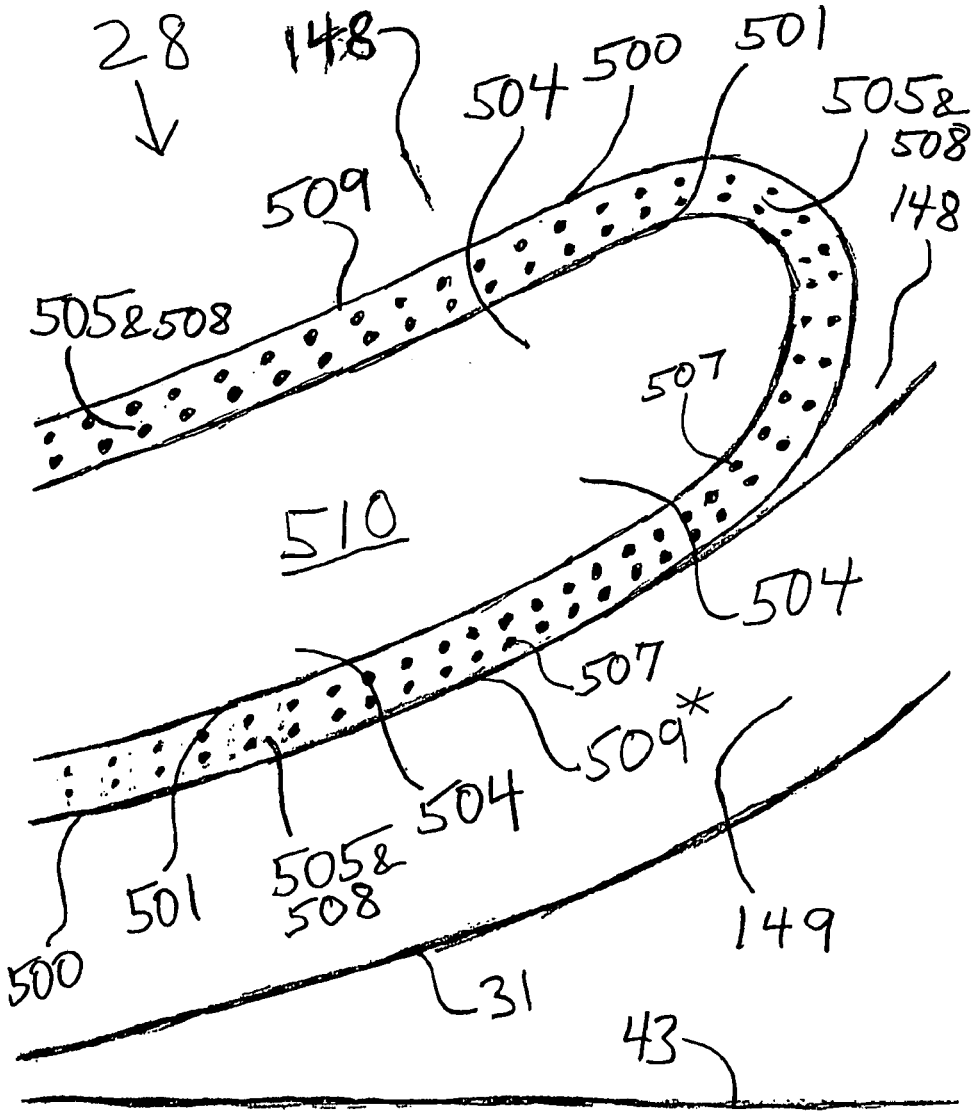

FIG. 99A shows a similar embodiment and view to that shown in FIG. 97, but including an electromagnetic shock absorption system. FIG. 99B is a close-up view of an embodiment like FIG. 89, but showing magnetorheological fluid 508 located within an internal sipe 505.

Figure 100A:
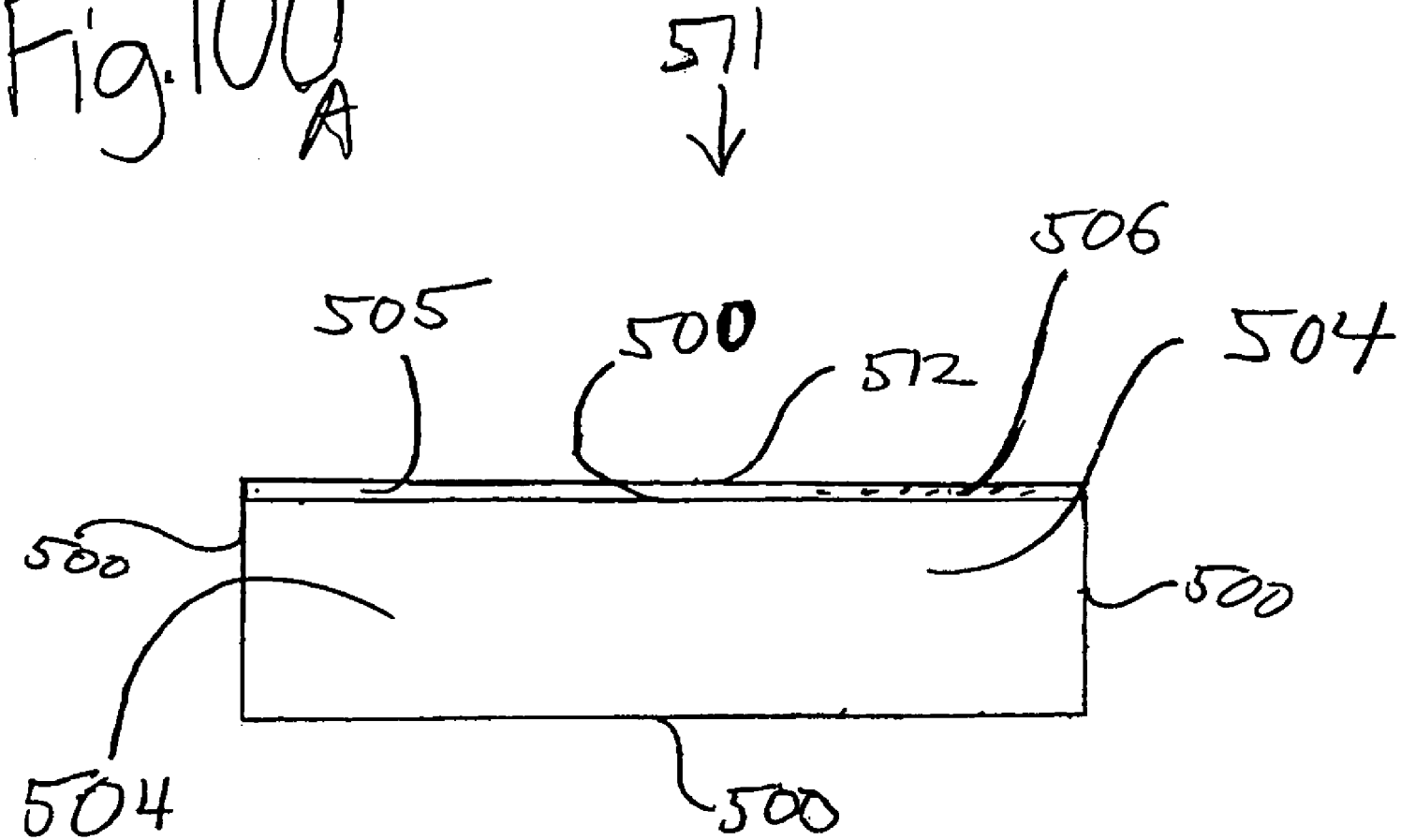
Figure 100B:
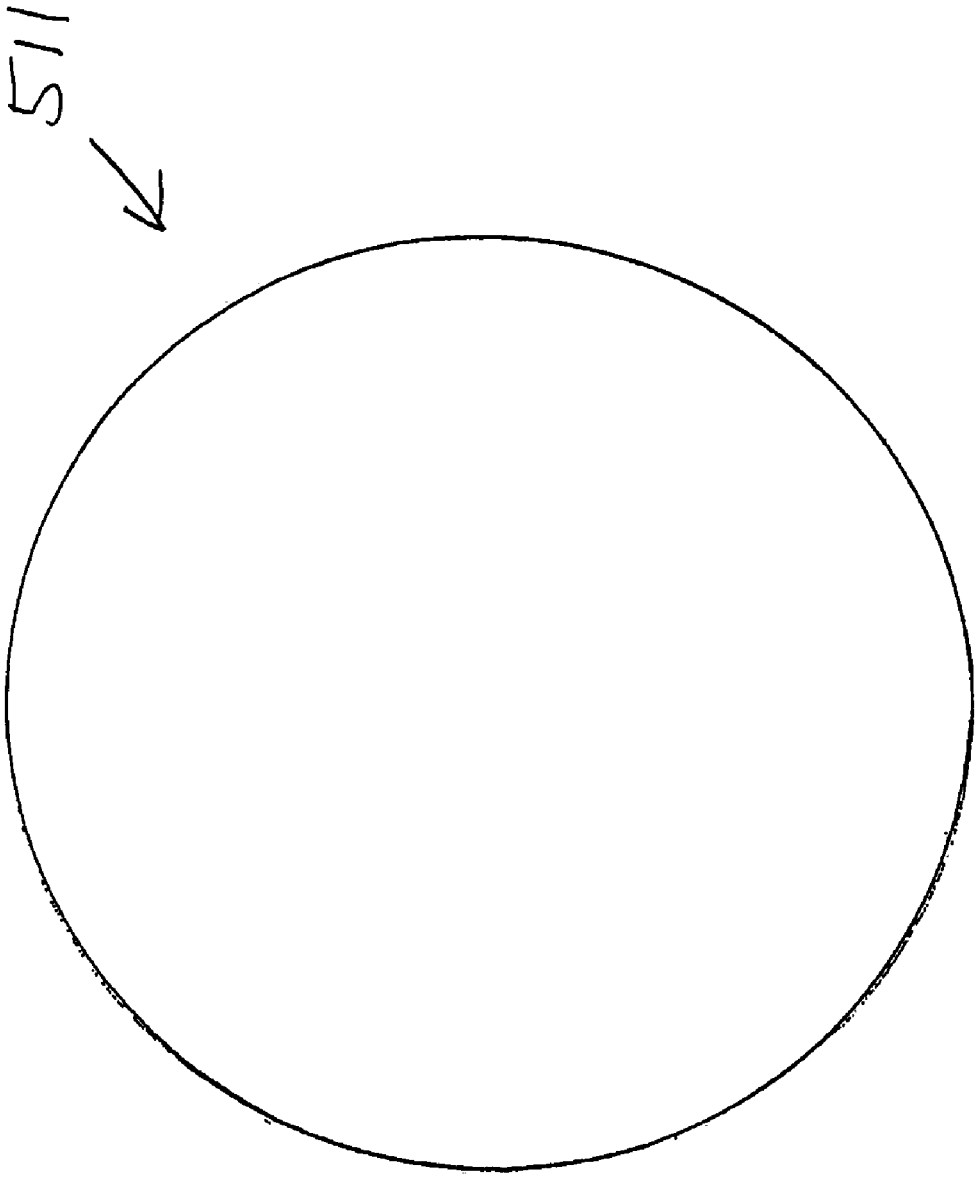
Figure 10A:
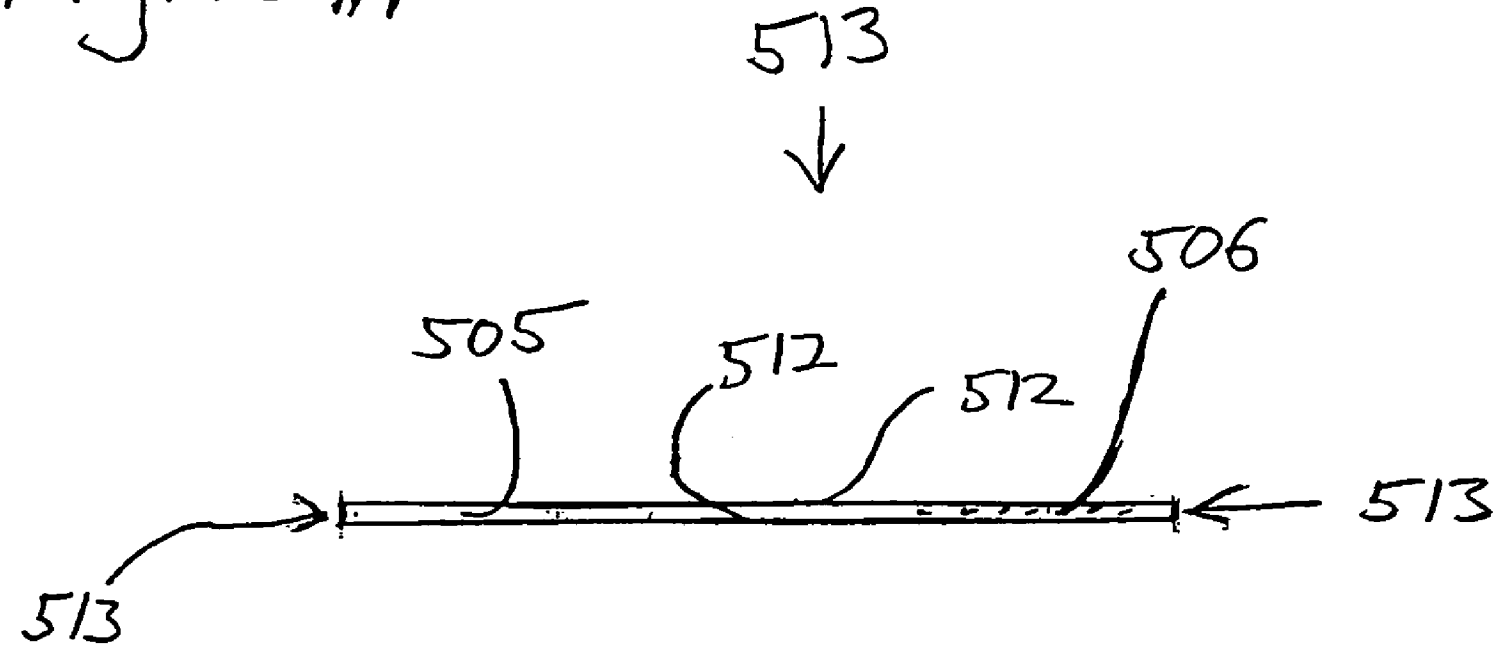

FIG. 100A shows, in a frontal or sagittal plane cross section, a flexible insert or component 511 including a singe compartment/chamber 161/188 or bladder with an associated internal sipe 505 component. FIG. 100B shows a horizontal plane view of 511.

Figure 101B:
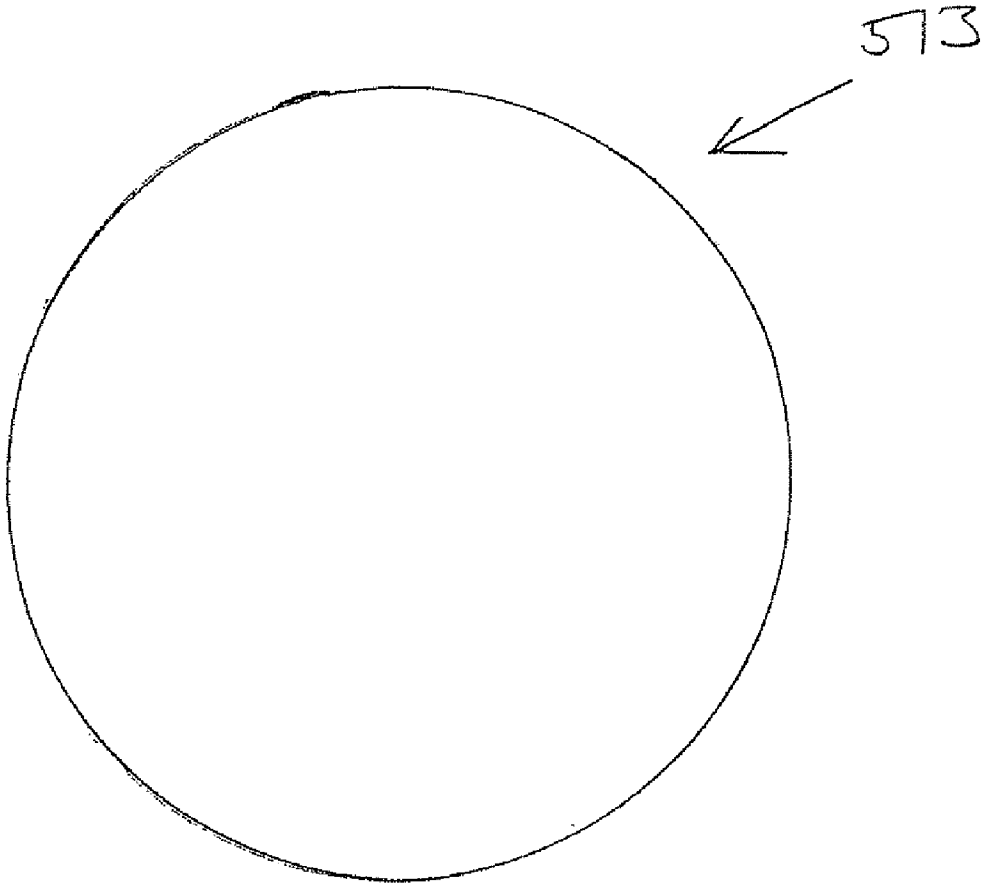

FIG. 101A shows, in frontal or sagittal plane cross section, a flexible insert or component 513 forming a unitary internal sipe. FIG. 101B is a horizontal plane view of 513.

Figure 102A:
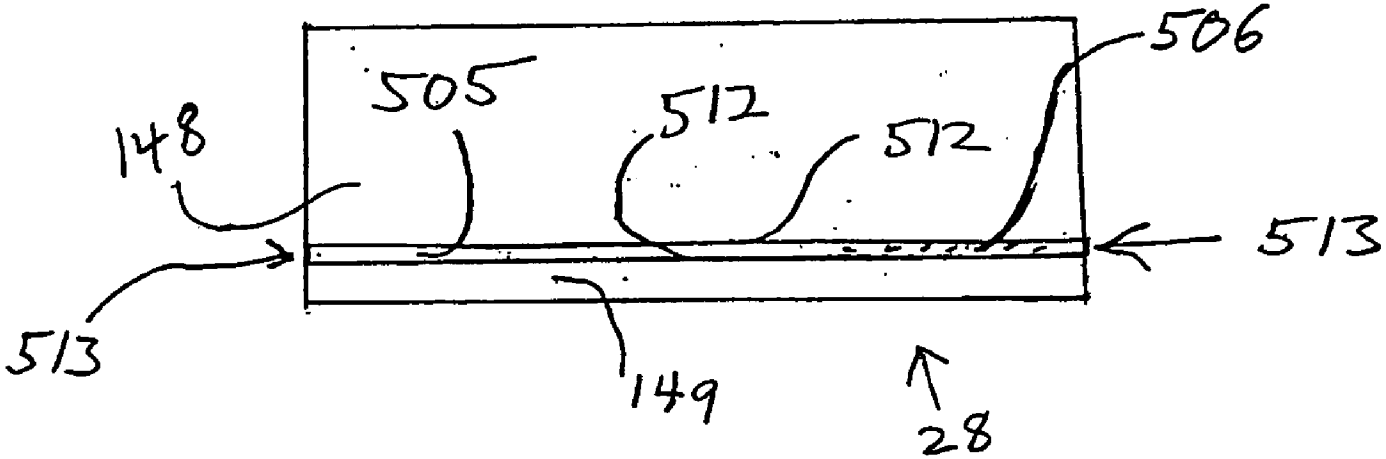

FIG. 102A shows, in frontal or sagittal plane cross section, the FIG. 101A embodiment of a unitary internal sips 513 position as a separate component in a footwear sole.

Figure 103A:
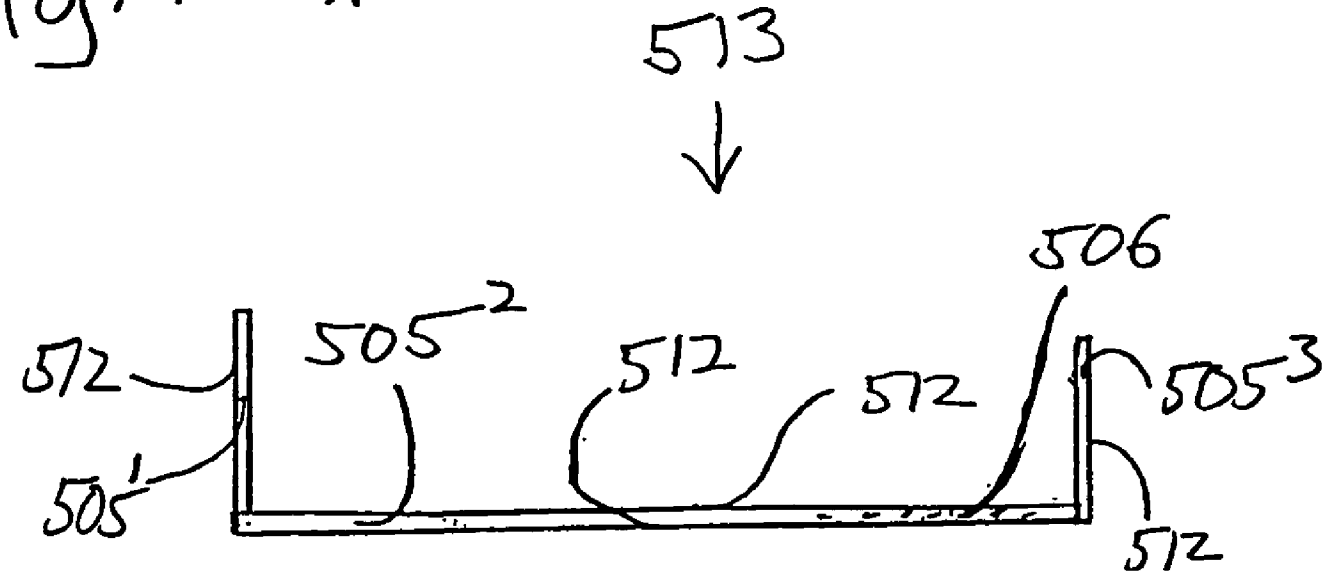

FIG. 103A shows, in frontal or sagittal plane cross section, the unitary internal sipe 513 in an embodiment including three separate internal flexibility sipes 505.

Figure 104:
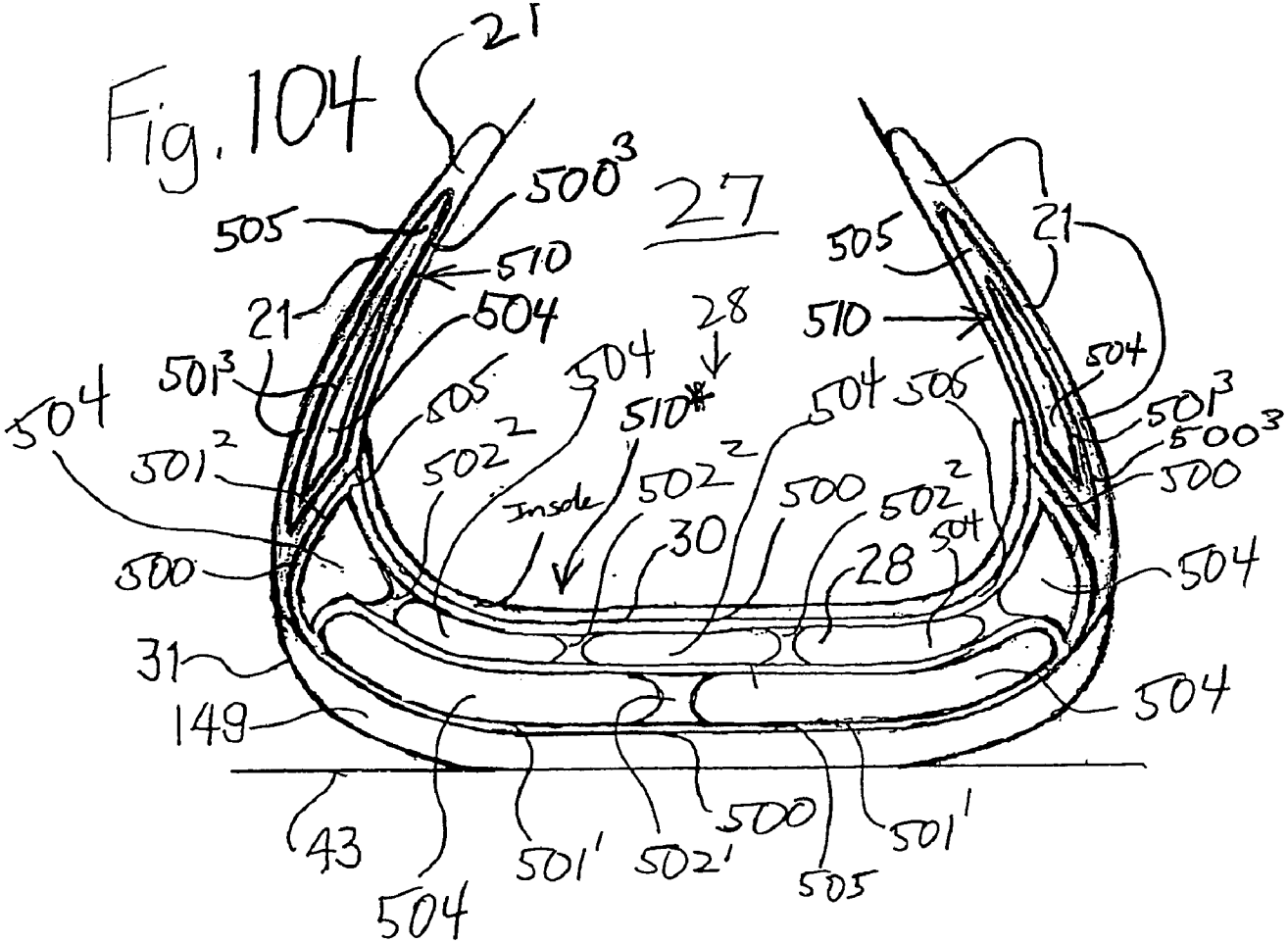

FIG. 104 shows, in frontal plane cross section in the heel area, a flexible insert or component 510 used in the footwear upper 21.

Figure 105:
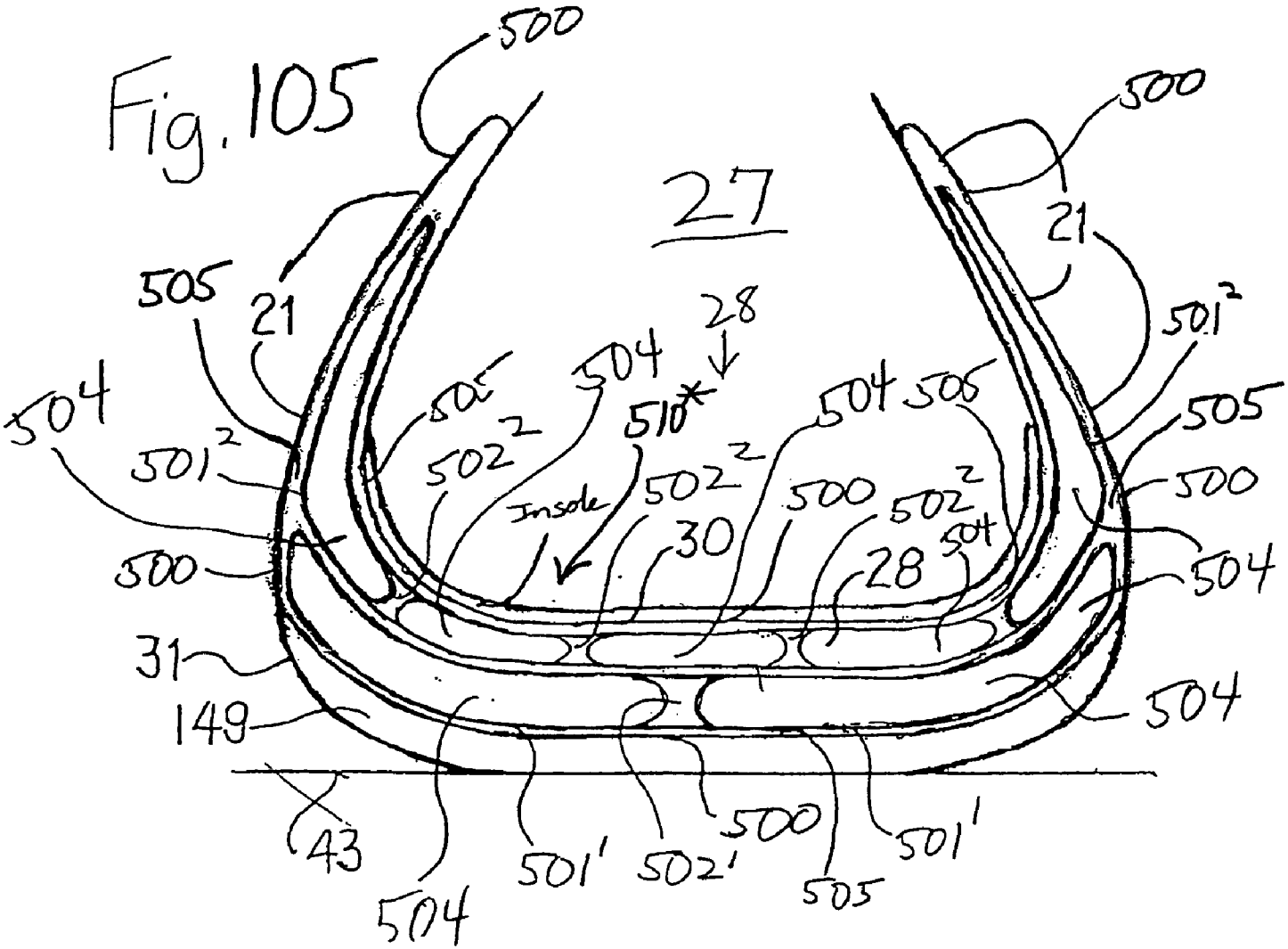

FIG. 105 shows, in frontal plane cross section in the heel area, a flexible insert or component 510 used both in the footwear upper 21 and in the sole 22 or 28.

Figure 106A:
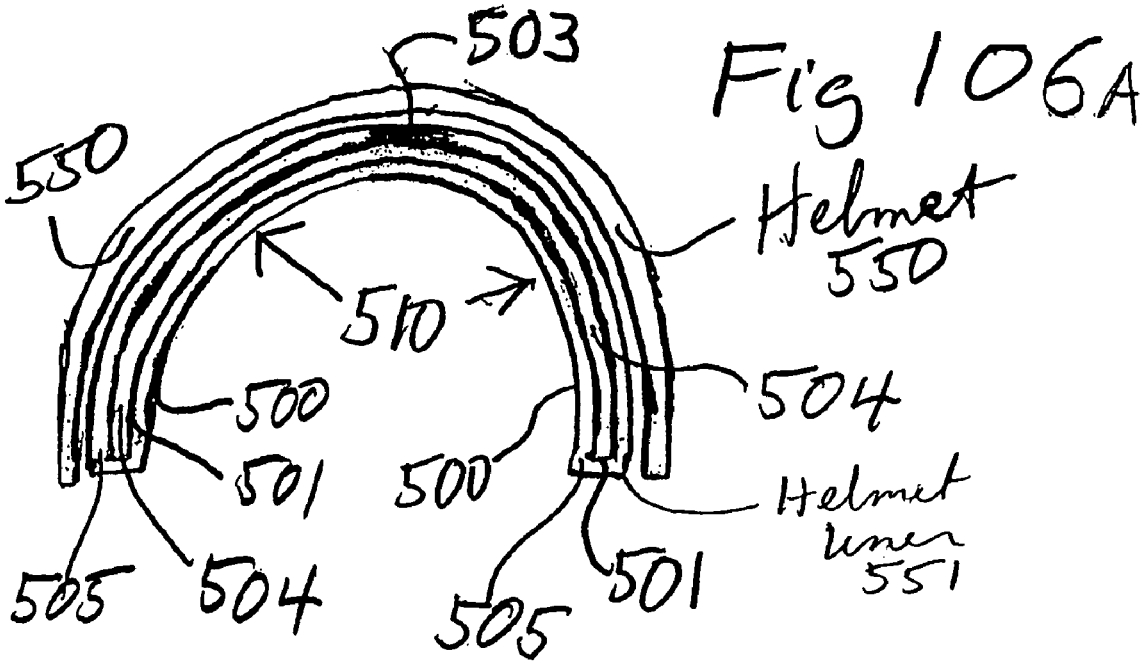
Figure 106B:
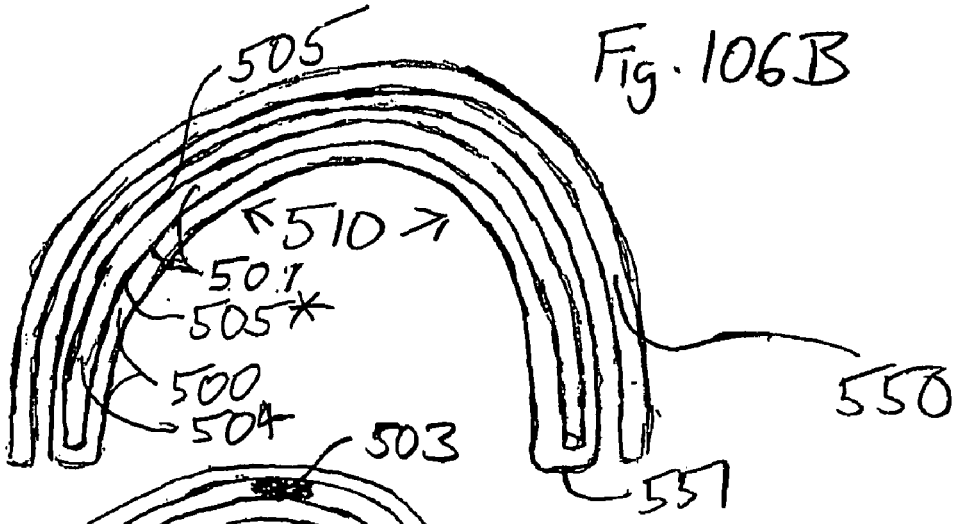

FIGS. 106A and 106B show, in frontal plane cross section, two example embodiments of any helmet 550 for any use with a cushioning helmet liner 551 including an inner flexible insert or component 510.

Figure 106C:
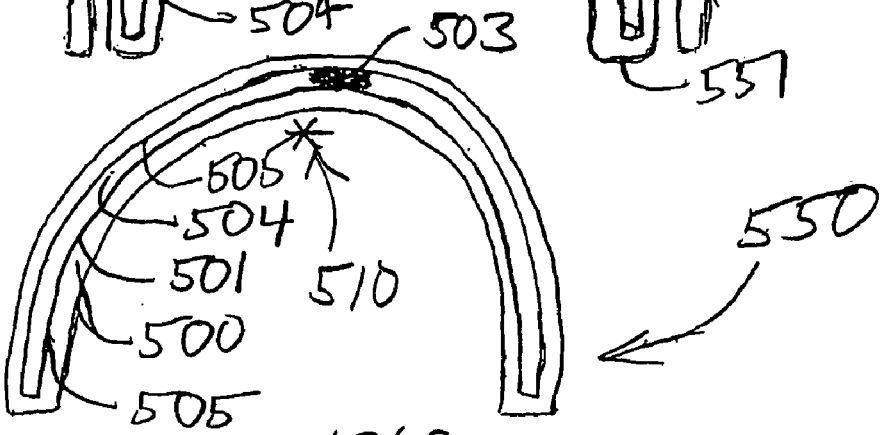
Figure 106D:
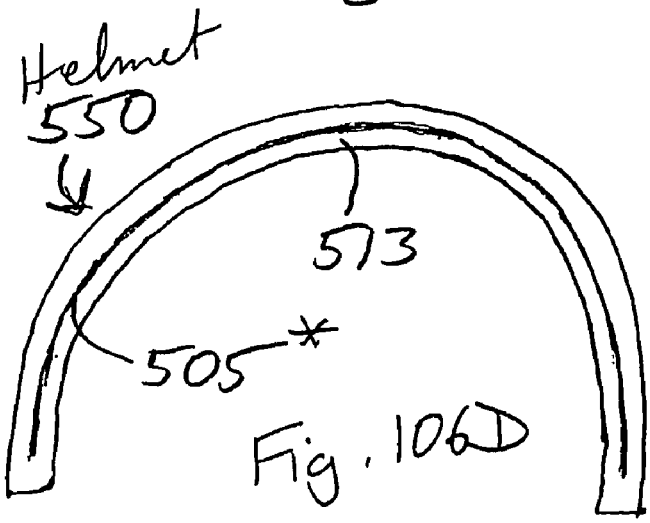

FIGS. 106C and 106D show, in frontal plane cross section, two example embodiments of any helmet 550 for any use including one or more internal sipes 505

Figure 107A:
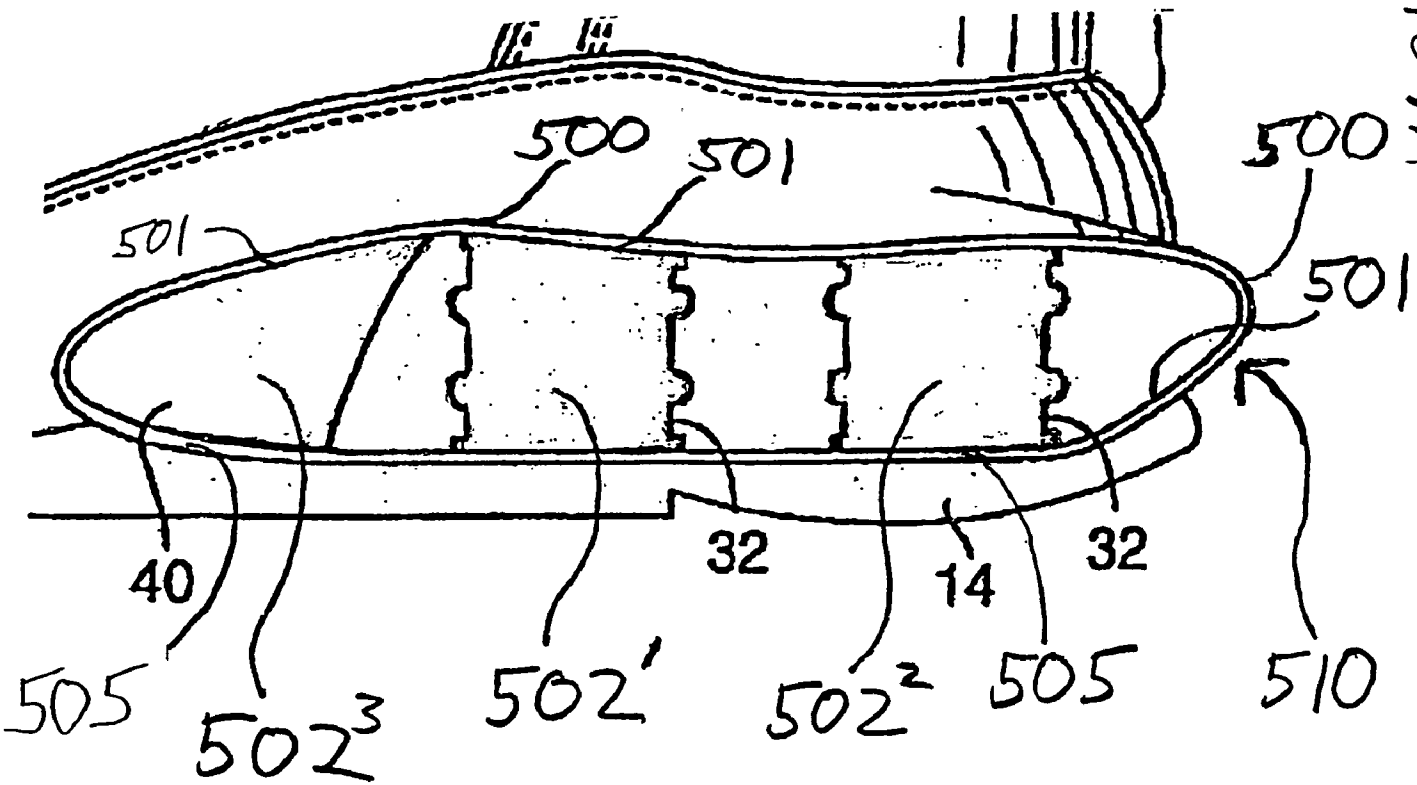
Figure 107B:
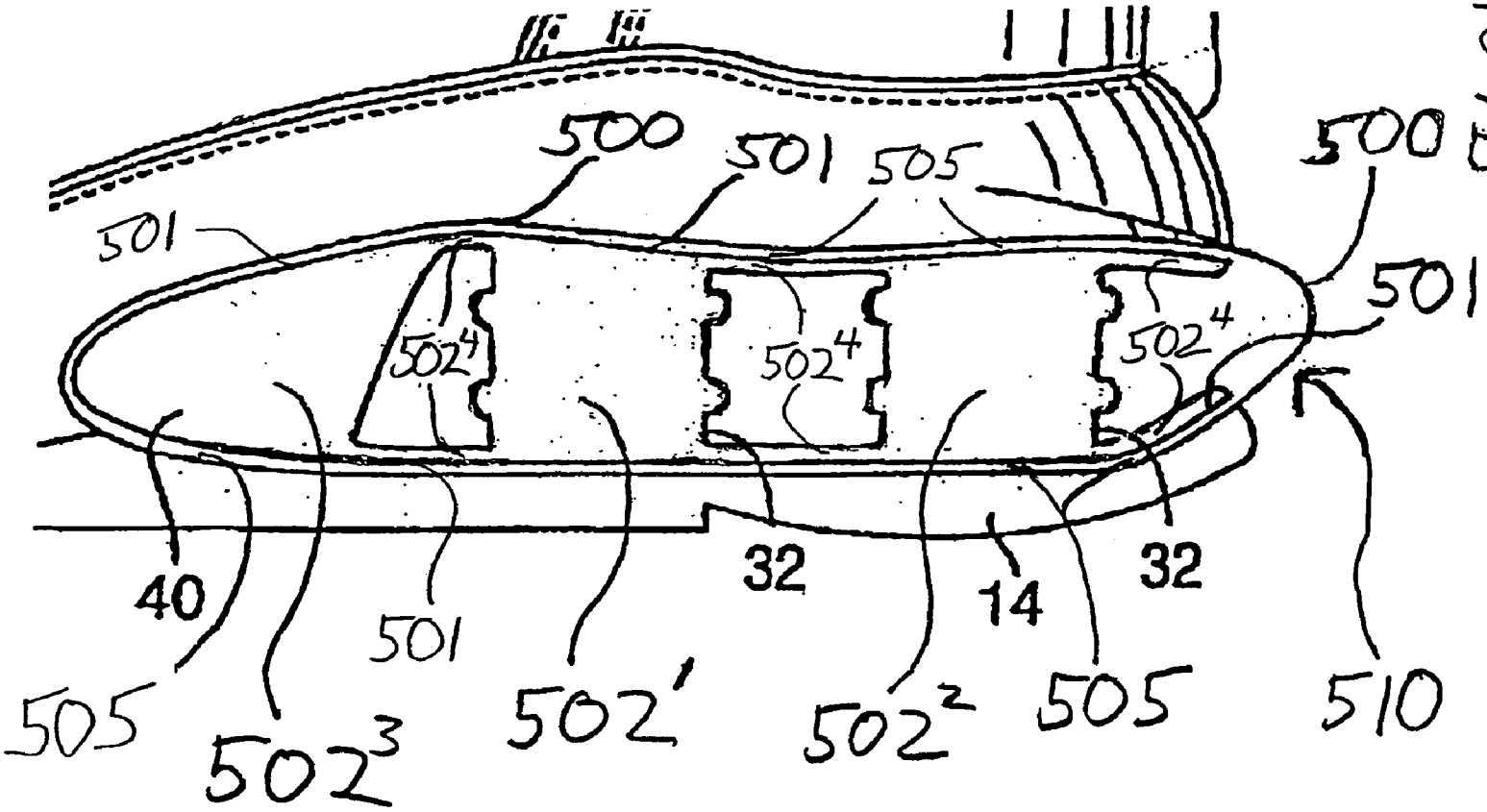
Figure 108A:
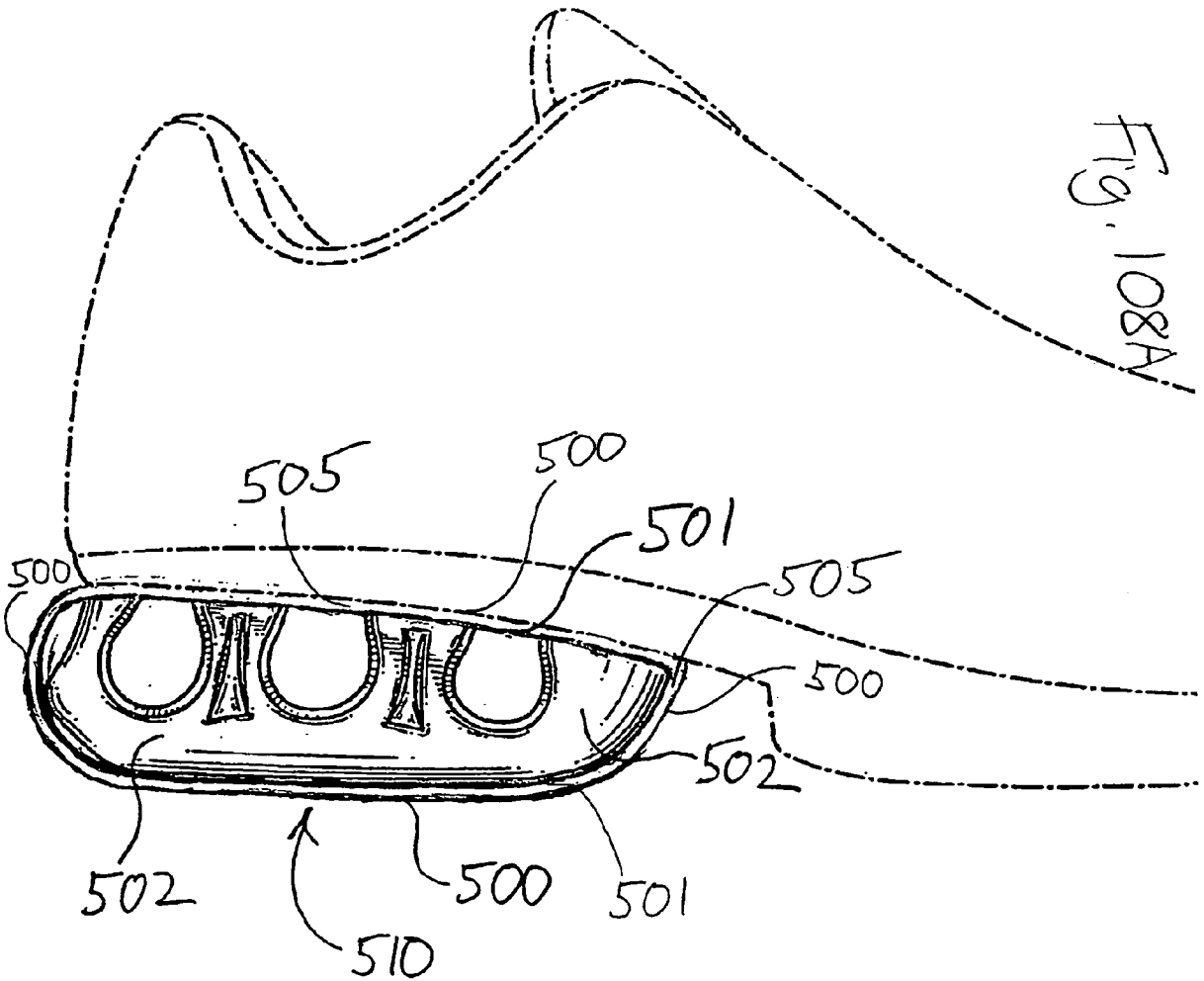
Figure 108B:
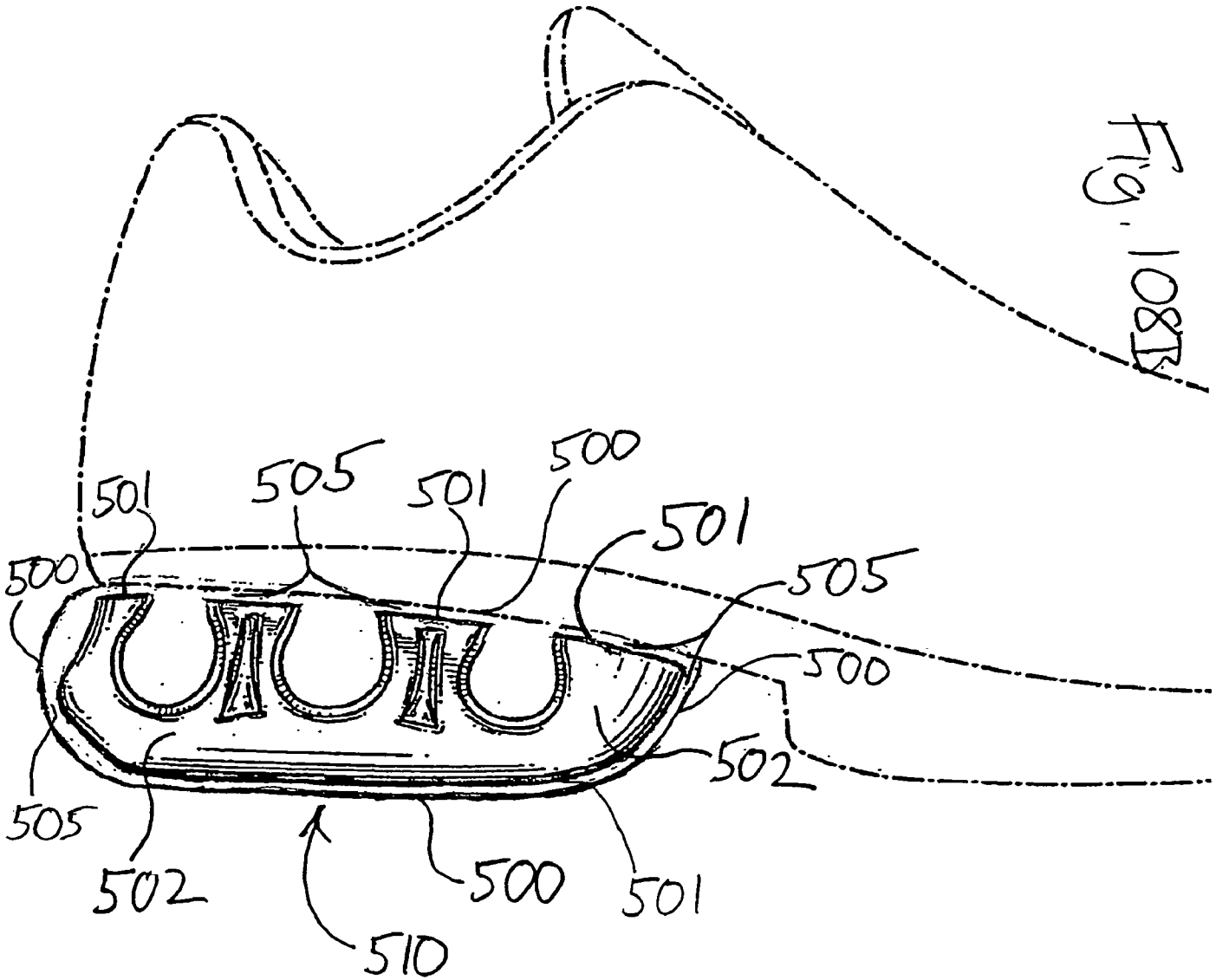

FIGS. 107A and 107B, as well as FIGS. 108A and 108B, show a heel section of a footwear sole or orthotic with an example of a flexible insert or component 510 using specific examples of the structural elements 502.

FIG. 108C shows an example in a horizontal plane cross-section of a footwear sole 22 of a device or flexible insert or component 510 in which the inner compartment 501 includes a flexible shank 514 located in the media 504 in the general area of the instep of the shoe sole between the heel area and the forefoot area. FIG. 108D shows two different examples of versions of the flexible shank 514 in frontal plane cross-sections.

Figure 109:
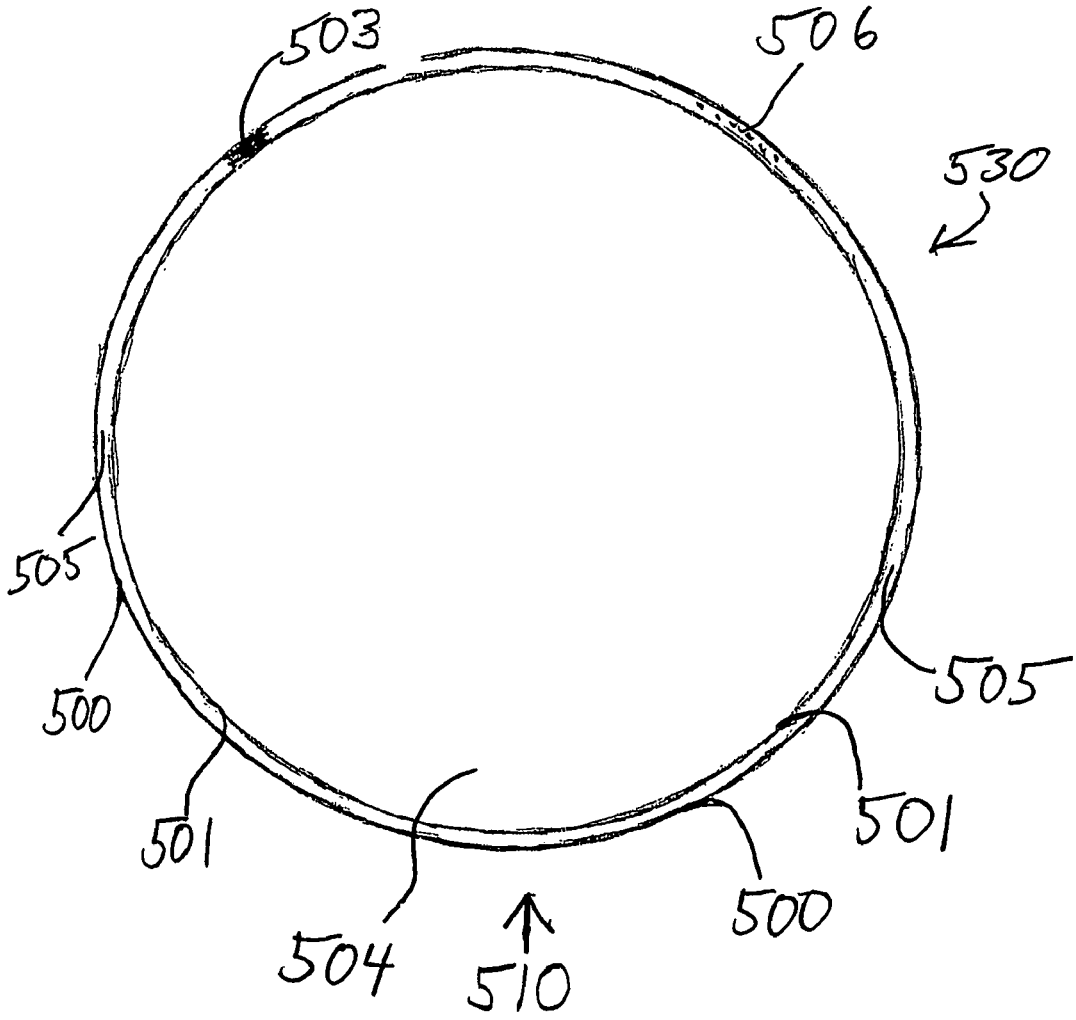

FIG. 109 shows an example of any ball 530 with one or more internal sipes 505 of any shape located between the outer surface of the ball and an inner surface.

Figure 110:
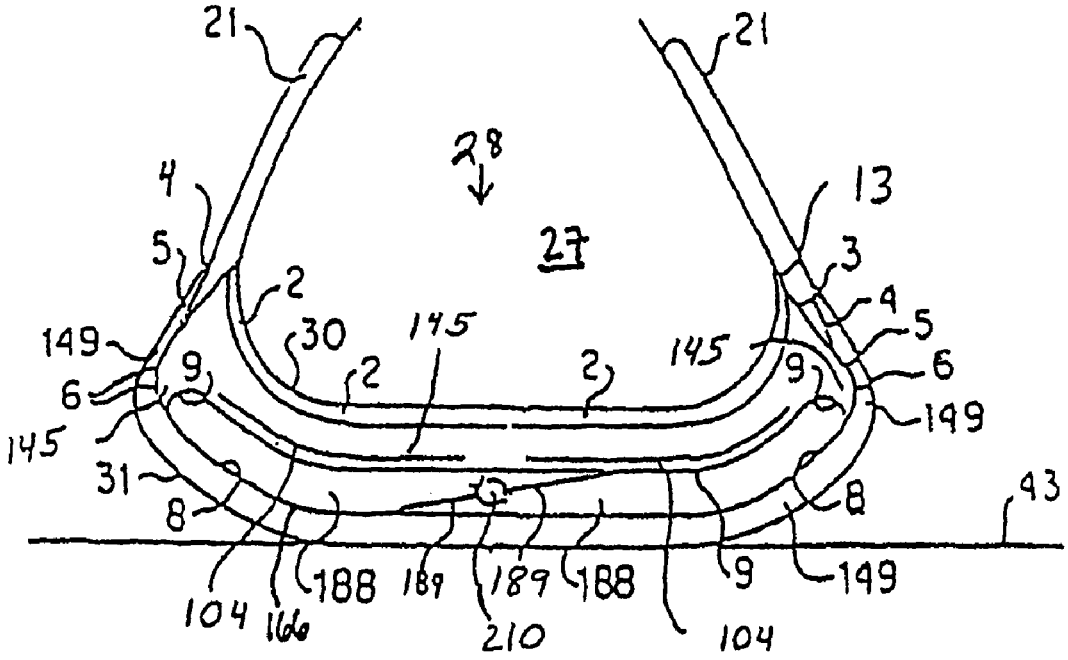
Figure 110A:
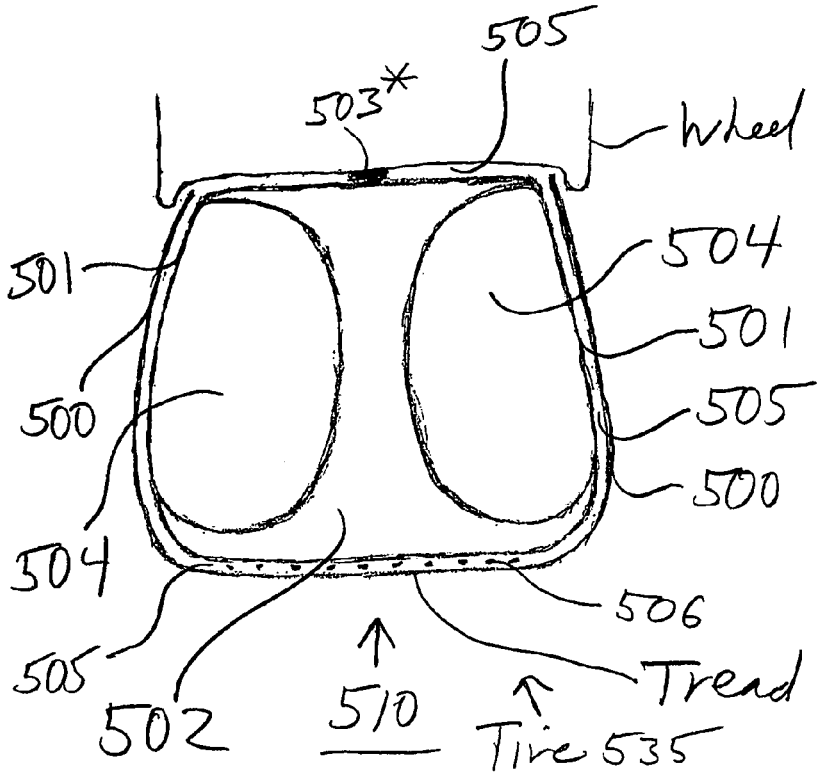
Figure 110B:
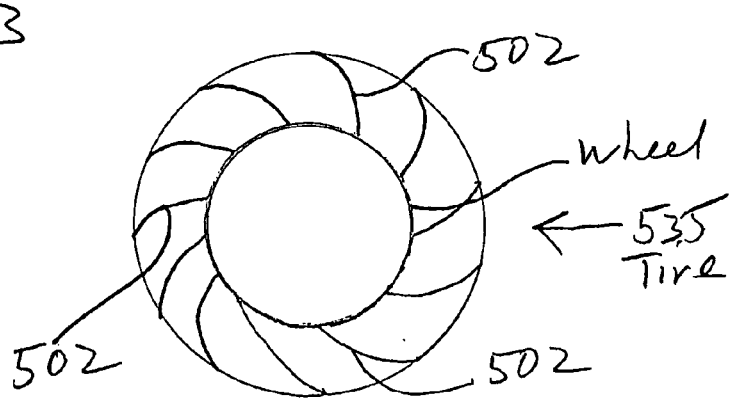

FIG. 110A shows in cross-section an example of a tire 535, such as for a wheel of a transportation vehicle, with a device 510. FIG. 110B shows in a side view cross-section an example of shape of structural elements 502 of the inner compartment 501.

Figure 111A:
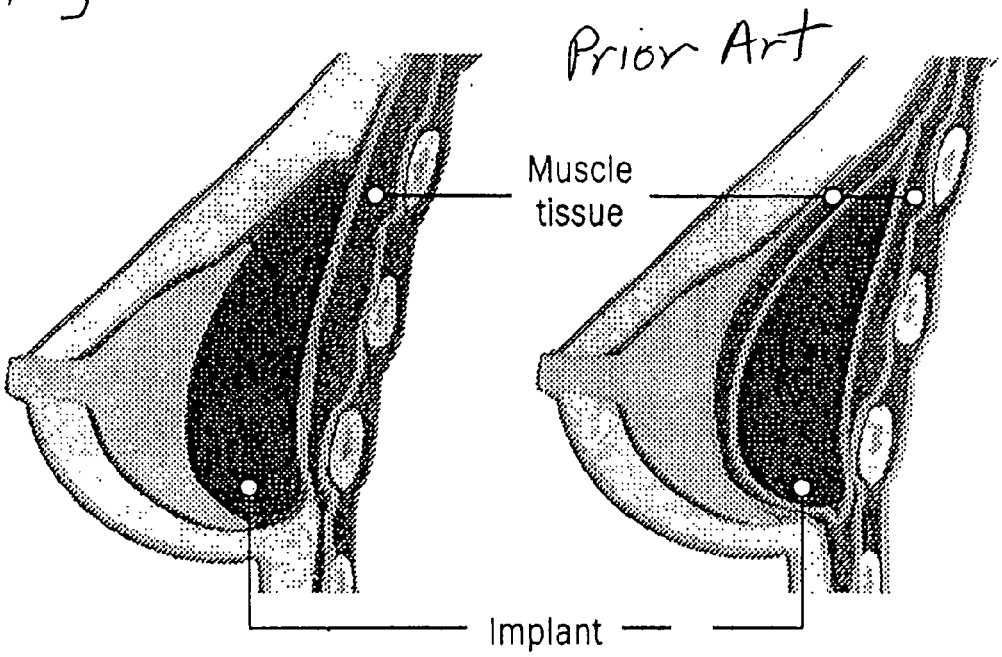
Fig. 111A Prior Art

FIG. 111A shows, in sagittal plane cross sections, two examples of prior art human breast implants, the first inserted over pectoral muscle and the second inserted under pectoral muscle. FIG. 11B shows an example of a human breast implant 540 with a siped compartment or chamber 510.

Figures 112A, 112B:
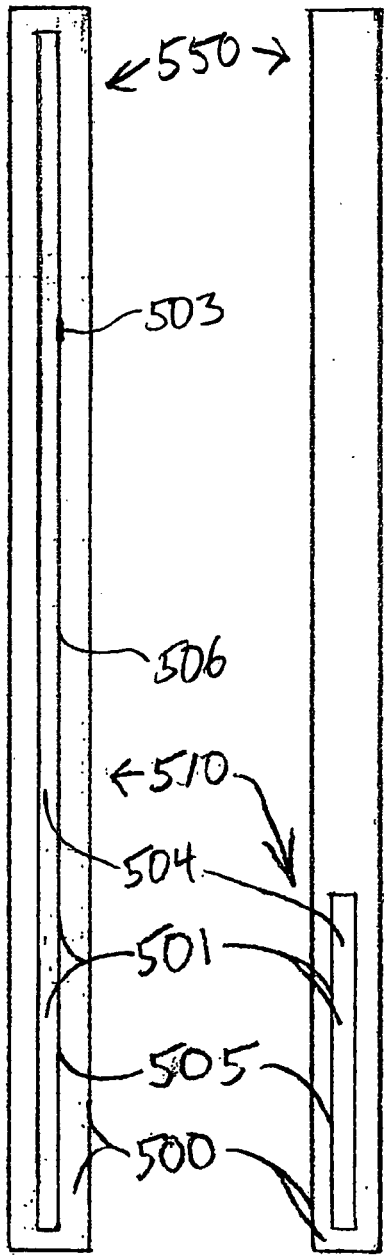
Figure 112C:
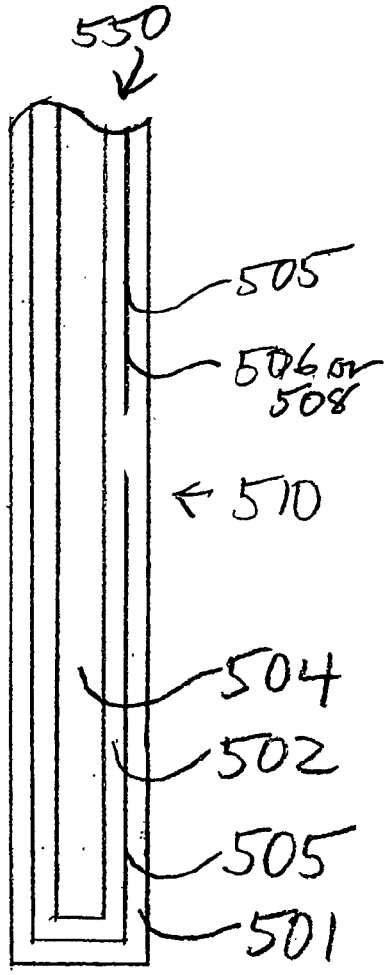

FIGS. 112A-112C show cross sectional examples of any structural or support element 550 in any device, including mechanical or architectural, including a beam or strut, or a tool or racquet handle or grip, shaft or body, or head, that incorporates a siped chamber 510.

FIG. 113A shows examples of prior art golf clubs. FIG. 113B shows an example of a golf (or other) club head or racket (or tool head or body or handle/grip) 550 with one or more internal sipes 505.

Figure 114A:
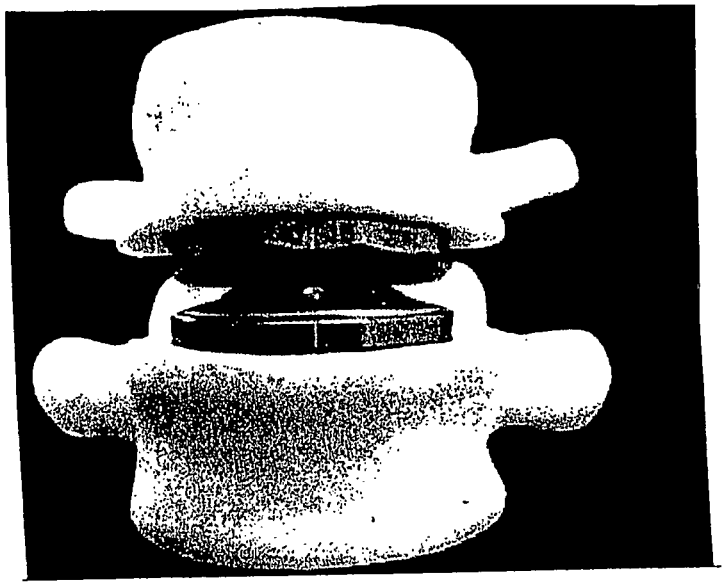
Fig. 114A Prior Art
Figure 114B:
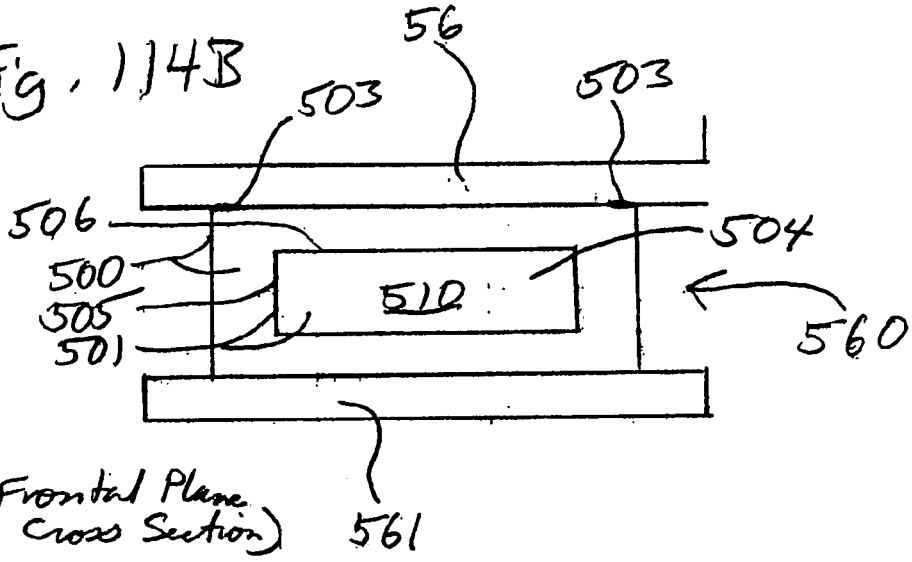

FIG. 114A shows in perspective view an example of a prior art artificial spinal or intervertebral disk. FIG. 114B shows in frontal plane cross section an example of an artificial spinal or intervertebral disk 560, including any artificial joint disk or any other surgical or prosthetic device with one or more internal sipes 505 of any form, including a siped compartment 510.

Figure 116:
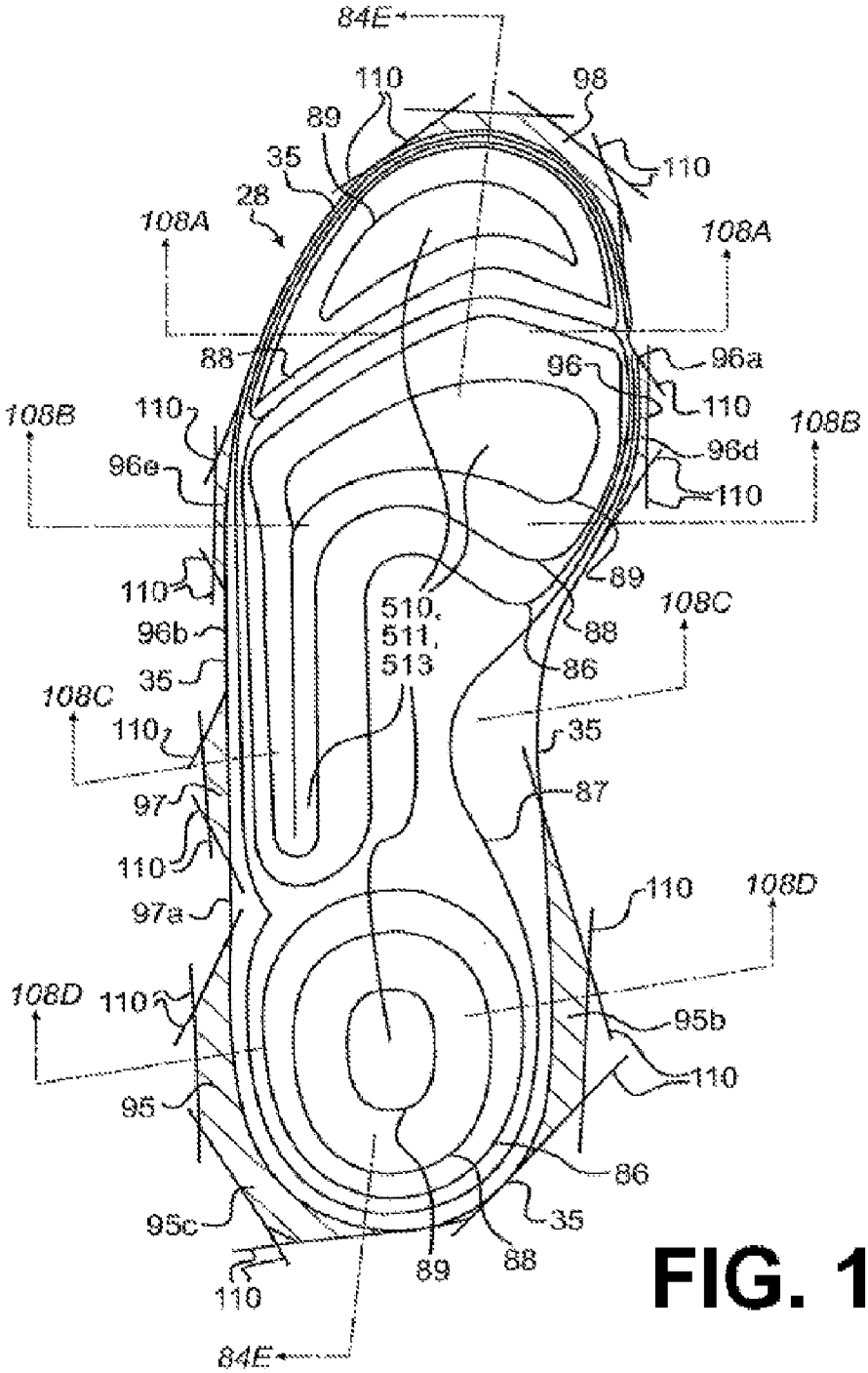

FIGS. 115 and 117 show frontal plane cross section examples of shoe soles 22 or 28 or midsole insert or orthotics 145 with several planar sides to approximate curvature from the applicant's WIPO publication No. WO 02,09547, which can be combined with the flexible insert or components 510, 511, or 513;

FIG. 116 shows a similar top view example.

Figure 118:
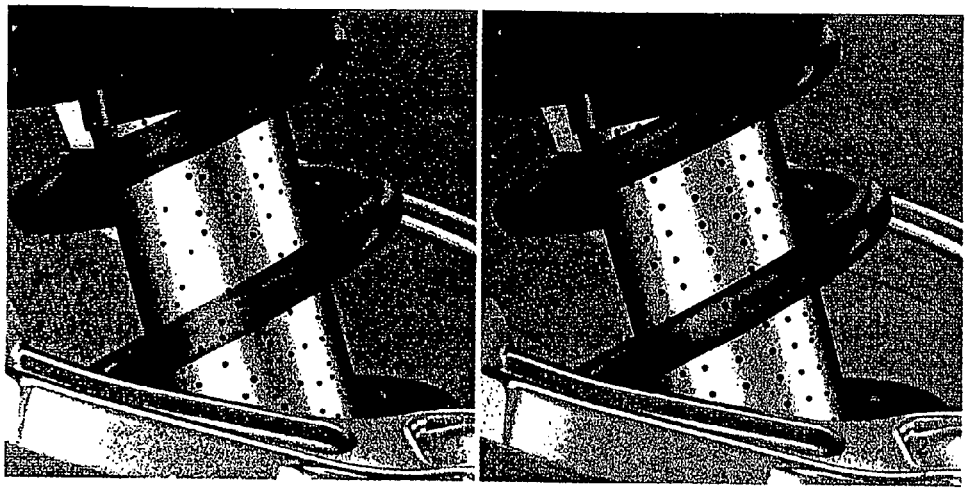

FIG. 118 shows prior art from the automotive industry relating to magnetoelectric cushioning systems shown in FIGS. 98 and 99.

FIGS. 119-126 show perspective views of prior art examples gas bladders of Nike Air™ (119-123), which are FIGS. 12-16 of U.S. Pat. No. 6,846,534 and Zoom Air™ (124-126), which are FIGS. 1-3 of published U.S. Patent Application 2005/0039346 A1.

Figure 127:
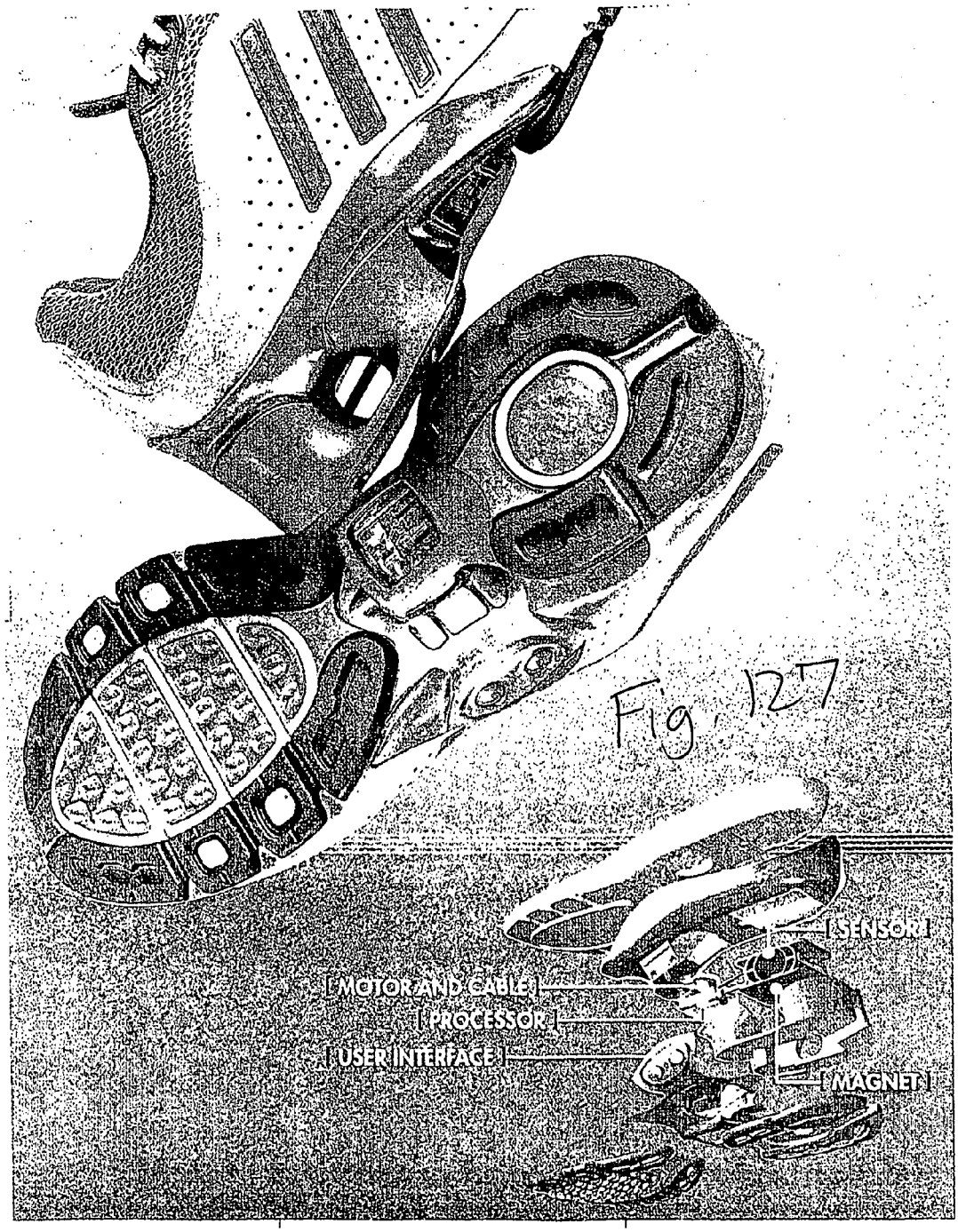

FIG. 127 shows perspective views of prior art Adidas 1™ shoe sole electronic/electromechanical cushioning system.

DETAILED DESCRIPTION OF THE PREFERRED EMBODIMENTS

All reference numerals used in the figures contained herein are defined as follows:

| Ref. No. | Element Description |
|---|---|
| 2 | insole |
| 3 | attachment point of upper midsole and shoe upper |
| 4 | attachment point of bottom sole and shoe upper |
| 5 | attachment point of bottom sole and upper midsole |
| 6 | attachment point of bottom sole and lower midsole |
| 8 | lower surface interface of removable midsole section |
| 9 | interface line between encapsulated section and midsole sections |
| 11 | lateral stability sipe |
| 12 | medial stability sipe |
| 13 | interface between insole and shoe upper |
| 14 | medial origin of the lateral stability sipe |
| 16 | hatched area of decreased area of footprint due to pronation |
| 17 | footprint outline when tilted |
| 18 | inner footprint outline of low arched foot |
| 19 | hatched area of increased area of footprint due to pronation |
| 20 | athletic shoe |
| 21 | shoe upper |
| 21a | inner or secondary shoe upper |
| 22 | conventional shoe sole |
| 23 | bottom outside edge of the shoe sole |
| 23a | lever arm |
| 26 | stabilizing quadrants |
| 27 | human foot |
| 28 | rounded shoe sole |
| 28a | rounded stability sides |
| 28b | load bearing shoe sole |
| 29 | outer surface of the foot |
| 30 | inner surface of the shoe sole |
| 30a | side or inner edge of the shoe sole stability side |
| 30b | inner shoe sole surface portion which contacts the wearer's foot |
| 31 | outer surface of the shoe sole |
| 31a | outer edge of rounded stability sides |
| 31b | outer surface portion of shoe sole parallel to 30b |
| 32 | outside and top edge of the stability side |
| 33 | inner edge of the naturally rounded stability side |
| 34 | perpendicular sides of the load-bearing shoe sole |
| 35 | peripheral extent of the upper surface of sole |
| 36 | shoe sole outline |
| 37 | foot outline |
| 37a | maximum supination position |
| 37b | maximum pronation position |
| 38 | heel lift or wedge |
| 39 | combined midsole and bottom sole |
| 40 | forefoot lift or wedge |
| 43 | ground |
| 45 | density edge |
| 51 | theoretically ideal stability plane |
| 51' | half of the theoretically ideal stability plane |
| 53a | upper side surface |
| 60 | tread portion |
| 61 | cleated portion |
| 62 | alternative tread construction |
| 63 | surface which the cleat bases are affixed |
| 70 | curve of range of side to side motion |
| 71 | center of gravity |
| 74 | shoe sole stability equilibrium point |
| 80 | conventional wide heel flare curve |
| 82 | narrow rectangle the width of heel curve |
| 85 | areas of shoe sole that are in contact with the ground under load |
| 86-89 | rounded line |
| 92 | head of first metatarsal |
| 93 | head of fifth distal phalange |
| 94 | head of fifth metatarsal |
| 95 | base and lateral tuberosity of the calcaneus |

-continued

| Ref. No. | Element Description |
|---|---|
| 95c | base of the calcaneus |
| 95d | lateral tuberosity of the calcaneus |
| 96a | stability correction supporting fifth metatarsal and distal phalange heads |
| 96b | stability correction supporting first metatarsal and distal phalange heads |
| 96c | head of the fifth metatarsal |
| 96d | head of the first metatarsal |
| 97 | base of the fifth metatarsal |
| 97' | fifth metatarsal support area |
| 98 | head of the first distal phalange |
| 98a | stability correction supporting first distal phalange |
| 98a' | stability correction supporting fifth distal phalange |
| 100 | straight line replacing indentation at the base of the fifth metatarsal |
| 104 | pressure sensing device |
| 108 | lateral tuberosity of the calcaneus |
| 109 | base of the calcaneus |
| 111-113 | flexibility axis |
| 115 | center of rotation of radius r + r' |
| 119 | center of shoe sole support section |
| 120 | pressure sensing circuitry |
| 121 | main longitudinal arch (long arch) |
| 122 | flexibility axis |
| 123 | flexible connecting top layer of sipes |
| 124 | flexibility axis |
| 125 | base of the calcaneus (heel) |
| 125' | heel support area |
| 126 | metatarsal heads (forefoot) |
| 126' | forefoot support area |
| 129 | honeycombed portion |
| 141 | snap-fit |
| 142 | mechanical fasteners/Velcro ™ |
| 143 | interlocking geometries |
| 145 | removable midsole insert |
| 146 | location of slight crimp |
| 147 | upper midsole (upper areas of shoe midsole) |
| 148 | midsole |
| 149 | bottom or outer sole |
| 149a | secondary bottom or outer sole |
| 150 | compression force |
| 151 | channel sipes |
| 155a | tension force along the top surface of the shoe sole |
| 155b | mirror image of tension force 155a |
| 158 | subcalcaneal fat pad |
| 159 | calcaneus |
| 160 | bottom sole of the foot |
| 161 | cushioning compartment |
| 162 | natural crease or upward taper |
| 163 | crease or taper in the human foot |
| 164 | chambers of matrix of elastic fibrous connective tissue |
| 165 | lower surface of the upper midsole |
| 166 | upper surface of the bottom sole |
| 167 | outer surface of the support structures of the foot |
| 168 | upper surface of the foot's bottom sole |
| 169 | shank |
| 170 | flexible filler material |
| 180 | mini-chambers |
| 181 | internal deformation slits (sipes) in the sagittal plane |
| 182 | internal deformation slits (sipes) in the horizontal plane |
| 184 | encapsulating midsole section |
| 185 | midsole sides |
| 187 | upper midsole section |
| 188 | bladder or encapsulated central section |
| 189 | central wall |
| 191 | fibrous capsule shell |
| 192 | subdivided cushioning compartments |
| 195 | heel element |
| 200 | pressures sensing system |
| 201 | horizontal line through the lowermost point of upper surface of the shoe sole |
| 205 | variable capacitor |
| 206 | fluid duct |
| 210 | fluid valve |
| 220 | pressure sensing circuitry |

-continued

| Ref. No. | Element Description |
|---|---|
| 223 | frequency-to-voltage converter (FVC) |
| 224 | oscillator |
| 225 | analog-to-digital (AID) converter |
| 227 | multiplexer |
| 228 | data lines |
| 229 | control lines |
| 270 | shoe sole last |
| 290 | lower surface of shoe sole last |
| 300 | encapsulated midsole section control system |
| 301 | programmable microcomputer |
| 302 | control lines |
| 303 | cushion adjustment control |
| 304 | illuminator |
| 310 | digital-to-analog (D/A) converter |

Figure 1:
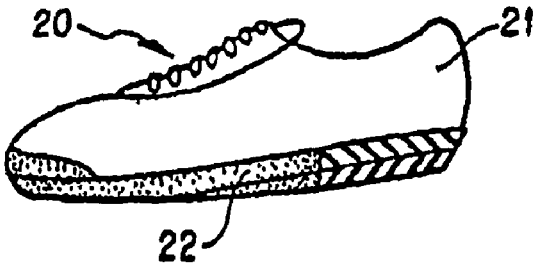
FIG. 1 (PRIOR ART)
FIGS. 1-82 are from the applicant's earlier applications and are FIGS. 1-82 in the applicant's PCT Application No. PCT/US01/13096, published by WIPO as WO 01/80678 A2 on 1 Nov. 2001.

FIG. 1 shows a perspective view of a shoe, such as a typical athletic shoe 20 according to the prior art, wherein the athletic shoe 20 includes a shoe upper 21 and a conventional shoe sole 22.

Figure 2:
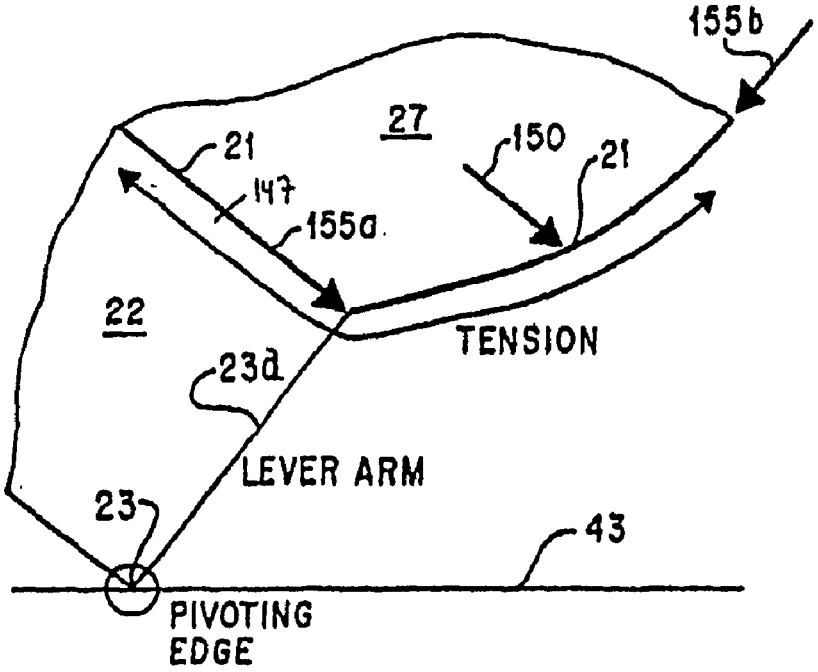
FIG. 2 illustrates in a close-up frontal plane cross-section of the heel at the ankle joint the typical shoe known in the art that does not deform as a result of body weight when tilted sideways on the bottom edge.
Figure 3:
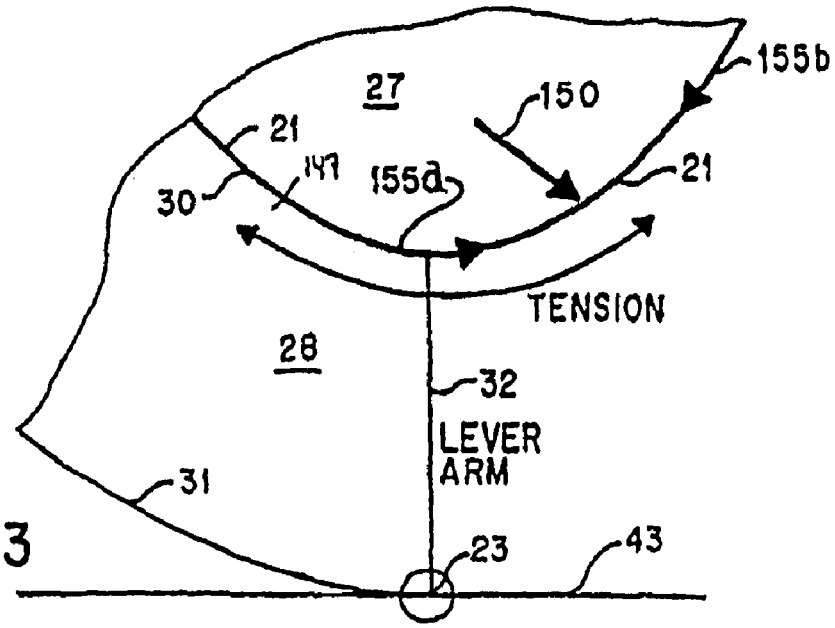
FIG. 3 shows, in the same close-up cross-section as FIG. 2, a naturally rounded shoe sole design also tilted sideways.

FIG. 2 illustrates, in a close-up, a cross-section of a typical shoe of existing art (undeformed by body weight) on the ground 43 when tilted on the bottom outside edge of the shoe sole 23, an inherent stability problem remains in existing shoe designs, even when the abnormal torque producing rigid heel counter and other motion devices are removed. The problem is that the remaining shoe upper 21 (shown in the thickened and darkened line), while providing no lever arm extension, since it is flexible instead of rigid, nonetheless creates unnatural destabilizing torque on the conventional shoe sole 22. The torque is due to the tension force along the top surface of the shoe sole 155*a* caused by a compression force 150 (a composite of the force of gravity on the body and a sideways motion force) to the side by the human foot 27, due simply to the shoe 20 being tilted to the side, for example. The resulting destabilizing force acts to pull the shoe sole 22 in rotation around a lever arm 23*a* that is the width of the shoe sole 22 at the edge 23. Roughly speaking, the force of the foot on the shoe upper 21 pulls the shoe 20 over on its side when the shoe 20 is tilted sideways. The compression force 150 also creates a tension force 155*b*, which is the mirror image of tension force 155*a*. FIG. 3 shows, in a close-up cross-section, a naturally rounded shoe sole 28 (also shown undeformed by body weight) when tilted on the bottom outside edge 23 having the same inherent stability problem remaining in the naturally rounded shoe sole 28 design, though to a reduced degree. The problem is less since the direction of the force vector 150 along the lower surface of the shoe upper 21 is parallel to the ground 43 at the outside edge 32 edge, instead of angled toward the ground 43 as in a conventional design like that shown in FIG. 2, so the resulting torque produced by a lever arm 23*a* created by the bottom outside edge 23 would be less, and the rounded shoe sole 28 provides direct structural support when tilted, unlike conventional designs.

Figure 4:
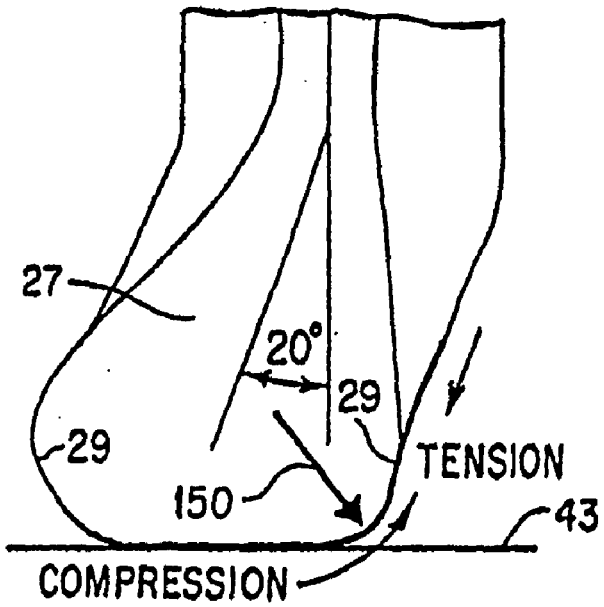
FIG. 4 shows a rear view of a barefoot heel tilted laterally 20 degrees.

FIG. 4 shows (in a rear view) that, in contrast, the bare human foot 27 is naturally stable because, when deformed by body weight and tilted to its natural lateral limit of about 20°, it does not create any destabilizing torque due to tension force. Even though tension paralleling that on the shoe upper 21 is created on the outer surface of the foot 29, of both the bottom and sides of the bare foot 27 by the compression force of weight-bearing, no destabilizing torque is created because the lower surface under tension (i.e., the foot's bottom sole, shown in the darkened line) is resting directly in contact with the ground 43. Consequently, there is no artificially created unnatural lever arm 23*a* against which to pull. The weight of the body firmly anchors the outer surface 29 of the sole underneath the foot 27 so that even considerable pressure against the outer surface 29 of the side of the foot 27 results in no destabilizing motion. When the foot 27 is tilted, the supporting structures of the foot 27, like the calcaneus 159, slide against the side of the strong but flexible outer surface of the foot 29 and create very substantial pressure on that outer surface 29 at the sides of the foot 27. But that pressure is precisely resisted and balanced by tension along the outer surface 29 of the foot 27, resulting in a stable equilibrium.

Figure 5A:
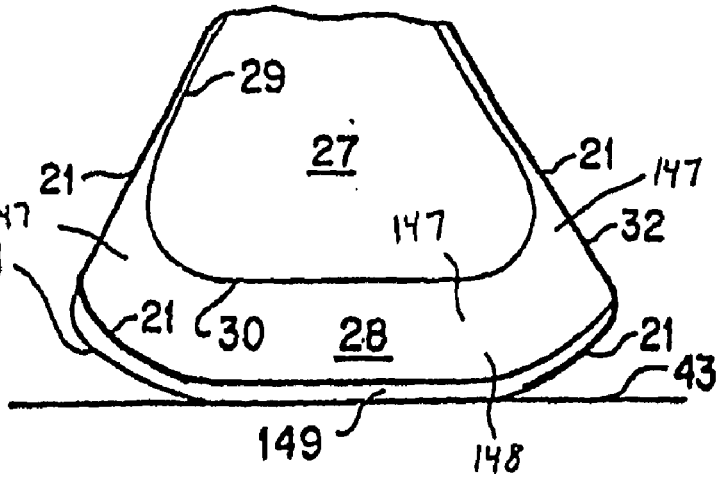
FIG. 5A shows, in a frontal plane cross-section at the ankle joint area of the heel, tension stabilized sides applied to a naturally rounded shoe sole.
Figure 5B:
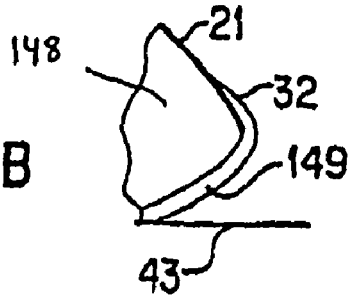
FIG. 5B shows a close-up of a second embodiment of tension stabilized sides.

FIG. 5 shows, in cross-section of the upright heel deformed by body weight, the principle of the tension-stabilized sides of the bare foot 27 applied to the naturally rounded shoe sole design. The same principle can be applied to conventional shoes, but is not shown. The key change from the existing art of shoes is that the sides of the shoe upper 21 (shown as darkened lines) must wrap around the outside edges 32 of the rounded shoe sole 28, instead of attaching underneath the foot 27 to the inner surface of the shoe sole 30, as is done conventionally. The shoe upper sides can overlap and be attached to either the inner surface of the shoe sole 30 (shown on the left) or outer surface of the shoe sole 31 (shown on the right) of the bottom sole 149, since those sides are not particularly load-bearing, as shown. Alternatively, the bottom sole 149, optimally thin and tapering as shown, can extend upward around the outside edges 32 of the rounded shoe sole 28 to overlap and attach to the shoe upper sides (shown FIG. 5B). Their optimal position coincides with the theoretically ideal stability plane, so that the tension force on the shoe sides is transmitted directly all the way down to the outer surface 31 of the shoe sole 28, which anchors it on the ground 43 with virtually no intervening artificial lever arm 23*a*. For shoes with only one sole layer, the attachment of the shoe upper sides should be at or near the outer surface 31 of the rounded shoe sole 28.

The design shown in FIG. 5 is based on a fundamentally different conception that the shoe upper 21 is integrated into the shoe sole 28, instead of attached on top of it, and the shoe sole 28 is treated as a natural extension of the foot sole, not attached to it separately.

The fabric (or other flexible material, like leather) of the shoe upper 21 would preferably be non-stretch or relatively so, so as not to be deformed excessively by the tension placed upon its sides when compressed as the foot and shoe tilt. The fabric can be reinforced in areas of particularly high tension, like the essential structural support and propulsion elements as shown and described in FIG. 11L (i.e., the base and lateral tuberosity of the calcaneus, the base of the fifth metatarsal, the heads of the metatarsals, and the first distal phalange). The reinforcement can take many forms, such as that of corners of the jib sail of a racing sailboat or more simply straps. As closely as possible, the reinforcement should have the same performance characteristics as the heavily callused skin of the sole of an habitually bare foot 27. Preferably, the relative density of the rounded shoe sole 28 is as described in FIG. 46 of the present application with the softest sole density nearest the foot sole, a progression through less soft sole density through the sole 28; to the firmest and least flexible at the outermost shoe sole layer. This arrangement allows the conforming sides of the shoe sole 28 to avoid providing a rigid destabilizing lever arm 23*a*.

The change from existing art to provide the tension-stabilized sides shown in FIG. 5 is that the shoe upper 21 is directly integrated functionally with the shoe sole 28, instead of simply being attached on top of it. The advantage of the tension-stabilized sides design is that it provides natural stability as close to that of the bare foot 27 as possible, and does so economically, with the minimum shoe sole side width possible.

Figure 6:
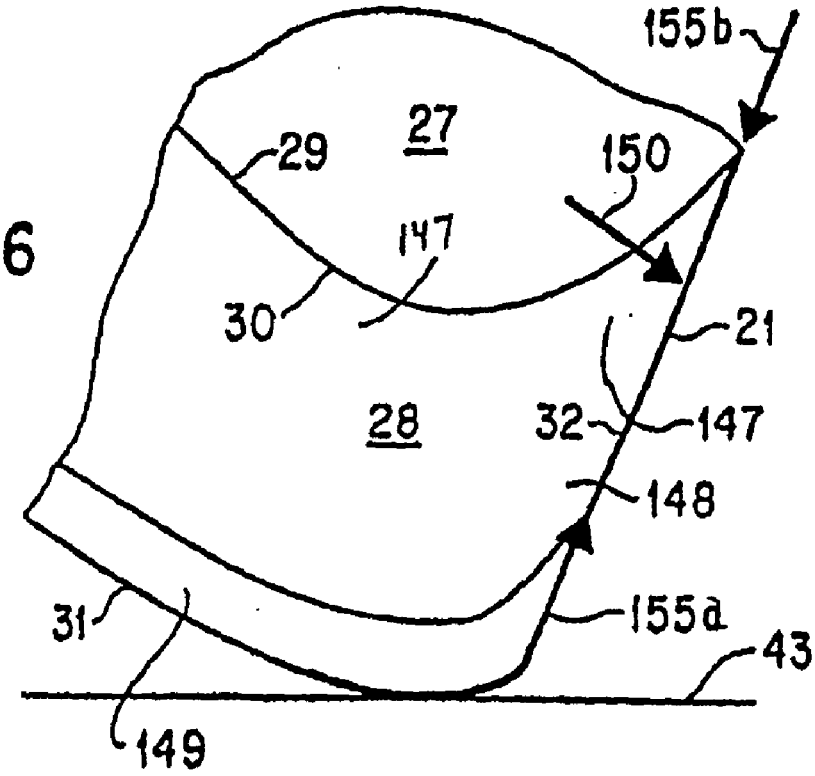
FIG. 6 shows, in a frontal plane cross-section, the FIG. 5 design when tilted to its edge but undeformed by load.

The result is a shoe sole 28 that is naturally stabilized in the same way the bare foot 27 is stabilized, as seen in FIG. 6, which shows a close-up cross-section of a naturally rounded shoe sole 28 (undeformed by body weight) when tilted to the edge. The same destabilizing force against the side of the shoe shown in FIG. 2 is now stably resisted by offsetting tension in the surface of the shoe upper 21 extended down the side of the shoe sole 28 so that it is anchored by the weight of the body when the shoe and foot 27 are tilted.

In order to avoid creating unnatural torque on the shoe sole 28, the shoe uppers 21 may be joined or bonded only to the bottom sole 149, not the midsole 148, so that pressure shown on the side of the shoe upper 21 produces side tension only and not the destabilizing torque from pulling similar to that described in FIG. 2. However, to avoid unnatural torque, the upper areas of the shoe midsole 147, which form a sharp corner, should be composed of relatively soft midsole material. In this case, bonding the shoe uppers 21 to the midsole 148 would not create very much destabilizing torque. The bottom sole 149 is preferably thin, at least on the stability sides, so that its attachment overlap with the shoe upper sides coincides, as closely as possible, to the theoretically ideal stability plane so that force is transmitted by the outer shoe sole surface 31 to the ground 43.

In summary, the FIG. 5 design is for a shoe construction including a shoe upper 21 that is composed of material that is flexible and relatively inelastic at least where the shoe upper 21 contacts the areas of the structural bone elements of the human foot 27, a shoe sole 28 that has relatively flexible sides and at least a portion of the sides of the shoe upper 21 are attached directly to the bottom sole 149, while enveloping the outside the other sole portions of the shoe sole 28. This construction can either be applied to conventional shoe sole structures or to the applicant's prior shoe sole inventions, such as the naturally rounded shoe sole 28 conforming to the theoretically ideal stability plane.

Figure 7:
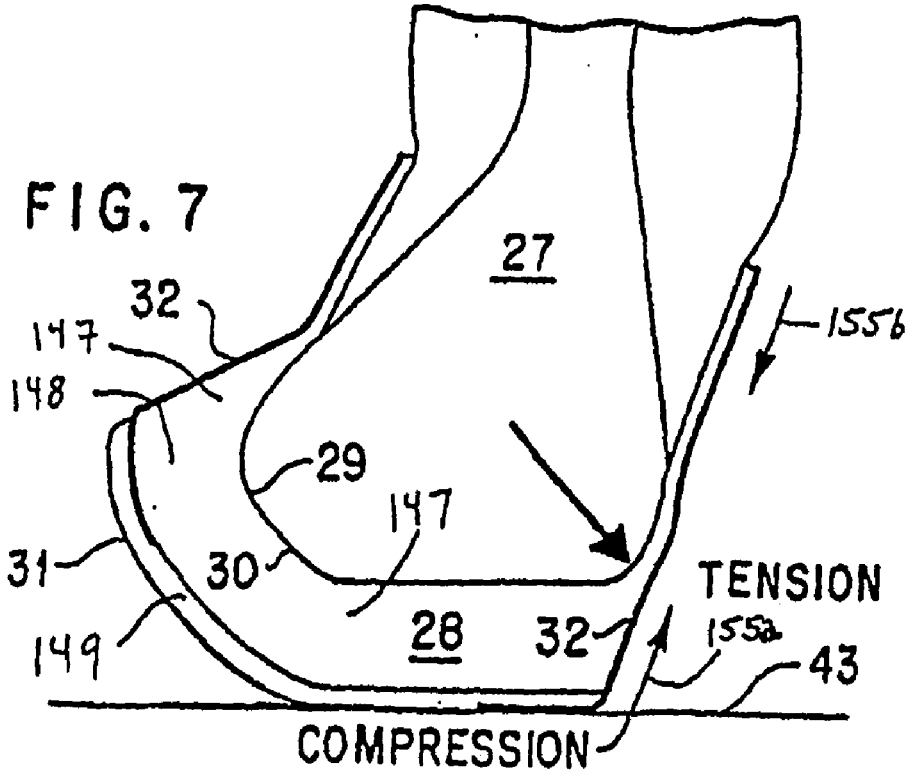
FIG. 7 shows, in frontal plane cross-section at the ankle joint area of the heel, the FIG. 5 design when tilted to its edge and naturally deformed by body weight.

FIG. 7 shows, in cross-section at the heel, the tension-stabilized sides concept applied to naturally rounded shoe sole 28 when the shoe and foot are tilted out fully and are naturally deformed by body weight. Although, constant shoe sole thickness is shown undeformed, FIG. 7 shows that the shape and stability function of the shoe sole 28 and shoe uppers 21 mirror almost exactly that of the human foot 27.

Figure 8A:
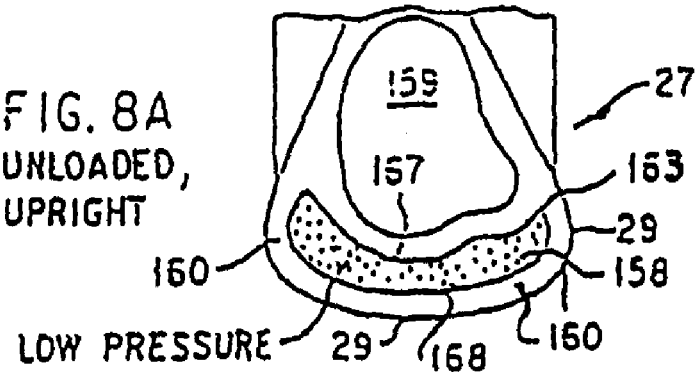
FIG. 8A-D are a sequential series of frontal plane cross-sections of the barefoot heel at the ankle joint area.

FIGS. 8A-8D show the natural cushioning of the human foot 27 in cross-sections at the heel. FIG. 8A shows the bare heel upright and unloaded, with little pressure on the sub calcaneal fat pad 158, which is evenly distributed between the calcaneus 159, which is the heel bone, and the bottom sole of the foot 160.

Figure 8B:
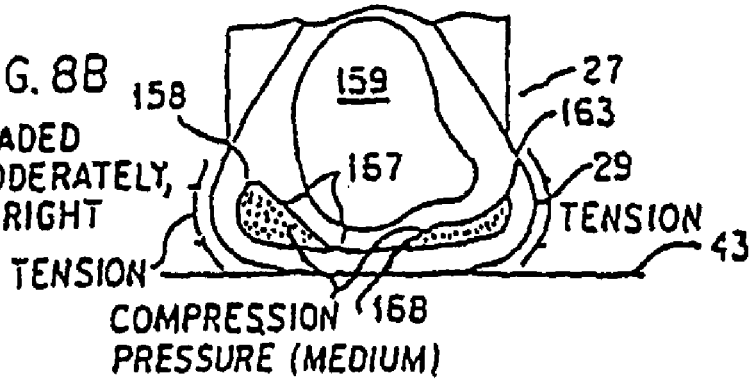

FIG. 8B shows the bare heel upright but under the moderate pressure of full body weight. The compression of the calcaneus 159 against the subcalcaneal fat pad 158 produces evenly balanced pressure within the subcalcaneal fat pad 158 because it is contained and surrounded by a relatively unstretchable fibrous capsule, the bottom sole of the foot 160. Underneath the foot, where the bottom sole of the foot 160 is in direct contact with the ground 43, the pressure caused by the calcaneus 159 on the compressed sub calcaneal fat pad 158 is transmitted directly to the ground 43. Simultaneously, substantial tension is created on the sides of the bottom sole of the foot 160 because of the surrounding relatively tough fibrous capsule. That combination of bottom pressure and side tension is the foot's natural shock absorption system for support structures like the calcaneus 159 and the other bones of the foot 27 that come in contact with the ground 43.

Of equal functional importance is the outer surface of the support structures of the foot 167 like the calcaneus 159 and other bones that make firm contact with the upper surface of the foot's bottom sole 168, with relatively little uncompressed fat pad intervening. In effect, the support structures of the foot land on the ground 43 and are firmly supported; they are not suspended on top of springy material in a buoyant manner analogous to a water bed or pneumatic tire, as in some existing proprietary shoe sole cushioning systems. This simultaneously firm, yet cushioned, support provided by the foot sole must have a significantly beneficial impact on energy efficiency, also called energy return, different from some conventional shoe sole designs which provide shock absorption cushioning during the landing and support phases of locomotion at the expense of firm support during the take-off phase.

Figure 8C:
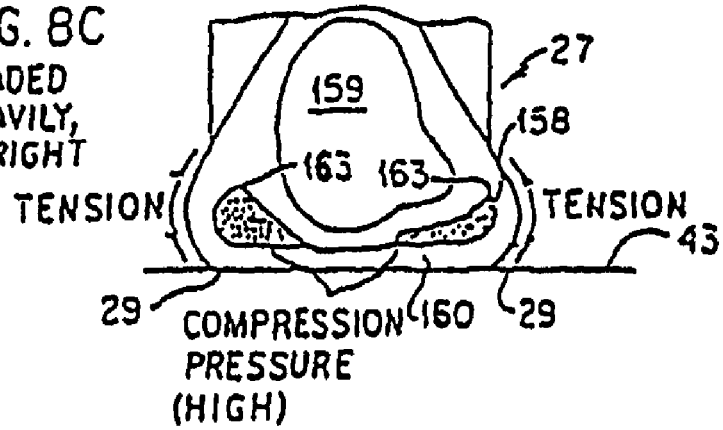

The incredible and unique feature of the foot's natural system is that once the calcaneus 159 is in fairly direct contact with the bottom sole 160 and therefore providing firm support and stability, increased pressure produces a more rigid fibrous capsule that protects the calcaneus 159 and produces greater tension at the sides to absorb shock. So, in a sense, even when the foot's suspension system would seem in a conventional way to have bottomed out under normal body weight pressure, it continues to react with a mechanism to protect and cushion the foot 27 even under much more extreme pressure. This is seen in FIG. 8C, which shows the human heel under the heavy pressure of roughly three times body weight force of landing during routine running. This can be easily verified when one stands barefoot on a hard floor. The heel feels very firmly supported and yet can be lifted and virtually slammed onto the floor with little increase in the feeling of firmness; the heel simply becomes harder as the pressure increases.

In addition, it should be noted that this system allows the relatively narrow base of the calcaneus 159 to pivot from side to side freely in normal pronation/supination motion without any obstructing torsion on it, despite the significantly greater width of a compressed foot sole providing protection and cushioning. This is important in maintaining natural alignment of joints above the ankle joint such as the knee, hip, and back, particularly in the horizontal plane, so that the entire body is properly adjusted to absorb shock correctly. In contrast, existing shoe sole designs, which are generally relatively wide to provide stability, produce unnatural frontal plane torsion on the calcaneus 159, restricting its natural motion and causing misalignment of the joints operating above it resulting in the overuse injuries unusually frequent with such shoes. Instead of flexible sides that harden under tension caused by pressure like that of the foot 27, some existing shoe sole designs are forced by lack of other alternatives to use relatively rigid sides in an attempt to provide sufficient stability to offset the otherwise uncontrollable buoyancy and lack of firm support of air or gel cushions.

Figure 8D:
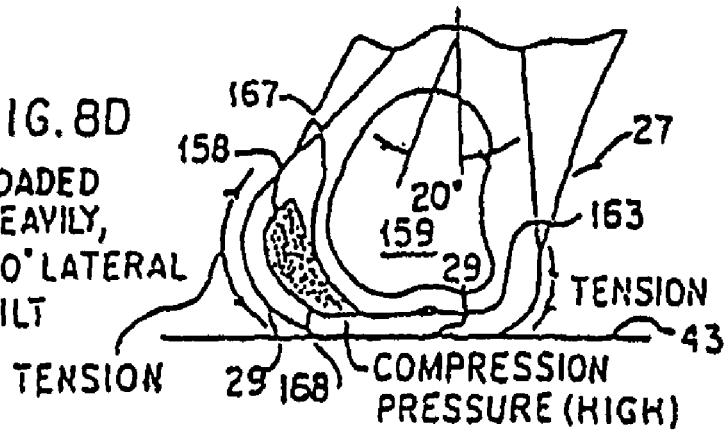

FIG. 8D shows the foot 27 deformed under full body weight and tilted laterally to roughly the 20° limit of normal movement range. Again it is clear that the natural system provides both firm lateral support and stability by providing relatively direct contact with the ground 43 while at the same time providing a cushioning mechanism through side tension and subcalcaneal fat pad pressure.

FIGS. 9A-9D show, also in cross-sections at the heel, a naturally rounded shoe sole design that parallels as closely as possible the overall natural cushioning and stability system of the bare foot 27 described in FIG. 8, including a cushioning compartment 161 under support structures of the foot 27 containing a pressure-transmitting medium like gas, gel, or liquid, like the subcalcaneal fat pad 158 under the calcaneus 159 and other bones of the foot 27. Consequently, FIGS. 9A-D directly correspond to FIGS. 8A-D. The optimal pressure-transmitting medium is that which most closely approximates the fat pads of the foot 27. Silicone gel is probably the optimal material currently available, but future improvements are probable. Since it transmits pressure indirectly, in that it compresses in volume under pressure, gas is significantly less optimal. The gas, gel, or liquid, or any other effective material can be further encapsulated with a separate encapsulation, in addition to the sides of the rounded shoe sole 28, to control leakage and maintain uniformity, as is conventional, and can be subdivided into any practical number of encapsulated areas within a cushioning compartment 161, again as is conventional. The relative thickness of the cushioning compartment 161 can vary, as can the bottom sole 149 and the upper midsole 147 and can be consistent or different in various areas of the shoe sole 28. The optimal relative sizes should be those that approximate most closely those of the average human foot 27, which suggests both a smaller upper and lower soles and a larger cushioning compartment 161 than shown in FIG. 9. The cushioning compartments or pads 161 can be placed anywhere from directly underneath the foot 27, like an insole, to directly above the bottom sole 149. Optimally, the amount of compression created by a given load in any cushioning compartment 161 should be tuned to approximate, as closely as possible, the compression under the corresponding fat pad of the foot 27.

The function of the subcalcaneal fat pad 158 is not met satisfactorily with existing proprietary cushioning systems, even those featuring gas, gel or liquid as a pressure transmitting medium. In contrast to those artificial systems, the design shown in FIG. 9 conforms to the natural rounded shape of the foot 27 and to the natural method of transmitting bottom pressure into side tension in the flexible but relatively non-stretching sides of the shoe sole 28.

Figure 9A:
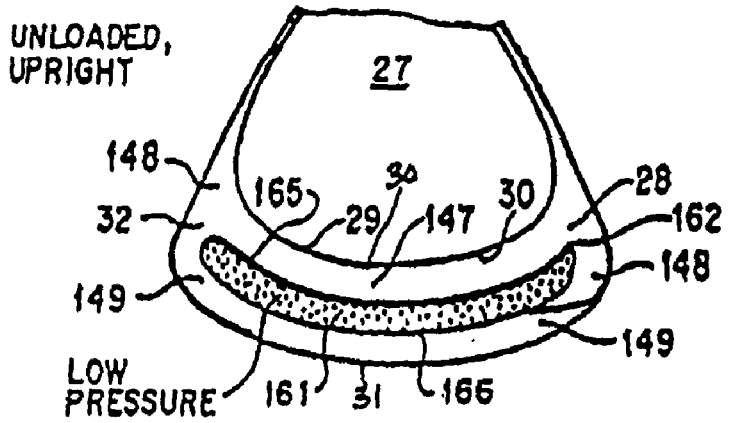
FIGS. 9A-9D show a sequential series of frontal plane cross-sections of a shoe sole design of the heel at the ankle joint area that corresponds exactly to the FIG. 8A-D series described above.
Figure 9B:
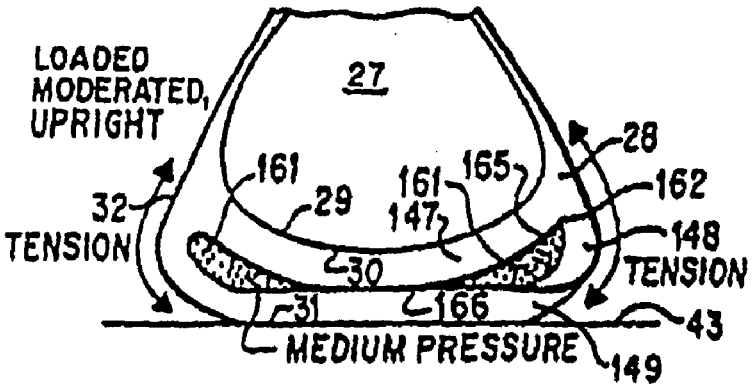
Figure 9C:
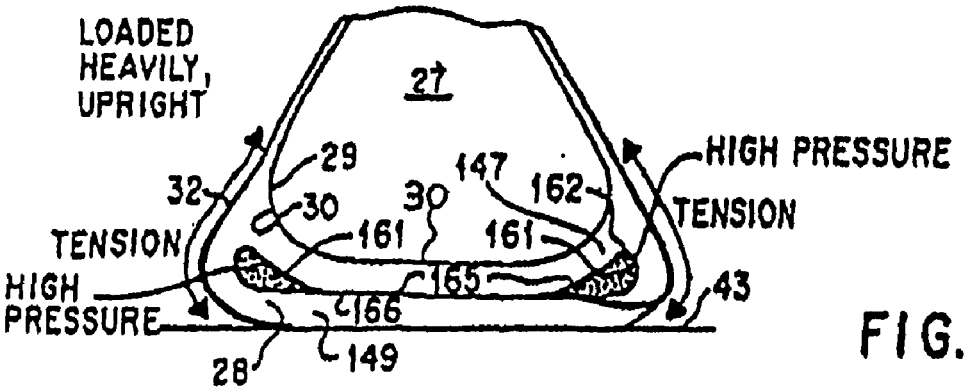

Some existing cushioning systems do not bottom out under moderate loads and rarely, if ever, do so under extreme loads. Rather, the upper surface of the cushioning device remains suspended above the lower surface. In contrast, the design in FIG. 9 provides firm support to foot support structures by providing for actual contact between the lower surface of the upper midsole 165 and the upper surface of the bottom sole 166 when fully loaded under moderate body weight pressure, as indicated in FIG. 9B, or under maximum normal peak landing force during running, as indicated in FIG. 9C, just as the human foot 27 does in FIGS. 8B and 8C. The greater the downward force transmitted through the foot 27 to the shoe, the greater the compression pressure in the cushioning compartment 161 and the greater the resulting tension on the shoe sole sides.

Figure 9D:
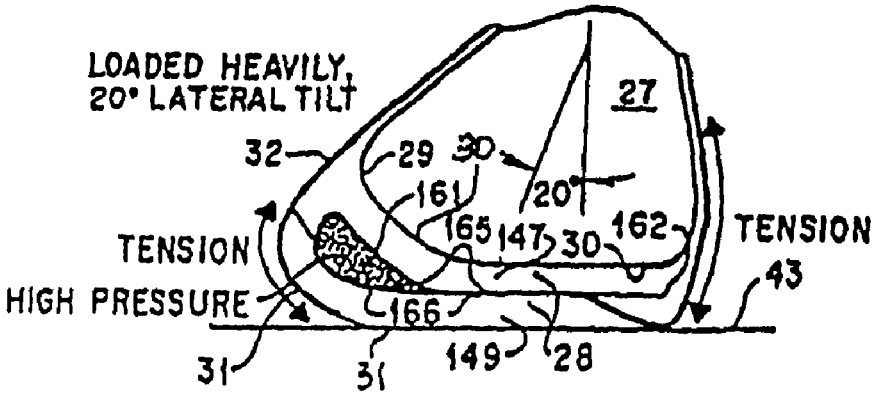

FIG. 9D shows the same shoe sole design when fully loaded and tilted to the natural 20° lateral limit, like FIG. 8D. FIG. 9D shows that an added stability benefit of the natural cushioning system for shoe soles is the effective thickness of the shoe sole 28 reduced by compression on the side so that the potential destabilizing lever arm 23*a* represented by the shoe sole thickness is also reduced, thereby, increasing foot and ankle stability. Another benefit of the FIG. 9 design is that the upper midsole 147 shoe surface can move in any horizontal direction, either sideways or front to back in order to absorb shearing forces. The shearing motion is controlled by tension in the sides. Note that the right side of FIGS. 9A-D is modified to provide a natural crease or upward taper 162 which allows complete side compression without binding or bunching between the upper and lower shoe sole components 147, 148, and 149. The shoe sole crease 162 parallels exactly a similar crease or taper in the human foot 163. Further, 201 represents a horizontal line through the lowermost point of the inner surface of the shoe sole.

Another possible variation of joining shoe upper 21 to shoe bottom sole 149 is on the right (lateral) side of FIGS. 9A-D which makes use of the fact that it is optimal for the tension absorbing shoe sole sides, whether shoe upper 21 or bottom sole 149, to coincide with the theoretically ideal stability plane along the side of the shoe sole 28 beyond that point reached when the shoe is tilted to the foot's natural limit, so that no destabilizing shoe sole lever arm 23*a* is created when the shoe is tilted fully as in FIG. 9D. The joint may be moved up slightly so that the fabric side does not come in contact with the ground 43 or it may be covered with a coating to provide both traction and fabric protection.

It should be noted that the FIG. 9 design provides a structural basis for the shoe sole 28 to conform easily to the natural shape of the human foot 27 and to parallel the natural deformation flattening of the foot 27 during load-bearing motion on the ground 43. This is true even if the shoe sole 28 is made conventionally with a flat sole, as long as rigid structures such as heel counters and motion control devices are not used. Though not optimal, such a conventional flat shoe made like FIG. 9 would provide the essential features of the invention resulting in significantly improved cushioning and stability. The FIG. 9 design could also be applied to intermediate-shaped shoe soles that neither conform to the flat ground 43 or the naturally rounded foot 27. In addition, the FIG. 9 design can be applied to the applicant's other designs, such as those described in FIGS. 14-28 of the present application.

In summary, the FIG. 9 design shows a shoe sole construction for a shoe, including a shoe sole 28 with a cushioning compartment or compartments 161 under the structural elements of the human foot 27, including at least the heel; the cushioning compartment or compartments 161 contain a pressure-transmitting medium like liquid, gas, or gel; a portion of the upper surface of the shoe sole compartment 161 firmly contacting the lower surface of said compartment 161 during normal load-bearing; and pressure from the load-bearing being transmitted progressively, at least in part, to the relatively inelastic sides, top, and bottom of the shoe sole compartment or compartments 161 producing tension.

While the FIG. 9 design copies in a simplified way the macro structure of the foot 27, FIGS. 10 A-C focus more on the exact detail of shoe sole 28 modeled after the natural structures of the foot 27 including the micro level. FIGS. 10A and 10C are perspective views of cross-sections of a part of a rounded shoe sole 28 with a structure like the human heel wherein elements of the shoe sole structure are similar to chambers of a matrix of elastic fibrous connective tissue 164 which hold closely packed fat cells in the foot 27. The chambers 164 in the foot 27 are structured as whorls radiating out from the calcaneus 159. These fibrous-tissue strands are firmly attached to the under surface of the calcaneus and extend to the subcutaneous tissues. They are usually in the form of the letter "U", with the open end of the "U" pointing toward the calcaneus 159.

As the most natural embodiment, an approximation of this specific chamber structure would appear to be optimal as an accurate model for the structure of the shoe sole cushioning compartments 161. The description of the structure of calcaneal padding provided by Erich Blechschmidt in Foot and Ankle, March, 1982, (translated from the original 1933 article in German) is so detailed and comprehensive that copying the same structure as a model in shoe sole design is not difficult technically, once the crucial connection is made that such copying of this natural system is necessary to overcome inherent weaknesses in the design of existing shoes. Other arrangements and orientations of the whorls are possible but would probably be less optimal.

Pursuing this nearly exact design analogy, the lower surface of the upper midsole 165 would correspond to the outer surface 167 of the calcaneus 159 and would be the origin of the U-shaped whorl chambers 164 noted above.

Figure 10A:
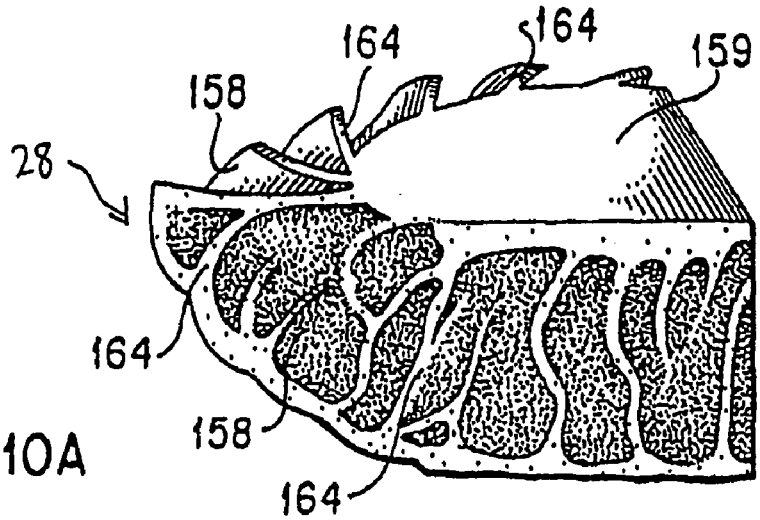
FIG. 10A-C shows two perspective views and a close-up view of a part of a shoe sole with a structure like the fibrous connective tissue of the groups of fat cells of the human heel.
Figure 10B:
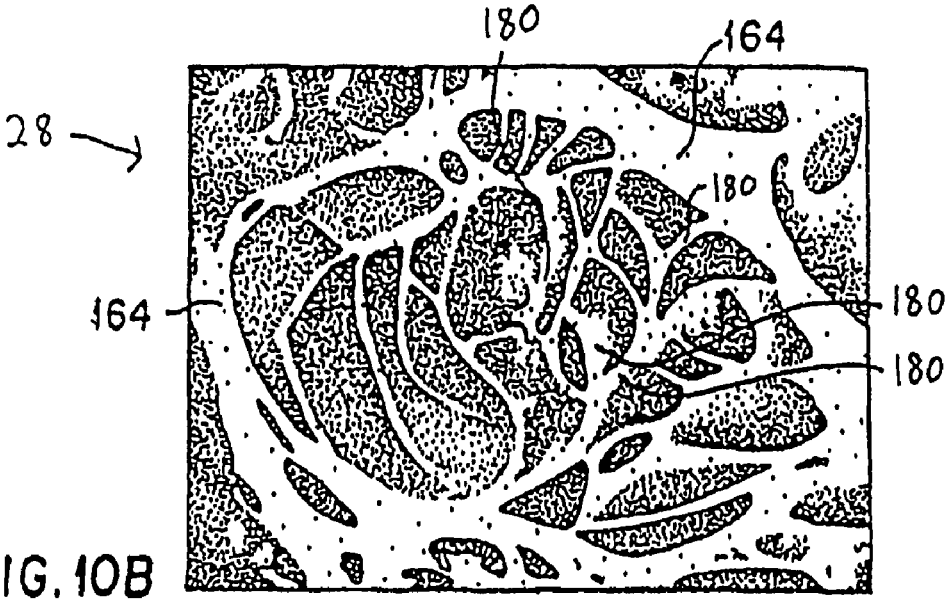
Figure 10C:
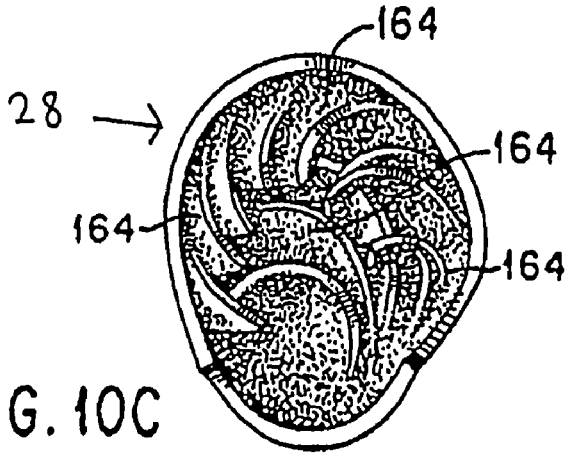

FIG. 10B shows a close-up of the interior structure of the large chambers of a rounded shoe sole 28 as shown in FIGS. 10A and 10C, with mini-chambers 180 similar to mini-chambers in the foot 27. It is clear from the fine interior structure and compression characteristics of the mini-chambers 180 in the foot that those directly under the calcaneus 159 become very hard quite easily due to the high local pressure on them and the limited degree of their elasticity so that they are able to provide very firm support to the calcaneus 159 and/or other bones of the foot sole. By virtue of their being fairly inelastic, the compression forces on those chambers are dissipated to other areas of the network of fat pads under any given support structure of the foot 27, like the calcaneus 159. Consequently, if a cushioning compartment 161, such as the compartment 161 under the heel shown in FIG. 9, is subdivided into smaller chambers, like those shown in FIG. 10, then actual contact between the lower surface of the upper midsole 165 and the upper surface of the bottom sole 166 would no longer be required to provide firm support so long as the compartment 161 and the pressure-transmitting medium contained in them have material characteristics similar to those of the foot 27 described above. The use of gas may not be satisfactory in this approach as its compressibility may not allow adequate firmness.

In summary, the FIGS. 10A-C design shows a shoe construction including a shoe sole 28 with compartments 161 under the structural elements of the human foot 27, including at least the heel; the compartments 161 containing a pressure-transmitting medium like liquid, gas or gel; the compartments 161 having a whorled structure like that of the fat pads of the human foot sole; and load-bearing pressure being transmitted progressively at least in part to the relatively inelastic sides, top, and bottom of the shoe sole compartments 161, producing tension therein. The elasticity of the material of the compartments 161 and the pressure-transmitting medium are such that normal weight-bearing loads produce sufficient tension within the structure of the compartments 161 to provide adequate structural rigidity to allow firm natural support to the foot structural elements, like that provided by the fat pads of the bare foot 27. That shoe sole construction can have shoe sole compartments 161 that are subdivided into mini-chambers like those of the fat pads of the foot sole.

Since the bare foot 27 that is never shod is protected by very hard calluses (called a "Seri boot") which the shod foot lacks, it seems reasonable to infer that the natural protection and shock absorption system of the shod foot 27 is adversely affected by its unnaturally undeveloped fibrous capsules (surrounding the sub calcaneal and other fat pads under foot bone support structures). A solution would be to produce a shoe intended for use without socks (i.e., with smooth surfaces above the foot bottom sole) that uses insoles that coincide with the foot bottom sole, including its sides. The upper surface of those insoles, which would be in contact with the bottom sole of the foot 27 (and its sides), would be coarse enough to stimulate the production of natural barefoot calluses. The insoles would be removable and available in different uniform grades of coarseness, as is sandpaper, so that the user can progress from finer grades to coarser grades as his foot soles toughen with use.

Similarly, socks could be produced to serve the same function, with the area of the sock that corresponds to the foot bottom sole (and sides of the bottom sole) made of a material coarse enough to stimulate the production of calluses on the bottom sole of the foot 27, with different grades of coarseness available, from fine to coarse, corresponding to feet from soft to naturally tough. Using a tube sock design with uniform coarseness, rather than conventional sock design assumed above, would allow the user to rotate the sock on his foot to eliminate any "hot spot" irritation points that might develop. Also, since the toes are most prone to blistering and the heel is most important in shock absorption, the toe area of the sock could be relatively less abrasive than the heel area.

The invention shown in FIGS. 11A-11C is a removable midsole insert 145. Alternatively, the removable midsole insert 145 can be attached permanently to adjoining portions of the rounded shoe sole 28 after initial insertion using glue or other common forms of attachment. The rounded shoe sole 28 has an inner surface 30 and a outer surface 31 with at least a part of both surfaces being concavely rounded relative to an intended wearer's foot location inside the shoe, as viewed in a frontal plane cross-section from inside the shoe when in an unloaded, upright condition. Preferably, all or part of the removable midsole insert 145 can be removable through any practical number of insertion/removal cycles. The removable midsole insert 145 can also, optionally, include a concavely rounded side, as shown in FIG. 11A, a concavely rounded underneath portion or be conventionally formed, with other portions of the shoe sole 28 including concave rounding on the side or underneath portion or portions. All or part of the preferred insole 2 can also be removable or can be integrated into the upper portion of the removable midsole insert 145.

The removable portion or portions of the midsole insert 145 can include all or part of the heel lift of the rounded shoe sole 28, or all or part of the heel lift 38 can be incorporated into the bottom sole 149 permanently, either using bottom sole material, midsole material or other suitable material. Heel lift 38 is typically formed from cushioning material such as the midsole materials described herein and may be integrated with the upper midsole 147 or midsole 148 or any portion thereof, including the removable midsole insert 145.

The removable portion of the midsole insert 145 can extend the entire length of the shoe sole 28, as shown in FIGS. 11K and 11L, or only a part of the length, such as a heel area as shown in cross-section in FIG. 11 G, a midtarsal area as shown in cross-section in FIG. 11H, a forefoot area as shown in cross-section in FIGS. 11I and 11J, or some portion or combination of those areas. The removable portion and/or midsole insert 145 may be fabricated in any suitable, conventional manner employed for the fabrication of shoe midsoles or other similar structures.

The midsole insert 145, as well as other midsole portions of the shoe sole 28 such as the midsole 148 and the upper midsole 147, can be fabricated from any suitable material such as elastomeric foam materials. Examples of current art for elastomeric foam materials include polyether urethane, polyester urethane, polyurethane foams, ethylene vinyl acetate, ethylene vinyl acetate/polyethylene copolymer, polyester elastomers such as Hytrel™, fluoroelastomers, chlorinated polyethylene, chlorosulfonated polyethylene, acrylonitrile rubber, ethylene vinyl acetate/polypropylene copolymers, polyethylene, polypropylene, neoprene, natural rubber, Dacron™ polyester, polyvinyl chloride, thermoplastic rubbers, nitrile rubber, butyl rubber, sulfide rubber, polyvinyl acetate, methyl rubber, buna N, buna S, polystyrene, ethylene propylene polymers, polybutadiene, butadiene styrene rubber, and silicone rubbers. The most preferred elastomeric foam materials in the current art of shoe sole midsole materials are polyurethanes, ethylene vinyl acetate, ethylene vinyl acetate/polyethylene copolymers, ethylene vinyl acetate/polypropylene copolymers, neoprene, and polyester elastomers. Suitable materials are selected on the basis of durability, flexibility, and resiliency for cushioning the foot among other properties.

As shown in FIG. 11D, the midsole insert 145 itself can incorporate cushioning or structural compartments 161 or components. FIG. 11D shows cushioning compartments or chambers 161 encapsulated in part of mid sole insert 145, as well as bottom sole 149, as viewed in a frontal plane cross-section. FIG. 11D is a perspective view to indicate the placement of disks or capsules of cushioning material. The disks or capsules of cushioning material may be made from any of the midsole materials mentioned above, and preferably include a flexible, resilient midsole material such as ethyl vinyl acetate (EVA), that may be softer or firmer than other sole material or may be provided with special shock absorption, energy efficiency, wear, or stability characteristics. The disks or capsules may include a gas, gel, liquid or any other suitable cushioning material. The cushioning material may optionally be encapsulated itself using a film made of a suitable material such as polyurethane film. Other similar materials may also be employed. The encapsulation can be used to form the cushioning material into an insertable capsule in a conventional manner. The example shown in FIG. 11D shows such cushioning disks 161 located in the heel area and the lateral and medial forefoot areas, proximate to the heads of the first and fifth metatarsal bones of a wearer's foot. The cushioning material, for example disks or compartments 161, may form part of the upper surface of the upper portion of the midsole insert 145 as shown in FIG. 11D. A cushioning compartment or disk 161 can generally be placed anywhere in the removable midsole insert 145 or in only a part of the midsole insert 145. A part of the cushioning compartment or disk 161 can extend into the outer sole 149 or other sole portions, or, alternatively, one or more compartments or disks 161 may constitute all or substantially all of the midsole insert 145. As shown in FIG. 11L, cushioning disks or compartments may also be suitably located at other essential support elements like the base of the fifth metatarsal 97, the head of the first distal phalange 98, or the base and lateral tuberosity of the calcaneus 95, among other suitable conventional locations. In addition, structural components like a shank 169 can also be incorporated partially or completely in a midsole insert 145, such as in the medial midtarsal area, as shown in FIG. 11D, under the main longitudinal arch of a wearer's foot, and/or under the base of the wearer's fifth metatarsal bone, or other suitable alternative locations.

In one embodiment, the FIG. 11D invention can be made of all mass-produced standard size components, rather than custom fit, but can be individually tailored for the right and left shoe with variations in the firmness of the material in compartments 161 for special applications such as sports shoes, golf shoes or other shoes which may require differences between firmness of the left and right shoe sole.

One of the advantages provided by the removable midsole insert 145 of the present invention is that it allows replacement of foamed plastic portions of the midsole which degrade quickly with wear, losing their designed level of resilience, with new midsole material as necessary over the life of the shoe to, thereby, maintain substantially optimal shock absorption and energy return characteristics of the rounded shoe sole 28.

The removable midsole insert 145 can also be transferred from one pair of shoes composed generally of shoe uppers and bottom sole like FIG. 11C to another pair like FIG. 11C, providing cost savings. Besides using the removable midsole insert 145 to replace worn components with new components, the removable midsole insert 145 can provide another advantage of allowing the use of different cushioning or support characteristics in a single shoe or pair of shoes made like FIG. 11C, such as firmer or softer portions of the midsole, or thicker or thinner portions of the midsole, or entire midsoles that are firmer, softer, thicker or thinner, either as separate layers or as an integral part of mid sole insert 145. In this manner, a single pair of shoes can be customized to provide the desired cushioning or support characteristics for a particular activity or different levels of activity such as running, training or racing. FIG. 11D shows an example of such removable midsole inserts 145 in the form of disks or capsules 161, but midsole or insole layers or the entire midsole insert 145 can be removed and replaced temporarily or permanently.

Such removable midsole inserts 145 can be made to include density or firmness variations like those shown in FIGS. 21-23, and 25. The midsole density or firmness variations can differ between a right foot shoe and a left foot shoe, such as FIG. 21's left shoe and FIG. 22's right shoe, showing equivalent portions.

Such replacement removable midsole inserts 145 can be made to include thickness variations, including those shown in FIG. 17-20, 24, 27 or 28. Combinations of density or firmness variations and thickness variations shown above can also be made in the removable midsole inserts 145.

Replacement removable midsole inserts 145 may be held in position at least in part by enveloping sides of the shoe upper 21 and/or bottom sole 149. Alternatively, a portion of the midsole material may be fixed in the shoe sole 28 and extend up the sides to provide support for holding removable midsole inserts 145 in place. If the associated rounded shoe sole 28 has one or more of the abbreviated sides shown in FIG. 11L, then the removable midsole insert can also be held in position against relative motion in the sagittal plane by indentations formed between one or more concavely rounded sides which match the contour of one or more of the adjacent abbreviations. Combinations of these various embodiments may also be employed.

The removable midsole insert 145 has a lower surface interface 8 with the upper surface of the bottom sole 166. The interface 8 would typically remain unglued, to facilitate repeated removal of the midsole inserts 145, or could be affixed by a weak glue, like that used with self-stick removable paper notes, that does not permanently fix the position of the midsole insert 145 in place.

The interface 8 can also be bounded by non-slip or controlled slippage surfaces. The two surfaces which form the interface 8 can have interlocking complementary geometry as shown, for example, in FIGS. 11E-11F, such as mating protrusions and indentations, or the removable midsole insert 145 may be held in place by other conventional temporary attachments, such as Velcro™ strips 142 shown in FIG. 11V. Conversely, providing no means to restrain slippage between the surfaces of interface 8 may, in some cases, provide additional injury protection. Thus, controlled facilitation of slippage at the interface 8 may be desirable in some instances and can be utilized within the scope of the invention.

The removable midsole insert 145 of the present invention may be inserted and removed in the same manner as conventional removable insoles or conventional midsoles, that is, generally in the same manner as the wearer inserts his foot 27 into the shoe. Insertion of the removable midsole insert 145 may, in some cases, requiring loosening of the shoelaces or other mechanisms for securing the shoe to a wearer's foot 27. For example, the midsole insert 145 may be inserted into the interior cavity of the shoe upper and affixed to or abutted against, the top side of the shoe sole. In a particularly preferred embodiment, a bottom sole 149 is first inserted into the interior cavity of the shoe upper 21 as indicated by the arrow in FIG. 75A. The bottom sole 149 is inserted into the cavity so that any rounded stability sides 28*a* are inserted into and protrude out of corresponding openings in the shoe upper 21. The bottom sole 149 is then attached to the shoe upper 21, preferably by a stitch that weaves around the outer perimeter of the openings thereby connecting the shoe upper 21 to the bottom sole 149. In addition, an adhesive can be applied to the surface of the shoe upper 21, which will contact the bottom sole 149 before the bottom sole 149 is inserted into the shoe upper 21.

Once the bottom sole 149 is attached, the removable midsole insert 145' may then be inserted into the interior cavity of the shoe upper 21 and affixed to the upper surface of the bottom sole 166, as shown in FIG. 75C. The midsole insert 145 can be releasably secured in place by any suitable method, including mechanical fasteners 142 shown in FIG. 11V, adhesives, snap-fit arrangements 141, reclosable compartments, interlocking geometries 143 and other similar structures. Additionally, the removable midsole insert 145 preferably includes protrusions placed in an abutting relationship with the bottom sole 149 so that the protrusions occupy corresponding recesses in the bottom sole 149. Alternatively, the removable midsole insert 145 may be glued to affix the midsole insert 145 in place on the bottom sole 149. In such an embodiment, an adhesive can be used on the interface 8 of the midsole insert 145 to secure it to the bottom sole 149.

Replacement removable midsole inserts 145 with concavely rounded sides that provide support for only a narrow range of sideways motion or with higher concavely rounded sides that provide for a very wide range of sideways motion can be used to adapt the same shoe for different sports, like running or basketball, for which lesser or greater protection against ankle sprains may be considered necessary, as shown in FIG. 11G. Different removable midsole inserts 145 may also be employed on the left or right side, respectively. Replacement removable midsole inserts 145 with higher curved sides that provide for an extra range of motion for sports tend to encourage pronation-prone wearers on the medial side or on the lateral side for sports which tend to encourage supination-prone wearers are other potentially beneficial embodiments.

Individual removable midsole inserts 145 can be custom-made for a specific class of wearer or can be selected by the individual from mass-produced standard sizes with standard variations in the height of the concavely rounded sides, for example.

FIGS. 11M-11P show shoe soles with one or more encapsulated midsole sections or chambers such as bladders 188 for containing fluid such as a gas, liquid, gel or other suitable materials with a duct, a flow regulator, a sensor, and a control system such as a microcomputer. The existing art is described by U.S. Pat. No. 5,813,142 by Demon, issued Sep. 29, 1998, and by the references cited therein.

Figure 11P:
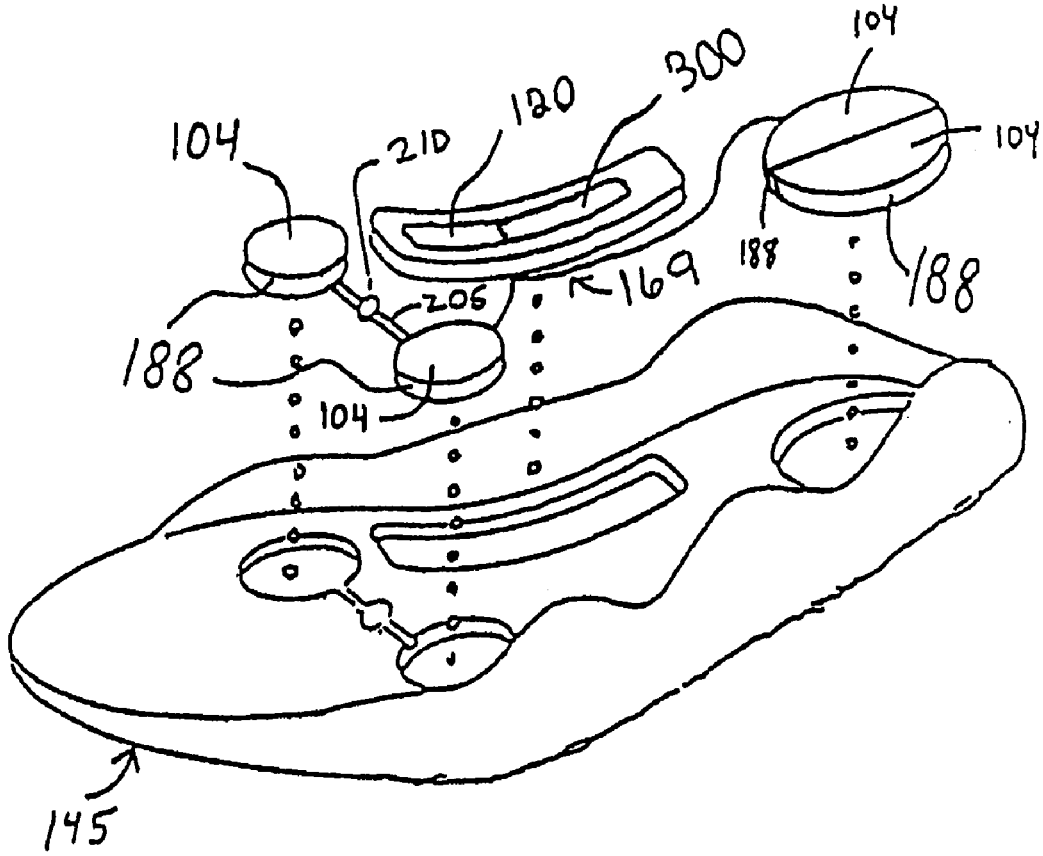
FIG. 11P is an exploded view of an embodiment of a removable midsole with pressure controlled encapsulated midsole sections and a control system such as a microprocessor.

FIGS. 11M-11P also include the applicant's concavely rounded sides as described elsewhere in this application, such as FIGS. 11A-11L (and/or concavely rounded underneath portions). In addition, FIGS. 11M-11P show ducts that communicate between encapsulated midsole sections or chambers/bladders 188 or within portions of the encapsulated midsole sections or bladders 188. Other suitable conventional embodiments can also be used in combination with the applicant's concavely rounded portions. Also, FIGS. 11N-11P show removable midsole inserts 145. FIG. 11M shows a non-removable midsole in combination with the pressure-controlled bladder or encapsulated section 188 of the invention. The bladders or sections 188 can be any size relative to the midsole encapsulating them, including replacing the encapsulating midsole substantially or entirely.

Also, included in the applicant's invention is the use of a piezo-electric effect controlled by a microprocessor control system to affect the hardness or firmness of the material contained in the encapsulated midsole section, bladder, or other midsole portion 188. For example, a disk-shaped midsole or other suitable cushioning compartment 161 may be controlled by electric current flow instead of fluid flow with common electrical components replacing those described below which are used for conducting and controlling fluid flow under pressure.

FIG. 11M shows a shoe sole embodiment with the applicant's concavely rounded sides invention described in earlier figures, including both concavely rounded sole inner and outer surfaces 30, 31, with a bladder or an encapsulated midsole section 188 in both the medial and lateral sides and in the middle or underneath portion between the sides. An embodiment with a bladder or encapsulated midsole section 188 located in only a single side and the middle portion is also possible as is an embodiment with a bladder or encapsulated midsole section 188 located in both the medial and lateral sides without one in the middle portion. Each of the bladders 188 is connected to an adjacent bladder(s) 188 by a fluid duct 206 passing through a fluid valve 210, located in midsole insert 145, although the location could be anywhere in a single or multi-layer rounded shoe sole 28. FIG. 11M is based on the left side of FIG. 13A. In a piezo-electric embodiment using midsole sections 188, the fluid duct between sections would be replaced by a suitable wired or wireless connection. A combination of one or more bladders 188 with one or more encapsulated midsole sections 188 is also possible.

One advantage of the applicant's invention, as shown in the applicant's FIG. 11M, is to provide better lateral or side-to-side stability through the use of rounded sides, to compensate for excessive pronation or supination, or both, when standing or during locomotion. The FIG. 11M embodiment also shows a fluid containment system that is fully enclosed and uses other bladders 188 as reservoirs to provide a unique advantage. The advantage of the FIG. 11M embodiment is to provide a structural means by which to change the hardness or firmness of each of the shoe sole sides and of the middle or underneath sole portion, relative to the hardness or firmness of one or both of the other sides or sole portion, as seen for example in a frontal plane, as shown. Similar structure can also be used to vary hardness or firmness as viewed in a sagittal plane.

Although FIG. 11M shows communication between, each bladder or midsole section 188 within a frontal plane cross-section (or sagittal plane cross-section), which is a highly effective embodiment, communication might also be between only two adjacent or non-adjacent bladders or midsole sections 188 due to cost, weight, or other design considerations.

Figure 11T:
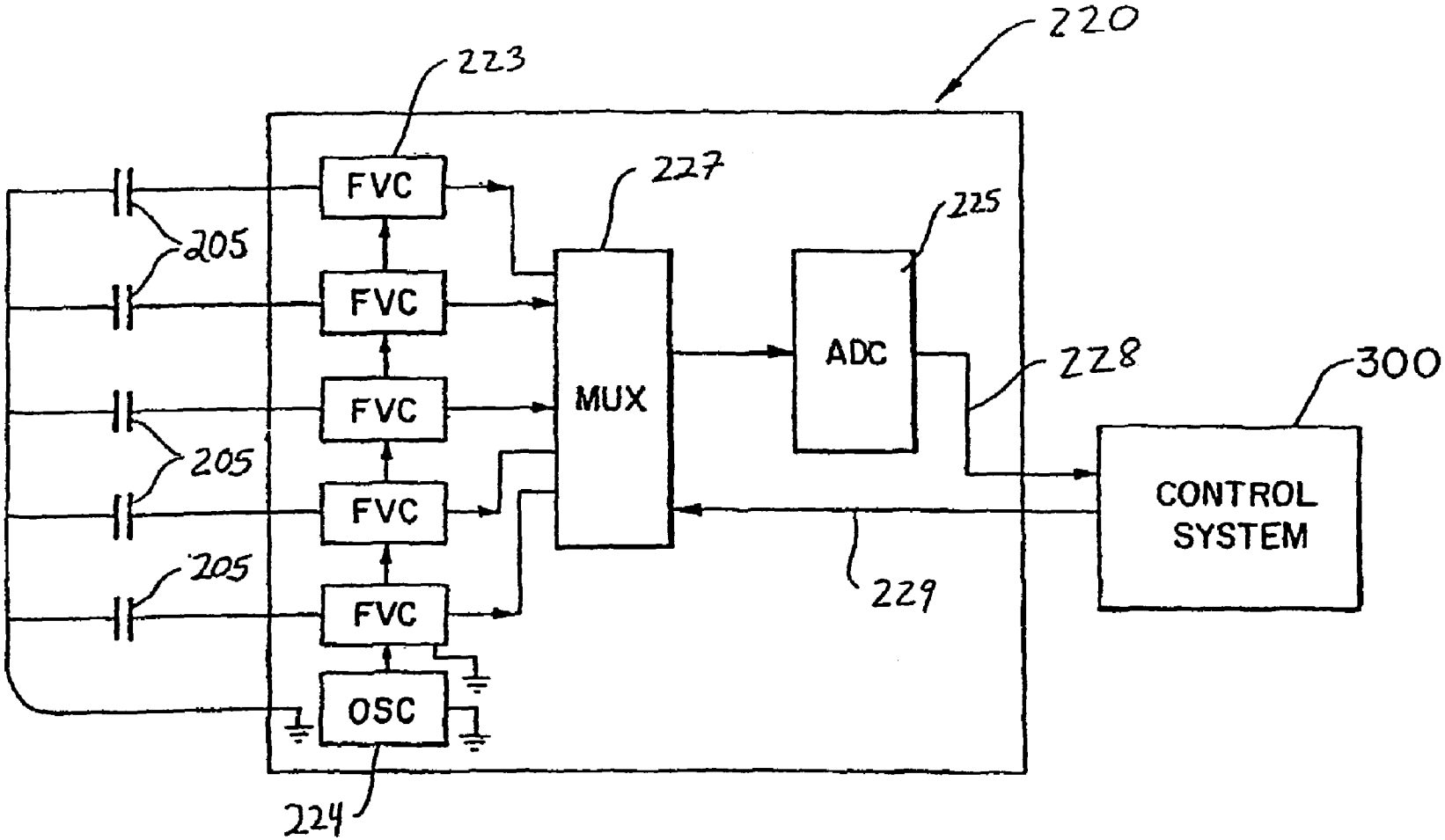
FIG. 11T is a schematic representation of suitable pressure sensing circuitry for use in the present invention.
Figure 11U:
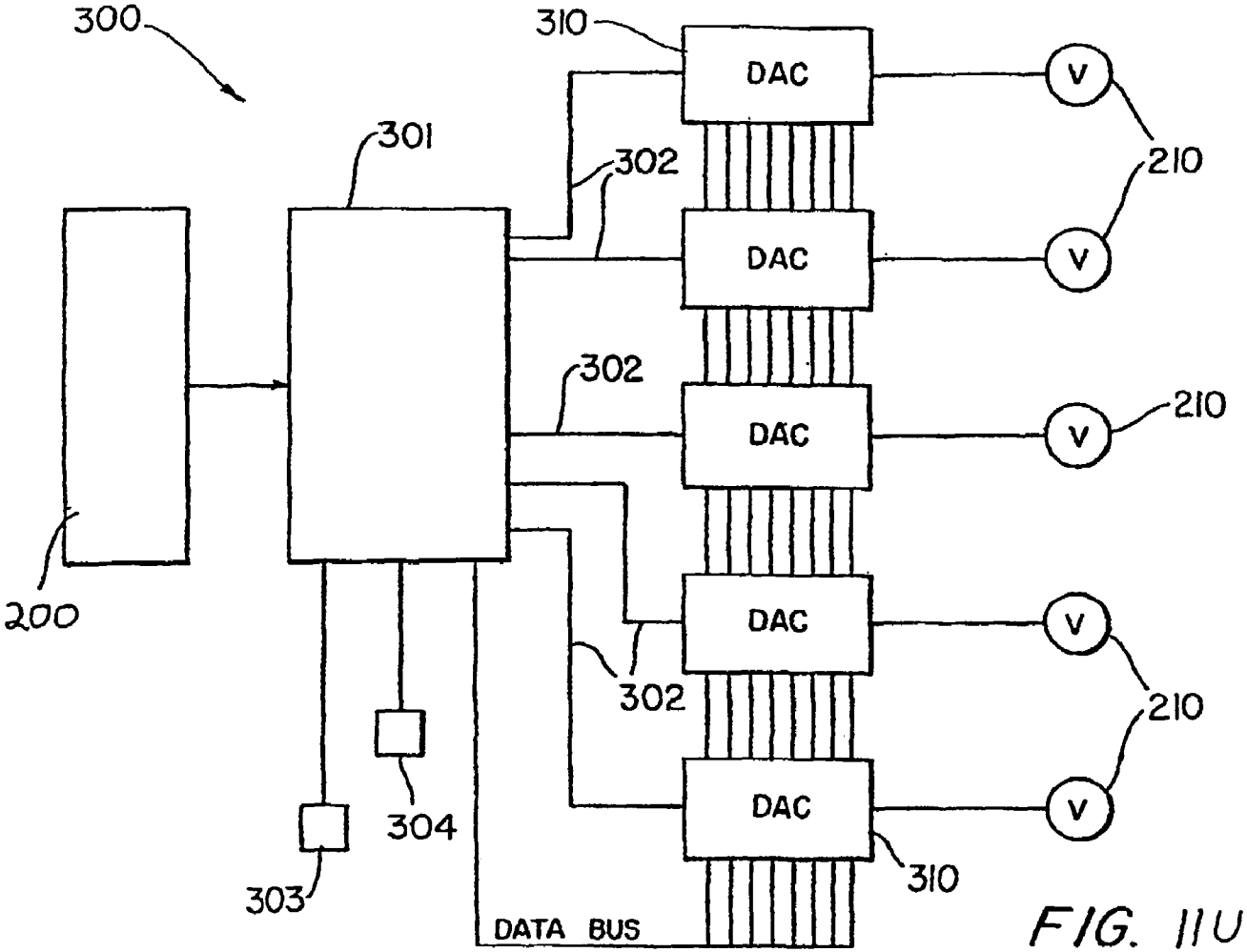
FIG. 11U is a schematic representation of a control system that may be employed in the present invention.

Pressures sensing system 200 also includes pressure sensing circuitry 220, shown in FIG. 11T, which converts the change in pressure detected by variable capacitor 205 into digital data. Each variable capacitor 205 forms part of a conventional frequency-to-voltage converter (FVC) 223 which outputs a voltage proportional to the capacitance of variable capacitor 205. Oscillator 224 is electrically connected to each FVC 223 and provides an adjustable reference oscillator. The voltage produced by each of the five FVC's 223 is provided as an input to multiplexer 227 which cycles through the five channels sequentially connecting the voltage from each FVC 223 to analog-to-digital (AID) converter 225 which converts the analog voltages into digital data for transmission to control system 300 via data lines 228, connecting each in turn to control system 300 via data lines 228. Control lines 229 allow control system 300 to control the multiplexer 227 to selectively receive data from each pressure sensing device in any desirable order. These components and this circuitry are well known to those skilled in the art and any suitable component or circuitry might be used to perform the same function.

Fluid pressure system 200 may selectively reduce the impact of the user's foot in each of the five zones.

Control system 300, which includes a programmable microcomputer 301 having conventional RAM and ROM, receives information from pressure sensing system 200 indicative of the relative pressure sensed by each pressure sensing device 104. Control system 300 receives digital data from pressure sensing circuitry 220 proportional to the relative pressure sensed by pressure sensing devices 104. Control system 300 is also in communication with fluid valves 210 to vary the opening of fluid valves 210 and thus control the flow air. As the fluid valves of this embodiment are solenoids (and thus electrically controlled), control system 300 is in electrical communication with fluid valves 210.

As shown in FIG. 11 U, programmable microcomputer 301 of control system 300 selects (via on of five control lines 302) one of the five digital-to-analog (D/A) converters 310 to receive data from microcomputer 301 to control fluid valves 210. The selected D/A converter 310 receives the data and produces an analog voltage proportional to the digital data received. The output of each D/A converter 310 remains constant until changed by microcomputer 301 (which can be accomplished using conventional data latches not shown). The output of each D/A converter 310 is supplied to each of the respective fluid valves 210 to selectively control the size of the opening of fluid valves 210.

Control system 300 also includes a cushion adjustment control 303 that allows the user to control the level of cushioning response from the shoe. A knob on the shoe is adjusted by the user to provide adjustments in cushioning ranging from no additional cushioning (fluid valves 210 never open) to a maximum cushioning. This is accomplished by scaling the data to be transmitted to the D/A converters (which controls the opening of fluid valves 210) by the amount of desired cushioning as received by control system 300 from cushion adjustment control 303. However, any suitable conventional means of adjusting the cushioning could be used.

An illuminator 304, such as a conventional light emitting diode (LED), is also mounted to the circuit board that houses the electronics of control system 300 to provide the user with an indication of the operation of the apparatus.

Each fluid bladder or midsole section 188 may be provided with an associated pressure-sensing device that measures the pressure exerted by the user's foot 27 on the fluid bladder or midsole section 188. As the pressure increases above a threshold, a control system opens (perhaps only partially) a flow regulator to allow fluid to escape from the fluid bladder or section 188. Thus, the release of fluid from the fluid bladder or section 188 may be employed to reduce the impact of the user's foot 27 on the ground 43. Point pressure under a single bladder 188, for example, can be reduced by a controlled fluid outflow to any other single bladder or any combination of the other bladders.

Preferably, the sole 28 of the shoe is divided into zones which roughly correspond to the essential structural support and propulsion elements of the intended wearer's foot 27, including the base and lateral tuberosity of the calcaneus 95, the heads of the metatarsals 96*c*, 96*d* (particularly the first and fifth), the base of the fifth metatarsal 97, the main longitudinal arch (optional), and the head of the first distal phalange 98. The zones under each individual element can be merged with adjacent zones, such as a lateral metatarsal head zone shown at 96*c* and a medial metatarsal head zone shown at 96*d*.

The pressure sensing system preferably measures the relative change in pressure in each of the zones. The fluid pressure system, thereby, reduces the impact experienced by the user's foot 27 by regulating the escape of a fluid from a fluid bladder or midsole section 188 located in each zone of the sole 28. The control system 300 receives pressure data from the pressure sensing system and controls the fluid pressure system in accordance with predetermined criteria, which can be implemented via electronic circuitry, software or other conventional means.

The pressure sensing system may include a pressure sensing device 104 disposed in the sole 28 of the shoe at each zone. In a preferred embodiment, the pressure sensing device 104 is a pressure sensitive variable capacitor which may be formed by a pair of parallel flexible conductive plates disposed on each side of a compressible dielectric. The dielectric can be made from any suitable material such as rubber or another suitable elastomer. The outside of each of the flexible conductive plates is preferably covered by a flexible sheath (such as rubber) for added protection. Since the capacitance of a parallel plate capacitor is inversely proportional to the distance between the plates, compressing the dielectric by applying increasing pressure results in an increase in the capacitance of the pressure sensitive variable capacitor. When the pressure is released, the dielectric expands substantially to its original thickness so that the pressure sensitive variable capacitor returns substantially to its original capacitance. Consequently, the dielectric must have a relatively high compression limit and a high degree of elasticity to provide ideal function under variable loading.

The pressure sensing system also includes pressure-sensing circuitry 120 which converts the change in pressure detected by the variable capacitor into digital data. Each variable capacitor forms part of a conventional frequency-to-voltage converter (FVC) which outputs a voltage proportional to the capacitance of a variable capacitor. An adjustable reference oscillator may be electrically connected to each FVC. The voltage produced by each of the FVC's is provided as an input to a multiplexer which cycles through the channels sequentially connecting the voltage from each FVC to an analog-to-digital (A/D) converter to convert the analog voltages into digital data for transmission to control system 300 via data lines, each of which is connected to control system 300. The control system 300 can control the multiplexer to selectively receive data from each pressure-sensing device in any desirable order. These components and circuitry are well known to those skilled in the art and any suitable component or circuitry might be used to perform the same function.

The fluid pressure system selectively reduces the impact of the user's foot 27 in each of the zones. Associated with each pressure-sensing device 104 in each zone, and embedded in the shoe sole 28, is at least one bladder or midsole section 188 that forms part of the fluid pressure system. A fluid duct 206 is connected at its first end to its respective bladder or section 188 and is connected at its other end to a fluid reservoir. In this embodiment, fluid duct 206 connects bladder or midsole section 188 with ambient air, which acts as a fluid reservoir, or, in a different embodiment, with another bladder 188 also acting as a fluid reservoir. A flow regulator, which in this embodiment is a fluid valve 210, is disposed in fluid duct 206 to regulate the flow of fluid through fluid duct 206. Fluid valve 210 is adjustable over a range of openings (i.e., variable metering) to control the flow of fluid exiting bladder or section 188 and may be any suitable conventional valve such as a solenoid valve as in this embodiment.

Control system 300, which preferably includes a programmable microcomputer having conventional RAM and/or ROM, receives information from the pressure sensing system indicative of the relative pressure sensed by each pressure sensing device 104. Control system 300 receives digital data from pressure sensing circuitry 120 proportional to the relative pressure sensed by pressure sensing devices 104. Control system 300 is also in communication with fluid valves 210 to vary the opening of fluid valves 210 and thus control the flow of fluid. As the fluid valves of this embodiment are solenoids (and thus electrically controlled), control system 300 is in electrical communication with fluid valves 210. An analog electronic control system 300 with other components being analog is also possible.

The preferred programmable microcomputer of control system 300 selects (via a control line) one of the digital-to-analog (D/A) converters to receive data from the microcomputer in order to control fluid valves 210. The selected D/A converter receives the data and produces an analog voltage proportional to the digital data received. The output of each D/A converter remains constant until changed by the microcomputer that can be accomplished using conventional data latches. The output of each D/A converter is supplied to each of the respective fluid valves 210 to selectively control the size of the opening of fluid valves 210.

Control system 300 also can include a cushioning adjustment control to allow the user to control the level of cushioning response from the shoe. A control device on the shoe can be adjusted by the user to provide adjustments in cushioning ranging from no additional cushioning (fluid valves 210 never open) to maximum cushioning (fluid valves 210 open wide). This is accomplished by scaling the data to be transmitted to the D/A converters (which controls the opening of fluid valves 210) by the amount of desired cushioning as received by control system 300 from the cushioning adjustment control. However, any suitable conventional means of adjusting the cushioning could be used.

An illuminator, such as a conventional light emitting diode (LED), can be mounted to the circuit board that houses the electronics of control system 300 to provide the user with an indication of the state of operation of the apparatus.

The operation of this embodiment of the present invention is most useful for applications in which the user is either walking or running for an extended period of time during which weight is distributed among the zones of the foot in a cyclical pattern. The system begins by performing an initialization process, which is used to set up pressure thresholds for each zone. During initialization, fluid valves 210 are fully closed while the bladders or sections 188 are in their uncompressed state (e.g., before the user puts on the shoes). In this configuration, no fluid, including a gas, like air, can escape the bladders or sections 188 regardless of the amount of pressure applied to the bladders or sections 188 by the user's foot 27. As the user begins to walk or run with the shoes on, control system 300 receives and stores measurements of the change in pressure of each zone from the pressure sensing system. During this period, fluid valves 210 are kept closed.

Next, control system 300 computes a threshold pressure for each zone based on the measured pressures for a given number of strides. In this embodiment, the system counts a predetermined number of strides, i.e., ten strides (by counting the number of pressure changes), but another system might simply store data for a given period of time (e.g., twenty seconds). The number of strides is preprogrammed into the microcomputer but might be inputted by the user in other embodiments. Control system 300 then examines the stored pressure data and calculates a threshold pressure for each zone. The calculated threshold pressure, in this embodiment, will be less than the average peak pressure measured and is in part determined by the ability of the associated bladder or section 188 to reduce the force of the impact as explained in more detail below.

After initialization, control system 300 will continue to monitor data from the pressure sensing system and compare the pressure data from each zone with the pressure threshold of that zone. When control system 300 detects a measured pressure that is greater than the pressure threshold for that zone, control system 300 opens the fluid valve 210 (in the manner as discussed above) associated with that pressure zone to allow fluid to escape from the bladder or section 188 into the fluid reservoir at a controlled rate. In this embodiment, air escapes from bladder or section 188 through fluid duct 206 (and fluid valve 210 disposed therein) into ambient air. The release of fluid from the bladder or section 188 allows the bladder or section 188 to deform and thereby lessens the "push back" of the bladder. The user experiences a "softening" or enhanced cushioning of the sole 28 of the shoe in that zone, which reduces the impact on the user's foot 27 in that zone.

The size of the opening of fluid valve 210 should be such as to allow fluid to escape the bladder or section 188 in a controlled manner. The fluid should not escape from bladder or section 188 so quickly that the bladder or section 188 becomes fully deflated (and can therefore supply no additional cushioning) before the peak of the pressure exerted by the user. However, the fluid must be allowed to escape from the bladder or section 188 at a high enough rate to provide the desired cushioning. Factors which will bear on the size of the opening of the flow regulator include the viscosity of the fluid, the size of the fluid bladder, the pressure exerted by fluid in the fluid reservoir, the peak pressure exerted, and the length of time such pressure is maintained.

As the user's foot 27 leaves the traveling surface, a fluid like air is forced back into the bladder or section 188 by a reduction in the internal air pressure of the bladder or section 188 (i.e., a vacuum is created) as the bladder or section 188 returns to its non-compressed size and shape. After control system 300 receives pressure data from the pressure sensing system indicating that no pressure (or minimal pressure) is being applied to the zones over a predetermined length of time (long enough to indicate that the shoe is not in contact with the ground 43 and that the bladders or sections 188 have returned to their non-compressed size and shape), control system 300 again closes all fluid valves 210 in preparation for the next impact of the user's foot 27 with the ground 43.

Pressure sensing circuitry 120 and control system 300 are mounted to the shoe and are powered by a conventional battery supply. As pressure sensing device 104 and the fluid system are generally located in the sole of the shoe, the described electrical connections are preferably embedded in the shoe upper 21 and the shoe sole 28.

The FIG. 11M embodiment can also be modified to omit the applicant's concavely rounded sides and can be combined with the various features of anyone or more of the other figures included in this application, as can the features of FIGS. 11N-11P. Pressure sensing devices 104 are also shown in FIG. 11M. A control system 300, such as a microprocessor as described above, forms part of the embodiment shown in FIG. 11M (and FIGS. 11N-11O), but does not appear in the frontal plane cross-section shown.

FIG. 11N shows the application of the FIG. 11M concept as described above and implemented in combination with a removable midsole insert 145. One significant advantage of this embodiment, besides improved lateral stability, is that the potentially most expensive component of the shoe sole, the removable insert, can be moved to other pairs of shoe upper 21/bottom soles 149, whether new or having a different style or function. Separate removable insoles can also be useful in this case, especially in changing from athletic shoes to dress shoes, for function and/or style.

FIG. 11N shows a simplified embodiment employing only two bladders or encapsulated sections 188, each of which extends from a concavely rounded side to the central portion. FIG. 11N is based on the right side of FIG. 13A.

The FIG. 11O embodiment is similar to the FIG. 11N embodiment, except that only one bladder or encapsulated section 188 is shown, separated centrally by a wall 189 containing a fluid valve communicating between the two separate chambers of the section or bladder 188. The angle of the separating central wall 189 provides a gradual transition from the pressure of the left chamber to the pressure of the right chamber but is not required. Other structures may be present within or outside the section or bladder 188 for support or other purposes, as is known in the art.

FIG. 11P is a perspective view of the applicant's invention, including the control system 300, such as a microprocessor and pressure-sensing circuitry 120, which can be located anywhere in the removable midsole insert 145 in order for the entire unit to be removable as a single piece. Placement in the shank proximate the main longitudinal arch of the wearer's foot 27 is shown in this figure, or alternatively, the removable midsole insert 145 may be located elsewhere in the shoe, potentially with a wired or wireless connection and potentially separate means of attachment. The heel bladder 188 shown in FIG. 11P is similar to that shown in FIG. 11O with both lateral and medial chambers. Like FIG. 11M, FIGS. 11N-11P operate in the manner known in the art as described above, except as otherwise shown or described herein by the applicant, with the applicant's depicted embodiments being preferred but not required.

The removable midsole insert 145 of the various embodiments shown in FIGS. 11A-11P can include its own integral upper or bootie, such as of elastic incorporating stretchable fabric, and its own outer sole for protection of the midsole and for traction so that the midsole insert 145 can be worn, preferably indoors, without the shoe upper 21 and outer sole 149. Such a removable midsole insert 145 can still be inserted into the FIG. 11C upper and sole as described above for outdoor or other rigorous use. An embodiment of a removable midsole insert 145 with an integral upper or bootie is described below.

As shown in FIGS. 11Q and 11R, the removable midsole insert 145 can include its own integral inner or secondary shoe upper 21*a*, such as a bootie or slipper incorporating stretchable fabric, i.e., elastic or Spandex™, non-stretchable fabric or both, with typical attachment means such as laces, straps, Velcro™ or zippers, or it can simply be a slip-on structure, like a slipper, loafer or pull-on boot.

FIGS. 11Q and 11R also show the removable midsole insert 145 with its own thin outer sole 149*a* made from rubber or other suitable, typical material for wear protection of the midsole and for traction so that the removable midsole insert 145 can be worn indoors, for example, without the shoe upper 21 and outer sole 149. However, it can also be inserted into, for example, the FIG. 11C shoe upper 21 and shoe sole 28 for heavier use, such as walking outdoors or engaging in athletics. Separate components or an entire outer sole 149 can also be affixed directly to the removable midsole insert 145 with a sufficiently durable secondary shoe upper 21*a* using conventional means for affixing it, such as the interface 8 interlocking geometrically with the upper surface of the bottom sole 166 or secondary bottom sole 149*a*, as shown in FIGS. 11E and 11F, in conjunction with straps, or with straps alone, roughly in the manner of sandals. Similarly, all or part of the shoe upper 21 can be affixed through conventional means to the secondary shoe upper 21*a*, independently of the bottom sole 149 or in combination with it.

FIGS. 11Q-11S show an embodiment of an inner shoe in accordance with the present invention. FIG. 11Q shows, in frontal plane cross-section, first, an embodiment with a very thin coat of traction material such as latex rubber forming a secondary bottom sole 149*a* providing traction to prevent slipping and protecting underneath portion of the removable midsole insert 145 from wear and, second, a lowtop slipper inner shoe upper 21 *a*. Such a latex rubber coat can be applied in a continuous manner over part or all of the outer surface of the secondary bottom sole 149*a* or it can be applied in a regular pattern, like dots or circles, as is typical to provide better grip for gloves, or can even be applied in a random pattern.

FIG. 11R shows, in frontal plane cross-section, another embodiment with a secondary bottom sole 149*a* of a rubber material that might be as thin as 1 millimeter, for example. The rubber material protects just that part of the removable midsole insert 145 which makes contact with the ground 43 when the intended wearer's foot is upright protecting the midsole part which would wear most quickly due to a high level of ground contact. Other suitable out sole material can be used. The secondary bottom sole 149*a* can extend part or all the way up either or both of the rounded shoe sole lateral and medial sides.

FIG. 11R also shows a lowtop slipper inner secondary shoe upper 21*a* which can envelop all or a portion of the midsole sides, including joining with the secondary bottom sole 149*a*, such as overlapping it on the inside between the removable midsole insert 145 and the secondary bottom sole 149*a*. FIG. 11Q shows the secondary shoe upper 21*a* connecting to the insole 2. The secondary shoe upper 21*a* can also envelop the insole.

FIG. 11S shows, in close-up cross-section, the interface surface 8 between the bottom sole 149 and the secondary bottom sole 149*a* of the removable midsole insert 145. Direct contact, as shown of the rubber or rubber-like materials or bottom sole 149 and secondary bottom sole 149*a*, provides an excellent means inside the shoe sole to prevent internal slipping due to shear forces at the interface 8, thereby increasing the stability of the shoe sole. Therefore, removal of typical materials other than those of bottom sole 149 and secondary bottom sole 149*a*, such as, for example, board last material, increases stability. This can be accomplished by outright removal of a board last after the upper to which it is attached has been assembled on a last or assembling without a lasting board. Alternatively, by using a board last with holes or sections removed, direct contact can occur at the bottom sole 149 and secondary bottom sole 149*a*. Such holes or sections can be random or regular, including simply a very loose weave fabric, or can coincide with some or all of the essential support and propulsion elements of the foot 27 described earlier, such as the pattern shown in FIG. 70.

In an advantageous embodiment, most or all of a stability enhancing portion of the removable midsole 145, such as special shaping or increased density inserts, is located in the upper portion of the removable midsole insert 145 where it is accessible through the opening of the secondary shoe upper 21*a* for alteration so that it can be modified to better compensate for instability based on testing and usage of the intended wearer.

In another advantageous embodiment, only this uppermost portion is the removable midsole insert 145 while the lower portion of the midsole is fixed in a conventional manner in the shoe sole 28. Such an embodiment can still be constructed using the embodiments described above, including FIGS. 11A-11S, especially including FIGS. 11Q-11R, and the compartments with computer control mechanisms, particularly as shown in FIG. 11P. The uppermost removable midsole insert 145 might include the relatively expensive computer microprocessor and associated memory, for example, which might communicate with the remaining portions of the compartment pressure controlling system using a wireless communication system.

The embodiments shown in FIGS. 11M-11S can also include the capability to function sufficiently rapidly to sense an unstable shoe sole condition such as, for example, that initiating a slip, trip or fall and to react to promote a stable or more stable shoe sole condition to attempt to prevent a fall or at least attempt to reduce associated injuries, for example, by rapidly reducing high point pressure in one zone of the shoe sole so that pressures in all zones are quickly equalized to restore the stability of the shoe sole.

The removable midsole insert 145, for example as shown in FIGS. 11A-11S, can also be used in combination with, or to implement, one or more features of any of the applicant's prior inventions shown in the other figures in this application. Such use can also include a combination of features shown in any other figures of the present application. For example, the removable midsole insert 145 of the present invention may replace all or any portion or portions of the various midsoles, insoles, and bottom soles which are shown in the figures of the present application and may be combined with the various other features described in reference to any of these figures in any of these forms.

The removable midsole insert 145 shown in FIGS. 11A-11S can be integrated into or may replace any conventional midsole, insert or portion thereof. If the removable midsole is used to replace a conventional mass-market or "over the counter" shoe sole insert, for example, then any of the features of the conventional insert can be provided by an equivalent feature, including structural support or cushioning or otherwise, in the removable midsole insert 145.

In summary, the FIG. 11A-11S relate generally to the provision of a removable midsole insert for a shoe sole which is formed at least in part by midsole material and may be removable from the shoe. The removable midsole insert can be used in combination with or to replace anyone or more features of the applicant's prior inventions as shown in the figures of this application. Such use of the removable midsole insert can also include a combination of features shown in any other figures of the present application. For example, the removable midsole insert of the present invention may replace all or any portion or portions of the various midsoles, insoles, and bottom soles which are shown in the figures of the present application and may be combined with or used to implement one or more of the various other features described in reference to any of these figures in any of these forms.

Figure 12A:
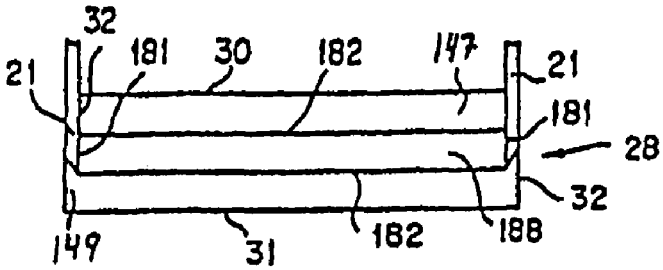
FIGS. 12A-12C show a series of conventional shoe sole cross-sections in the frontal plane at the heel utilizing both sagittal plane and horizontal plane sipes, and in which some or all of the sipes do not originate from any outer shoe sole surface, but rather are entirely internal
Figure 12B:
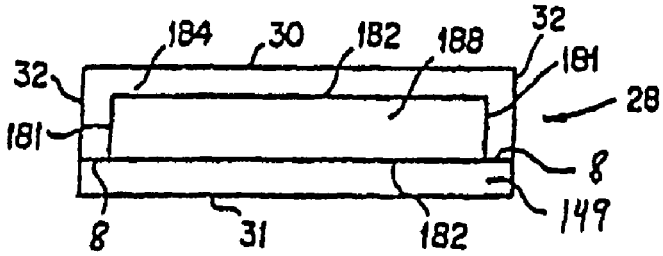
Figure 12C:
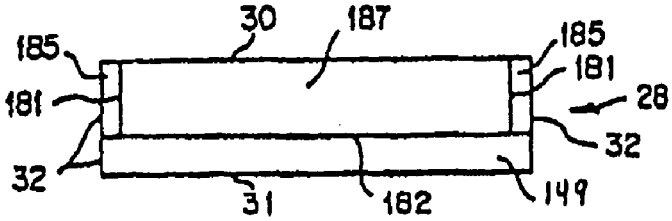

FIGS. 12A-C show a series of conventional shoe sole cross-sections in the frontal plane at the heel utilizing both sagittal plane sipes 181 and horizontal plane sipes 182, and in which some or all of the sipes do not originate from any outer shoe sole surface 31, but rather are entirely internal. Relative motion between internal surfaces is, thereby, made possible to facilitate the natural deformation of the shoe sole 28.

FIG. 12A shows a group of three midsole sections or lamination layers. Preferably, the central section 188 is not glued to the other surfaces in contact with it. Instead, those surfaces are internal deformation sipes in the sagittal plane 181 and in the horizontal plane 182, which encapsulate the central section 188, either completely or partially. The relative motion between midsole section layers at the deformation sipes 181 and 182 can be enhanced with lubricating agents, either wet like silicone or dry like Teflon™, of any degree of viscosity. Shoe sole materials can be closed cell if necessary to contain the lubricating agent or a non-porous surface coating or layer of lubricant can be applied. The deformation sipes 181, 182 can be enlarged to channels or any other practical geometric shape as sipes defined in the broadest possible terms.

The use of roughened surfaces or other conventional methods of increasing the coefficient of friction between midsole section layers can diminish the relative motion. If even greater control of the relative motion of the central layer 188 is desired, as few as one or many more points can be glued together anywhere on the internal deformation sipes 181 and 182, making them discontinuous, and the glue can be any degree of elastic or inelastic.

In FIG. 12A, the outside structure of the sagittal plane deformation sipes 181 is the shoe upper 21, which is typically flexible and relatively elastic fabric or leather. In the absence of any connective outer material like the shoe upper 21 shown in FIG. 12A, just the outer edges of the horizontal plane deformation sipes 182 can be glued together.

FIG. 12B shows another conventional shoe sole in frontal plane cross-section at the heel with a combination similar to FIG. 12A of both horizontal and sagittal plane deformation sipes 181, 182 that encapsulate a central section 188. Like FIG. 12A, the FIG. 12B structure allows the relative motion of the central section 188 with its encapsulating midsole section 184, which encompasses its sides as well as the top surface, and bottom sole 149, both of which are attached at the interface 8.

This FIG. 12B approach is analogous to the applicant's fully rounded shoe sole 28 invention with an encapsulated midsole compartment 161 of a pressure-transmitting medium like gas, gel or liquid and which is preferably silicone. In this conventional shoe sole case, however, the pressure-transmitting medium is a more conventional section of a typical shoe cushioning material like PV or EVA, which also provides cushioning.

FIG. 12C is another conventional shoe sole shown in frontal plane cross-section at the heel with a combination similar to FIGS. 12A and 12B of both horizontal and sagittal plane deformation sipes 181, 182. However, instead of encapsulating a central section 188, in FIG. 12C an upper midsole section 187 is partially encapsulated by an encapsulating midsole section 184 and surrounded by deformation sipes 181, 182 so that it acts much like the central section 188, but is more stable and more closely analogous to the actual structure of the human foot 27.

The upper midsole section 187 would be analogous to the integrated mass of fatty pads, which are U shaped and attached to the calcaneus 159 or heel bone. Similarly, the shape of the deformation sipes 181, 182 is U-shaped in FIG. 12C and the upper section 187 is attached to the heel by the shoe upper 21, so it should function in a similar fashion to the aggregate action of the fatty pads. The major benefit of the FIG. 12C invention is that the approach is so much simpler and therefore easier and faster to implement than the highly complicated anthropomorphic design shown in FIG. 10A-C above. The midsole sides 185 shown in FIG. 12C are like the side portion of the encapsulating midsole section 184 in FIG. 12B.

Figure 12D:
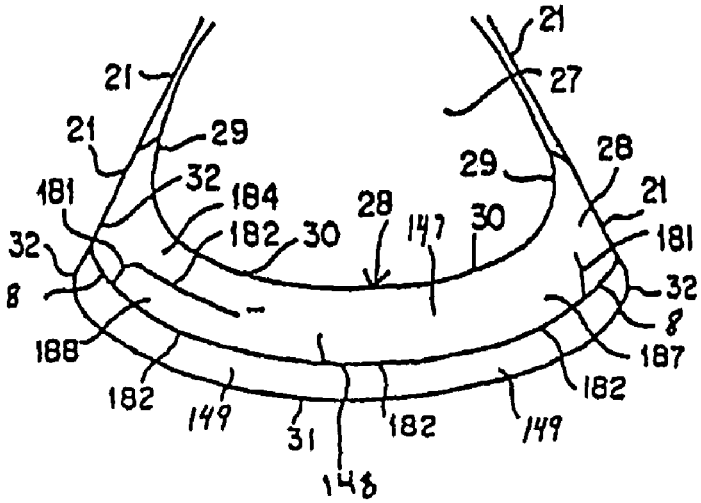
FIG. 12D shows a similar approach as is shown in FIGS. 12A-12C applied to the fully rounded design.

FIG. 12D shows, in a frontal plane cross-section at the heel, a similar approach applied to the applicant's fully rounded design. FIG. 12D shows a design including two different embodiments of a partially encapsulated central section 188 and a variation of the attachment for attaching the shoe upper 21 to the bottom sole 149. The left side of FIG. 12D shows a variation of the encapsulation of a central section 188 shown in FIG. 12B, but the encapsulation is only partial, with a center upper section of the central section 188 either attached to or continuous with the encapsulating midsole section 184. The right side of FIG. 12D shows a structure of deformation sipes 181, 182 like that of FIG. 12C, with the upper midsole section 187 provided with the capability of moving relative to both the bottom sole 149 and the side of the midsole 148. The FIG. 12D structure varies from that of FIG. 12C also in that the deformation sipe 181 in roughly the sagittal plane is partial only and does not extend to the inner surface 30 of the midsole 148, as it does FIG. 12C.

Figure 13A:
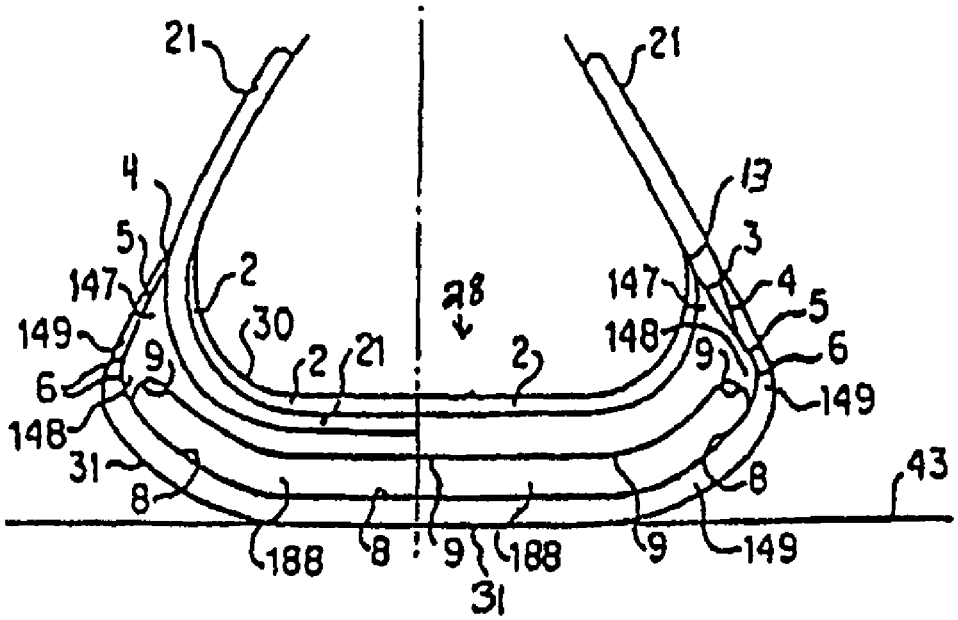
FIGS. 13A-13B show, in frontal plane cross-section at the heel area, shoe sole structures similar to those shown in FIGS. 5A-B, but in more detail and with the bottom sole extending relatively farther up the side of the midsole.
Figure 13B:
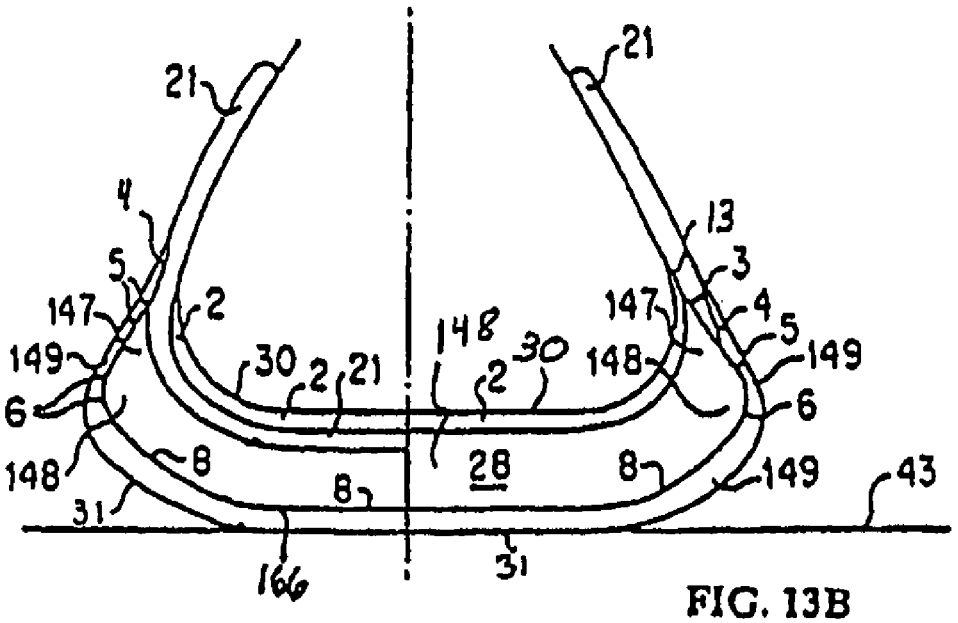

FIGS. 13A and 13B show, in frontal plane cross-section at the heel area, shoe sole structures like FIGS. 5A and B, but in more detail and with the bottom sole 149 extending relatively farther up the side of the midsole 148.

The right side of FIGS. 13A and 13B show the preferred embodiment, which is a relatively thin and tapering portion of the bottom sole 149 extending up most of the midsole 148 and is attached to the midsole and to the shoe upper 21, which is also attached preferably first to the upper midsole 147 where both meet at the attachment point of upper midsole and shoe upper 3 and attached to the bottom sole where both meet at the attachment point of bottom sole and shoe upper 4. The bottom sole 149 is also attached to the upper midsole 147 where they join at the attachment point of bottom sale and upper midsole 5 and to the midsole 148 at the attachment point of bottom sole and lower midsole 6.

The left side of FIGS. 13A and 13B shows a more conventional attachment arrangement where the shoe sale 28 is attached to a fully lasted shoe upper 21. The bottom sale 149 is attached to the midsole 148 where their surfaces coincide at the attachment point of bottom sole and lower midsole 6, the upper midsole 147 at the attachment point of bottom sale and upper midsole 5, and the shoe upper 21 at the attachment point of bottom sole and shoe upper 4.

FIG. 13A shows a shoe sole with another variation of an encapsulated midsole section 188. The encapsulated midsole section 188 is shown bounded by the bottom sole 149 at line 8 and by the rest of the midsole 147 and 148 at line 9. FIG. 13A shows more detail than prior figures, including an insole 2 (also called a sock liner), which is rounded to the shape of the wearer's foot sole, just like the rest of the shoe sole 28. In this manner, the foot sole is supported throughout its entire range of sideways motion, from maximum supination to maximum pronation.

The insole 2 overlaps the shoe upper 21 at interface 13. This approach ensures that the load-bearing surface of the wearer's foot sole does not come in contact with any seams, which could cause abrasions. Although only the heel section is shown in this figure, the same insole structure would preferably be used elsewhere, particularly the forefoot. Preferably, the insole 2 would coincide with the entire load-bearing surface of the wearer's foot sole, including the front surface of the toes, to provide support for front-to-back motion as well as sideways motion.

The FIG. 13 design provides firm flexibility by encapsulating fully or partially, roughly the central section 188 of the relatively thick heel of the shoe sole 28 or other areas of the sole, such as any or all of the essential support elements of the foot including the lateral tuberosity of the calcaneus 108; base of the calcaneus 109; base of the fifth metatarsal 97; the heads of the metatarsals 92, 94; and the first distal phalange 98. The outer surfaces of that encapsulated section or sections 188 are allowed to move relatively freely by not gluing the encapsulated midsole section 188 to the surrounding shoe sole 28.

Firmness in the FIG. 13 design is provided by the high pressure created under multiples of body weight loads during locomotion within the encapsulated section or sections 188, making it relatively hard under extreme pressure, roughly like the heel of the foot 27. Unlike conventional shoe soles 22, which are relatively inflexible and thereby create local point pressures, particularly at the bottom outside edge of the shoe sole 23, the FIG. 13 design tends to distribute pressure evenly throughout the encapsulated section 188, so that the natural biomechanics of the wearer's foot sole are maintained and shearing forces are more effectively dealt with.

In the FIG. 13A design, firm flexibility is provided by encapsulating roughly the middle section of the relatively thick heel of the shoe sole 28 or other areas of the sole 28, while allowing the outer surfaces of that section to move relatively freely by not conventionally gluing the encapsulated section 188 to the surrounding shoe sole 28. Firmness is provided by the high pressure created under body weight loads within the encapsulated section 188, making it relatively hard under extreme pressure, roughly like the heel of the foot 27, because it is surrounded by flexible but relatively inelastic materials, particularly the bottom sole 149, and connecting to the shoe upper 21, which also can be constructed by flexible and relatively inelastic material. The same U-shaped structure is, thus, formed on a macro level by the shoe sole 28 that is constructed on a micro level in the human foot sole, as described definitively by Erich Blechschmidt in Foot and Ankle, March, 1982.

In summary, the FIG. 13A design shows a shoe sole construction for a shoe, comprising a shoe sole 28 with at least one compartment defined by interfaces 8, 9 under the structural elements of the human foot 27; the compartment containing a pressure-transmitting medium composed of an central section 188 of midsole material that is not firmly attached to the shoe sole 28 surrounding it; and pressure from normal load-bearing that is transmitted progressively at least in part to the relatively inelastic sides, top, and bottom of said shoe sole compartment producing tension. The FIG. 13A design can be combined with the designs shown in FIGS. 58-60 so that the compartment is surrounded by a reinforcing layer of relatively flexible and inelastic fiber.

FIGS. 13A and 13B show constant shoe sole thickness in frontal plane cross-sections, but that thickness can vary somewhat (up to roughly 25% in some cases). FIG. 13B shows a design just like FIG. 13A except that the encapsulated section is reduced to only the load-bearing boundary layer between the midsole 148 and the bottom sole 149. In simple terms, then, most or all of the upper surface of the bottom sole 166 and the lower surface of the midsole 148 are not attached, or at least not firmly attached, where they coincide at interface 8. The bottom sole and the midsole are firmly attached only along the non-load-bearing sides of the midsole 148. This approach is simple and easy. The load-bearing boundary layer at interface 8 is like the internal horizontal sipe 182 described in FIG. 12 above. The sipe at interface 8 can be a channel filled with flexible material or it can simply be a thinner chamber.

The boundary area at interface 8 can be unglued, so that relative motion between the two surfaces is controlled only by their structural attachment together at the sides. In addition, the boundary area can be lubricated to facilitate relative motion between surfaces or lubricated by a viscous liquid that restricts motion or the boundary area at interface 8 can be glued with semi-elastic or semi-adhesive glue that controls relative motion but still permits some motion. The semi-elastic or semi-adhesive glue would then serve a shock absorption function as well.

In summary, the FIG. 13B design shows a shoe construction for a shoe including a shoe upper 21 and a shoe sole 28 that has a bottom portion with sides that are relatively flexible and inelastic. This design also includes at least a portion of the bottom sole sides that is firmly attached directly to the shoe upper 21 and a shoe upper 21 that is composed of material that is flexible and relatively inelastic, at least where the shoe upper 21 is attached to the bottom sole 149. The attached portions envelop the other sole portions of the shoe sole 28; and the shoe sole 28 has at least one horizontal boundary area at interface 8 serving as a sipe that is contained internally within the shoe sole 28. The FIG. 13B design can be combined with FIGS. 58-60 to include a shoe sole bottom portion composed of material reinforced with at least one fiber layer that is relatively flexible and inelastic and that is oriented in the horizontal plane.

Figure 14:
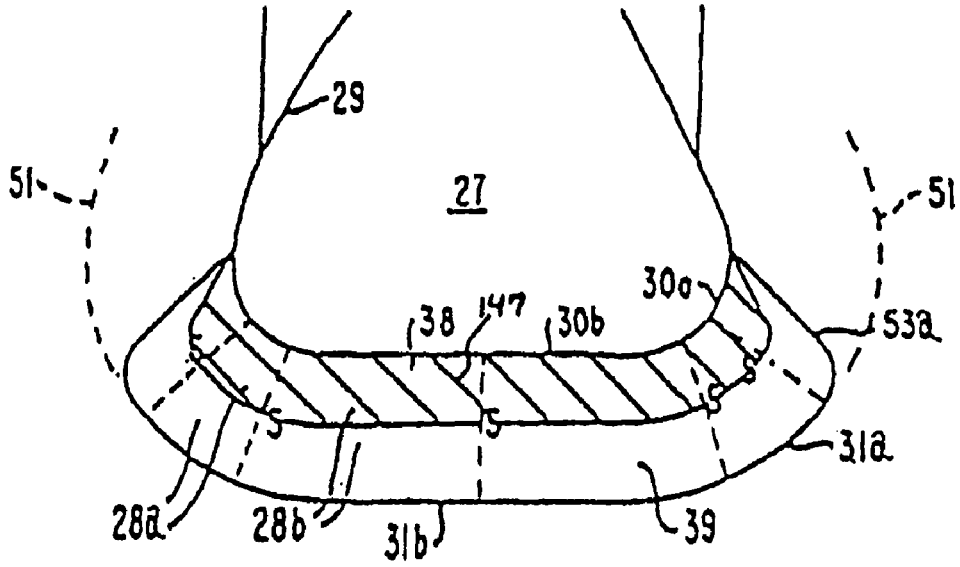
FIG. 14 shows, in frontal plane cross-section at the heel portion of a shoe, a shoe sole with naturally rounded sides based on a theoretically ideal stability plane.
Figure 15:
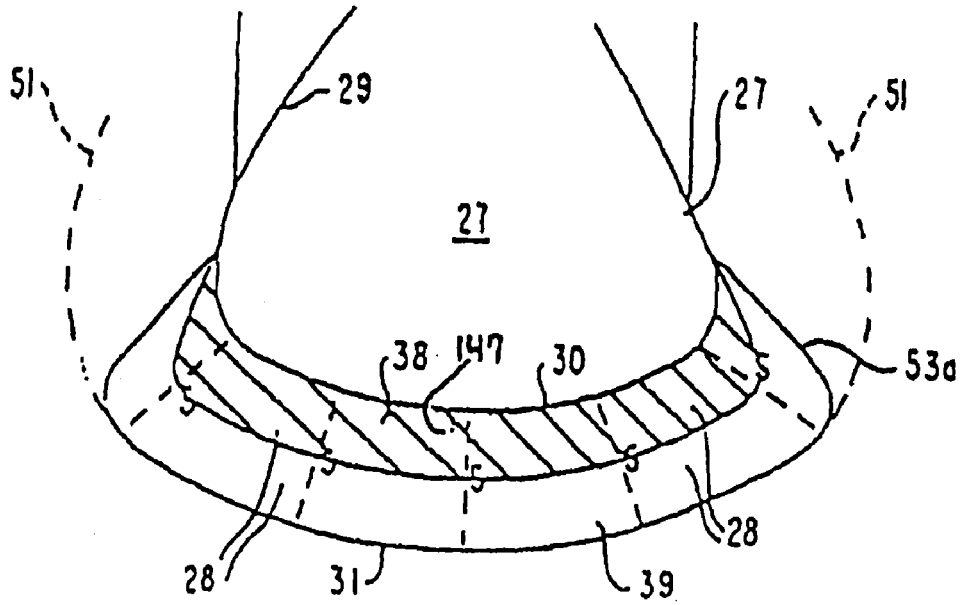
FIG. 15 shows, in frontal plane cross-section, the most general case of a fully rounded shoe sole that follows the natural contour of the bottom of the foot as well as its sides, also as based on the theoretically ideal stability plane.
Figure 16A:
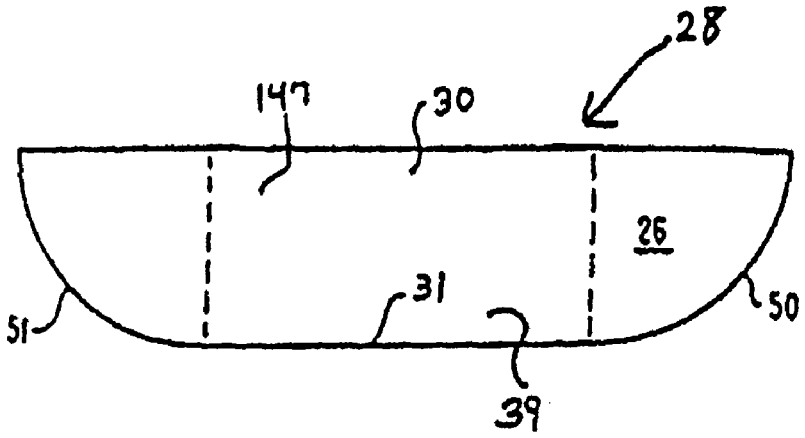
FIGS. 16A-16C show, in frontal plane cross-section at the heel, a quadrant-sided shoe sole, based on a theoretically ideal stability plane.
Figure 16B:
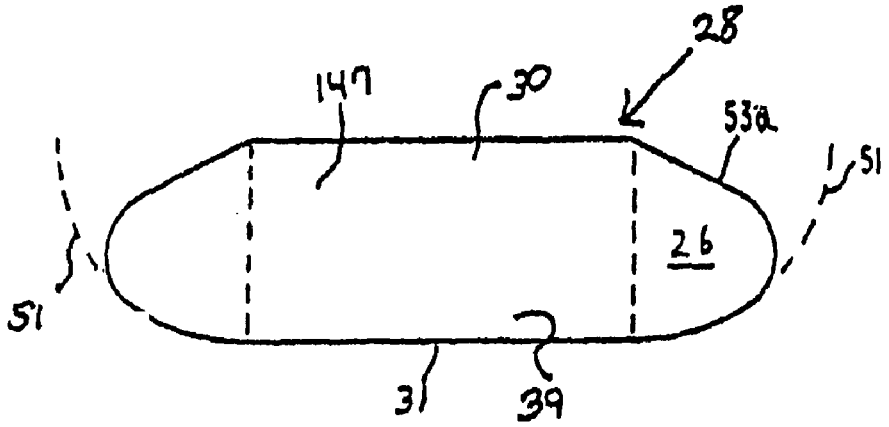
Figure 16C:
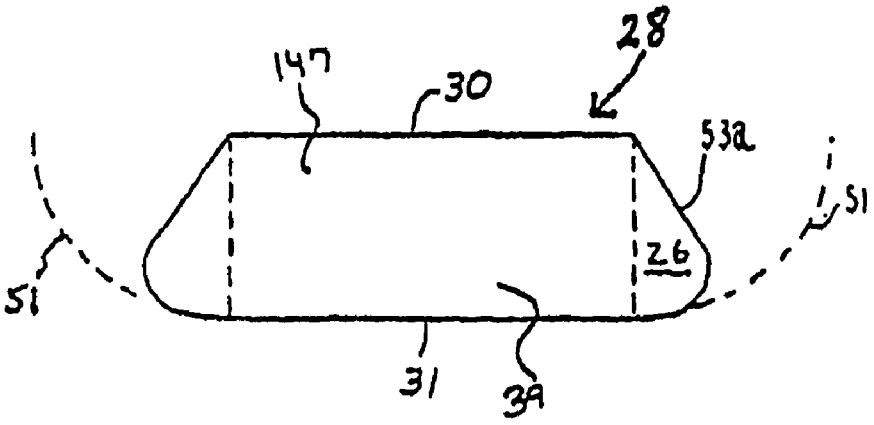
Figure 17:
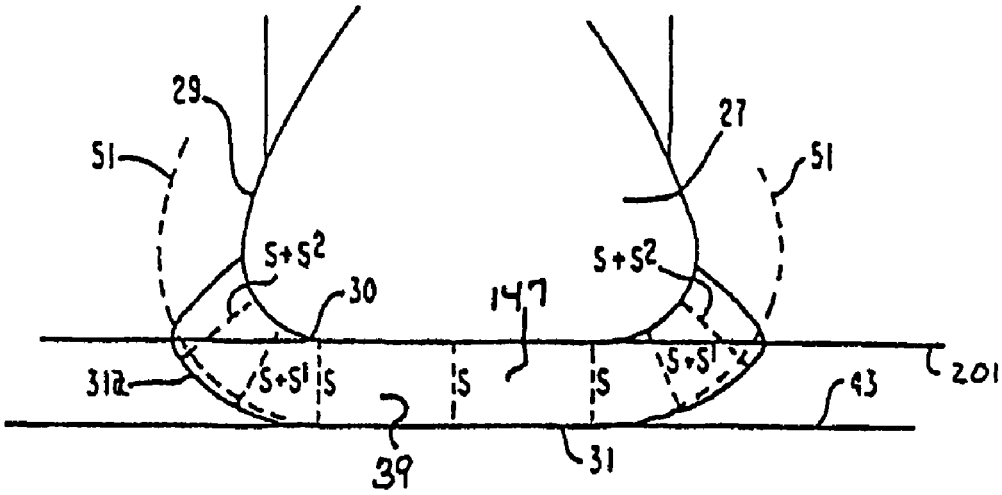
FIG. 17 shows a frontal plane cross-section at the heel portion of a shoe with naturally rounded sides like those of FIG. 14, wherein a portion of the shoe sole thickness is increased beyond the theoretically ideal stability plane.

FIGS. 14, 15, and 16 show frontal plane cross-sectional views taken at about the ankle joint of sole 28 according to the applicant's prior inventions based on the theoretically ideal stability plane to show the heel section of the shoe. FIGS. 17 through 26 show the same view of the applicant's enhancement of that invention. In the figures, a foot 27 is positioned in a naturally rounded shoe having an upper 21 and a rounded shoe sole 28. The shoe sole 28 normally contacts the ground 43 at about the lower central heel portion thereof, as shown in FIG. 17. The concept of the theoretically ideal stability plane defines the plane 51 in terms of a locus of points determined by the thickness (s) of the shoe sole 28.

FIG. 14 shows, in a rear cross-sectional view, the inner surface of the shoe sole 30 conforming to the natural rounded shape of the foot 27 and the thickness (s) of the shoe sole 28 remaining constant in the frontal plane, so that the outer surface of the shoe sole 31 coincides with the theoretically ideal stability plane.

FIG. 15 shows a fully rounded shoe sole design that follows the natural rounded shape of the bottom as well as the sides of the foot 27, while retaining a constant shoe sole thickness (s) in the frontal plane. The fully rounded shoe sole 28 assumes that the resulting slightly rounded bottom when unloaded will deform under load and flatten just as the human foot bottom is slightly rounded unloaded but flattens under load. Therefore, the shoe sole material must be of such composition as to allow the natural deformation following that of the foot 27. The design applies to the heel and to the rest of the shoe sole 28 as well. By providing the closest match to the natural shape of the foot 27, the fully rounded design allows the foot 27 to function as naturally as possible. Under load, the design of FIG. 15 would deform by flattening to look essentially like the design shown in FIG. 14. Seen in this light, the naturally rounded side design in FIG. 14 is a more conservative design that is a special case of the more general fully rounded design in FIG. 15, which is the closest to the natural form of the foot 27. The amount of deformation flattening used in the FIG. 14 design, which obviously varies under different loads, is not an essential element of the applicant's invention.

FIGS. 14 and 15 both show in frontal plane cross-sections the theoretically ideal stability plane which is also theoretically ideal for efficient natural motion of all kinds, including running, jogging or walking. FIG. 15 shows the most general case, the fully rounded design that conforms to the natural shape of the unloaded foot 27. For any given individual, the theoretically ideal stability plane 51 is determined, first, by the desired shoe sole thickness (s) in a frontal plane cross-section, and, second, by the natural shape of the individual's outer foot surface 29.

For the special case shown in FIG. 14, the theoretically ideal stability plane for any particular individual (or size average of individuals) is determined, first, by the given frontal plane cross-section shoe sole thickness (s); second, by the natural shape of the individuals foot 27; and, third, by the frontal plane cross section width of the individual's load-bearing footprint, which is defined as the inner surface of the shoe sole 30 that is in physical contact with and supports the human foot sole.

The theoretically ideal stability plane for the special case is composed conceptually of two parts. Shown in FIG. 14, the first part is a outer surface portion 31*b* of equal length and parallel to inner surface portion 30*b* at a constant distance equal to shoe sole thickness (s). This corresponds to a conventional shoe sole 22 directly underneath the human foot 27, and also corresponds to the flattened portion of the bottom of the load-bearing shoe sole 28*b*. The second part is the naturally rounded stability side outer edge 31*a* located at each side of the outer surface portion 31*b*. Each point on the rounded side outer edge 31*a* is located at a distance, which is exactly the shoe sole thickness (s) from the closest point on the rounded side inner edge 30*a*.

In summary, the theoretically ideal stability plane is used to determine a geometrically precise lower surface rounding of the shoe sole 28 based on an upper surface rounding that conforms to the contour of the foot 27.

It can be stated unequivocally that any shoe sole contour even having a similar shape that exceeds the theoretically ideal stability plane will restrict natural foot motion, while any rounding less than that plane will degrade natural stability in direct proportion to the amount of the deviation. The theoretical ideal was taken to be that which is closest to natural.

FIG. 16 illustrates in frontal plane cross-section another variation of a shoe sole 28 that uses stabilizing quadrants 26 at the outer edge of a shoe sole 28. The stabilizing quadrants 26 would be abbreviated as viewed in a horizontal plane in actual embodiments.

FIG. 17 illustrates the shoe sole side thickness increasing beyond the theoretically ideal stability plane to increase stability somewhat beyond its natural level. The unavoidable trade-off which results is that natural motion would be restricted somewhat and the weight of the shoe sole 28 would increase somewhat.

FIG. 17 shows a situation wherein the thickness of the combined midsole and bottomsole 39 at each of the opposed sides is thicker at the outer edge of the sides 31 *a* by a thickness which gradually varies continuously from a thickness (s) through a thickness (S+S1) to a thickness (S+S2). These designs recognize that lifetime use of existing shoes, the design of which has an inherent problem that continually disrupts natural human biomechanics, has produced, thereby, actual structural changes in a human foot 27 and ankle to an extent that must be compensated for. Specifically, one of the most common of the abnormal effects of the inherent existing problem is a weakening of the long arch of the foot 27, increasing pronation. These designs, therefore, provide greater than natural stability and should be particularly useful to individuals, generally with low arches, prone to pronate excessively, and could be used only on the medial side. Similarly, individuals with high arches and a tendency to over supinate and who are vulnerable to lateral ankle sprains would also benefit, and the design could be used only on the lateral side. A shoe for the general population that compensates for both weaknesses in the same shoe would incorporate the enhanced stability of the design compensation on both sides. FIG. 17, like FIGS. 14 and 15, shows an embodiment which allows the shoe sole 28 to deform naturally, closely paralleling the natural deformation of the bare foot 27 under load. In addition, shoe sole material must be of such composition as to allow natural deformation similar to that of the foot 27.

This design retains the concept of contouring the shape of the shoe sole 28 to the shape of the human foot 27. The difference is that the shoe sole thickness in the frontal plane is allowed to vary rather than remain uniformly constant. More specifically, FIGS. 17, 18, 19, 20, and 24 show, in frontal plane cross-sections at the heel, that the shoe sole thickness can increase beyond the theoretically ideal stability plane 51, in order to provide greater than natural stability. Such variations (and the following variations) can be consistent through all frontal plane cross-sections, so that there are proportionately equal increases to the theoretically ideal stability plane 51 from the front of the shoe sole 28 to the back. Alternatively, the thickness can vary, preferably continuously, from one frontal plane to the next.

The exact amount of the increase in shoe sole thickness beyond the theoretically ideal stability plane is to be determined empirically. Ideally, right and left shoe soles could be for each individual based on a biomechanical analysis of the extent of his or her foot and ankle dysfunction in order to provide an optimal individual correction. If epidemiological studies indicate general corrective patterns for specific categories of individuals or the population as a whole, then mass-produced shoes with soles incorporating rounded sides having a thickness exceeding the theoretically ideal stability plane would be possible. It is expected that any such mass-produced shoes for the general population would have thicknesses exceeding the theoretically ideal stability plane by an amount up to 5 or 10 percent, while more specific groups or individuals with more severe dysfunction could have an empirically demonstrated need for greater thicknesses on the order of up to 25 percent more than the theoretically ideal stability plane. The optimal rounded sides for the increased thickness may also be determined empirically.

Figure 18:
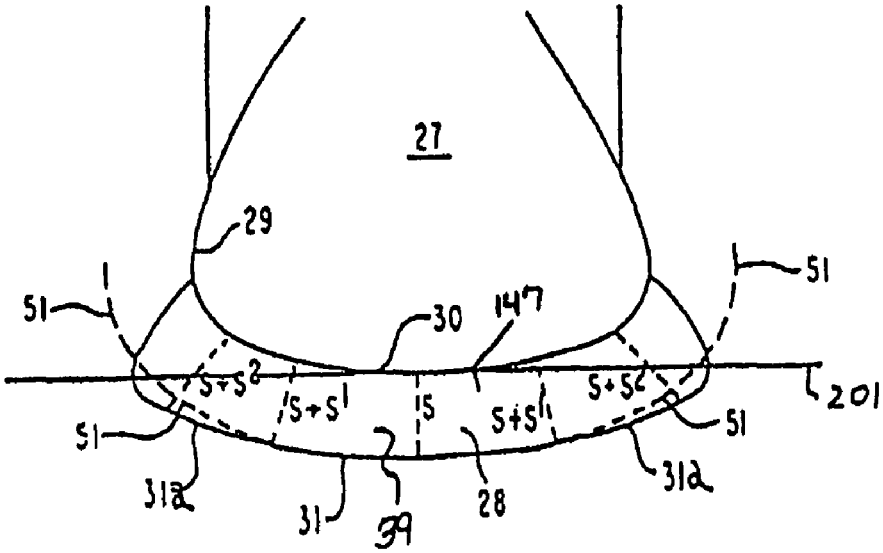
FIG. 18 is a view similar to FIG. 17, but of a shoe with fully rounded sides wherein the sole thickness increases with increasing distance from the center line of the ground-contacting portion of the sole.

FIG. 18 shows a variation of the enhanced fully rounded design wherein the shoe sole 28 begins to thicken beyond the theoretically ideal stability plane 51 that is somewhat offset to the sides.

Figure 19:
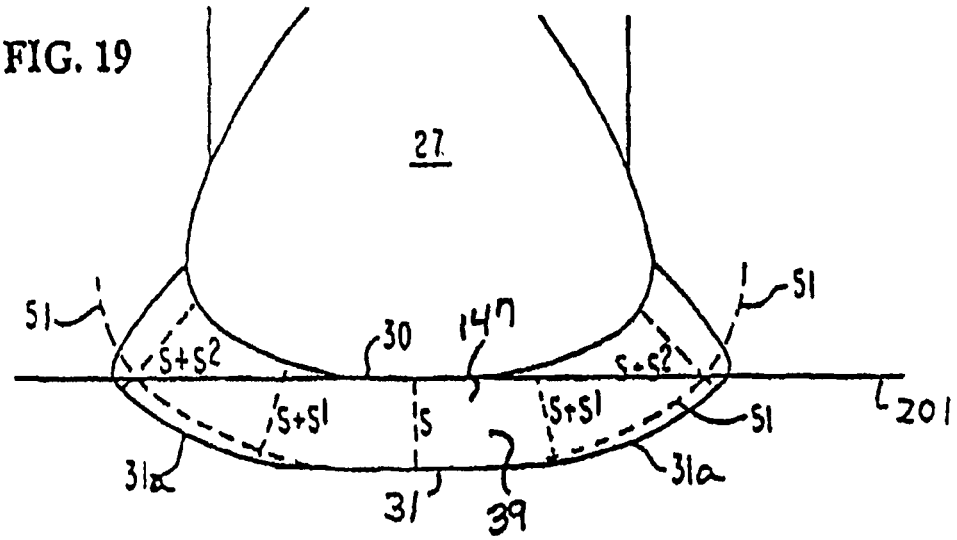
FIG. 19 is a view similar to FIG. 18 where the fully rounded sole thickness variations are continually increasing on each side.

FIG. 19 shows a thickness variation which is symmetrical as in the case of FIGS. 17 and 18, but wherein the shoe sole begins to thicken beyond the theoretically ideal stability plane 51 directly underneath the foot heel 27 on about a center line of the shoe sole. In fact, in this case the thickness of the shoe sole is the same as the theoretically ideal stability plane only at that beginning point underneath the upright foot. For the embodiment wherein the shoe sole thickness varies, the theoretically ideal stability plane is determined by the least thickness in the shoe sole's direct load-bearing portion meaning that portion with direct tread contact on the ground. The outer edge or periphery of the shoe sole is obviously excluded, since the thickness there always decreases to zero. Note that the capability of the design to deform naturally may make some portions of the shoe sole load-bearing when they are actually under a load, especially walking or running, even though they may not be when the shoe sole is not under a load.

Figure 20:
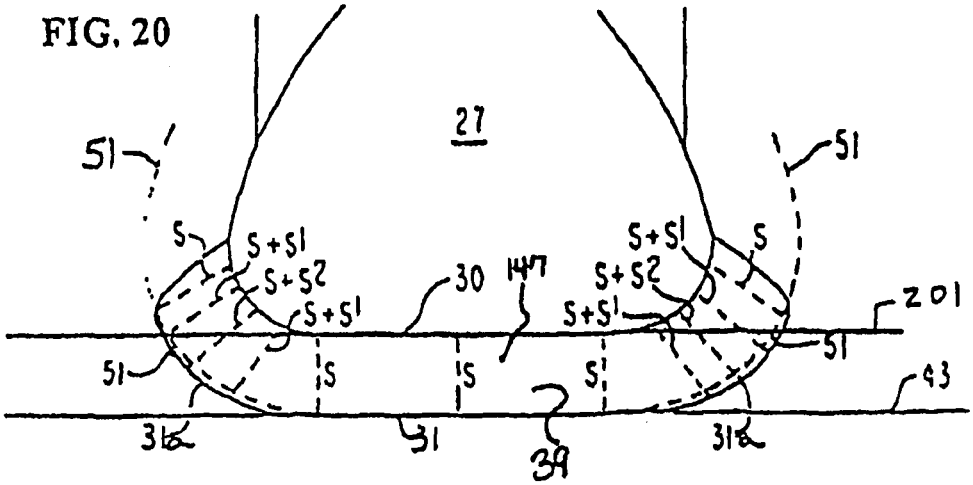
FIG. 20 is a view similar to FIGS. 17-19 wherein the sole thickness varies in diverse sequences.

FIG. 20 shows that the thickness can also increase and then decrease. Other thickness variation sequences are also possible. The variation in rounded side thickness can be either symmetrical on both sides or asymmetrical, particularly with the medial side being thicker to provide more stability than the lateral side, although many other asymmetrical variations are possible. Also, the pattern of the right foot can vary from that of the left foot.

FIGS. 21, 22, 23, and 25 show that similar variations in the density of the shoe midsole 148 (other portions of the shoe sole area not shown) can provide similar, but reduced, effects to the variations in shoe sole thickness described previously in FIGS. 17-20. The major advantage of this approach is that the structural theoretically ideal stability plane is retained, so that naturally optimal stability and efficient motion are retained to the maximum extent possible.

Figure 21:
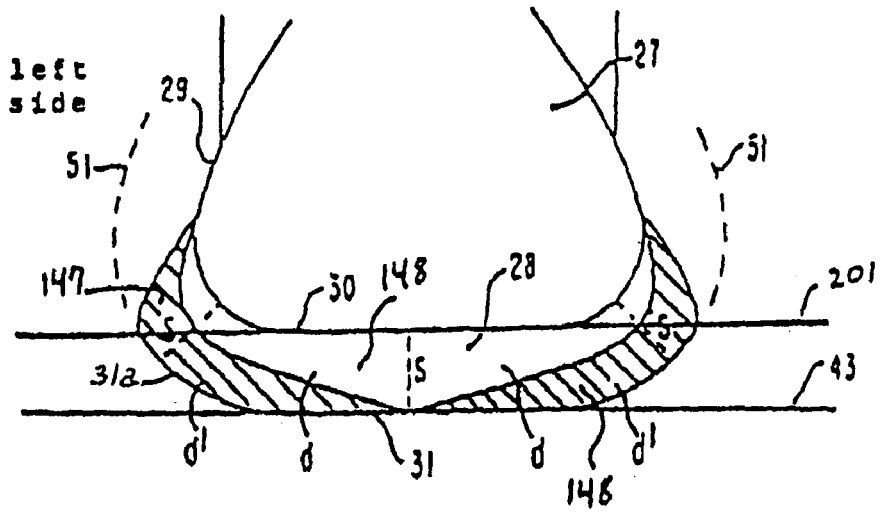
FIG. 21 is a frontal plane cross-section showing a density variation in the midsole.
Figure 22:
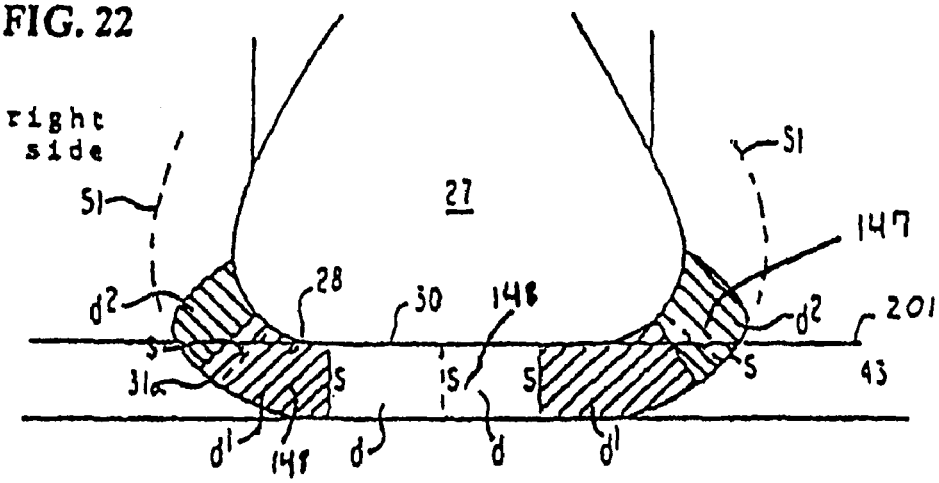
FIG. 22 is a view similar to FIG. 21 wherein the firmest density material is at the outermost edge of the midsole.

The forms of dual and tri-density midsoles 148 shown in the figures are extremely common in the current art of athletic shoes 20, and any number of densities are theoretically possible, although an angled alternation of just two densities like that shown in FIG. 21 provides continually changing composite density. However, multi-densities in the midsole 148 are not preferred since only a uniform density provides a neutral shoe sole design that does not interfere with natural foot and ankle biomechanics in the way that multi-density shoe soles do by providing different amounts of support to different parts of the foot 27. In these figures, the density of the sole material designated by the legend ($d^1$) is firmer than (d), while ($d^2$) is the firmest of the three representative densities shown. In FIG. 21, a dual density sole is shown, with (d) being the less firm density. Shoe soles using a combination both of sole thicknesses greater than the theoretically ideal stability plane and of midsole density variations like those just described are also possible.

Figure 23:
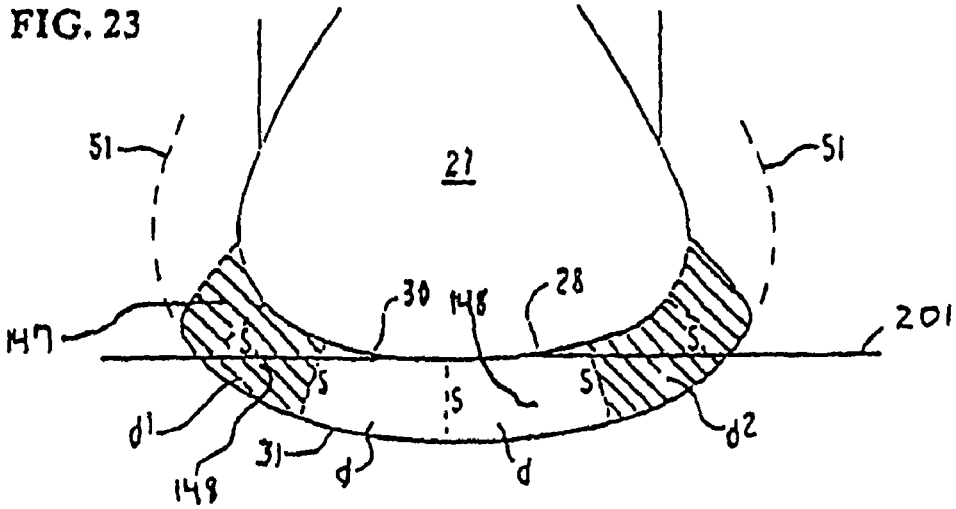
FIG. 23 is a view similar to FIGS. 21 and 22 showing still another density variation that is asymmetrical.
Figure 24:
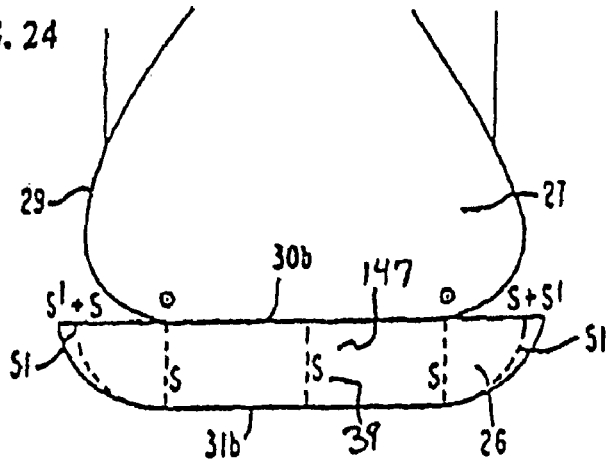
FIG. 24 shows a variation in the thickness of the sole for the quadrant-sided shoe sole embodiment of FIGS. 16A-16C that is greater than a theoretically ideal stability plane.
Figure 25:
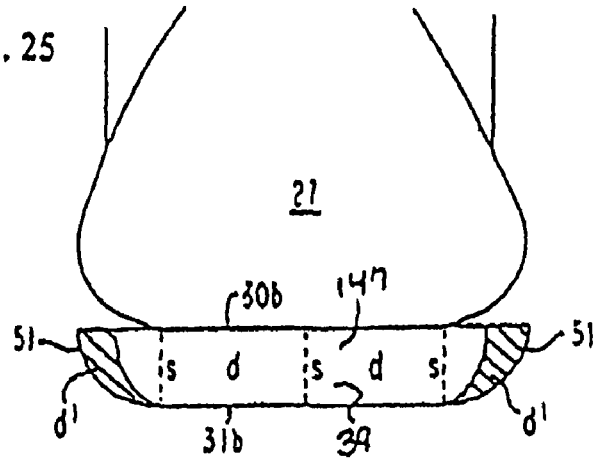
FIG. 25 shows a quadrant-sided embodiment as in FIG. 24 wherein the density of the sole varies.
Figure 26:
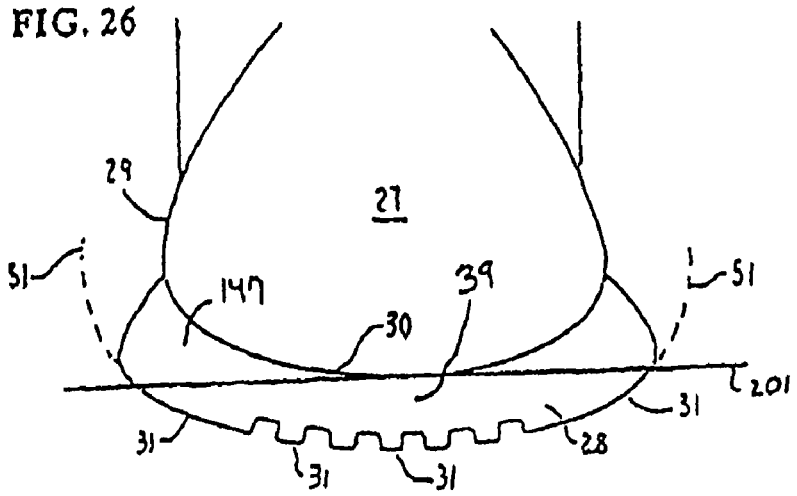
FIG. 26 shows a bottom sole tread design that provides a similar density variation to that shown in FIG. 23.

FIG. 26 shows a bottom sole tread design that provides about the same overall shoe sole density variation as that provided in FIG. 23 by midsole density variation. The less supporting tread there is under any particular portion of the shoe sole 28, the less effective overall shoe sole density there is since the midsole above that portion will deform more easily than if it were fully supported.

FIG. 27 shows embodiments like those in FIGS. 17 through 26 but wherein a portion of the shoe sole thickness is decreased to less than the theoretically ideal stability plane 51. It is anticipated that some individuals with foot and ankle biomechanics that have been degraded by existing shoes may benefit from such embodiments which would provide less than natural stability but greater freedom of motion and less shoe sole weight and bulk. In particular, it is anticipated that individuals with overly rigid feet, those with restricted range of motion, and those tending to over-supinate may benefit from the FIG. 14 embodiments. Even more particularly, it is expected that the invention will benefit individuals with significant bilateral foot function asymmetry, namely, a tendency toward pronation on one foot and supination on the other foot. Consequently, it is anticipated that this embodiment would be used only on the shoe sole of the supinating foot, and on the inside portion only, possibly only a portion thereof. It is expected that the range less than the theoretically ideal stability plane would be a maximum of about five to ten percent, though a maximum of up to twenty-five percent may be beneficial to some individuals.

Figure 27A:
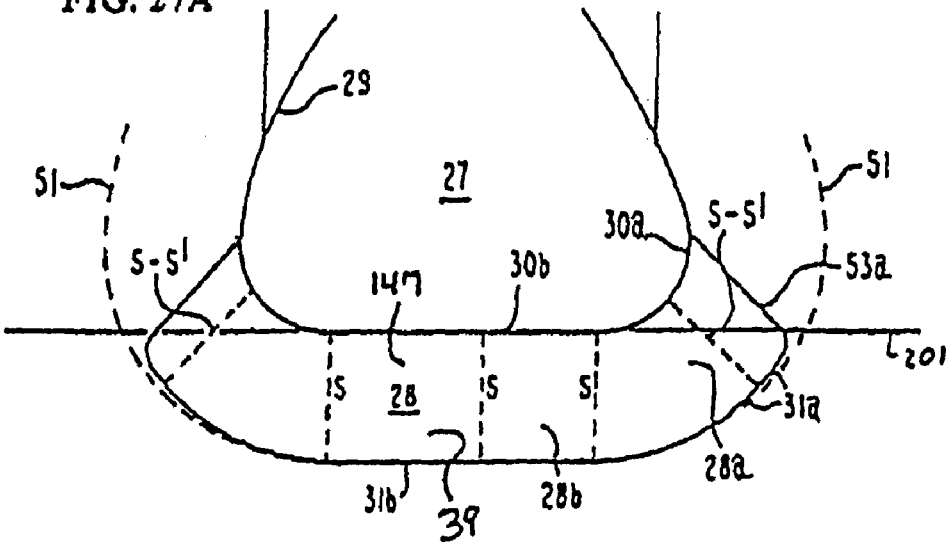
FIGS. 27A-27C show embodiments similar to those shown in FIGS. 14-16, but wherein a portion of the shoe sole thickness is decreased to less than the theoretically ideal stability plane.
Figure 27B:
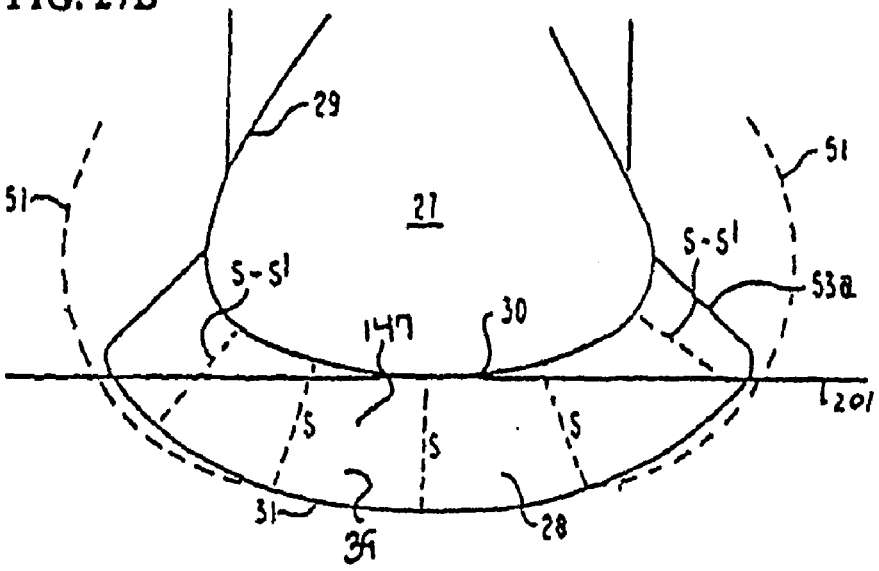
Figure 27C:
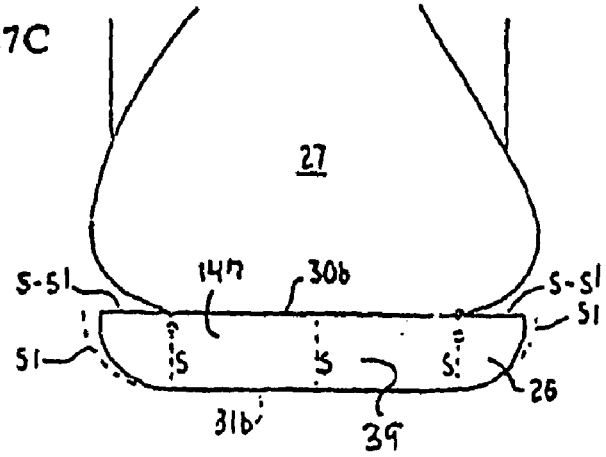

FIG. 27A shows an embodiment like FIGS. 17 and 20, but with naturally rounded sides less than the theoretically ideal stability plane. FIG. 27B shows an embodiment like the fully rounded design in FIGS. 18 and 19, but with a shoe sole thickness decreasing with increasing distance from the center portion of the sole 28. FIG. 27C shows an embodiment like the quadrant-sided design of FIG. 24 but with the quadrant sides reduced from the theoretically ideal stability plane in a manner whereby the thickness decreases with increasing distance from the center portion of the shoe sole 28. The lesser-sided design of FIG. 27 would also apply to the FIGS. 21-23, and 25 density variation approach and to the FIG. 26 approach using tread design to approximate density variation.

Figure 28A:
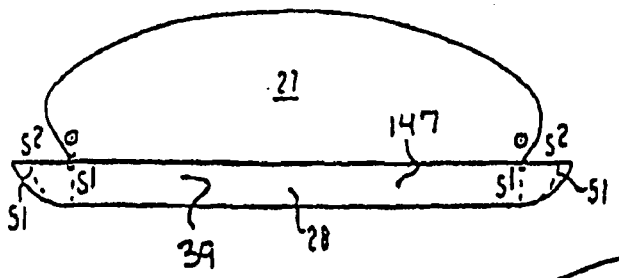
FIGS. 28A-28F show embodiments of the invention with shoe sole sides having thicknesses both greater and lesser than the theoretically ideal stability plane.
Figure 28D:
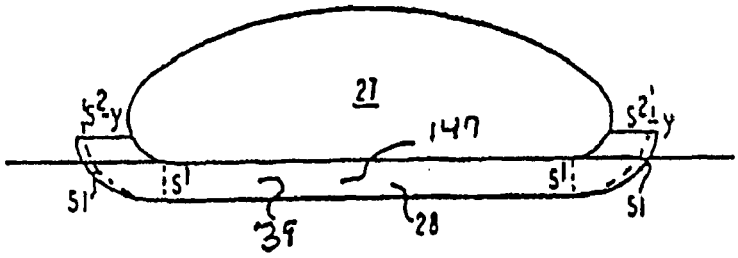
Figure 28B:
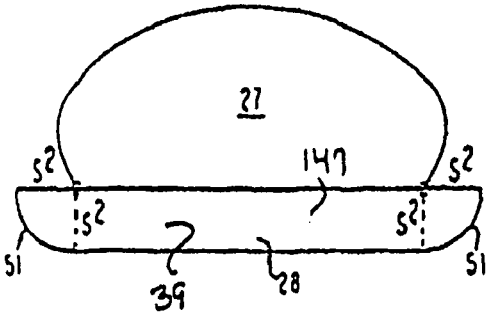
Figure 28E:
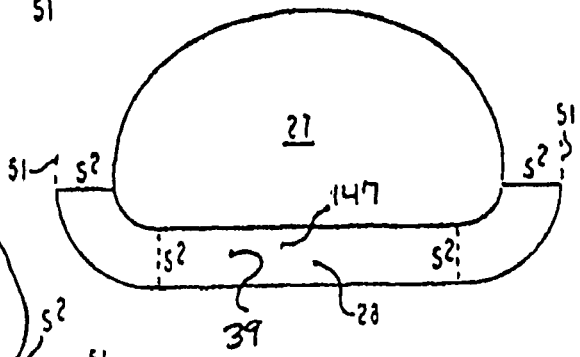
Figure 28C:
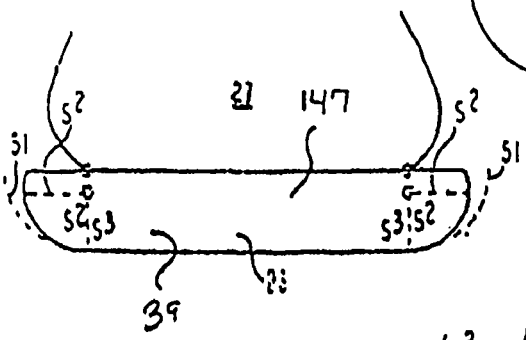

FIG. 28A-28C show, in cross-sections, that with the quadrant-sided design of FIGS. 16, 24, 25, and 27C, it is possible to have shoe sole sides that are both greater and lesser than the theoretically ideal stability plane in the same shoe. The radius of an intermediate shoe sole thickness, taken at (S2) at the base of the fifth metatarsal in FIG. 28B, is maintained constant throughout the quadrant sides of the shoe sole 28, including both the heel, as shown in FIG. 28C, and the forefoot, as shown in FIG. 28A, so that the side thickness is less than the theoretically ideal stability plane at the heel and more at the forefoot. Though possible, this is not a preferred approach.

Figure 28F:
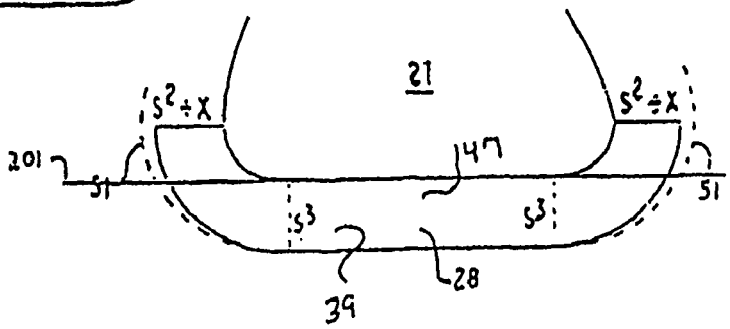

The same approach can be applied to the naturally rounded sides or fully rounded designs described in FIGS. 14, 15, 17-23 and 26, but it is also not preferred. In addition, as shown in FIGS. 28D-28F, it is possible to have shoe sole sides with thicknesses that are both greater and lesser than the theoretically ideal stability plane in the same shoe, like FIGS. 28A-28C, but wherein the side thickness (or radius) is neither constant like FIGS. 28A-28C nor varies directly with shoe sole thickness, but instead varies indirectly with shoe sole thickness. As shown in FIGS. 28D-28F, the shoe sole side thickness varies from somewhat less than the shoe sole thickness at the heel to somewhat more at the forefoot. This approach, though possible, is again not preferred and can be applied to the quadrant-sided design, but it is not preferred there either.

FIG. 29 shows in a frontal plane cross-section at the heel (center of ankle joint) the general concept of a shoe sole 28 that conforms to the natural shape of the human foot 27 and that has a constant thickness (s) in frontal plane cross-sections. The outer surface of the foot 29 of the bottom and sides of the foot 27 should correspond exactly to the inner surface of the shoe sole 30. The shoe sole thickness is defined as the shortest distance (s) between any point on the inner surface of the shoe sole 30 and the outer surface of the shoe sole 31. In effect, the applicant's general concept is a shoe sole 28 that wraps around and conforms to the natural contours of the foot 27 as if the shoe sole 28 were made of a theoretical single flat sheet of shoe sole material of uniform thickness, wrapped around the foot 27 with no distortion or deformation of that sheet as it is bent to the foot's contours. To overcome real world deformation problems associated with such bending or wrapping around contours, actual construction of the shoe sole contours of uniform thickness will preferably involve the use of multiple sheet lamination or injection molding techniques.

FIGS. 30A, 30B, and 30C illustrate in frontal plane cross-section use of naturally rounded stabilizing sides 28*a* at the outer edge of a shoe sole. This eliminates the unnatural sharp bottom outside edge 23, especially of flared shoes, in favor of a naturally rounded shoe sole outer surface 31 as shown in FIG. 29. The side or inner edge of the shoe sole stability side 30*a* is rounded like the natural form on the side or edge of the human foot 27, as is the outer edge of the shoe sole stability side 31*a* to follow a theoretically ideal stability plane. The thickness (s) of the shoe sole 28 is maintained exactly constant, even if the shoe sole 28 is tilted to either side, forward or backward. Thus, the naturally rounded stability sides 28*a*, are defined as the same as the thickness (s) of the shoe sole 28 so that, in cross-section, the stable shoe sole 28 has at its outer edge naturally rounded stability sides 28*a* with an outer edge 31 *a* representing a portion of a theoretically ideal stability plane and described by naturally rounded sides 28*a* equal to the thickness (s) of the sole 28. The inner surface portion 30*b* of the sole 28 coincides with the shoe wearer's load-bearing footprint since in the case shown, the shape of the foot 27 is assumed to be load-bearing and, therefore, flat along the bottom A top edge 32 of the naturally rounded stability side 28*a* can be located at any point along the rounded side of the outer surface of the foot 29, while the inner edge of the naturally rounded stability side 33 coincides with the perpendicular sides of the load-bearing shoe sole 34. In practice, the shoe sole 28 is preferably integrally formed from the portions 28*b* and 28*a*. Thus, the theoretically ideal stability plane includes the rounded outer edge 31 *a* merging into the outer surface portion 31*b* of the rounded shoe sole 28.

Preferably, the peripheral extent of the shoe sole outline 36 of the load-bearing portion of the shoe sole 28*b* includes all of the support structures of the foot but extends no further than the outer edge of the foot sole 37 as defined by a load-bearing footprint, as shown in FIG. 30D, which is a top view of the inner shoe sole surface portion 30*b*. FIG. 30D thus illustrates a foot outline at numeral 37 and a recommended shoe sole outline 36 relative thereto. Thus, a horizontal plane outline of the top of the load-bearing portion of the shoe sole 28, exclusive of rounded stability sides, should, preferably, coincide as nearly as practicable with the loadbearing portion of the foot outline 37 with which it comes into contact. Such a shoe sole outline 36, as best seen in FIGS. 30D and 33D, should remain uniform throughout the entire thickness of the shoe sole 28 eliminating negative or positive sole flare so that the sides are exactly perpendicular to the horizontal plane as shown in FIG. 30B. Preferably, the density of the shoe sole material is uniform.

As shown diagrammatically in FIG. 31, preferably, as the heel lift or wedge 38 of thickness ($s^1$) increases the total thickness ($s+s^1$) of the combined midsole and outer sole 39 of thickness (s) in an anterior direction of the shoe, the naturally rounded stability sides 28*a* increase in thickness exactly the same amount according to the principles discussed in connection with FIG. 30. Thus, the thickness of the inner edge of the naturally rounded stability side 33 is always equal to the constant thickness (s) of the load-bearing shoe sole 28*b* in the frontal plane cross-section.

As shown in FIG. 31B, for a shoe that follows a more conventional horizontal plane outline, the shoe sole 28 can be improved significantly by the addition of a naturally rounded stability side 28*a* which correspondingly varies with the thickness of the shoe sole 28 and changes in the frontal plane according to the shoe heel lift 38. Thus, as illustrated in FIG. 31B, the thickness of the naturally rounded stability side 28*a* in the heel section is equal to the thickness ($s+s^1$) of the shoe sole 28 which is thicker than the combined midsole and outer sole 39 thickness (s) shown in FIG. 31A by an amount equivalent to the heel lift 38 thickness ($s^1$). In the generalized case, the thickness (s) of the rounded stability side 28*a* is thus always equal to the thickness (s) of the shoe sole 28.

FIG. 32 illustrates a side cross-sectional view of a shoe to which the invention has been applied and is also shown in a top plan view in FIG. 33.

Thus, FIGS. 33A, 33B, and 33C represent frontal plane cross-sections taken along the forefoot, at the base of the fifth metatarsal, and at the heel, thus, illustrating that the shoe sole thickness is constant within each frontal plane cross-section, even though, that thickness varies from front to back due to the heel lift 38 as shown in FIG. 32 and that the thickness of the naturally rounded stability sides 28*a* is equal to the shoe sole thickness in each FIG. 33A-33C frontal plane cross-section. Moreover, as shown in FIG. 33D, a horizontal plan view of the left shoe, the rounded stability side 28*a* of the shoe sole 28 follows the preferred principle in matching, as nearly as practical, the load-bearing foot outline 37 shown in FIG. 30D.

FIG. 34 illustrates an embodiment of the invention which utilizes varying portions of the theoretically ideal stability plane 51 in the naturally rounded stability sides 28*a* in order to reduce the weight and bulk of the sole 28, while accepting a sacrifice in some stability of the shoe. Thus, FIG. 34A illustrates the preferred embodiment as described above in connection with FIG. 31 wherein the outer edge 31 *a* of the naturally rounded stability sides 28*a* follows a theoretically ideal stability plane 51. As in FIGS. 29 and 30, the rounded outer edges 31*a* and the outer surface portion 31*b* of the shoe sole 28 lie along the theoretically ideal stability plane 51. As shown in FIG. 34B, an engineering trade-off results in an abbreviation within the theoretically ideal stability plane 51 by forming a naturally rounded upper side surface 53*a* approximating the natural rounded shape of the foot 27 (or more geometrically regular, which is less preferred) at an angle relative to the upper plane of the shoe sole 28 so that only a smaller portion of the rounded side 28*a* defined by the constant thickness lying along the outer edge 31*a* is coplanar with the theoretically ideal stability plane 51. FIGS. 34C and 34D show similar embodiments wherein each engineering trade-off shown results in progressively smaller portions of rounded side 28*a*, which lies along the theoretically ideal stability plane 51. The portion of the outer edge 31*a* merges into the upper side surface 53*a* of the naturally rounded side 28*a*.

The embodiment of FIG. 34 may be desirable for portions of the shoe sole 28, which are less frequently used so that the additional part of the side is used less frequently. For example, a shoe may typically roll out laterally, in an inversion mode, to about 20° on the order of 100 times for each single time it rolls out to 40°. For a basketball shoe, shown in FIG. 34B, the extra stability is needed. Yet, the added shoe weight to cover that infrequently experienced range of motion is about equivalent to covering the more frequently encountered range. Since in a racing shoe this weight might not be desirable, an engineering trade-off of the type shown in FIG. 34D is possible. A typical athletic/jogging shoe is shown in FIG. 34C. The range of possible variations is limitless.

FIG. 35 shows the theoretically ideal stability plane 51 in defining embodiments of the shoe sole 28 having differing tread or cleat patterns. Thus, FIG. 35 illustrates that the invention is applicable to shoe soles 28 having conventional bottom treads. Accordingly, FIG. 35A is similar to FIG. 34B further including a tread portion 60, while FIG. 35B is also similar to FIG. 34B wherein the sole includes a cleated portion 61. The surface to which the cleat bases are affixed 63 should preferably be on the same plane and parallel the theoretically ideal stability plane 51, since in soft ground that surface 63, rather than the cleats, become loadbearing. The embodiment in FIG. 35C is similar to FIG. 34C showing still another alternative tread construction 62. In each case, the load-bearing outer surface of the tread or cleat pattern 60, 61 or 62 lies along the theoretically ideal stability plane 51.

Figure 36:
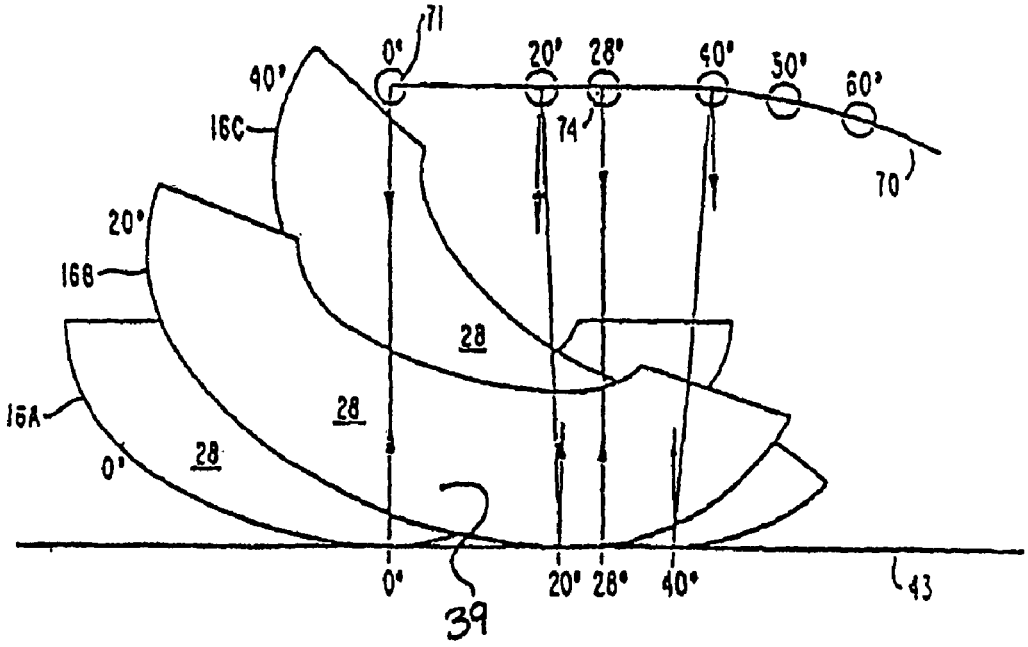
FIG. 36 is a diagrammatic frontal plane cross-sectional view of static forces acting on the ankle joint and its position relative to a shoe sole according to the invention during normal and extreme inversion and eversion motion.

FIG. 36 illustrates in a curve of range of side to side motion 70 as inversion or eversion of the ankle center of gravity 71 from the shoe shown in frontal plane cross-section at the ankle. Thus, in a static case where the center of gravity 71 lies at approximately the mid-point of the shoe sole 28, and assuming that the shoe inverts or everts from 0° to 20° to 40°, as shown in progressions in FIGS. 36A, 36B and 36C, the locus of points of motion for the center of gravity 71 thus defines the curve 70 wherein the center of gravity 71 maintains a steady level motion with no vertical component through 400 of inversion or eversion. For the embodiment shown, the shoe sole stability equilibrium point, is at 28° (at point 74) and in no case is there a pivoting edge to define a rotation point. The inherently superior side to side stability of the design provides pronation or eversion control, as well as lateral or inversion control. In marked contrast to conventional shoe sole designs, this design creates virtually no abnormal torque to resist natural inversion/eversion motion or to destabilize the ankle joint.

Figure 37:
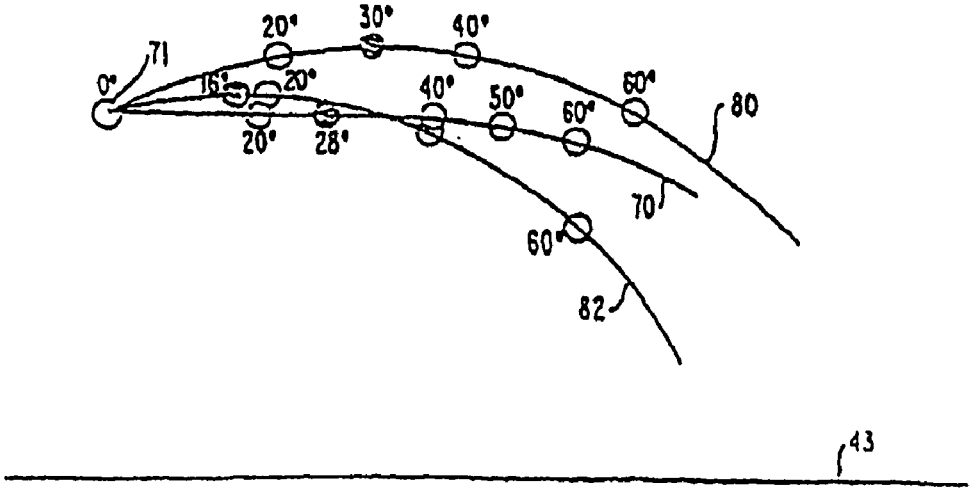
FIG. 37 is a diagrammatic frontal plane view of a plurality of moment curves of the center of gravity for various degrees of inversion for a shoe sole according to the invention contrasted with comparable motions of conventional shoes.

FIG. 37 thus compares the range of motion of the center of gravity 71 for the invention, as shown in curve 70, in comparison to the conventional wide heel flare curve 80 and a narrow rectangle the width of a heel curve 82. Since the shoe stability limit is 28° in the inverted mode, the shoe sole is stable at the 20° approximate bare foot inversion limit. That factor, and the broad base of support rather than the sharp bottom edge of the prior art, makes the rounded design stable even in the most extreme case as shown in FIGS. 36A-36C and permits the inherent stability of the bare foot to dominate without interference, unlike existing designs, by providing constant, unvarying shoe sole thickness in successive frontal plane cross-sections. The stability superiority of the rounded side design is, thus, clear when observing how much flatter its center of gravity curve 70 is than in existing popular wide flare curve design 80. The curve demonstrates that the rounded side design has significantly more efficient natural 70 inversion/eversion motion than the narrow rectangle design having the width of a human heel and is much more efficient than the conventional wide flare design. At the same time, the rounded side design is more stable in extremis than either conventional design because of the absence of destabilizing torque.

FIGS. 38A-38D illustrate, in frontal plane cross-sections, the naturally rounded sides design extended to the other natural contours underneath the load-bearing foot 27, such as the main longitudinal arch, the metatarsal (or forefoot) arch, and the ridge between the heads of the metatarsals (forefoot) and the heads of the distal phalanges (toes). As shown, the shoe sole thickness remains constant as the rounded inner and outer surfaces 30, 31 of the shoe sole 28 follows that of the sides and bottom of the load-bearing foot 27. FIG. 38E shows a sagittal plane cross-section of the shoe sole 28 conforming to the rounded of the bottom of the load-bearing foot 27 with thickness varying according to the heel lift 38. FIG. 38F shows a horizontal plane top view of the left shoe that shows the areas 85 of the shoe sole 28 that correspond to the flattened portions of the foot sole that are in contact with the ground when load-bearing. Rounded lines 86 and 87 show approximately the relative height of the shoe sole contours above the flattened load-bearing areas 85 but within roughly the peripheral extent of the inner surface of sole 35 shown in FIG. 30. A horizontal plane bottom view (not shown) of FIG. 38F would be the exact reciprocal or converse of FIG. 38F (i.e., peaks and valleys contours would be exactly reversed).

FIGS. 39A-39D show, in frontal plane cross-sections, the fully rounded shoe sole design extended to the bottom of the entire non-load-bearing foot 27. FIG. 39E shows a sagittal plane cross-section. The shoe sole contours underneath the foot 27 are the same as FIGS. 38A-38E except that there are no flattened areas corresponding to the flattened areas of the load-bearing foot 27. The exclusively rounded contours of the shoe sole follow those of the unloaded foot 27. A heel lift 38 and a combined midsole and outer sole 39, the same as that of FIG. 38, are incorporated in this embodiment.

FIG. 40 shows the horizontal plane top view of the left shoe corresponding to the fully rounded design described in FIGS. 39A-39E but abbreviated along the sides to only essential structural support and propulsion elements. Shoe sole material density can be increased in the unabbreviated essential elements to compensate for increased pressure loading there. The essential structural support elements are the base and lateral tuberosity of the calcaneus 95*c*, 95*d*, the heads of the metatarsals 96*c*, 96*d*, and the base of the fifth metatarsal 97. They must be supported both underneath and to the outside for stability. The essential propulsion element is the head of first distal phalange 98. The medial (inside) and lateral (outside) sides supporting the base of the calcaneus 95*c* are shown in FIG. 40 oriented roughly along either side of the horizontal plane subtalar ankle joint axis but can be located also more conventionally along the longitudinal axis of the shoe sole 28. FIG. 40 shows that the naturally rounded stability sides need not be used except in the identified essential areas. Omitting the non-essential stability sides can make flexibility improvements and result in weight savings. Rounded lines 86 through 89 show approximately the relative height of the shoe sole contours within roughly the peripheral extent of the inner surface of shoe sole 35. A horizontal plane bottom view of FIG. 40 would be the exact reciprocal or converse of FIG. 40 (i.e., peaks and valleys contours would be exactly reversed).

FIG. 41A shows a development of street shoes with naturally rounded sole sides 28*a* incorporating features according to the present invention. FIG. 41A develops a theoretically ideal stability plane 51, as described above, for such a street shoe, wherein the thickness of the naturally rounded stability sides 28*a* equals the shoe sole thickness. The resulting street shoe with a correctly rounded shoe sole 28 is, thus, shown in frontal plane heel cross-section in FIG. 41A, with side edges perpendicular to the ground, as is typical. FIG. 41B shows a similar street shoe with a fully rounded design, including the bottom of the shoe sole 28. Accordingly, the invention can be applied to an unconventional heel lift shoe, like a simple wedge, or to the most conventional design of a typical walking shoe with its heel separated from the forefoot by a hollow under the instep. The invention can be applied just at the shoe heel or to the entire shoe sole. With the invention, as so applied, the stability and natural motion of any existing shoe design, except for high heels or spike heels, can be significantly improved by the naturally rounded shoe sole design.

FIG. 42 shows a non-optimal but interim or low cost approach to shoe sole construction, whereby the midsole 148 and heel lift 38 are produced conventionally, or nearly so (at least leaving the midsole bottom surface flat, though the sides can be rounded), while the bottom or outer sole 149 includes most or all of the special contours of the design. Not only would that completely or mostly limit the special contours to the bottom sole 149, which would be molded specially, it would also ease assembly, since two flat surfaces of the bottom of the midsole 148 and the top of the bottom sole 149 could be mated together with less difficulty than two rounded surfaces, as would be the case otherwise.

Figure 42A:
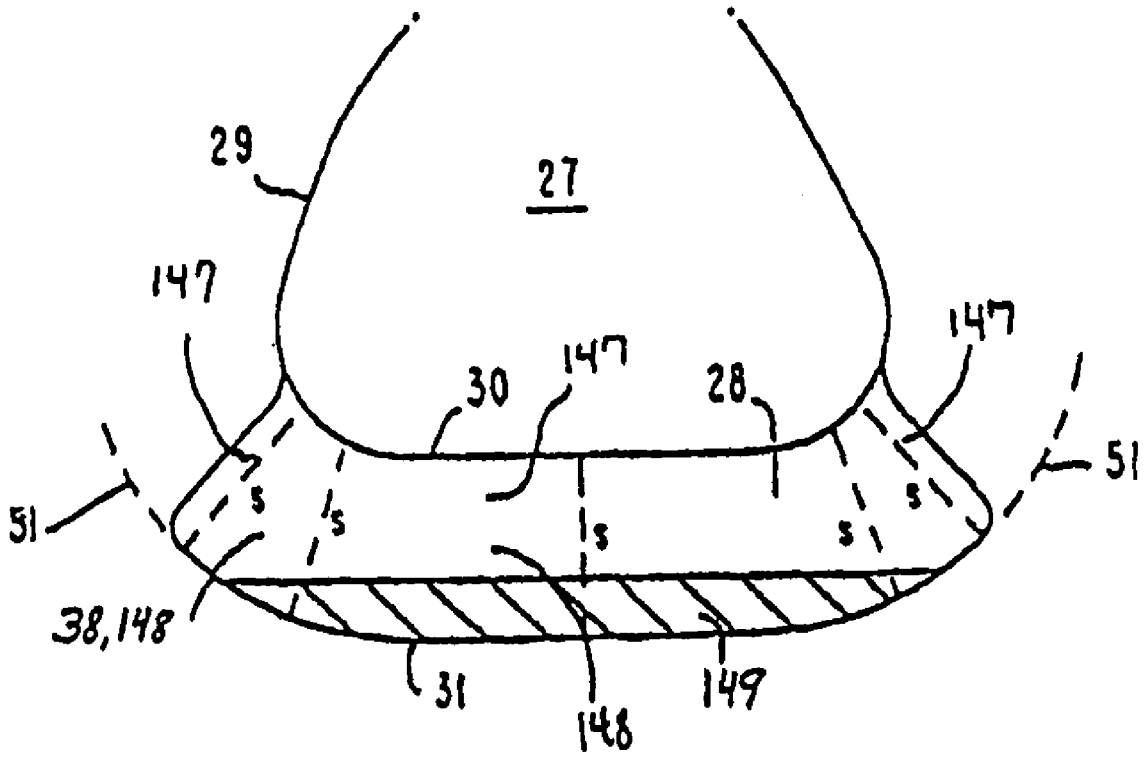
FIGS. 42A-42D show several embodiments wherein the bottom sole includes most or all of the special rounding of the designs and retains a flat upper surface.

The advantage of this approach is seen in the naturally rounded design example illustrated in FIG. 42A, which shows some contours on the relatively softer midsole sides, which are subject to less wear but benefit from greater traction for stability and ease of deformation, while the relatively harder rounded bottom sole 149 provides good wear for the load-bearing areas.

Figure 42C:
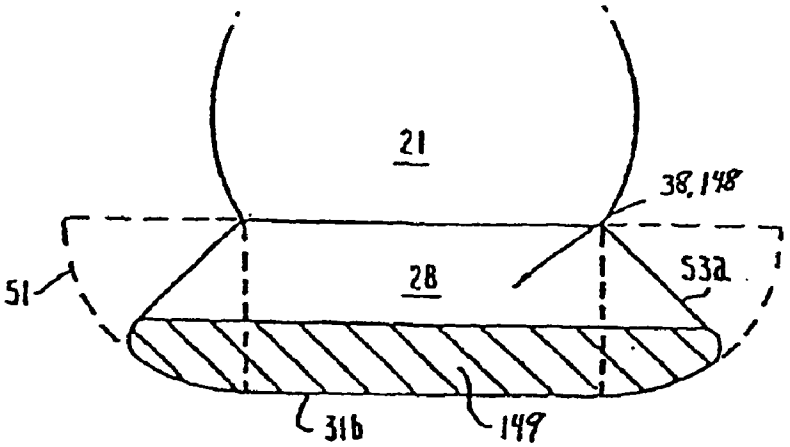
Figure 42D:
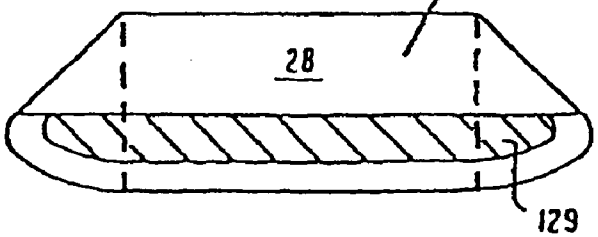
Figure 42B:
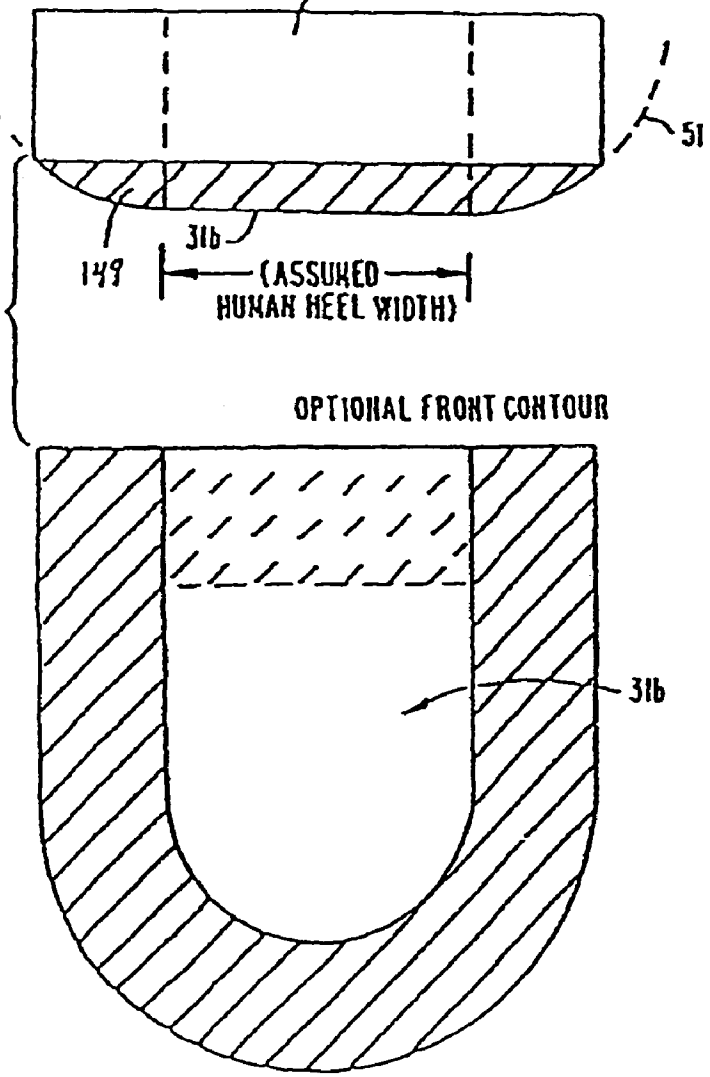

FIG. 42B shows in a quadrant-sided design the concept applied to conventional street shoe heels that are usually separated from the forefoot by a hollow instep area under the main longitudinal arch.

FIG. 42C shows in frontal plane cross-section the concept applied to the quadrant-sided or single plane design and indicating, in FIG. 42D, the honeycombed portion 129 (shaded) of the bottom sole 149 (axis on the horizontal plane) which functions to reduce the density of the relatively hard bottom sole 149 to that of the midsole material to provide for relatively uniform shoe density.

Generally, insoles or sock liners should be considered structurally and functionally as part of the shoe sole 28, as should any shoe material between foot 27 and ground 43, like the bottom of the shoe upper 21 in a slip-lasted shoe or the board in a board-lasted shoe.

Figure 43:
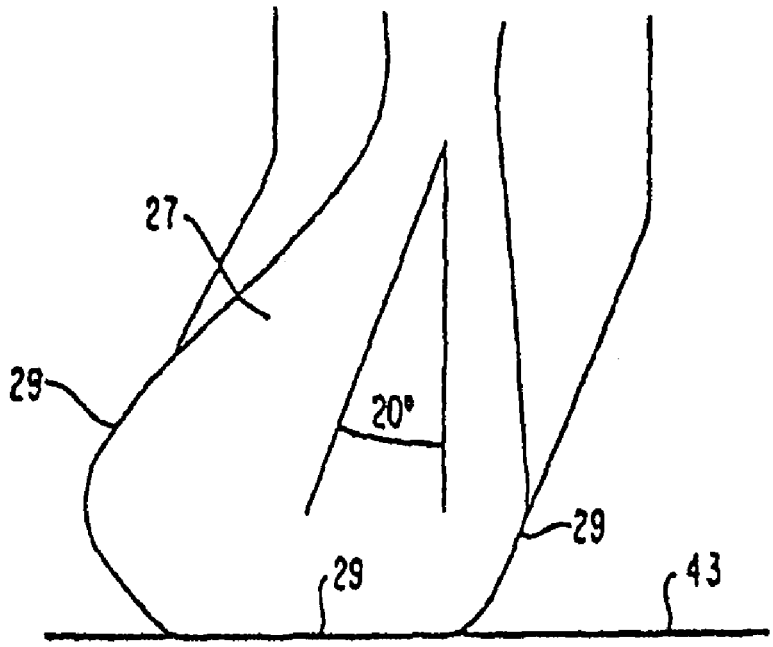
FIG. 43 is a rear view of a heel of a foot for explaining the use of a stationary sprain simulation test.

FIG. 43 shows in a realistic illustration a foot 27 in position for a new biomechanical test that is the basis for the discovery that ankle sprains are in fact unnatural for the bare foot. The test simulates a lateral ankle sprain, where the foot 27 on the ground 43 rolls or tilts to the outside, to the extreme end of its normal range of motion, which is usually about 20° at the outer surface of the foot 29, as shown in a rear view of a bare (right) heel in FIG. 43. Lateral (inversion) sprains are the most common ankle sprains accounting for about three-fourths of all ankle sprains.

The especially novel aspect of the testing approach is to perform the ankle spraining simulation while standing stationary. The absence of forward motion is the key to the dramatic success of the test because otherwise it is impossible to recreate for testing purposes the actual foot and ankle motion that occurs during a lateral ankle sprain and simultaneously to do it in a controlled manner while at normal running speed or even jogging slowly, or walking. Without the critical control achieved by slowing forward motion all the way down to zero, any test subject would end up with a sprained ankle.

That is because actual running in the real world is dynamic and involves a repetitive force maximum of three times one's full body weight for each footstep, with sudden peaks up to roughly five or six times for quick stops, missteps, and direction changes, as might be experienced when spraining an ankle. In contrast, in the static simulation test, the forces are tightly controlled and moderate, ranging from no force at all up to whatever maximum amount that is comfortable.

The Stationary Sprain Simulation Test (SSST) consists simply of standing stationary with one foot bare and the other shod with any shoe. Each foot alternately is carefully tilted to the outside up to the extreme end of its range of motion, simulating a lateral ankle sprain. The SSST clearly identifies what can be no less than a fundamental problem in existing shoe designs. It demonstrates conclusively that nature's biomechanical system, the bare foot, is far superior in stability to man's artificial shoe design. Unfortunately, it also demonstrates that the shoe's severe instability overpowers the natural stability of the human foot and synthetically creates a combined biomechanical system that is artificially unstable. The shoe is the weak link. The test shows that the bare foot is inherently stable at the approximate 20° end of normal joint range because of the wide, steady foundation the bare heel provides the ankle joint, as seen in FIG. 43. In fact, the area of physical contact of the bare heel with the ground 43 is not much less when tilted all the way out to 20° as when upright at 0°.

The SSST provides a natural yardstick to determine whether any given shoe allows the foot within it to function naturally. If a shoe cannot pass this simple test, it is positive proof that a particular shoe is interfering with natural foot and ankle biomechanics. The only question is the exact extent of the interference beyond that demonstrated by the SSST.

Conversely, the applicant's designs employ shoe soles thick enough to provide cushioning (thin-soled and heel-less moccasins do pass the test, but do not provide cushioning and only moderate protection) and naturally stable performance, like the bare foot, in the SSST.

Figure 44:
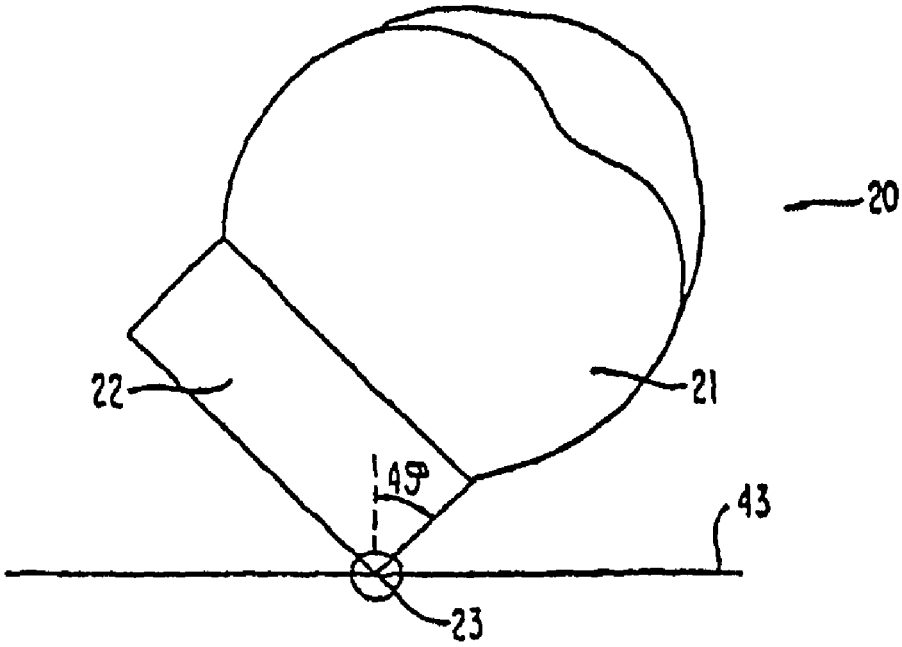
FIG. 44 is a rear view of a conventional athletic shoe unstably rotating about an edge of its sole when the shoe sole is tilted to the outside.

FIG. 44 shows that, in complete contrast the foot equipped with a conventional athletic shoe 20 having an shoe upper 21, though initially very stable while resting completely flat on the ground 43, becomes immediately unstable when the conventional shoe sole 22 is tilted to the outside. The tilting motion lifts from contact with the ground 43 all of the shoe sole 22 except the artificially sharp bottom outside edge 23 of the bottom outside corner. The shoe sole instability increases the farther the foot is rolled laterally. Eventually, the instability induced by the shoe itself is so great that the normal load-bearing pressure of full body weight would actively force an ankle sprain, if not controlled. The abnormal tilting motion of the shoe does not stop at the bare foot's natural 20° limit, as can be seen from the 45° tilt of the shoe heel in FIG. 44.

That continued outward rotation of the shoe past 20° causes the foot to slip within the shoe, shifting its position within the shoe to the outside edge, further increasing the shoe's structural instability. The slipping of the foot within the shoe is caused by the natural tendency of the foot to slide down the typically flat surface of the tilted shoe sole 22; the more the tilt, the stronger the tendency. The heel is shown in FIG. 44 because of its primary importance in sprains due to its direct physical connection to the ankle ligaments that are torn in an ankle sprain and also because of the heel's predominant role within the foot in bearing body weight.

It is easy to see in the two figures, FIGS. 43 and 44, how totally different the physical shape of the natural bare foot is compared to the shape of the artificial, conventional shoe sole. It is strikingly odd that the two objects, which apparently both have the same biomechanical function, have completely different physical shapes. Moreover, the shoe sole 22 clearly does not deform the same way the human foot sole does, primarily as a consequence of its dissimilar shape.

Figure 45A:
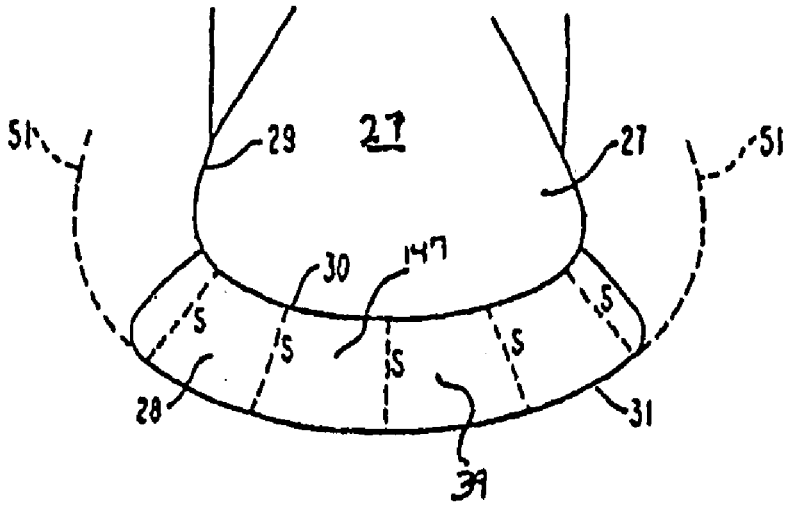
FIGS. 45A-45C illustrate functionally the principles of natural deformation as applied to the shoe soles of the invention.
Figure 45B:
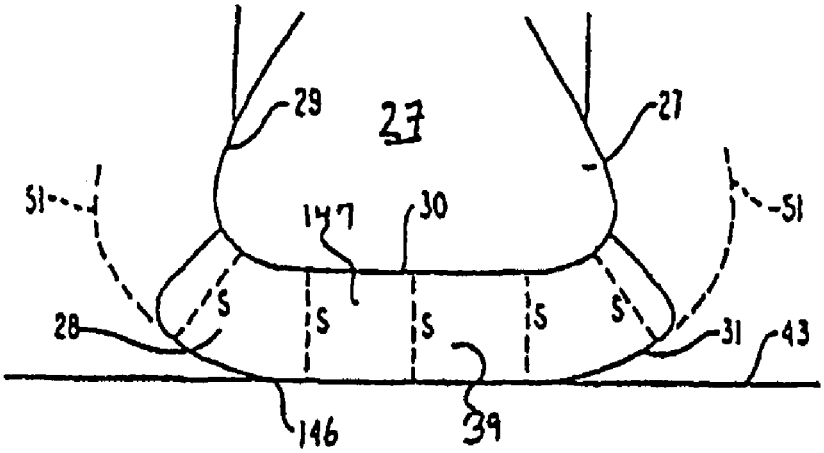
Figure 45C:
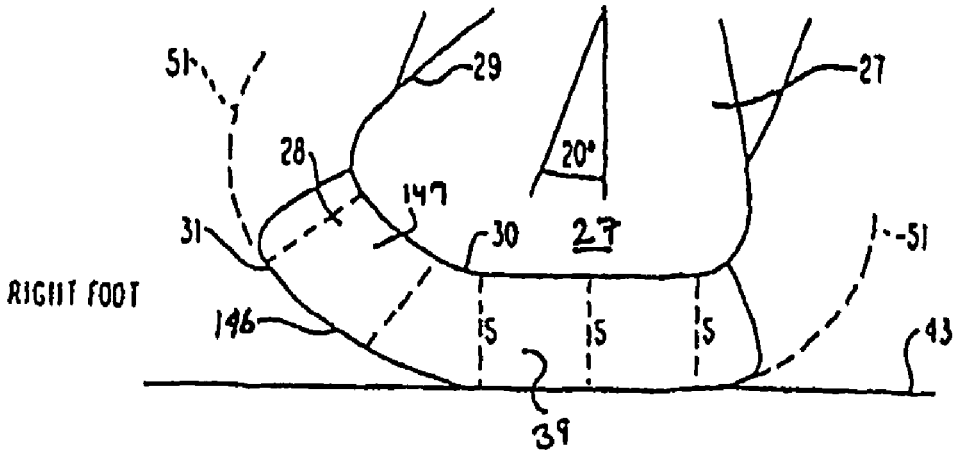

FIGS. 45A-45C illustrate clearly the principle of natural deformation as it applies to the applicant's designs, even though, design diagrams like those preceding are normally shown in an ideal state, without any functional deformation, obviously to show their exact shape for proper construction. That natural structural shape, with its rounded sole design paralleling the foot, enables the shoe sole 28 to deform naturally like the foot 27. The natural deformation feature creates such an important functional advantage it will be illustrated and discussed here fully. Note in the figures that even when the shoe sole shape is deformed, the constant shoe sole thickness, as viewed in the frontal plane, of the invention is maintained.

FIG. 45A shows in the upright, unloaded condition, and therefore undeformed, the fully rounded shoe sole design indicated in FIG. 15 above. FIG. 45A shows a fully rounded shoe sole design that follows the natural rounded shape of all of the foot sole, the bottom as well as the sides. The fully rounded shoe sole 28 assumes that the resulting slightly rounded bottom when unloaded will deform under load as shown in FIG. 45B and flatten just as the human foot bottom is slightly rounded unloaded but flattens under load, like FIG. 14 above. Therefore, the shoe sole material must be of such composition as to allow the natural deformation following that of the foot 27. The design applies particularly to the heel, but to the rest of the shoe sole 28 as well. By providing the closest possible match to the natural shape of the foot 27, the fully rounded design allows the foot 27 to function as naturally as possible. Under load, the FIG. 45A design would deform by flattening to look essentially like the design of FIG. 45B.

FIGS. 45A and 45B show in frontal plane cross-sections the theoretically ideal stability plane 51 which is also theoretically ideal for efficient natural motion of all kinds, including running, jogging or walking. For any given individual, the theoretically ideal stability plane 51 is determined, first, by the desired shoe sole thickness (s) in a frontal plane cross-section, and, second, by the natural shape of the individual's foot 29. For the case shown in FIG. 45B, the theoretically ideal stability plane 51 for any particular individual (or size average of individuals) is determined, first, by the given frontal plane cross-section shoe sole thickness (s); second, by the natural shape of the individuals foot; and, third, by the frontal plane cross-sectional width of the individual's load-bearing footprint which is defined as the upper surface of the shoe sole 28 that is in physical contact with and supports the human foot sole.

FIG. 45B shows the same fully rounded design when upright, under normal load (body weight) and therefore deformed naturally in a manner very closely paralleling the natural deformation under the same load of the foot 27. An almost identical portion of the foot sole that is flattened in deformation is also flattened in deformation in the shoe sole 28. FIG. 45C shows the same design when tilted outward 20° laterally, the normal bare foot limit; with virtually equal accuracy it shows the same design for the opposite foot tilted 20°inward, in fairly severe pronation. As shown, the deformation of the shoe sole 28 again very closely parallels that of the foot 27 even as it tilts. Just as the area of foot contact is almost as great when tilted 20°, the flattened area of the deformed shoe sole 28 is also nearly the same as when upright. Consequently, the bare foot is fully supported structurally and its natural stability is maintained undiminished, regardless of shoe tilt. In marked contrast, a conventional shoe 22, shown in FIG. 2, makes contact with the ground with only its relatively sharp bottom outside edge 23 when tilted and is therefore inherently unstable.

The capability to deform naturally is a design feature of the applicant's naturally rounded shoe sole designs, whether fully rounded or rounded only at the sides, though the fully rounded design is most optimal and is the most natural assuming the use of shoe sole material that allows natural deformation. It is an important feature because, by following the natural deformation of the human foot 27, the naturally deforming shoe sole 28 can avoid interfering with the natural biomechanics of the foot and ankle.

FIG. 45C also represents with reasonable accuracy a shoe sole design corresponding to FIG. 45B, a naturally rounded shoe sole with a conventional built-in flattening deformation, as in FIG. 14 above, except that design would have a slight crimp at location 146. Seen in this light, the naturally rounded side design in FIG. 45B is a more conservative design that is a special case of the more generally fully rounded design in FIG. 45A, which is the closest to the natural form of the foot 27. The natural deformation of the applicant's shoe sole design follows that of the foot 27 very closely so that both provide a nearly equal flattened base to stabilize the foot 27.

Figure 46:
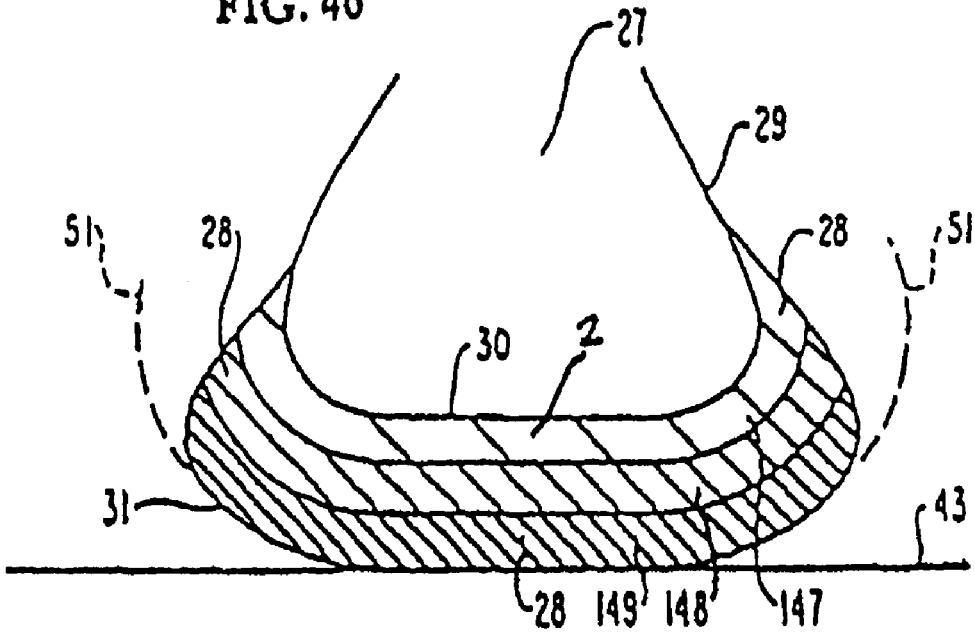
FIG. 46 shows variations in the relative density of the shoe sole including the shoe insole to maximize an ability of the sole to deform naturally.

FIG. 46 shows the preferred relative density of the shoe sole 28, including the insole 2 as a part, in order to maximize the shoe sole's ability to deform naturally following the natural deformation of the foot sole. Regardless of how many shoe sole layers (including insole 2) or laminations of differing material densities and flexibility are used in total, the softest and most flexible material should be closest to the foot sole at the insole 2 or upper midsole 147, with a progression through less soft material, such as a midsole 148 or heel lift 38, to the firmest and least flexible material at the outermost shoe sole layer, the bottom sole 149. This arrangement helps to avoid the unnatural side lever arm/torque problem mentioned in the several previous figures. That problem is most severe when the shoe sole is relatively hard and non-deforming uniformly throughout the shoe sole 28, like most conventional street shoes, since hard material transmits the destabilizing torque most effectively by providing a rigid lever arm 23*a*.

The relative density shown in FIG. 46 also helps to allow the shoe sole 28 to duplicate the same kind of natural deformation exhibited by the bare foot sole in FIG. 43, since the shoe sole layers closest to the foot 27, and therefore with the most severe contours, have to deform the most in order to flatten like the bare foot and consequently need to be soft to do so easily. This shoe sole arrangement also replicates roughly the natural bare foot, which is covered with a very tough "Seri boot" outer surface (protecting a softer cushioning interior of fat pads), especially among primitive barefoot populations.

Finally, the use of natural relative density as indicated in FIG. 46 will allow more anthropomorphic embodiments of the applicant's designs (right and left sides of FIG. 46 show variations of different degrees) with sides going higher around the side contour of the foot 27 and thereby blending more naturally with the sides of the foot 27. These conforming sides will not be effective as destabilizing lever arms 23*a* because the shoe sole material there would be soft and unresponsive in transmitting torque, since the lever arm 23*a* will bend.

As a point of clarification, the forgoing principle of preferred relative density refers to proximity to the foot 27 and is not inconsistent with the term "uniform density" used in conjunction with certain embodiments of applicant's invention. Uniform shoe sole density is preferred strictly in the sense of preserving even and natural support to the foot like the ground provides, so that a neutral starting point can be established, against which so-called improvements can be measured. The preferred uniform density is in marked contrast to the common practice in athletic shoes today, especially those beyond cheap or "bare bones" models, of increasing or decreasing the density of the shoe sole, particularly in the midsole, in various areas underneath the foot to provide extra support or special softness where believed necessary. The same effect is also created by areas either supported or unsupported by the tread pattern of the bottom sole. The most common example of this practice is the use of denser midsole material under the inside portion of the heel, to counteract excessive pronation.

Figure 47:
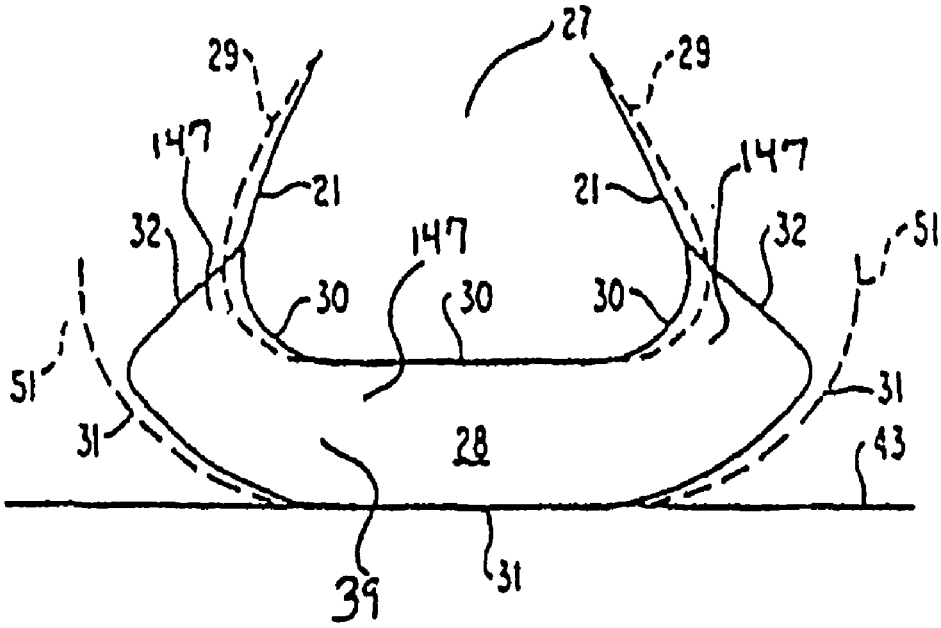
FIG. 47 shows a shoe having naturally rounded sides bent inwardly from a conventional design so then when worn the shoe approximates a custom fit.

FIG. 47 illustrates that the applicant's naturally rounded shoe sole sides can be made to provide a fit so close as to approximate a custom fit. By molding each mass-produced shoe size with sides that are bent in somewhat from the position 29 they would normally be able to conform to that standard size shoe last. The shoe soles so produced will very gently hold the sides of each individual foot exactly. Since the shoe sole 28 is designed as described in connection with FIG. 46 to deform easily and naturally like that of the bare foot, it will deform easily to provide this designed-in custom fit. The greater the; flexibility of the shoe sole sides, the greater the range of individual foot size variations can be custom fitted by a standard size. This approach applies to the fully rounded design described here in FIG. 45A and in FIG. 15 above, which would be even more effective than the naturally rounded sides design shown in FIG. 47.

Besides providing a better fit, the intentional under-sizing of the flexible shoe sole sides of FIG. 47 allows for a simplified design utilizing a geometric approximation of the actual contour of the human foot 27. This geometric approximation is close enough to provide a virtual custom fit, when compensated for by the flexible under-sizing from standard shoe lasts described above.

FIG. 48 illustrates a fully rounded design, but abbreviated along the sides to only essential structural stability and propulsion elements as shown in FIG. 11G-L above combined with freely articulating structural elements underneath the foot 27. The unifying concept is that, on both the sides and underneath the main load-bearing portions of the shoe sole 28, only the important structural (i.e., bone) elements of the foot 27 should be supported by the shoe sole 28, if the natural flexibility of the foot 27 is to be paralleled accurately in shoe sole flexibility, so that the shoe sole 28 does not interfere with the foot's natural motion. In a sense, the shoe sole 28 should be composed of the same main structural elements as the foot 27 and they should articulate with each other just as do the main joints of the foot 27.

Figure 48A:
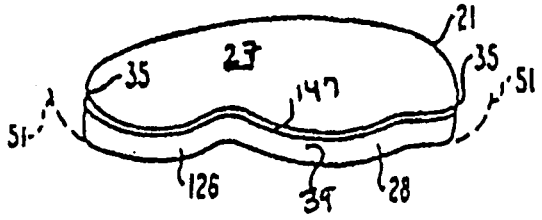
FIGS. 48A-48J show a shoe sole having a fully contoured design but having sides which are abbreviated to the essential structural stability and propulsion elements and are combined and integrated into discontinuous structural elements underneath the foot that simulate those of the foot.
Figure 48B:
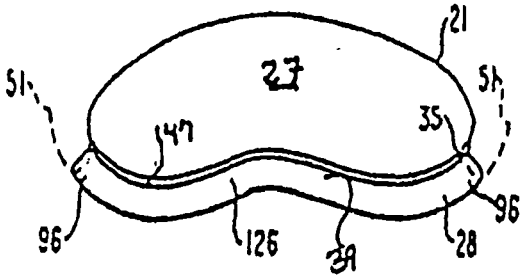
Figure 48C:
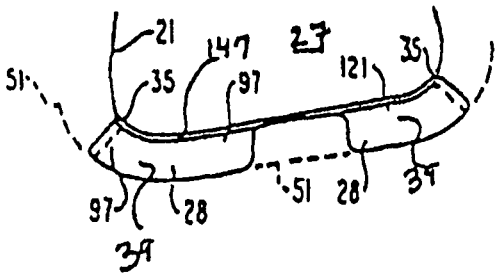
Figure 48D:
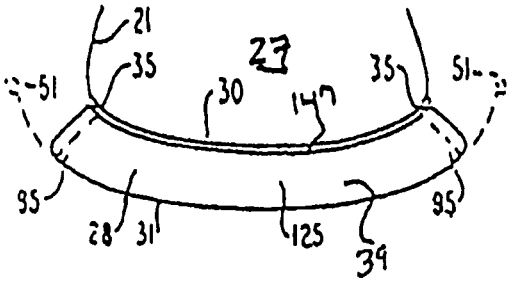
Figure 48E:
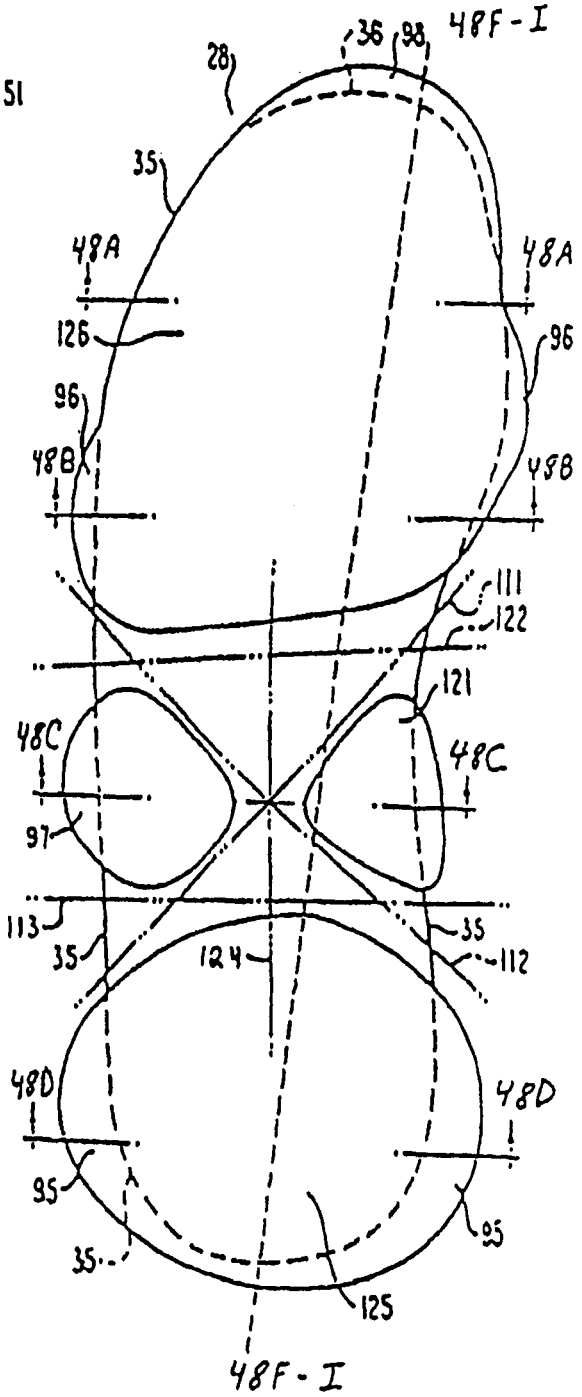
Figure 48E:
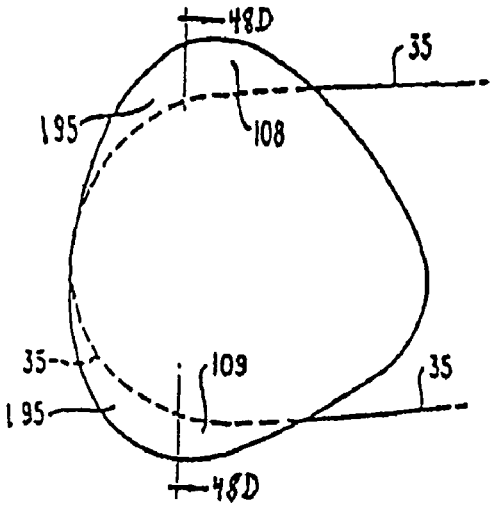

FIG. 48E shows the horizontal plane bottom view of the right shoe corresponding to the fully rounded design previously described, but abbreviated along the sides to only essential structural support and propulsion elements. Shoe sole material density can be increased in the unabbreviated essential elements to compensate for increased pressure loading there. The essential structural support elements are the base and lateral tuberosity of the calcaneus 95*c*, 95*d*, the heads of the metatarsals 96*c*, 96*d*, and the base of the fifth metatarsal 97 (and the adjoining cuboid in some individuals). They must be supported both underneath and to the outside edge of the foot for stability. The essential propulsion element is the head of the first distal phalange 98. FIG. 48 shows that the naturally rounded stability sides need not be used except in the identified essential areas. Weight savings and flexibility improvements can be made by omitting the non-essential stability sides.

The design of the portion of the shoe sole 28 directly underneath the foot shown in FIG. 48 allows for unobstructed natural inversion/eversion motion of the calcaneus by providing maximum shoe sole flexibility particularly between area 125 at the base of the calcaneus (heel) and area 126 at the metatarsal heads (forefoot) along a flexibility axis 124. An unnatural torsion occurs about that axis if flexibility is insufficient so that a conventional shoe sole 22 interferes with the inversion/eversion motion by restraining it. The object of the design is to allow the relatively more mobile (in inversion and eversion) calcaneus to articulate freely and independently from the relatively more fixed forefoot instead of the fixed or fused structure or lack of stable structure between the two in conventional designs. In a sense, freely articulating joints are created in the shoe sole 28 that parallel those of the foot 27. The design is to remove nearly all of the shoe sole material between the heel and the forefoot except under one of the previously described essential structural support elements, the base of the fifth metatarsal 97. An optional support for the main longitudinal arch 121 may also be retained for runners with substantial foot pronation, although it would not be necessary for many runners.

The forefoot can be subdivided (not shown) into its component essential structural support and propulsion elements, the individual heads of the metatarsal and the heads of the distal phalanges, so that each major articulating joint set of the foot is paralleled by a freely articulating shoe sole support propulsion element, an anthropomorphic design. Various aggregations of the subdivision are also possible.

The design in FIG. 48 features an enlarged structural support at the base of the fifth metatarsal 97 in order to include the cuboid, which can also come into contact with the ground under arch compression in some individuals. In addition, the design can provide general heel elements 195 for support in the heel area, as shown in FIG. 48E' or alternatively can carefully orient the stability sides in the heel area to the exact positions of the lateral calcaneal tuberosity 108 and the main base of the calcaneus 109, as in FIG. 48E (showing heel area only of the right shoe). FIGS. 48A-48D show frontal plane cross-sections of the left shoe and FIG. 48E shows a bottom view of the right shoe, with flexibility axes 122, 124, 111, 112, and 113 indicated. FIG. 48F shows a sagittal plane cross-section showing the structural elements joined by a very thin and relatively soft upper midsole layer 147. FIGS. 48G and 48H show similar cross-sections with slightly different designs featuring durable fabric only (slip-lasted shoe) or a structurally sound arch design, respectively. FIG. 481 shows a side medial view of the shoe sole 28.

Figure 48J:
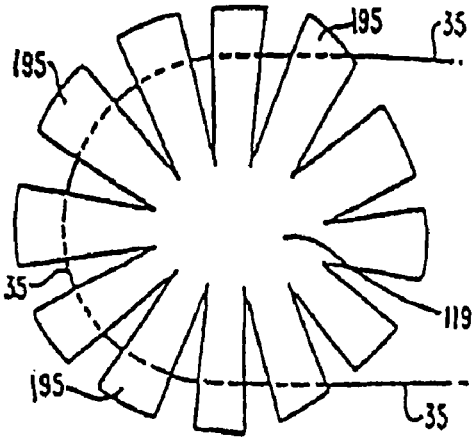
Figure 48F:
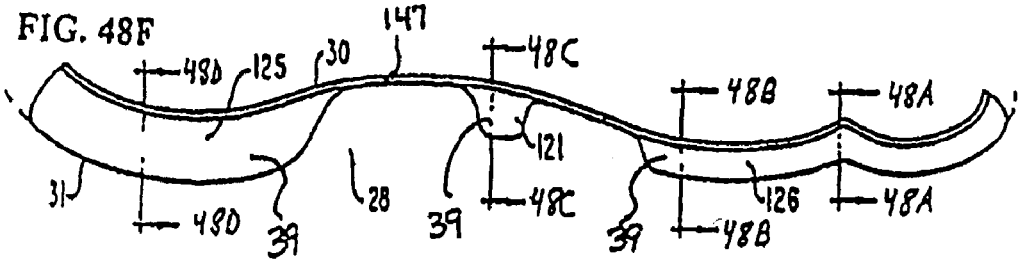
Figure 48G:
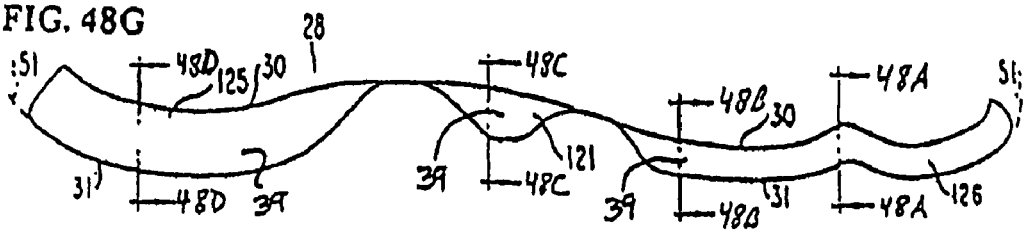
Figure 48H:
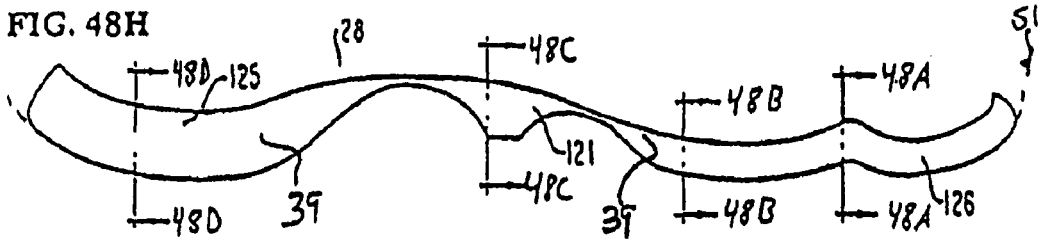
Figure 48I:
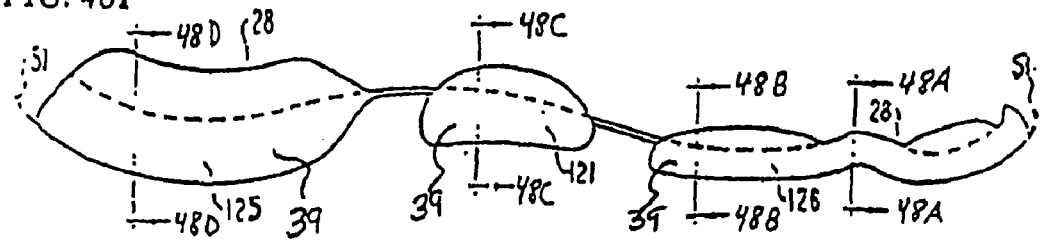

FIG. 48J shows a simple interim or low cost construction for the articulating heel support element 195 (showing the heel area only of the right shoe); while it is most critical and effective for the heel support element 95, it can also be used with the other elements, such as the base of the fifth metatarsal 97 and the longitudinal arch 121. The heel element 195 shown can be a single flexible layer or a lamination of layers. When cut from a flat sheet or molded in the general pattern shown, the outer edges can be easily bent to follow the contours of the foot 27, particularly the sides. The shape shown allows a flat or slightly rounded heel element 195 to be attached to a highly rounded shoe upper 21 or very thin upper sole layer like that shown in FIG. 48F. Thus, a very simple construction technique can yield a highly sophisticated shoe sole design. The size of the center of the shoe sole support section 119 can be small to conform to a fully or nearly fully rounded design or larger to conform to a rounded sides design, where there is a large flattened sole area under the heel. The flexibility is provided by the removed diagonal sections, the exact proportion of size and shape of which can vary.

FIGS. 49A-D shows use of the theoretically ideal stability plane 51 concept to provide natural stability in negative heel shoe soles that are less thick in the heel area than in the rest of the shoe sole 28; specifically, a negative heel version of the naturally rounded sides conforming to a load-bearing foot design shown in FIG. 14 above.

FIGS. 49A, 49B, and 49C represent frontal plane cross-sections taken along the forefoot, at the base of the fifth metatarsal, and at the heel, thus, illustrating that the shoe sole thickness is constant at each frontal plane cross-section, even though that thickness varies from front to back due to the forefoot lift 40 (shown hatched) causing a lower heel than forefoot, and that the thickness of the naturally rounded sides is equal to the shoe sole thickness in each FIG. 49A-49C cross-section. Moreover, in FIG. 49D, a horizontal plane overview or top view of the left shoe sole, it can be seen that the horizontal contour of the sole 28 follows the preferred principle in matching, as nearly as practical, the rough footprint of the load-bearing foot sole.

The abbreviation of essential structural support elements can also be applied to negative heel shoe soles 28 such as that shown in FIG. 49A-D and dramatically improves their flexibility. Negative heel shoe soles 28 such as are shown in FIG. 49A-D can also be modified by inclusion of aspects of the other embodiments disclosed herein.

Figure 50A:
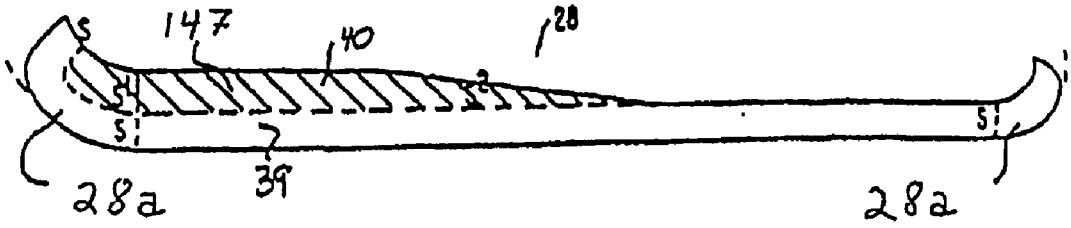
FIGS. 50A-50E show a plurality of side sagittal plane cross-sectional views of examples of negative heel sole thickness variations (forefoot lift) to which the general approach shown in FIGS. 49A-49D can be applied.
Figure 50B:
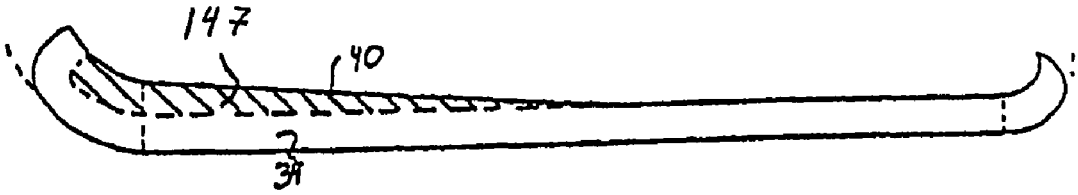
Figure 50C:
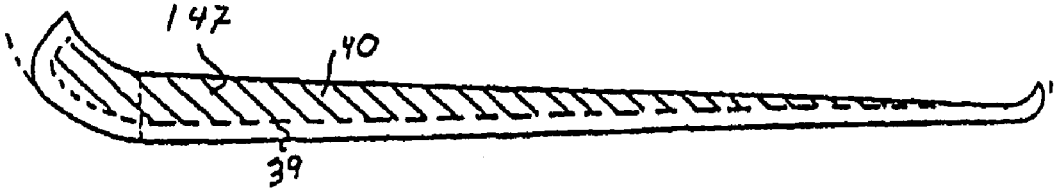
Figure 50D:
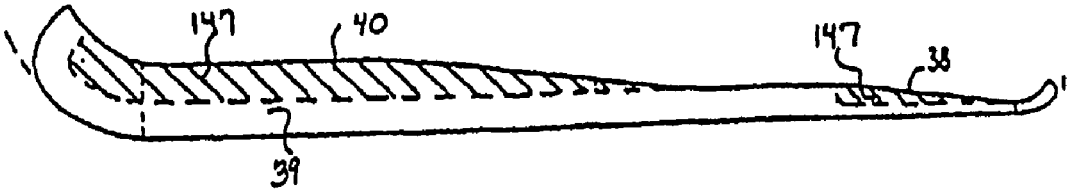
Figure 50E:
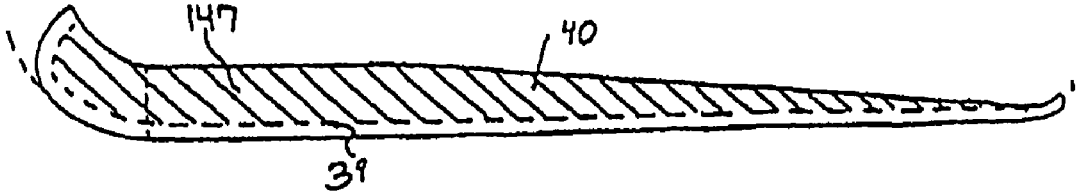

FIG. 50 shows, in FIGS. 50A-50D, possible sagittal plane shoe sole thickness variations for negative heel shoes. The hatched areas indicate the forefoot lift or wedge 40. At each point along the shoe soles 28 seen in sagittal plane cross-sections, the thickness varies as shown in FIGS. 50A-50D, while the thickness of the naturally rounded stability sides 28*a*, as measured in the frontal plane, equals and, therefore, varies directly with those sagittal plane thickness variations. FIG. 50A shows the same embodiment as FIG. 49.

FIGS. 51A-D shows the application of the theoretically ideal stability plane concept in flat shoe soles 28 that have no heel lift to provide for natural stability, maintaining the same thickness throughout, with rounded stability sides abbreviated to only essential structural support elements to provide the shoe sole 28 with natural flexibility paralleling that of the human foot.

Figure 51A:
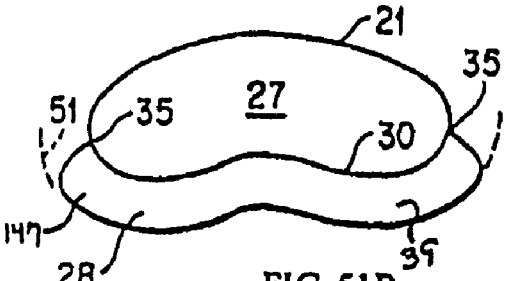
FIG. 51A-D shows the use of the theoretically ideal stability plane concept applied to a flat shoe sole with no heel lift by maintaining the same thickness throughout and providing the shoe sole with rounded stability sides abbreviated to only essential structural support elements.
Figure 51B:
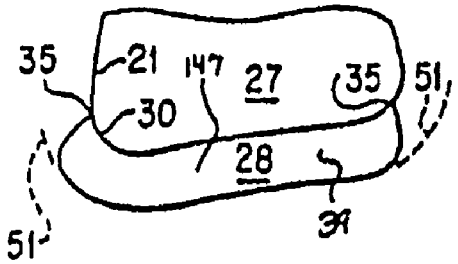
Figure 51C:
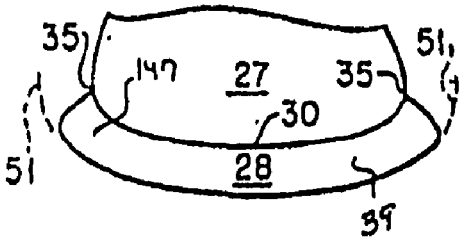
Figure 51E:
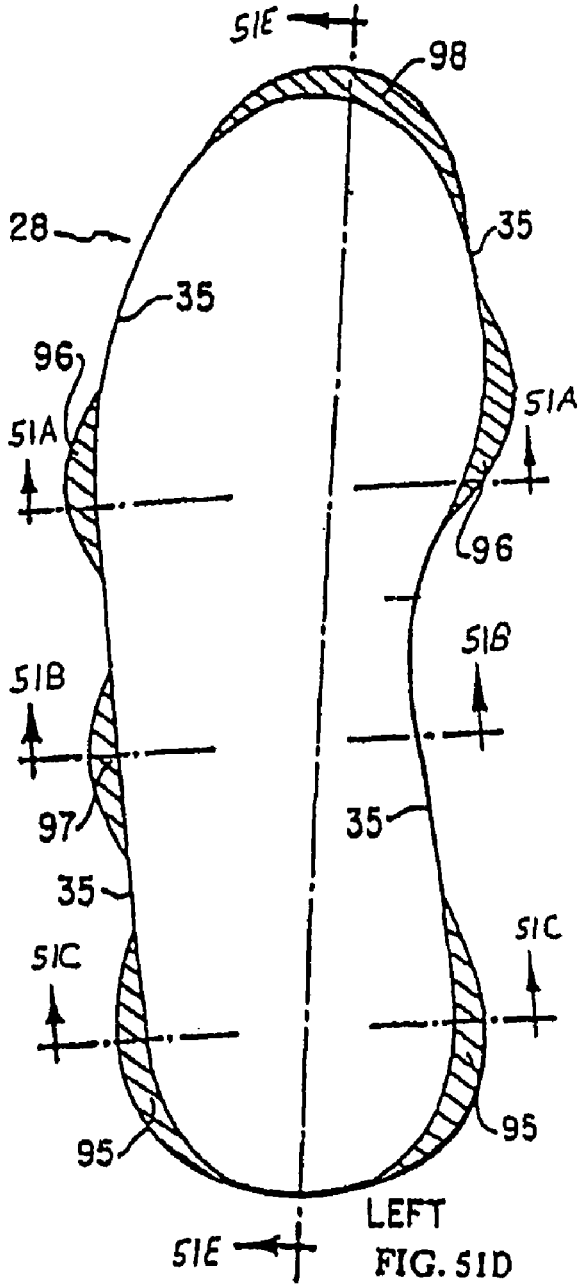
FIG. 51E is a sagittal plane cross-section of the shoe sole of FIG. 51D.
Figure 51D:
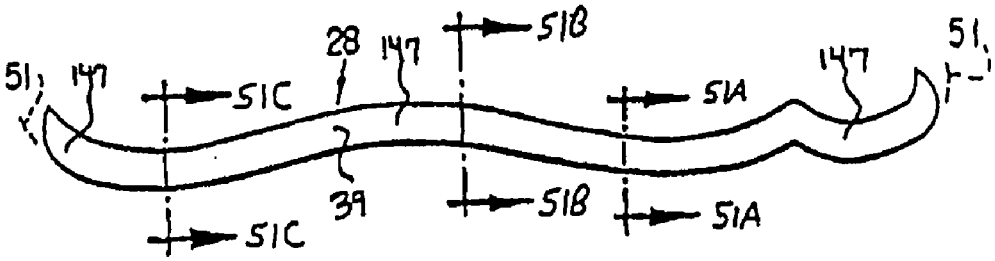

FIGS. 51A, 51B, and 51 C represent frontal plane cross-sections taken along the forefoot, at the base of the fifth metatarsal, and at the heel, thus, illustrating that the shoe sole thickness is constant at each frontal plane cross-section, while also constant in the sagittal plane from front to back, so that the heel and forefoot have the same shoe sole thickness, and that the thickness of the naturally rounded sides is equal to the shoe sole thickness in each FIG. 51A-51C cross-section. Moreover, in FIG. 51C, a horizontal plane overview or top view of the left shoe sole, it can be seen that the horizontal contour of the shoe sole follows the preferred principle in matching, as nearly as practical, the rough footprint of the load-bearing foot sole. FIG. 51B, a sagittal plane cross-section, shows that shoe sole thickness is constant in that plane.

FIGS. 51A-D shows the applicant's prior invention of rounded sides abbreviated to essential structural elements, as applied to a flat shoe sole 28. FIG. 51A-D shows the horizontal plane top view of fully rounded shoe sole 28 of the left foot abbreviated along the sides to only essential structural support and propulsion elements (shown hatched). Shoe sole material density can be increased in the unabbreviated essential elements to compensate for increased pressure loading there. The essential structural support elements are the base and lateral tuberosity of the calcaneus 95, the heads of the metatarsals 96*c* and 96*d*, and base of the fifth metatarsal 97. They must be supported both underneath and to the outside for stability. The essential propulsion element is the head of the first distal phalange 98.

The medial (inside) and lateral (outside) sides supporting the base and lateral tuberosity of the calcaneus 95 are shown in FIGS. 51A-D oriented in a conventional way along the longitudinal axis of the shoe sole in order to provide direct structural support to the base and lateral tuberosity of the calcaneus, but they can be located also along either side of the horizontal plane subtalar ankle joint axis. FIGS. 51A-D shows that the naturally rounded stability sides need not be used except in the identified essential areas. Weight savings and flexibility improvements can be made by omitting the non-essential stability sides. A horizontal plane bottom view (not shown) of FIGS. 51A-D would be the exact reciprocal or converse of FIGS. 51A-D with the peaks and valleys contours exactly reversed. Flat shoe soles such as FIGS. 51A-D can also be modified by inclusion of aspects of the other embodiments disclosed herein.

Central section 188 and upper midsole section 187 in FIG. 12 must fulfill a cushioning function that frequently calls for relatively soft midsole material. The shoe sole thickness effectively decreases in the FIG. 12 embodiment when the soft central section is deformed under weight-bearing pressure to a greater extent than the relatively firmer sides.

In order to control this effect, it is necessary to measure it. What is required is a methodology of measuring a portion of a static shoe sole at rest that will indicate the resultant thickness under deformation. A simple approach is to take the actual least distance thickness at any point and multiply it times a factor for deformation or "give", which is typically measured in durometer (on Shore A scale), to get a resulting thickness under a standard deformation load. Assuming a linear relationship (which can be adjusted empirically in practice), this method would mean that a shoe sole midsection of 1 inch thickness and a fairly soft 30 durometer would be roughly functionally equivalent under equivalent load-bearing deformation to a shoe midsole section of ½ inch and a relatively hard 60 durometer; they would both equal a factor of 30 inch-durometer. The exact methodology can be changed or improved empirically, but the basic point is that static shoe sole thickness needs to have a dynamic equivalent under equivalent loads, depending on the density of the shoe sole material.

Since the theoretically ideal stability plane 51 has already been generally defined in part as having a constant frontal plane thickness and preferring a uniform material density to avoid arbitrarily altering natural foot motion, it is logical to develop a non-static definition that includes compensation for shoe sole material density. The theoretically ideal stability plane 51 defined in dynamic terms would alter constant thickness to a constant multiplication product of thickness times density.

Using this restated definition of the theoretically ideal stability plane 51 presents an interesting design possibility. The somewhat extended width of shoe sole sides that are required under the static definition of the theoretically ideal stability plane 51 could be reduced by using a higher density midsole material in the naturally rounded sides.

Figure 52:
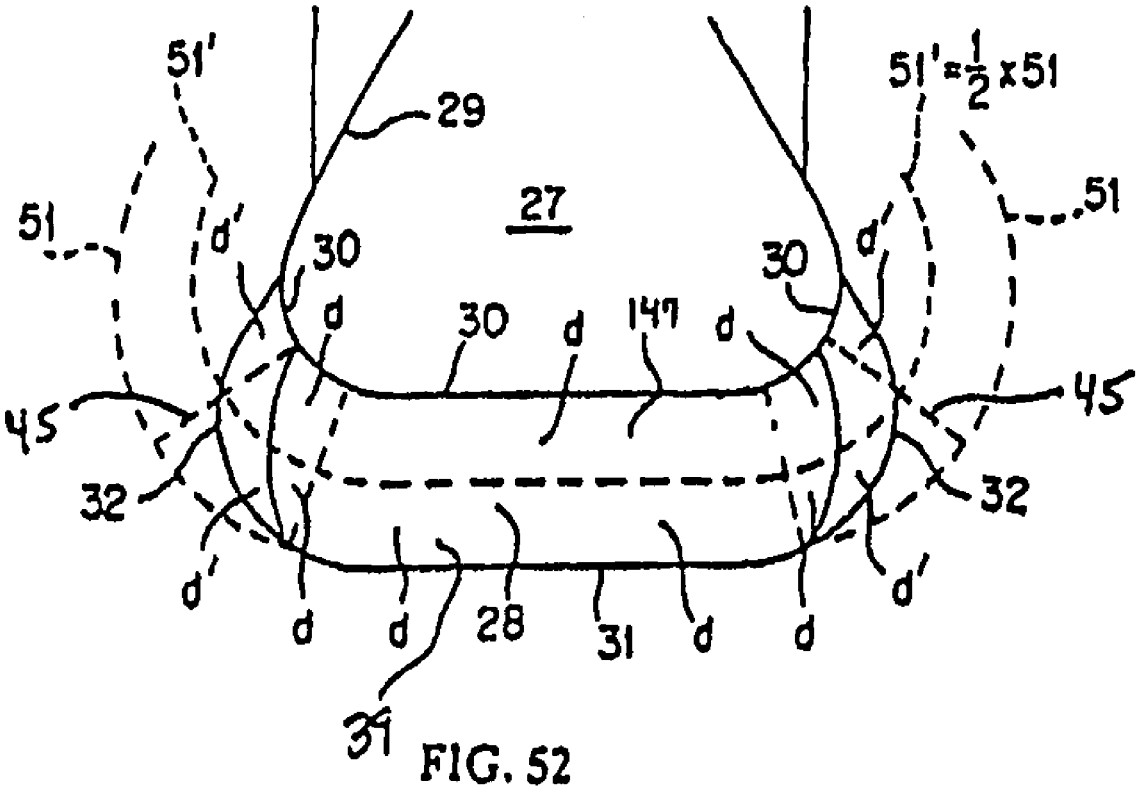
FIG. 52 shows, in frontal plane cross-section at the heel, the use of a high-density midsole material on the naturally rounded sides and a low-density midsole material everywhere else to reduce side width.

FIG. 52 shows, in frontal plane cross-section at the heel, the use of a high density (d') midsole material on the naturally rounded sides and a low density (d) midsole material everywhere else to reduce side width. To illustrate the principle, it was assumed in FIG. 52 that density (d') is twice that of density (d), so the effect is somewhat exaggerated, but the basic point is that shoe sole width can be reduced significantly by using the theoretically ideal stability plane 51 with a definition of thickness that compensates for dynamic force loads. In the FIG. 52 example, about one-fourth of an inch in width on each side is saved under the revised definition, for a total width reduction of one half inch, while rough functional equivalency should be maintained as if the frontal plane thickness and density were each unchanging.

As shown in FIG. 52, the boundary between sections of different density is indicated by the density edge 45 and the line 51' parallel to the theoretically ideal stability plane 51 at half the distance from the outer surface of the foot 29. The design in FIG. 52 uses low density midsole material, which is effective for cushioning throughout that portion of the shoe sole 28 that would be directly load-bearing from roughly 10° of inversion to roughly 10° of eversion, the normal range of maximum motion during athletics; the higher density midsole material is tapered in from roughly 10° to 30° on both sides, at which ranges cushioning is less critical than providing stabilizing support.

Figures 53A, 53B, 53C:
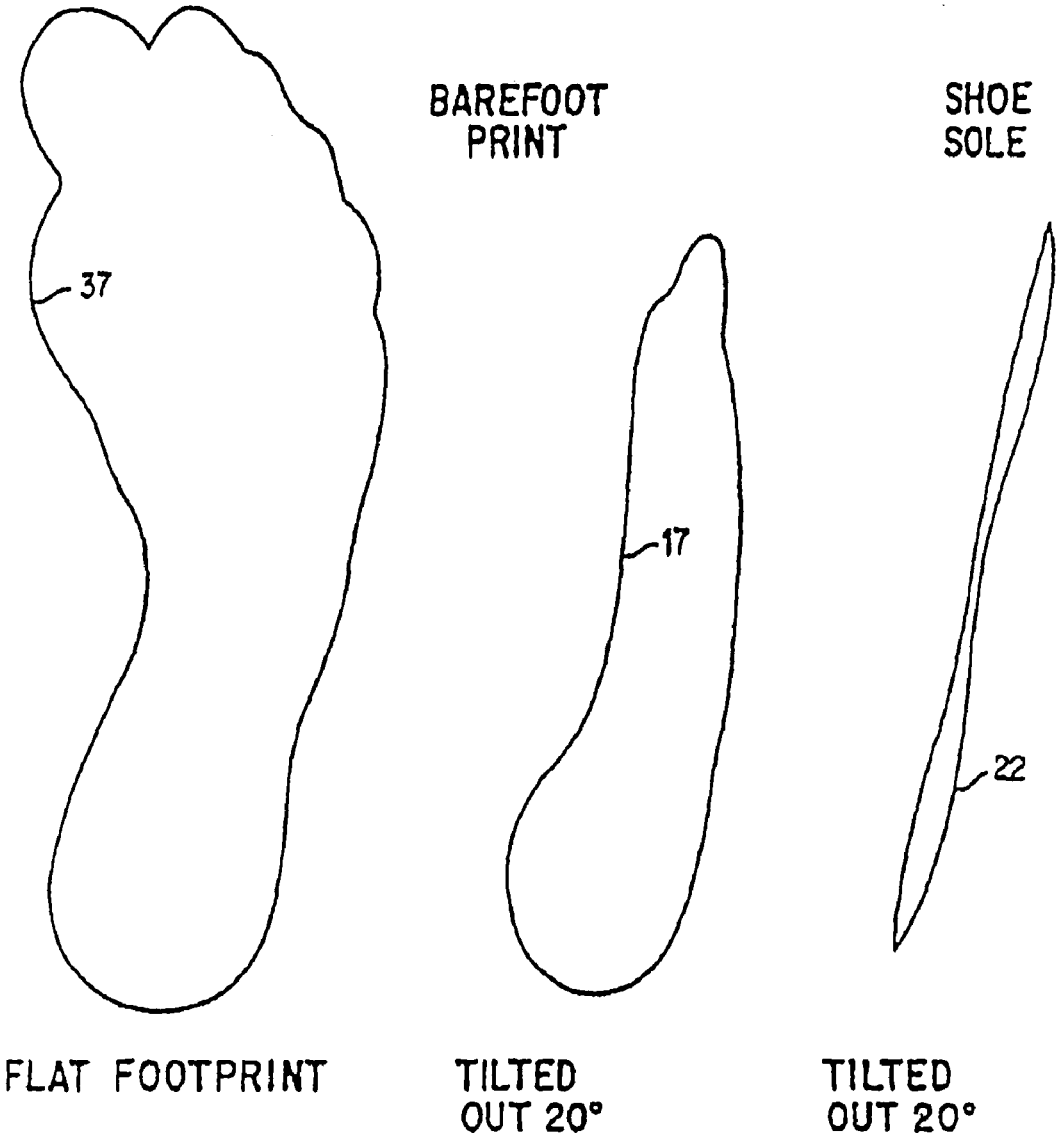
FIG. 53A-C shows the footprints of, the natural barefoot sole and shoe sole.

FIG. 53A-C shows the footprints of the natural foot outline 37 and conventional shoe sole 22. The footprints are the areas of contact between the bottom of the foot 27 or shoe sole 22 and the flat, horizontal plane of the ground, under normal body weight-bearing conditions. FIG. 53A shows a typical right footprint outline 37 when the foot 27 is upright with its sole flat on the ground.

FIG. 53B shows the footprint outline 17 of the same foot when tilted out 20° to about its normal limit; this footprint corresponds to the position of the foot shown in FIG. 43 above. Critical to the inherent natural stability of the bare foot is that the area of contact between the heel and the ground is virtually unchanged, and the area under the base of the fifth metatarsal and cuboid is narrowed only slightly. Consequently, the bare foot maintains a wide base of support even when tilted to its most extreme lateral position.

The major difference shown in FIG. 53B is clearly in the forefoot, where all of the heads of the first through fourth metatarsals and their corresponding phalanges no longer make contact with the ground. Of the forefoot, only the head of the fifth metatarsal continues to make contact with the ground as does its corresponding phalange, although the phalange does so only slightly. The motion of the forefoot is relatively great compared to that of the heel.

FIG. 53C shows a shoe sole print outline of a conventional shoe sole 22 of the same size as the bare foot in FIGS. 53A and 53B when tilted out 20° to the same position as FIG. 53B; this position of the shoe sole corresponds to that shown in FIG. 44 above. The shoe sole 22 maintains only a very narrow bottom edge in contact with the ground 43, an area of contact many times less than the bare foot.

Figure 54:
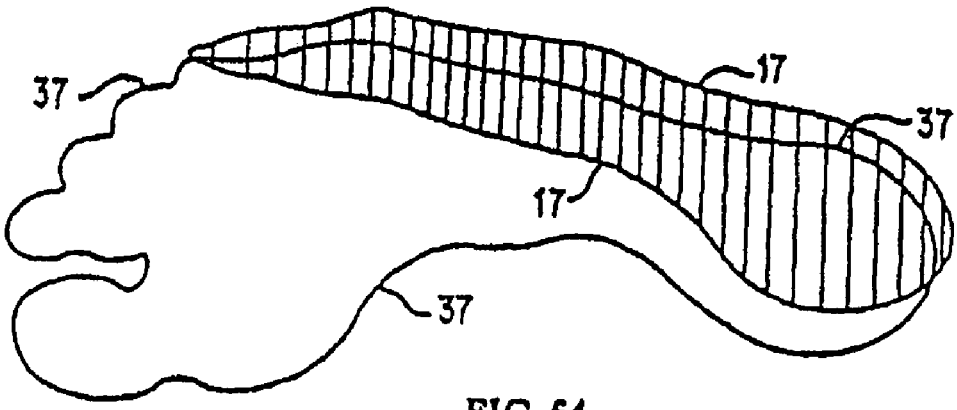
FIG. 54 shows footprints like those shown in FIGS. 53A and 53B of a right bare foot upright and tilted out 20 degrees, but showing also their actual relative positions to each other as a high arched foot rolls outward from upright to tilted out 20 degrees.

FIG. 54 shows two footprints like footprint 37 in FIG. 53A of a bare foot upright and footprint outline 17 in FIG. 53B of a bare foot tilted out 20°, but showing also their actual relative positions to each other as the foot 27 rolls outward from upright to tilted out 20°. The bare foot tilted outline 17 is shown hatched. The position of tilted footprint outline 17 so far to the outside of upright foot outline 37 demonstrates the requirement for greater shoe sole width on the lateral side of the shoe to keep the foot 27 from simply rolling off of the shoe sole 22; this problem is in addition to the inherent problem caused by the rigidity of the conventional shoe sole 22. The footprints are of a high arched foot.

Figure 55A:
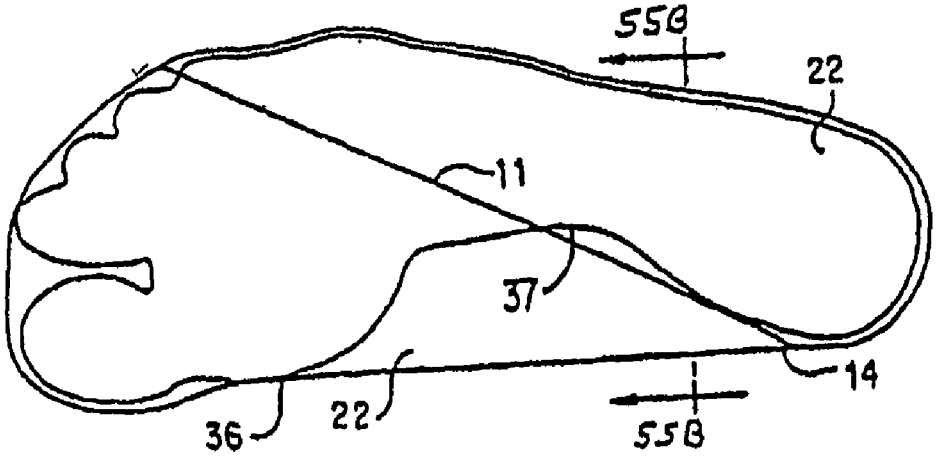
FIG. 55A is a top view of a conventional shoe sole with a corresponding outline of the wearer's footprint superimposed on it to identify the position of the lateral stability sipe relative to the wearer's foot.
Figure 55B:
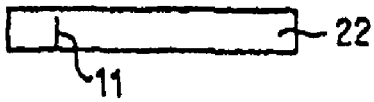
FIG. 55B is a frontal plane cross-section of the shoe sole with lateral stability sipe.
Figure 55C:
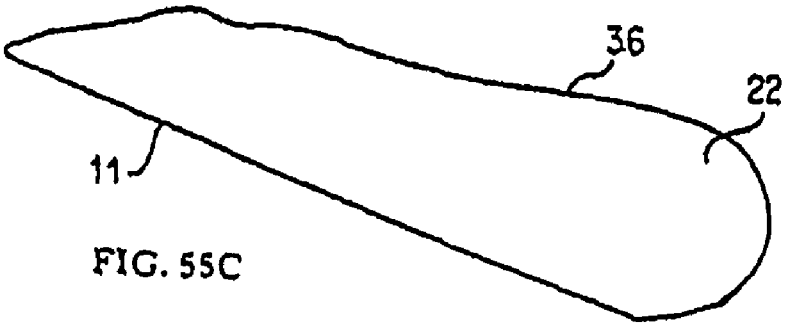
FIG. 55C is a top view like FIG. 55A, but showing the print of the shoe sole with a lateral stability sipe when it is tilted outward 20 degrees.

FIG. 55A-C shows the applicant's invention of a shoe sole 22 with a lateral stability sipe 11 in the form of a vertical slit. The lateral stability sipe 11 allows the shoe sole 22 to flex in a manner that parallels the foot sole, as seen is FIGS. 53 and 54. The lateral stability sipe 11 allows the forefoot of the shoe sole 22 to pivot off the ground with the wear's forefoot when the wearer's foot rolls out laterally. At the same time, it allows the remaining shoe sole 22 to remain flat on the ground under the wearer's load-bearing tilted footprint outline 17 in order to provide a firm and natural base of structural support to the wearer's heel, his fifth metatarsal base and head, as well as cuboid and fifth phalange and associated softer tissues. In this way, the lateral stability sipe provides the wearer of even a conventional shoe sole with lateral stability like that of the bare foot. All types of shoes can be distinctly improved with this invention, even women's high-heeled shoes.

With the lateral stability sipe 11, the natural supination of the foot, which is its outward rotation during load-bearing, can occur with greatly reduced obstruction. The functional effect is analogous to providing a car with independent suspension, with the axis aligned correctly. At the same time, the principle load-bearing structures of the foot are firmly supported with no sipes directly underneath.

FIG. 55A is a top view of a conventional shoe sole 22 with a corresponding outline of the wearer's footprint superimposed on it to identify the position of the lateral stability sipe 11, which is fixed relative to the wearer's foot, since it removes the obstruction to the foot's natural lateral flexibility caused by the conventional shoe sole 22.

With the lateral stability sipe 11 in the form of a vertical slit, when the foot sole is upright and flat, the shoe sole 22 provides firm structural support as if the sipe 11 were not there. No rotation beyond the flat position is possible with a sipe 11 in the form of a slit, since the shoe sole 22 on each side of the sipe 11 prevents further motion.

Many variations of the lateral stability sipe 11 are possible to provide the same unique functional goal of providing shoe sole flexibility along the general axis shown in FIGS. 55A-C. For example, the sipe 11 can be of various depths depending on the flexibility of the shoe sole material used; the depth can be entirely through the shoe sole 22, so long as some flexible material acts as a joining hinge, like the cloth of a fully lasted shoe, which covers the bottom of the foot sole, as well as the sides. The sipes can be multiple, in parallel or askew; they can be offset from vertical; and they can be straight lines, jagged lines, curved lines or discontinuous lines.

Although slits are preferred, other forms of sipe 11, such as channels or variations in material densities as described above, can also be used, though many such forms will allow varying degrees of further pronation rotation beyond the flat position, which may not be desirable, at least for some categories of runners. Other methods in the existing art can be used to provide flexibility in the shoe sole 22 similar to that provided by the lateral stability sipe 11 along the axis shown in FIGS. 55A-C.

The axis shown in FIGS. 55A-C can also vary somewhat in the horizontal plane. For example, the foot outline 37 shown in FIGS. 55A-C is positioned to support the heel of a high arched foot; for a low arched foot tending toward excessive pronation, the medial origin of the lateral stability sipe 14 would be moved forward to accommodate the more inward or medial position of a pronator's heel. The axis position can also be varied for a corrective purpose tailored to the individual or category of individual: the axis can be moved toward the heel of a rigid, high arched foot to facilitate pronation and flexibility, and the axis can be moved away from the heel of a flexible, low arched foot to increase support and reduce pronation.

It should be noted that various forms of firm heel counters and motion control devices in common use can interfere with the use of the lateral stability sipe 11 by obstructing motion along its axis; therefore, the use of such heel counters and motion control devices should be avoided. The lateral stability sipe 11 may also compensate for shoe heel-induced outward knee cant.

FIG. 55B is a cross-section of a conventional shoe sole 22 with lateral stability sipe 11. The shoe sole thickness is constant but could vary as do the thicknesses of many conventional and unconventional shoe soles known to the art. The shoe sole 22 could be conventionally flat like the ground or conform to the shape of the wearer's foot 27.

FIG. 55C is a top view like FIG. 55A but showing the shoe sole outline 36 with a lateral stability sipe 11 when the shoe sole 22 is tilted outward 20° so that the forefoot of the shoe sole 22 is no longer in contact with the ground while the heel and the lateral section do remain flat on the ground.

Figure 56:
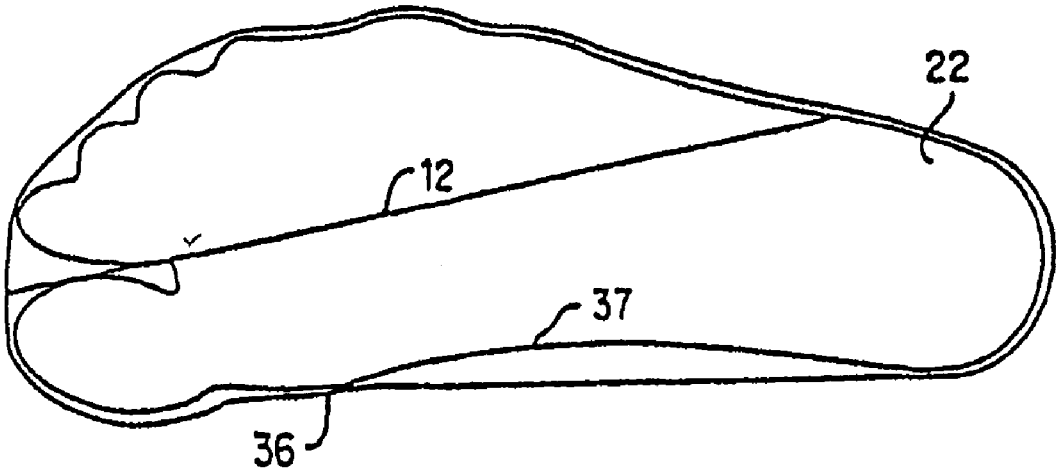
FIG. 56 shows a medial stability sipe, analogous to the lateral sipe, providing increased pronation stability. The head of the first metatarsal and the first phalange are included with the heel to form a medial support section.

FIG. 56 shows a conventional shoe sole 22 with a medial stability sipe 12 that is like the lateral stability sipe 11 but with a purpose of providing increased medial or pronation stability instead of lateral stability; the head of the first metatarsal and the first phalange are included with the heel to form a medial support section inside of a flexibility axis defined by the medial stability sipe 12. The medial stability sipe 12 can be used alone, as shown, or together with the lateral stability sipe 11.

Figure 57:
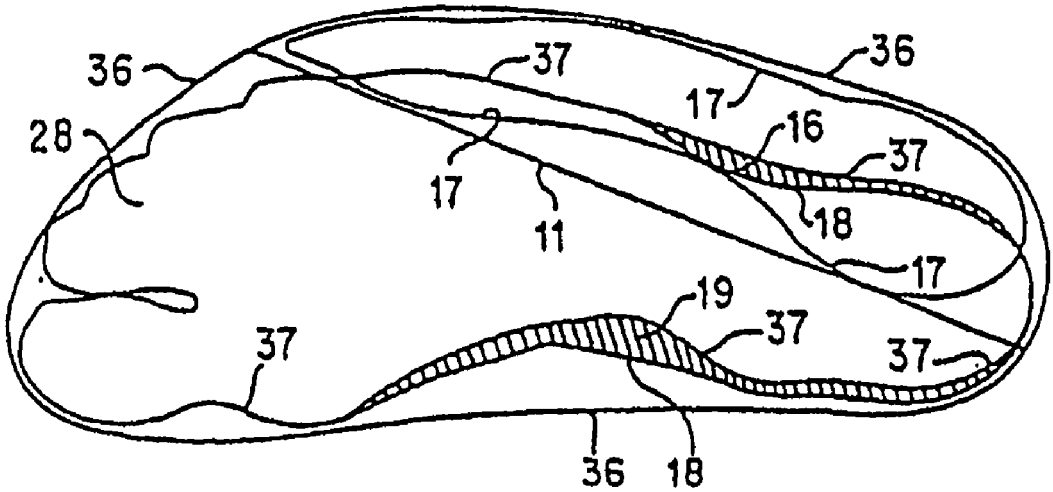
FIG. 57 shows footprints like FIG. 54, of a right bare foot upright and tilted out 20 degrees, showing the actual relative positions to each other as a low arched foot rolls outward from upright to tilted out 20 degrees.

FIG. 57 shows foot outlines 37 and 17, like FIG. 54, of a right barefoot upright and tilted out 20°, showing the actual relative positions to each other as a low arched foot rolls outward from upright to tilted out 20°. The low arched foot is particularly noteworthy because it exhibits a wider range of motion than the FIG. 54 high arched foot, so the 20° laterally tilted foot outline 17 is farther to the outside of upright foot outline 37. In addition, the low arched foot pronates inward to inner footprint outlines 18; the hatched area 19 is the increased area of the footprint due to the pronation, whereas the hatched area 16 is the decreased area due to pronation.

In FIG. 57, the lateral stability sipe 11 is clearly located on the shoe sole 22 along the inner margin of the lateral footprint outline 17 superimposed on top of the shoe sole 22 and is straight to maximize ease of flexibility. The basic FIG. 57 design can of course also be used without the lateral stability sipe 11. A shoe sole of extreme width is necessitated by the common foot tendency toward excessive pronation, as shown in FIG. 57, in order to provide structural support for the full range of natural foot motion, including both pronation and supination. Extremely wide shoe soles are most practical if the sides of the shoe sole 22 are not flat as is conventional but rather are bent up to conform to the natural shape of the shoe wearer's foot sole.

FIGS. 58A-58D shows the use of flexible and relatively inelastic fiber in the form of strands, woven or non-woven (such as pressed sheets), embedded in midsole and bottom sole material. Optimally, the fiber strands parallel (at least roughly) the plane surface of the wearer's foot sole in the naturally rounded design in FIGS. 58A-58C and parallel the flat ground 43 in FIG. 58D, which shows a section of conventional, non-rounded shoe sole 22. Fiber orientations at an angle to this parallel position will still provide improvement over conventional soles 22 without fiber reinforcement, particularly if the angle is relatively small; however, very large angles or the omni-directionality of the fibers will result in increased rigidity or increased softness.

Figure 58A:
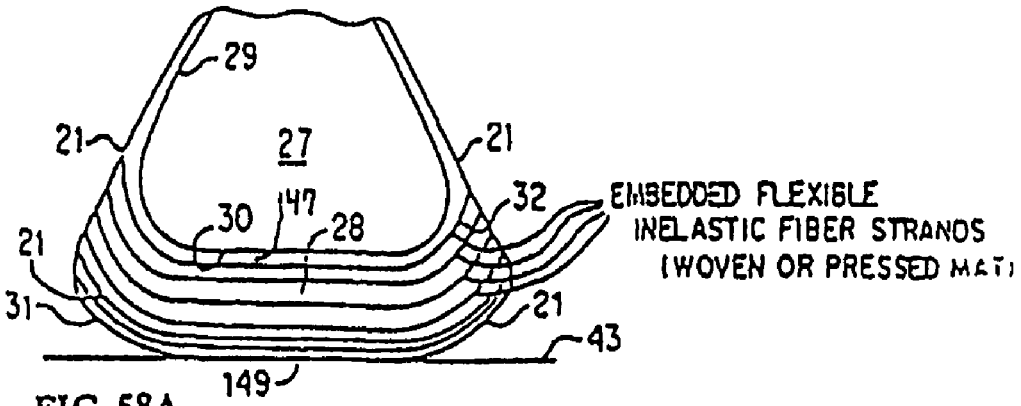
FIGS. 58A-D show the use of flexible and relatively inelastic fiber in the form of strands, woven or unwoven (such as pressed sheets), embedded in midsole and bottom sole material.
Figure 58B:
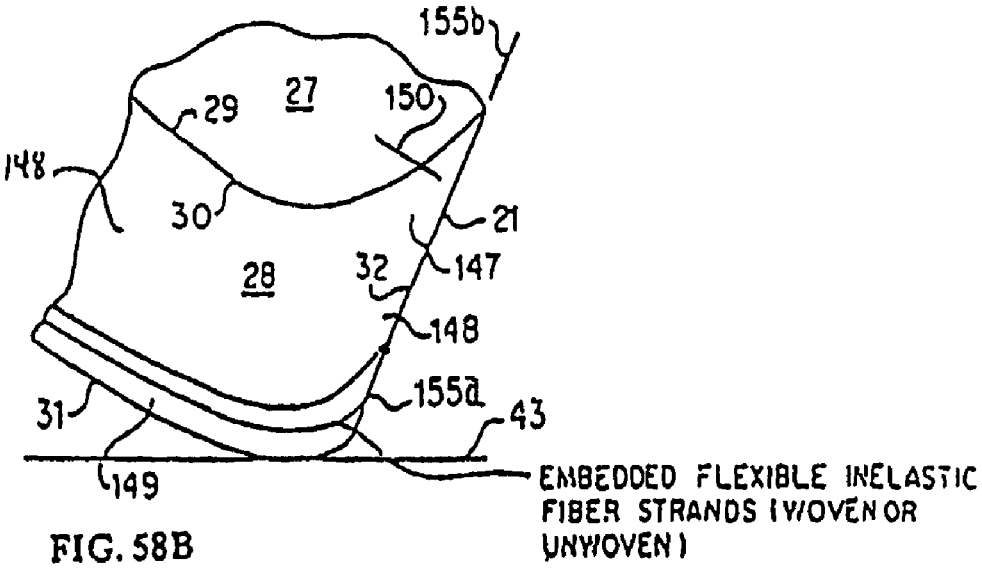
Figure 58C:
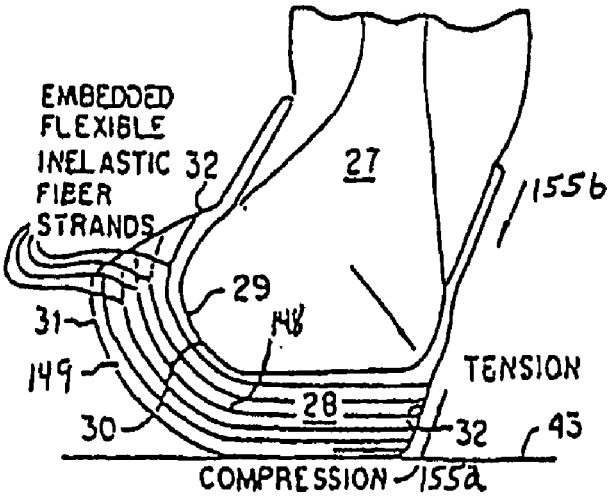
Figure 58D:
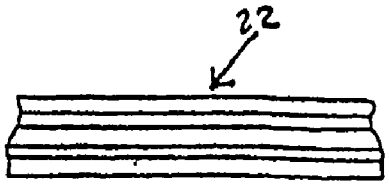

This preferred orientation of the fiber strands, parallel to the plane of the wearer's foot sole, allows for the shoe sole 28 to deform to flatten in parallel with the natural flattening of the foot sole under pressure. At the same time, the tensile strength of the fibers resist the downward pressure of body weight that would normally squeeze the shoe sole material to the sides, so that the side walls of the shoe sole 28 will not bulge out (or will do so less). The result is a shoe sole material that is both flexible and firm. This unique combination of functional traits is in marked contrast to conventional shoe sole materials in which increased flexibility unavoidably causes increased softness, and increased firmness also increases rigidity. FIG. 58A is a modification of FIG. 5A, FIG. 58B is FIG. 6 modified, and FIG. 58C is FIG. 7 modified. The position of the fibers shown would be the same even if the shoe sole material is made of one uniform material or of other layers than those shown here.

The use of the fiber strands, particularly when woven, provides protection against penetration by sharp objects, much like the fiber in radial automobile tires. The fiber can be of any size, either individually or in combination to form strands; and of any material with the properties of relative inelasticity (to resist tension forces) and flexibility. The strands of fiber can be short or long, continuous or discontinuous. The fibers facilitate the capability of any shoe sole using them to be flexible but hard under pressure like the foot sole. The fibers used in both the cover of insoles and the Dellinger Web is knit or loosely braided rather than woven, which is not preferred, since such fiber strands are designed to stretch under tensile pressure so that their ability to resist sideways deformation would be greatly reduced compared to non-knit fiber strands that are individually (or in twisted groups of yarn) woven or pressed into sheets.

Figure 59A:
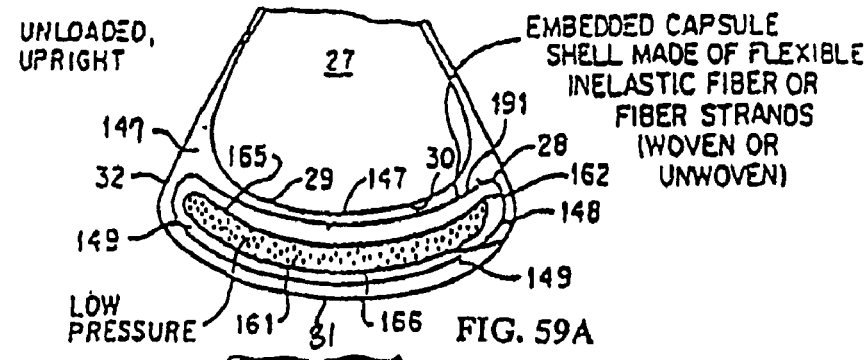
FIGS. 59A-F show the use of flexible inelastic fiber or fiber strands, woven or unwoven (such as pressed sheets) to make an embedded capsule shell that surrounds the cushioning compartment 161 containing a pressure-transmitting medium like gas, gel, or liquid.
Figure 59B:
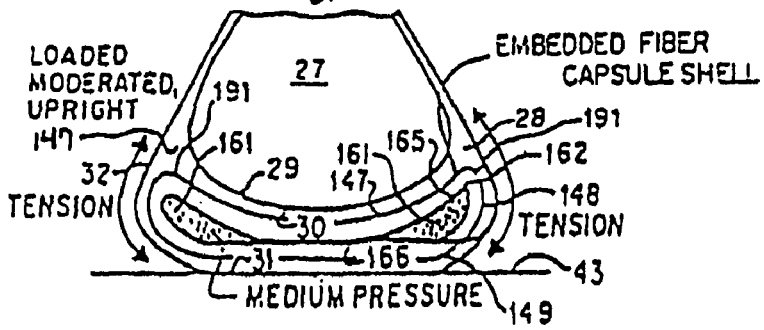
Figure 59C:
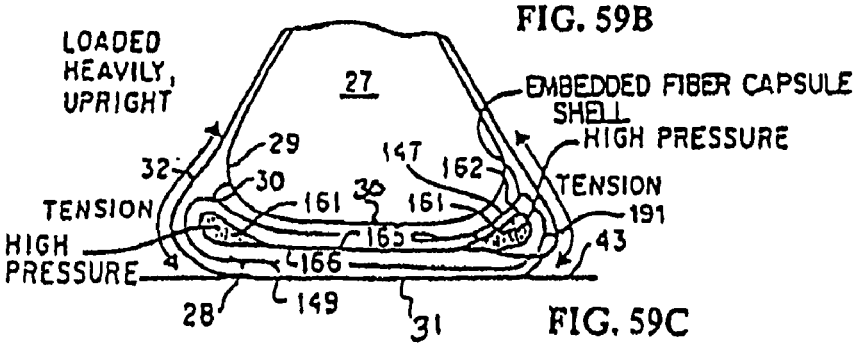
Figure 59D:
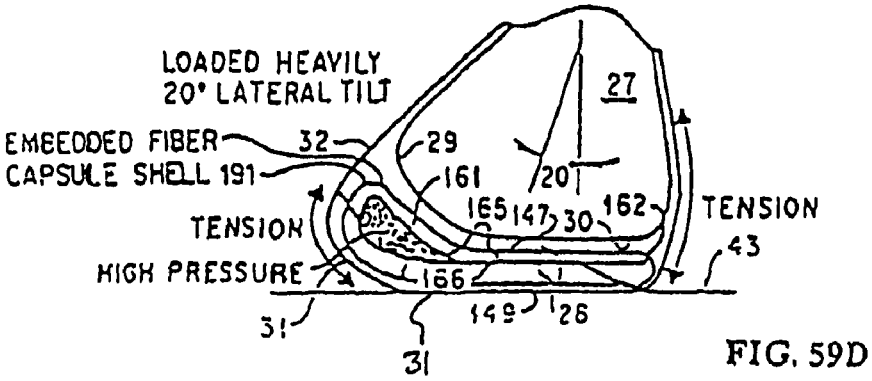
Figure 59E:
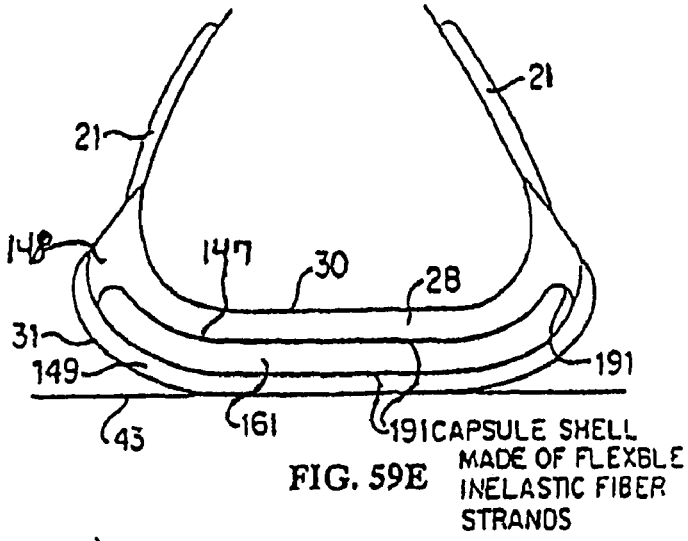

FIGS. 59A-59D are FIGS. 9A-D modified to show the use of flexible inelastic fiber or fiber strands, woven or non-woven (such as pressed sheets) to make an embedded capsule shell that surrounds the cushioning compartment 161 containing a pressure-transmitting medium like gas, gel or liquid. The fibrous capsule shell could also directly envelope the surface of the cushioning compartment 161, which is easier to construct especially during assembly. FIG. 59E is a figure showing a fibrous capsule shell 191 that directly envelopes the surface of a cushioning compartment 161; the shoe sole 28 is not fully rounded, like FIG. 59A, but naturally rounded, and has a flat middle portion corresponding to the flattened portion of a wearer's load-bearing foot sole.

Figure 59F:
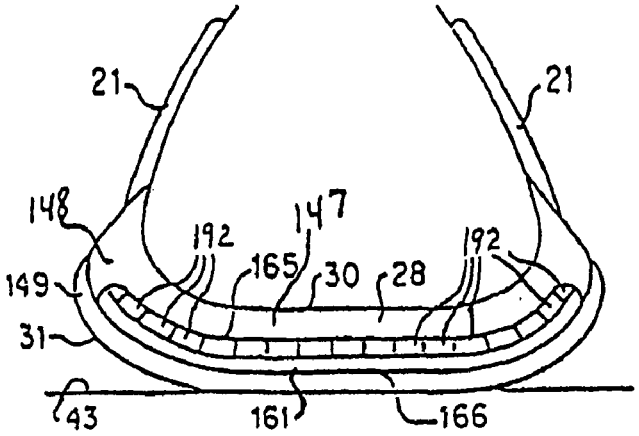
Figure 60A:
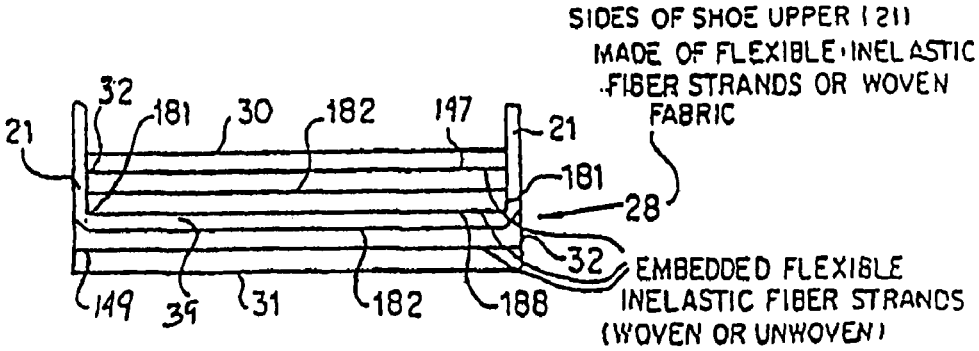

FIG. 59F shows a unique combination of the FIGS. 9 and 10A-C design above. The upper surface of the bottomsole 166 and the lower surface of the midsole 165 contain the cushioning compartment 161, which is subdivided into two parts. The lower half of the cushioning compartment 161 is both structured and functions like the compartment shown in FIG. 9 above. The upper half is similar to FIGS. 10A-C above but subdivided into chambers 192 that are more geometrically regular so that construction is simpler; the structure of the chambers 192 can be honeycombed. The advantage of this design is that it copies more closely than the FIG. 9 design the actual structure of the wearer's foot sole, while being much more simple to construct than the FIG. 10A-C design. Like the wearer's foot sole, the FIG. 59F design would be relatively soft and flexible in the lower half of the chamber 161, but firmer and more protective in the upper half, where the chambers 192 would stiffen quickly under load-bearing pressure. Other multi-level arrangements are also possible. FIGS. 60A-60D show the use of embedded flexible inelastic fiber or fiber strands, woven or non-woven, in various embodiments similar those shown in FIGS. 58A-58D. FIG. 60E is a figure showing a frontal plane cross-section of a fibrous capsule shell 191 that directly envelopes the surface of the midsole section 188.

Figure 61B:
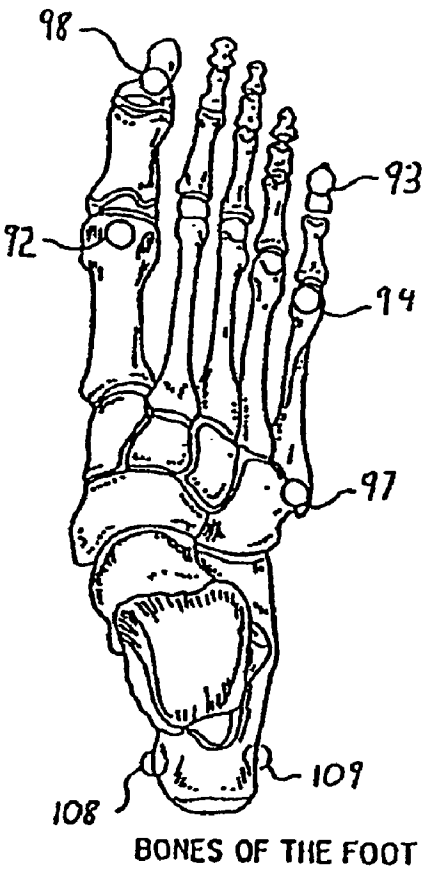
FIG. 61B shows an overhead perspective of the actual bone structures of the foot that are indicated in FIG. 63C.
Figure 61A:
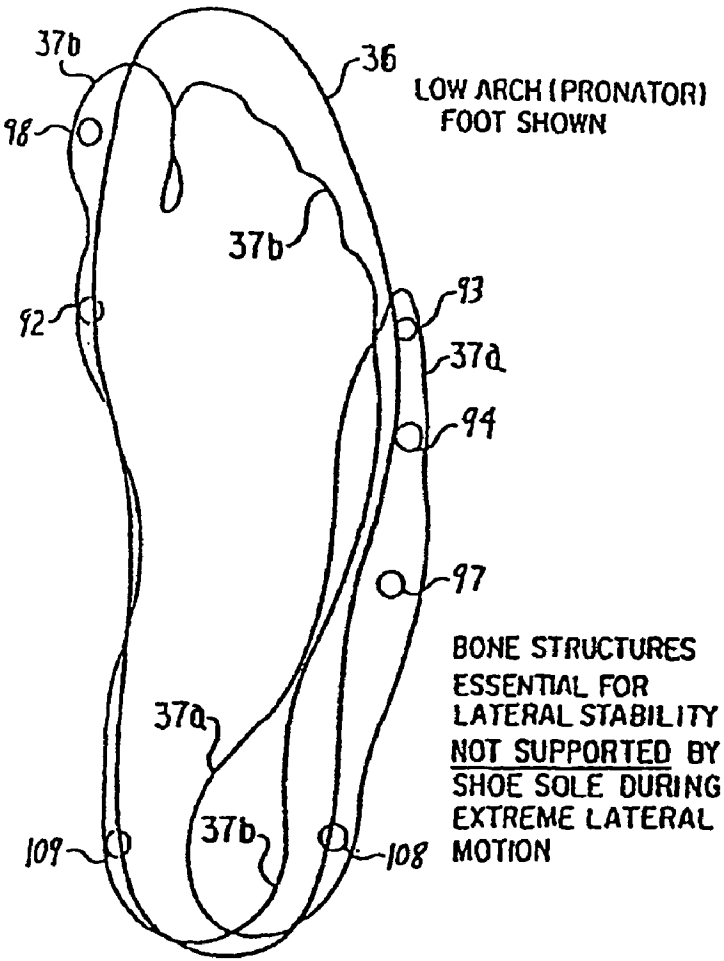
FIG. 61A compares the footprint made by a conventional shoe with the relative positions of the wearer's right foot sole in the maximum supination position 37*a* and the maximum pronation position 37*b*.

FIG. 61A compares the footprint made by a conventional shoe shown as shoe sole outline 36 with the relative positions of the wearer's right foot sole in the maximum supination position 37*a* and the maximum pronation position 37*b*. FIG. 61 C reinforces the indication that more relative sideways motion occurs in the forefoot and midtarsal areas than in the heel area.

As shown in FIG. 61A, at the extreme limit of supination and pronation foot motion, the base of the calcaneus 109 and the lateral calcaneal tuberosity 108 roll slightly off the sides of the peripheral extent of the upper surface of shoe sole 35. However, at the same extreme limit of supination, the base of the fifth metatarsal 97 and the heads of the fifth metatarsal 94 and the fifth distal phalange 93 all have rolled completely off the peripheral extent of the upper surface of the shoe sole 35.

FIG. 61B shows an overhead perspective of the actual bone structures of the foot.

Figure 62:
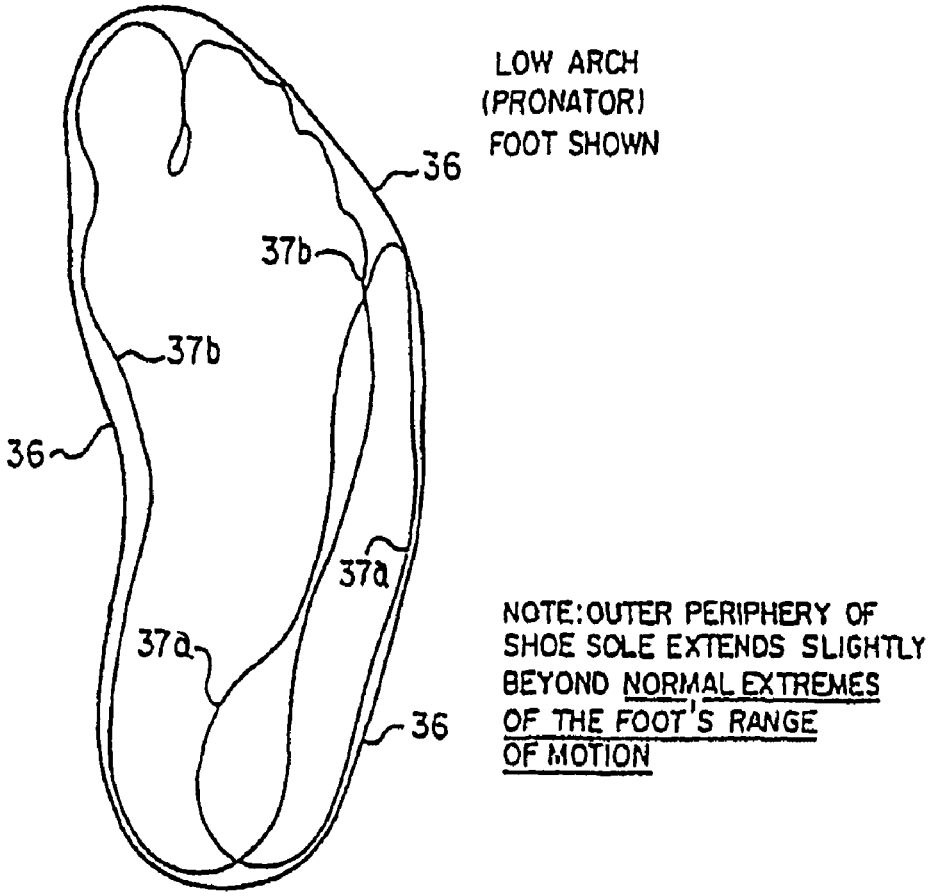
FIG. 62 compares a footprint made by a convention shoe with the relative position of the wearer's right foot sole in the maximum supination position.

FIG. 62 is similar to FIG. 57 above in that it shows a shoe sole that covers the full range of motion of the wearer's right foot sole, with or without a lateral stability sipe 11. However, while covering that full range of motion, it is possible to abbreviate the rounded sides of the shoe sole to only the essential structural and propulsion elements of the foot sole as previously discussed herein.

Figure 63:
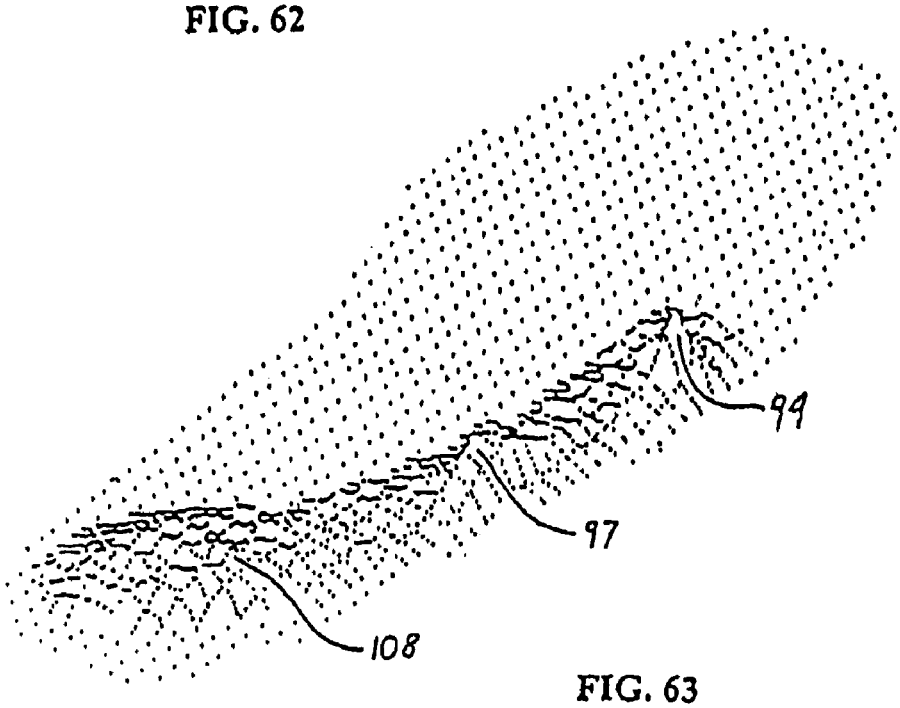
FIG. 63 shows an electronic image of the relative forces present at the different areas of the bare foot sole when at the maximum supination position shown as 37*a* in FIG. 61A; the forces were measured during a standing simulation of the most common ankle spraining position.

FIG. 63 shows an electronic image of the relative forces present at the different areas of the bare foot sole when at the maximum supination position shown as 37*a* in FIG. 62 above; the forces were measured during a standing simulation of the most common ankle spraining position. The maximum force was focused at the head of the fifth metatarsal 94 and the second highest force was focused at the base of the fifth metatarsal 97. Forces in the heel area were substantially less overall and less focused at any specific point.

FIG. 63 indicates that, among the essential structural support and propulsion elements shown in FIG. 40 above, there are relative degrees of importance. In terms of preventing ankle sprains, the most common athletic injury (about two-thirds occur in the extreme supination position 37*a* shown in FIG. 62), FIG. 63 indicates that the head of the fifth metatarsal 94 is the most critical single area that must be supported by a shoe sole in order to maintain barefoot-like lateral stability. FIG. 63 indicates that the base of the fifth metatarsal 97 is very close to being as important. Generally, the base and the head of the fifth metatarsal 94, 97 are completely unsupported by a conventional shoe sole 22.

Figure 64:
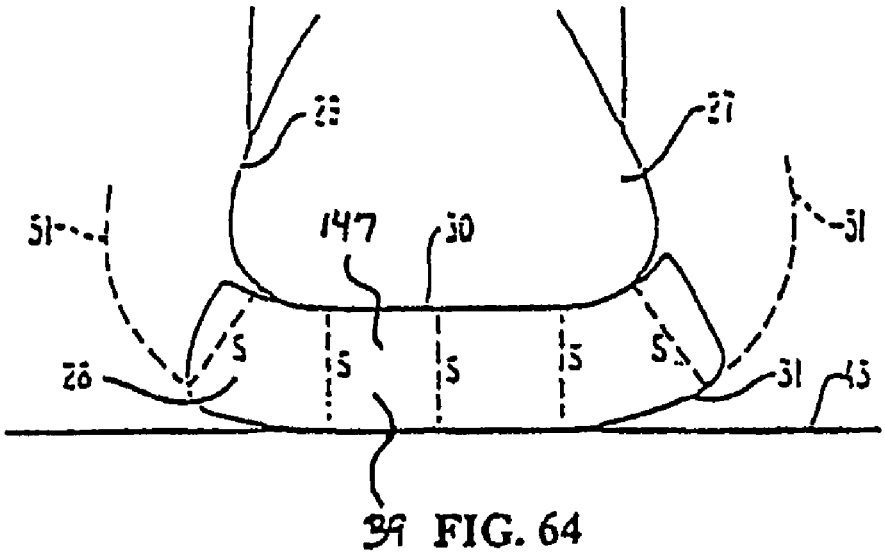
FIG. 64 shows on the right side an upper shoe sole surface of the rounded side that is complementary to the shape of the wearer's foot soles on the left side

The right side of FIG. 64 includes an inner shoe sole surface 30 that is complementary to the shape of all or a portion the wearer's foot sole. In addition, this application describes rounded sole side designs wherein the upper surface of the theoretically ideal stability plane 51 lies at some point between conforming or complementary to the shape of the wearer's foot sole, that is—roughly paralleling the foot sole including its side—and paralleling the flat ground 43; that upper surface of the theoretically ideal stability plane 51 becomes load-bearing in contact with the foot sole during foot inversion and eversion which is normal sideways or lateral motion.

Again, for illustration purposes, the left side of FIG. 64 describes shoe sole side designs wherein the lower surface of the theoretically ideal stability plane 51, which equates to the load-bearing surface of the bottom or outer shoe sole of the shoe sole side portions is above the plane of the underneath portion of the shoe sole, when measured in frontal or transverse plane cross-sections; and that lower surface of the theoretically ideal stability plane 51 becomes load-bearing in contact with the ground during foot inversion and eversion which is normal sideways or lateral motion.

Although the inventions described in this application may in some instances be less than optimal, they nonetheless distinguish over all prior art and still do provide a significant stability improvement over existing footwear and thus provide significantly increased injury prevention benefit compared to existing footwear.

Figure 65:
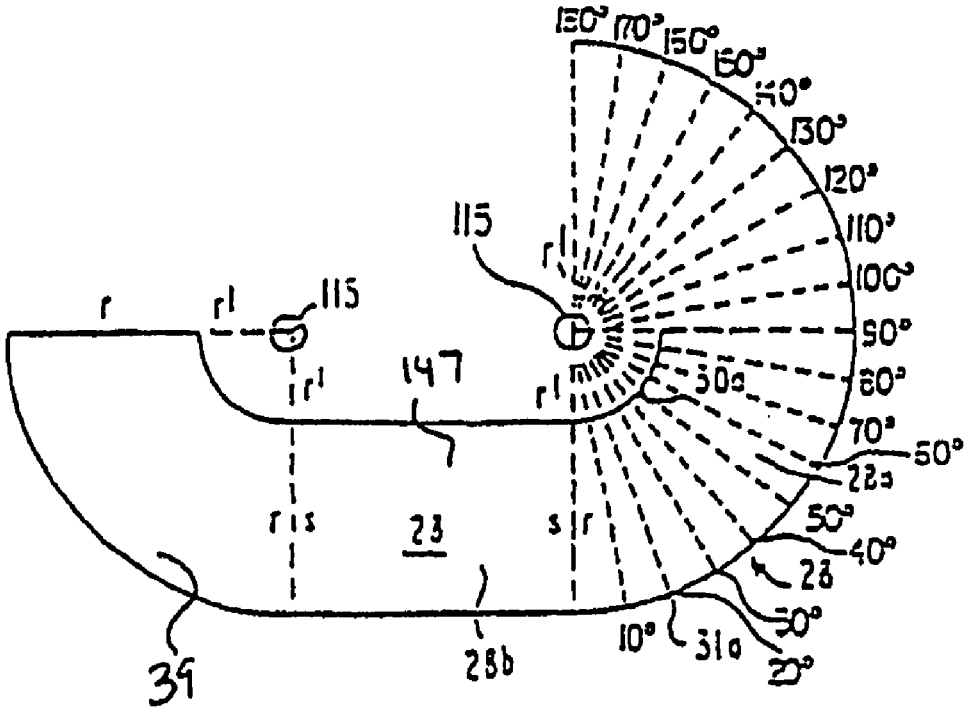
FIG. 65 indicates the angular measurements of the rounded shoe sole sides from zero degrees to 180 degrees.

FIG. 65 provides a means to measure the rounded shoe sole sides incorporated in the applicant's inventions described above. FIG. 65 correlates the height or extent of the rounded side portions of the shoe sole 28 with a precise angular measurement from 0-180°. That angular measurement corresponds roughly with the support for sideways tilting provided by the rounded shoe sole sides of any angular amount from 0-180°, at least for such rounded sides proximate to anyone or more or all of the essential stability or propulsion structures of the foot as defined above. The rounded shoe sole sides as described in this application can have any angular measurement from 0-180°.

FIGS. 66A-66F, FIGS. 67A-67E, and FIG. 68 describe shoe sole structural inventions that are formed with an upper surface to conform, or at least be complementary, to the all or most or at least part of the shape of the wearer's foot sole, whether under a body weight load or unloaded, but without rounded stability sides as defined by the applicant. As such, FIGS. 66-68 are similar to FIGS. 38-40 above, but without the rounded stability sides at the essential structural support and propulsion elements, which are the base and lateral tuberosity of the calcaneus, the heads of the first and fifth metatarsals, the base of the fifth metatarsal, and the first distal phalange, and with shoe sole rounded side thickness variations, as measured in frontal plane cross sections as defined in this and earlier applications.

FIGS. 66A-66F, FIG. 67A-67E, and FIG. 68, like the many other variations of the applicant's naturally rounded design described in this application, show a shoe sole invention wherein both the upper foot sole contacting surface of the shoe sole and the bottom, ground-contacting surface of the shoe sole mirror the contours of the bottom surface of the wearer's foot sole, forming, in effect, a flexible three dimensional mirror of the load-bearing portions of that foot sole when bare.

The shoe sole shown in FIGS. 66-68 preferably include an insole layer, a midsole layer, and bottom sole layer, and variation in the thickness of the shoe sole, as measured in sagittal plane cross-sections, like the heel lift common to most shoes as well as a shoe upper 21.

FIGS. 69A-69D show the implications of relative difference in range of motions between forefoot, midtarsal, and heel areas. FIGS. 69A-D are a modification of FIG. 33 above with the left side of the figures showing the required range of motion for each area.

Figure 69A:
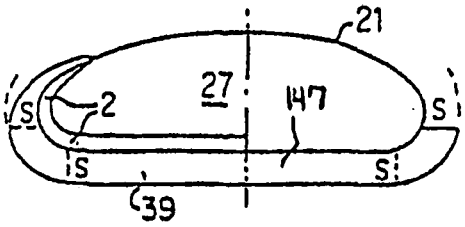
FIGS. 69A-69D show additional variations of the naturally rounded sides of the present invention.

FIG. 69A shows a cross-section of the forefoot area and, therefore, on the left side shows the highest rounded sides (compared to the thickness of the shoe sole in the forefoot area) to accommodate the greater forefoot range of motion. The rounded side is sufficiently high to support the entire range of motion of the wearer's foot sole. Note that the sock liner or insole 2 is shown.

Figure 69B:
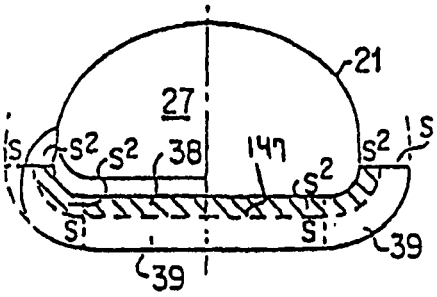
Figure 69C:
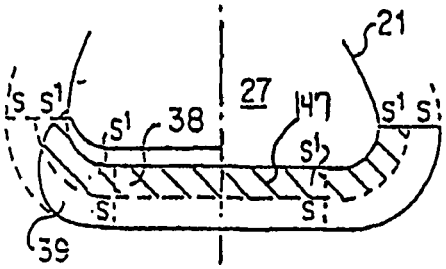
Figure 69D:
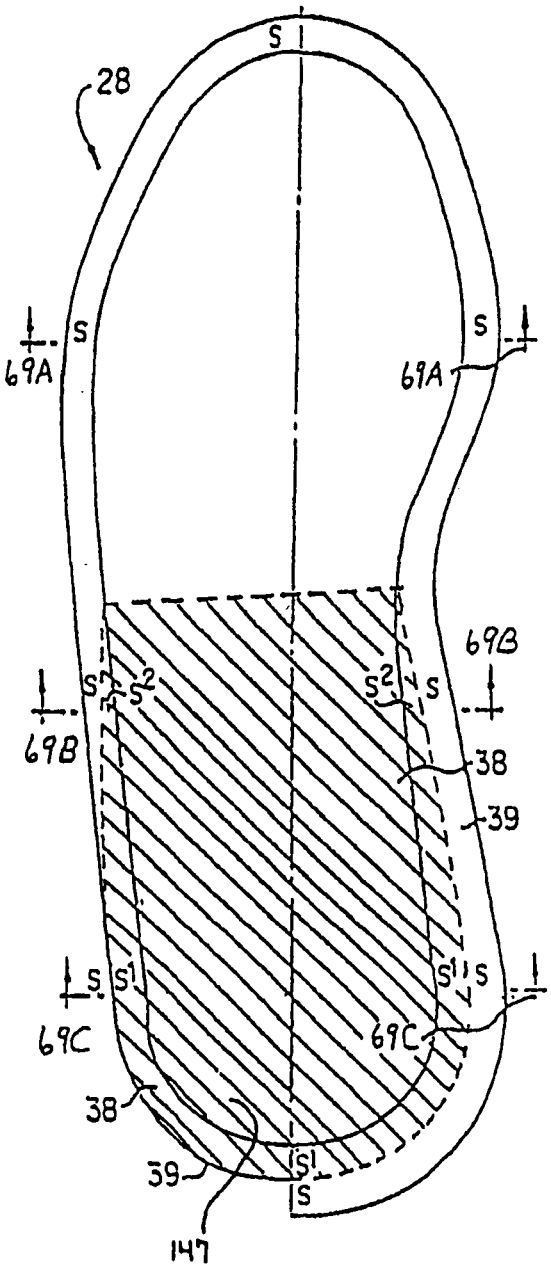

FIG. 69B shows a cross-section of the midtarsal area at about the base of the fifth metatarsal, which has somewhat less range of motion and therefore the rounded sides are not as high (compared to the thickness of the shoe sole at the midtarsal). FIG. 69C shows a cross-section of the heel area, where the range of motion is the least, so the height of the rounded sides is relatively the least of the three general areas (when compared to the thickness of the shoe sole in the heel area).

Each of the three general areas, forefoot, midtarsal, and heel, have rounded sides that differ relative to the height of those sides compared to the thickness of the shoe sole in the same area. At the same time, note that the absolute height of the rounded sides is about the same for all three areas and the contours have a similar outward appearance, even though the actual structure differences are quite significant as shown in cross-section.

In addition, the rounded sides shown in FIG. 69A-D can be abbreviated to support only those essential structural support and propulsion elements identified in FIG. 40 above. The essential structural support elements are the base and lateral tuberosity of the calcaneus 95, the heads of the metatarsals 96*c* and 96*d*, and the base of the fifth metatarsal 97. The essential propulsion element is the head of the first distal phalange 98.

Figure 70:
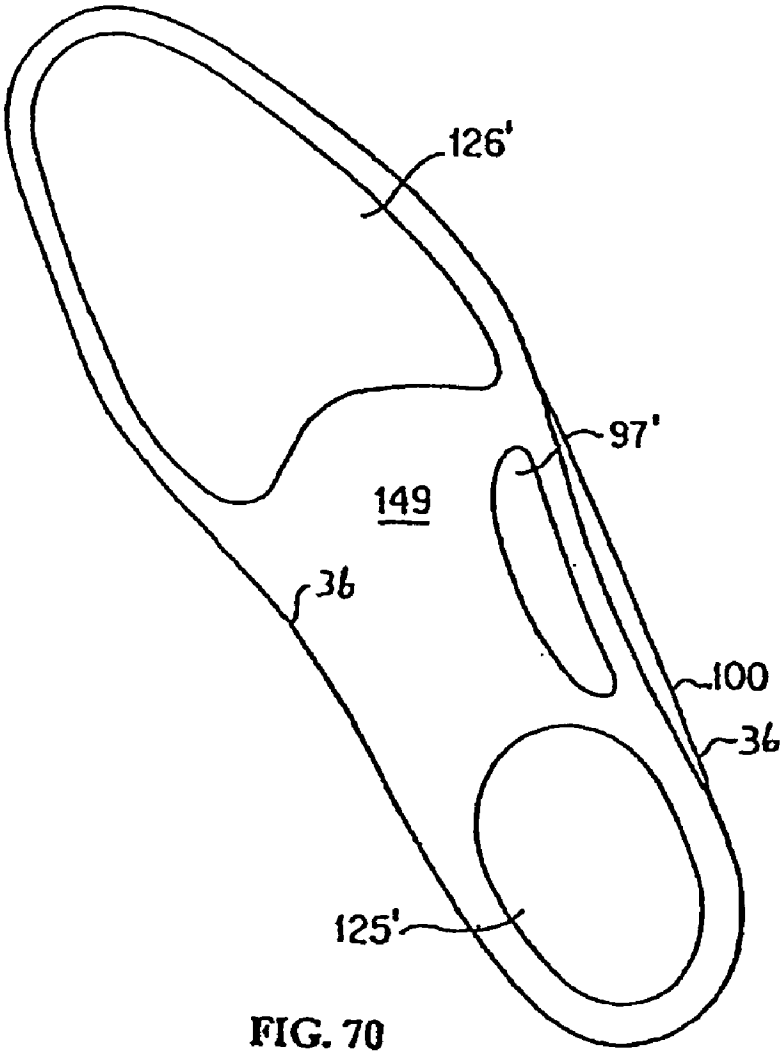
FIG. 70 shows a bottomsole structure with forefoot, heel, and base of the fifth metatarsal support areas.

FIG. 70 shows a similar view of a bottom sole structure 149 but with no side sections. The areas under the forefoot 126', heel 125', and base of the fifth metatarsal 97' would not be glued or attached firmly, while the other area (or most of it) would be glued or firmly attached. FIG. 70 also shows a modification of the outer periphery 36 of the conventional shoe sole 22 (i.e. the typical indentation at the base of the fifth metatarsal is removed and replaced by a fairly straight line 100).

Figure 71:
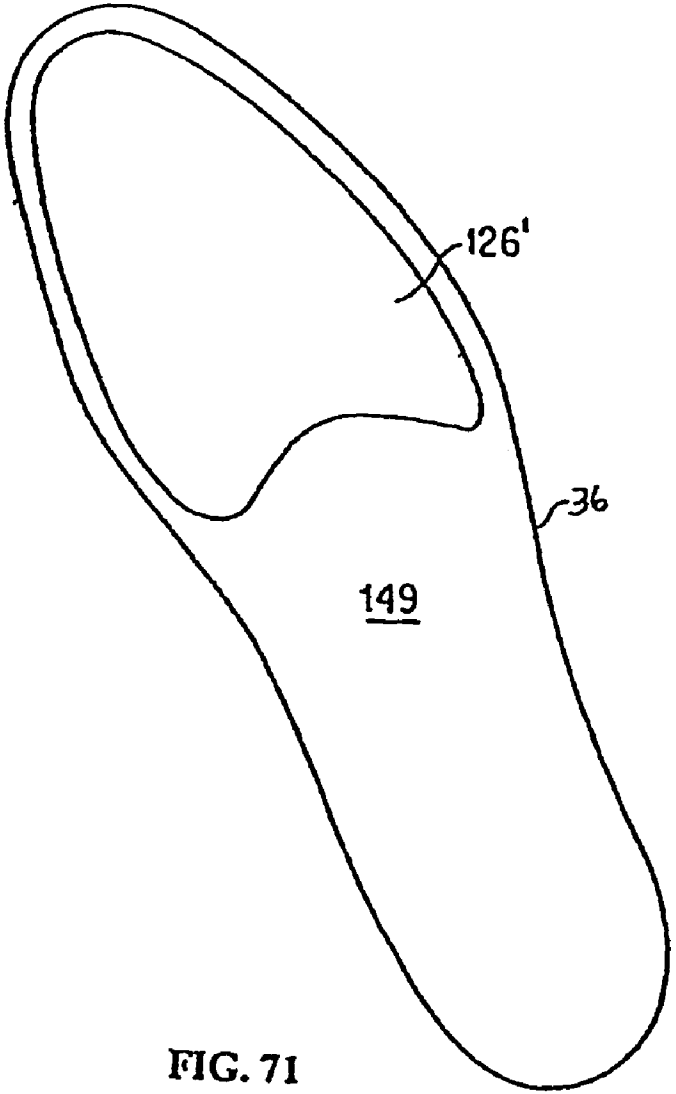
FIG. 71 shows a similar structure to FIG. 70, but with only the section under the forefoot unglued or not firmly attached.
Figure 72B:
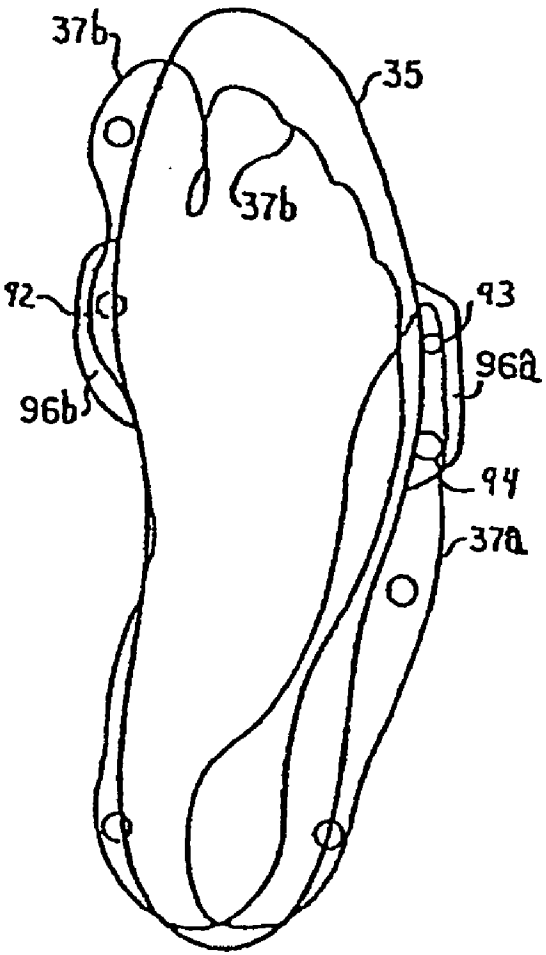
FIG. 72B shows a shoe sole with symmetrical stability additions 96*a* and 96*b*.
Figure 72A:
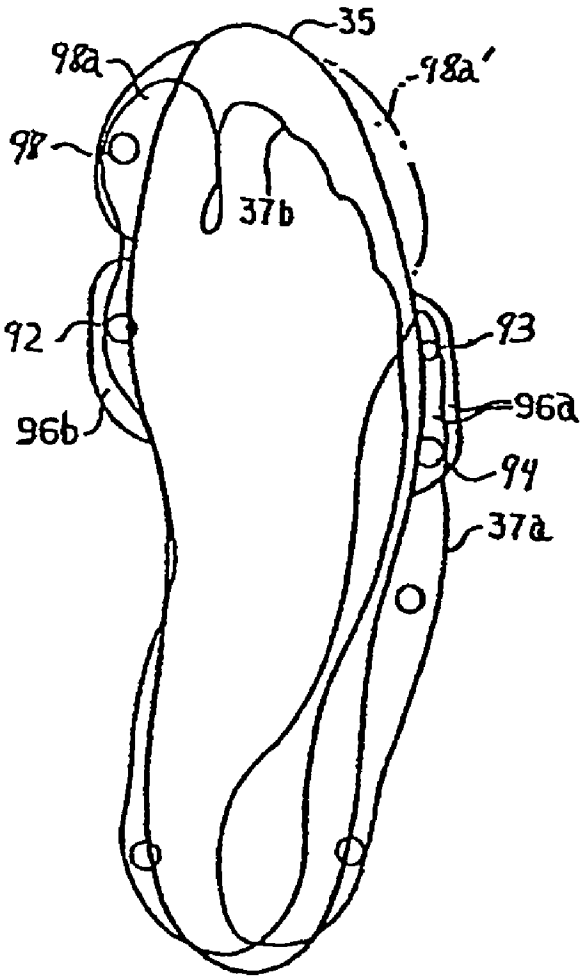
FIG. 72A shows a shoe sole combining additional stability corrections 96*a*, 96*b*, and 98*a*', supporting the first and fifth metatarsal heads and distal phalange heads.

FIG. 71 shows a similar structure to FIG. 70, but with only the section under the forefoot 126' unglued or not firmly attached; the rest of the bottom sole 149 (or most of it) would be glued or firmly attached. FIGS. 72A-72B show shoe soles with only one or more, but not all, of the essential stability elements (the use of all of which is still preferred) but which, based on FIG. 63, still represent major stability improvements over existing footwear. This approach of abbreviating structural support to a few elements has the economic advantage of being capable of construction using conventional flat sheets of shoe sole material, since the individual elements can be bent up to the contour of the wearer's foot with reasonable accuracy and without difficulty. Whereas a continuous naturally rounded side that extends all of, or even a significant portion of, the way around the wearer's foot sole would buckle partially since a flat surface cannot be accurately fitted to a rounded surface; hence, injection molding is required for accuracy. The features of FIGS. 72A-72B can be used in combination with the designs shown in this application. Further, various combinations of abbreviated structural support elements may be utilized other than those specifically illustrated in the figures.

FIG. 72A shows a shoe sole combining the additional stability corrections 96*a*, 96*b*, and 98*a* supporting the first and fifth metatarsal heads and distal phalange heads. The dashed line 98*a*' represents a symmetrical optional stability addition on the lateral side for the heads of the second through fifth distal phalanges, which are less important for stability.

FIG. 72B shows, a shoe sole with symmetrical stability additions 96*a* and 96*b*. Besides being a major improvement in stability over existing footwear, this design is aesthetically pleasing and could even be used with high heel type shoes, especially those for women, but also any other form of footwear where there is a desire to retain relatively conventional looks or where the shear height of the heel or heel lift precludes stability side corrections at the heel or the base of the fifth metatarsal because of the required extreme thickness of the sides. This approach can also be used where it is desirable to leave the heel area conventional, since providing both firmness and flexibility in the heel is more difficult that in other areas of the shoe sole since the shoe sole thickness is usually much greater there; consequently, it is easier and less expensive in terms of change, and less of a risk in departing from well understood prior art just to provide additional stability corrections to the forefoot and/or base of the fifth metatarsal area only.

Since the shoe sole thickness of the forefoot can be kept relatively thin, even with very high heels, the additional stability corrections can be kept relatively inconspicuous. They can even be extended beyond the load-bearing range of motion of the wearer's foot sole, even to wrap all the way around the upper portion of the foot in a strictly ornamental way (although they can also play a part in the shoe upper's structure), as a modification of the strap, for example, often seen on conventional loafers.

FIGS. 73A-73D show close-up cross-sections of shoe soles modified with the applicant's inventions for deformation sipes.

Figure 73A:
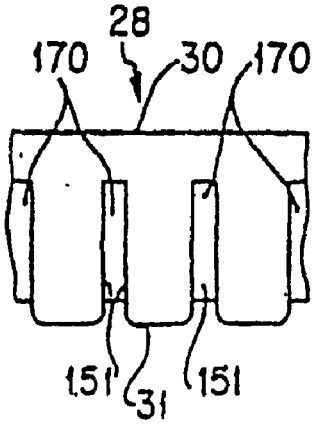
FIGS. 73A-73D show in close-up sections of the shoe sole including various new forms of sipes, including both slits and channels.
Figure 73B:
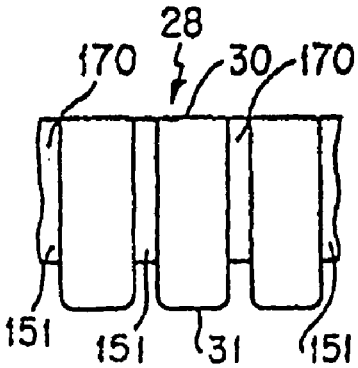

FIG. 73A shows a cross-section of a design with deformation sipes in the form of channels 151, but with most of the channels 151 filled with a filler material 170 flexible enough that it still allows the shoe sole 28 to deform like the human foot. FIG. 73B shows a similar cross-section with the channel sipes 151 extending completely through the shoe sole 28, but with the intervening spaces also filled with a flexible material 170 like FIG. 73A; a flexible connecting top layer of sipes 123 can also be used, but is not shown. The relative size and shape of the sipes 151 can vary almost infinitely. The relative proportion of flexible filler material 170 can vary, filling all or nearly all of the sipes 151, or only a small portion, and can vary between sipes 151 in a consistent or even random pattern. As before, the exact structure of the sipes 151 and filler material 170 can vary widely and still provide the same benefit, though some variations will be more effective than others. Besides the flexible connecting utility of the filler material 170, it also serves to keep out pebbles and other debris that can be caught in the channel sipes 151, allowing relatively normal bottom sole tread patterns to be created.

Figure 73C:
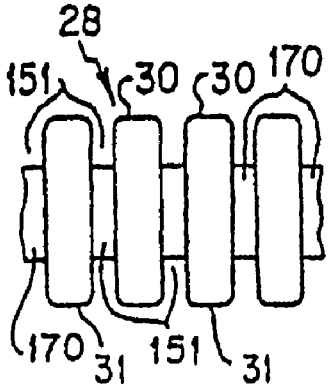
Figure 73D:
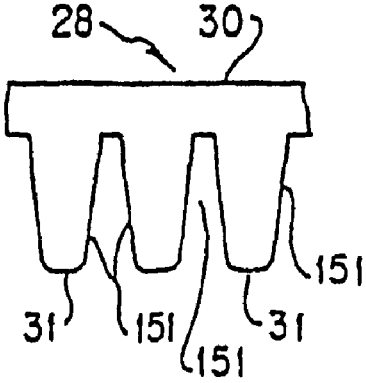

FIG. 73C shows a similar cross-section of a design with deformation sipes in the form of channels 151 that penetrate the shoe sole 28 completely and are connected by a flexible filler material 170 which does not reach the inner surface of the shoe sole 30. Such an approach can create an upper shoe sole surface similar to that of the trademarked Maseur™ sandals, but one where the relative positions of the various sections of the inner surface of the shoe sole 30 will vary between each other as the shoe sole 28 bends up or down to conform to the natural deformation of the foot. The shape of the channels 151 should be such that the resultant shape of the shoe sole sections would be similar but rounder than those honeycombed shapes of FIG. 14D of International Publication No. WO 91/05491. In fact, like the Maseur sandals, cylindrical sections with a rounded or beveled upper surface is probably optimal. The relative position of the flexible filler material 170 can vary widely and still provide the essential benefit. Preferably, the attachment of the shoe uppers 21 would be to the upper surface of the flexible filler material 170.

A benefit of the FIG. 73C design is that the resulting inner surface of the shoe sole 30 can change relative to the surface of the foot sole due to natural deformation during normal foot motion. The relative motion makes practical the direct contact between shoe sole 28 and foot sole without intervening insoles or socks, even in an athletic shoe 20. This constant motion between the two surfaces allows the inner surface of the shoe sole 30 to be roughened to stimulate the development of tough calluses (called a "Seri boot"), as described at the end of FIGS. 10A-C above, without creating points of irritation from constant, unrelieved rubbing of exactly the same corresponding shoe sole 28 and foot sole points of contact.

FIG. 73C shows a similar cross-section of a design with deformation sipes in the form of angled channel sipes 151 in roughly and inverted V-shape. Such a structure allows deformation bending freely both up and down; in contrast deformation slits can only be bent up and channel sipes 151 generally offer only a limited range of downward motion. The FIG. 73D angled channels would be particularly useful in the forefoot area to allow the shoe sole 28 to conform to the natural contour of the toes that curl up and then down. As before, the exact structure of the angled channel sipes 151 can vary widely and still provide the same benefit, though some variations will be more effective than others. Finally, deformation slits can be aligned above deformation channel sipes 151, in a sense continuing the channel in circumscribed form.

Figures 74, 74A, 74B, 74C, 74D, 74E:
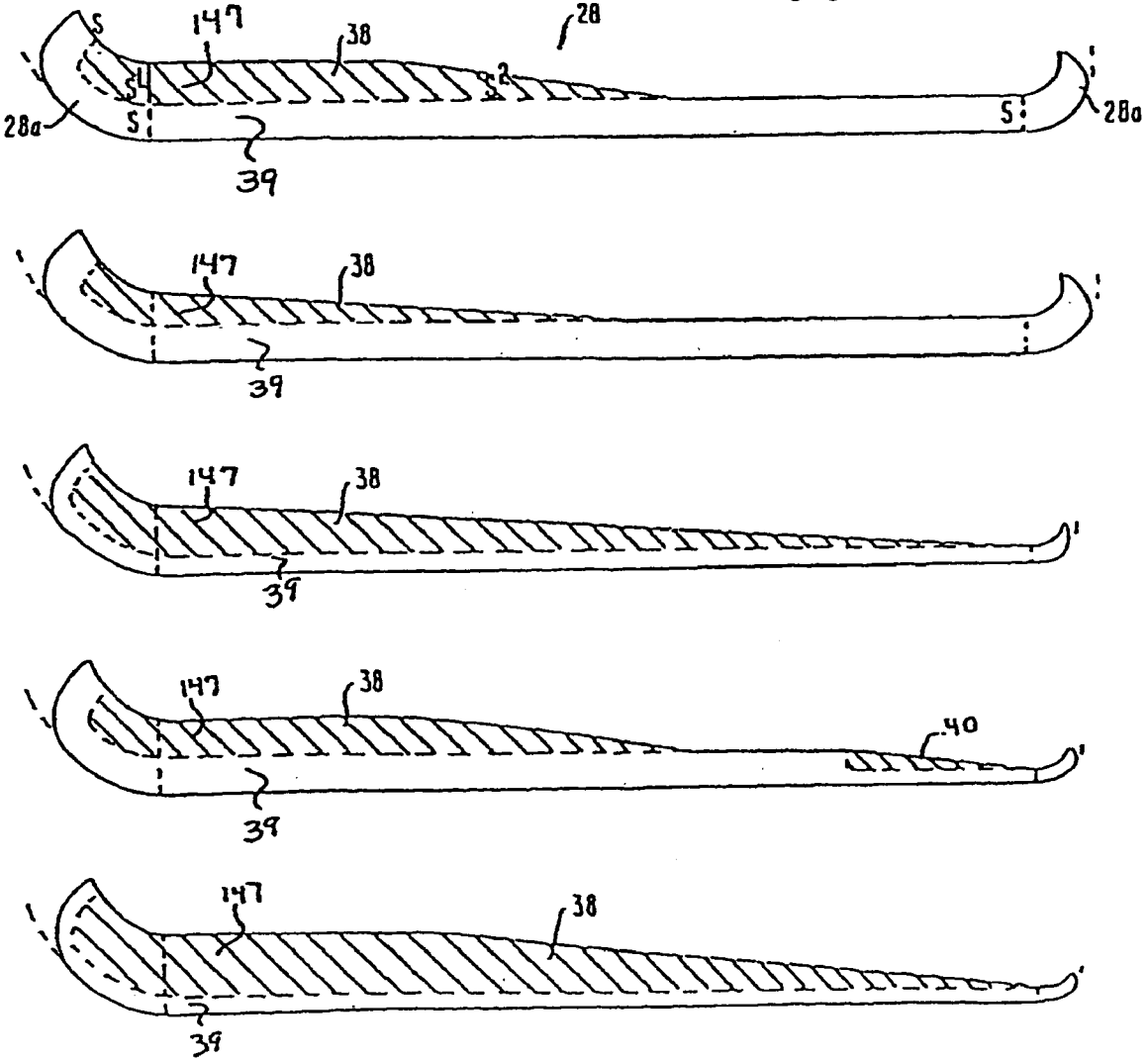
FIG. 74 shows, in FIGS. 74A-74B, a plurality of side sagittal plane cross-sectional views showing examples of variations in heel lift thickness similar to those shown in FIGS. 50A-E for the forefoot lift.

FIG. 74 shows sagittal plane shoe sole thickness variations, such as heel lifts 38 and forefoot lifts 40, and how the rounded stability sides 28*a* equal and, therefore, varying with those varying thicknesses as discussed in connection with FIG. 31.

FIG. 75 shows, in FIGS. 75A-75C, a method, mown from the prior art, for assembling the midsole shoe sole structure of the present invention, showing in FIG. 75C the general concept of inserting the removable midsole insert 145 into the shoe upper 21 and sole combination in the same very simple manner as an intended wearer inserts his foot into the shoe upper 21 and sole combination. FIGS. 75A and 75B show a similar insertion method for the bottom sole 149.

Figure 76:
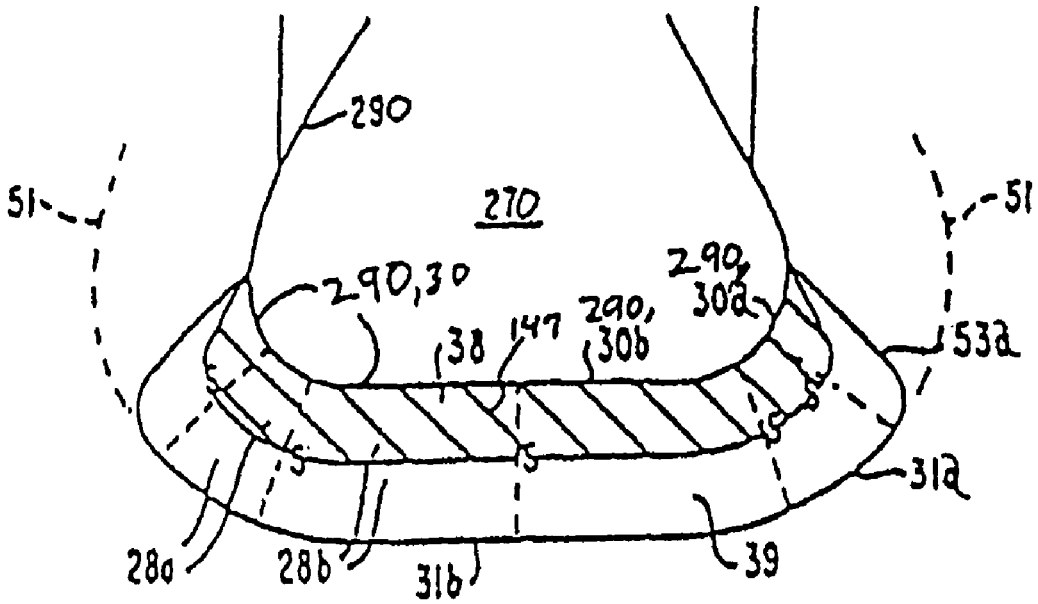
FIG. 76 shows a frontal plane cross-section of a shoe sole structure wherein one or more components are manufactured by the method of the present invention.
Figure 77:
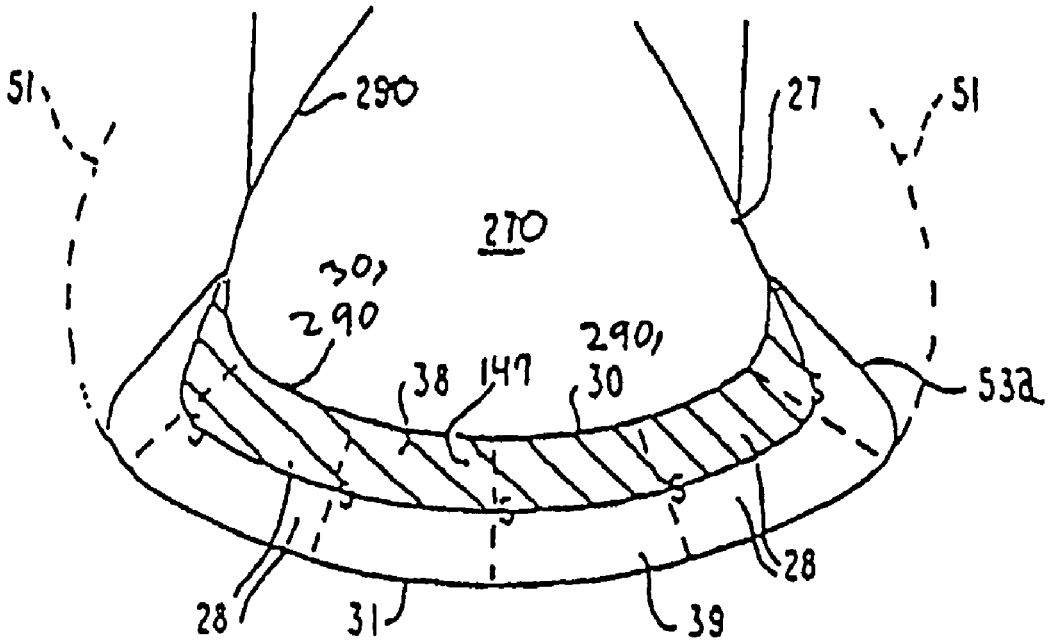
FIG. 77 also shows a frontal plane cross-section of a shoe sole structure wherein one or more components are manufactured by the method of the present invention.

Referring to FIGS. 76 and 77, the invention disclosed includes an inner shoe sole surface 30 with one or more rounded portions that is substantially the same as a lower surface 290 with one or more rounded portions of a shoe sole last 270 for a mass-produced shoe designed to fit an averaged size wearer as is conventional in the art. The invention adds a outer surface 31 with one or more rounded surfaces that is substantially the same or at least similar in shape to the inner surface 30, both shoe soles as seen in a frontal plane cross-section in an unloaded, upright shoe sole condition.

The inner shoe sole surface 30 can be made with conventional molding means but can advantageously be made using a laser or other scan of the lower surface 290 of the shoe sole last 270, using scanning means well mown in the art, such as a digital laser scanner or other conventional scanner for use with a digital computer. Scan data obtained using a laser scanning apparatus may be entered into a CAD/CAM system, which can be used to substantially reproduce the inner shoe sole surface 30 on the outer shoe sole surface 31 by copying it using the scanned data. The scan resolution can be adjusted to achieve the degree of accuracy needed or to meet the requirements of the CAD/CAM system. Using the CAD/CAM system, the outer shoe sole surface 31 can be increased in scale to create shoe soles 28 as shown in FIGS. 11, 38, 39, 48, 51, 66, and 67, for example. Alternatively, any other version or modification of the shoe soles depicted in the figures shown in this application can also be made by this method. For example, the scanned data can be mathematically manipulated in any number of ways to create new designs based on the original scanned data.

The shoe last can be any shoe last, but the more accurately the shoe last fits the true anatomic form of the average wearer's foot, the more comfortable and stable will be the shoe sole 28 derived therefrom. Thus, it is preferred to employ a shoe last which accurately fits the anatomic form of an average wearer's foot, including a category or class of wearers such as pronators, supinators, flat-footed, high-arched, heavy, etc.

Use of this scanning methodology and/or CAD/CAM system invention to aid in the making of a shoe sole 28 in the manner described above allows the manufacturing of very complex and highly non-regular geometric shapes for shoe soles 28 such as those shown in FIGS. 11, 38, 39, 48, 51, 66, and 67, for example. Such shoe soles 28 can be made based on the similarly complex and highly non-regular geometric shape of the wearer's human foot 27. This invention solves an important and longstanding problem, which is that the extreme complexity of certain shoe sole embodiments of the shoe sole designs shown in FIGS. 11, 38, 39, 48, 51, 66, and 67, for example, which incorporate relatively thick portions of cushioning midsole 148 with heel lift 38, are too complicated to be produced accurately and/or economically through conventional shoe design and construction techniques. As a result, the very high degree of comfort and stability afforded by those designs are practically not obtainable except through the use of the method of the invention as described above.

The method of the present invention can be used to make any surface of a shoe, including surfaces of athletic shoes 20, such as the inner and outer surfaces of an insole, midsole 148, bottom sole 149, or the shoe upper 21. Any other elements of the shoe sole such as the shank or shanks, the compartment or compartments and any other cushioning, stability or support devices may also be made using the method of the present 15 invention. In fact, all or any part of the shoe sole 28 or shoe upper 21 can be made using the method of the above-described invention.

The lower surface of the bottom sole 149 made using the method of the present invention can include the tread pattern, if used, or exclude it.

The above invention can be used as part of a prototyping process or manufacturing process to form all or part of the shoe sole 28 or shoe upper 21 directly out of shoe sole material or materials or shoe upper material or materials. Alternatively, the invention can be used to create shoe sole manufacturing molds that may then be used to directly make all or part of the shoe sole.

Using the method of the present invention, all or any part of the shoe sole inner surface 30 can be tilted relative to the shoe sole inner surface 30 as viewed in a sagittal plane cross-section to make sagittal plane thickness variations such as heel lift, toe taper or negative heel shoe soles, for example.

In addition to being increased in scale, the shoe sole outer surface 31 described above can also be modified using the CAD/CAM system in other ways. A particularly advantageous modification is to scan one foot or both feet of the individual intended wearer's foot sole, instead of scanning a standard size shoe last with inherently a somewhat different size and shape than the individual intended wearer's foot, to create embodiments like FIGS. 14 and 15, for example, in comparison to similar FIGS. 76 and 77. The standard size shoe last intended for mass-production can itself be designed by using an average of the feet (either right or left or both) of a number of intended wearers who approximate the standard size or by scanning a representative individual wearer's foot or several individual wearer's feet.

An inner surface 30 based on an individual intended wearer's foot can be combined with an outer surface 31 based on a standard size or other shoe last. Also, a shoe sole inner surface 30 derived from a standard size or other size shoe last can be combined with an outer shoe sole surface 31 based on a foot sole or feet soles of an individual intended wearer or a group of intended wearers. When a group of wearers of similar size or category is employed as the basis for the design, a single design may be obtained by, for example, averaging the sizes and/or contours of the feet of the group of wearers. Any of the inner and outer surfaces 30 and 31 can be scanned and/or molded. Combinations with molded or other non-scanned shoe sole surfaces, upper and lower, is also possible.

Scanning an individual or group of intended wearers can be done directly on the wearers' bare foot or feet, or on the foot or feet wearing socks or other intermediary material. This may be useful if it is desired to fabricate a shoe design customized to a sock covered wearer's foot or feet, for example.

FIGS. 78A-78E illustrate the above described method and structure, wherein generally the medial and lateral side portion outer surfaces 31 are bent out from the medial and lateral side portion inner surfaces 53*a* and from the copy 30' of the inner surface 30 in the position of the lower surface. For comparison, outer surface 31 is a superimposed conventional flat lower surface, like that of an Adidas™ Adilette sandal which includes an inner surface 30 concavely rounded to approximately match the rounded shape of a standard sized intended wearer's upright, unloaded foot sole. Uniformly thick side portions are shown, as viewed in a frontal plane cross-section in a shoe sole upright, unloaded condition. Such uniformly thick sides as viewed in a frontal plane have a stability and comfort advantage.

The outer surface 31 of the central portion of the shoe sole shown in FIGS. 78A-78E may be either a copy 30' of the inner surface 30 with uniformly thick side portions, or may be slightly changed, if desired. This may be accomplished, for example, using the method of the present invention described above. Similar surface configurations can be made in sagittal plane cross-sections and as viewed in top view or horizontal plane views of the sole as well.

Figure 78A:
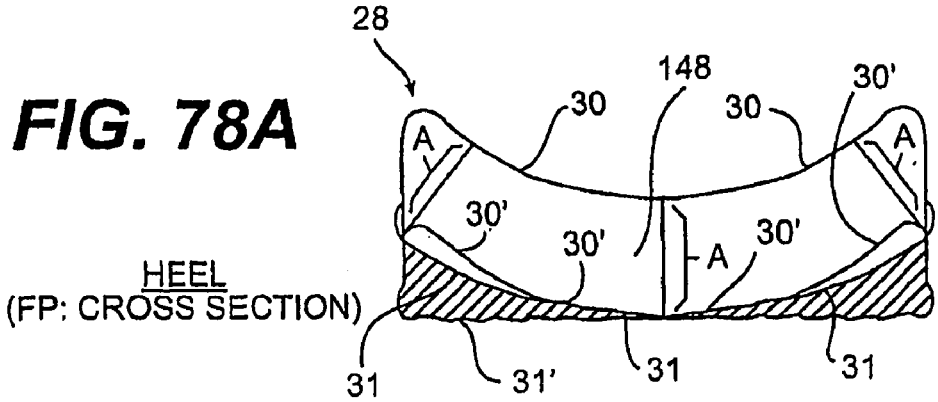
Figure 78B:
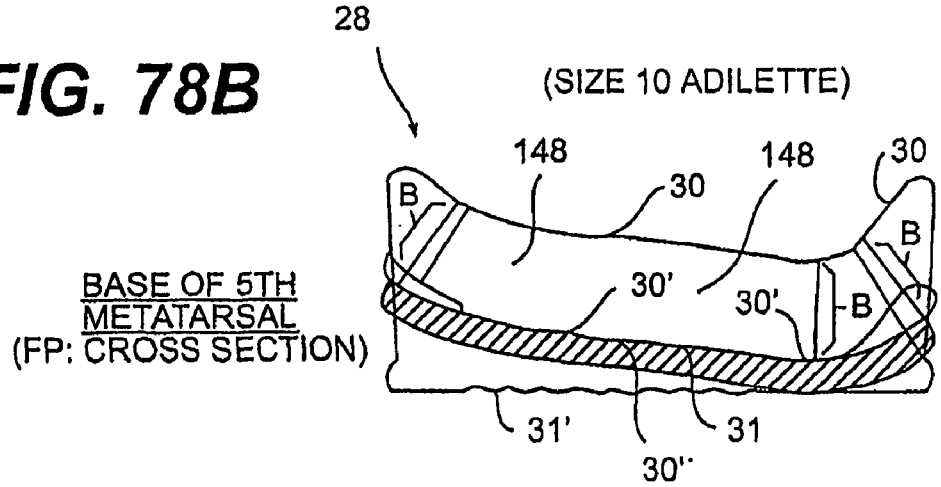
Figure 78C:
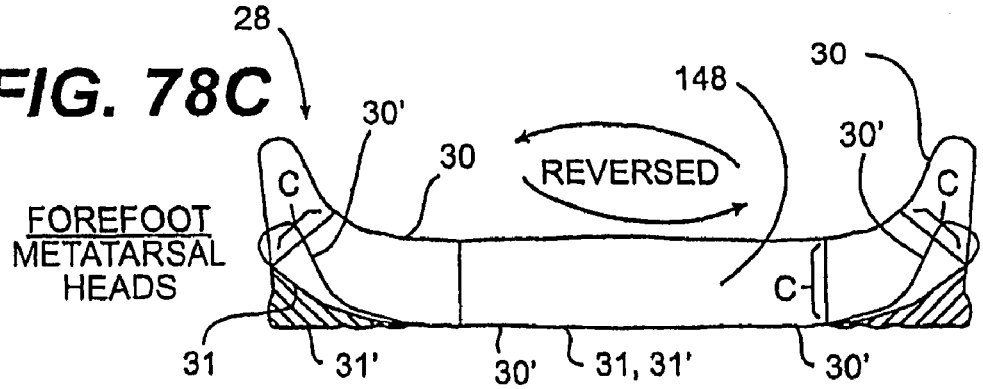
Figure 78D:
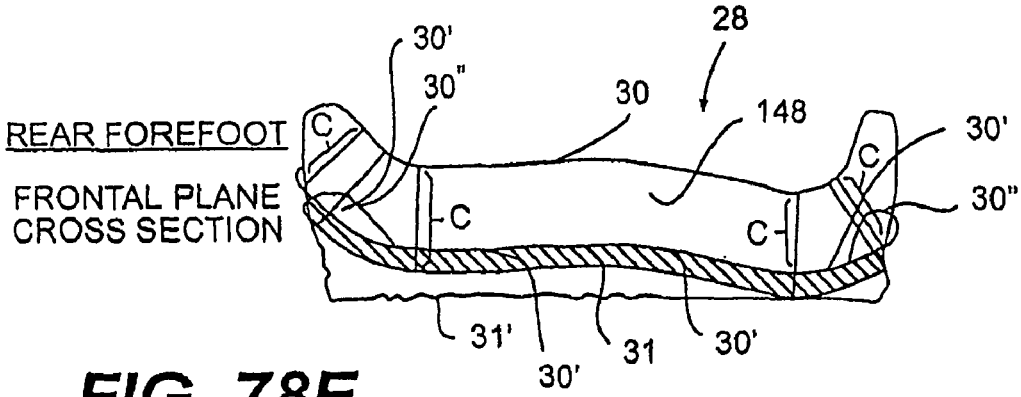
Figure 78E:
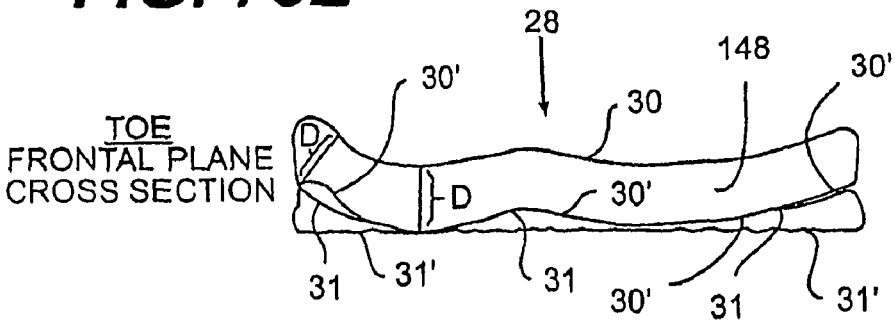

In addition, FIGS. 78B and 78D show a thickness adjustment in the sole designed to enhance comfort and stability in the midtarsal area of the shoe sole 28 by providing a frontal plane thickness B in the midtarsal area that is about halfway between the thickness of the heel area frontal plane thickness A and the frontal plane thickness C in the forefoot area under the heads of the metatarsals; that is, B=C+(A−C)/2. With this shoe sole thickness adjustment, the sole area located in the vicinity of the intended wearer's foot base of the fifth metatarsal bone can deform to flatten under a body weight load or heavier loads such as those encountered during locomotion, especially three or more times body weight during running and even higher peak forces when jumping high, in a natural manner, like the flattening of the intended wearer's bare foot on the ground.

Various features of the embodiments shown in FIGS. 76, 77, and 78 can be combined with the features of one or more embodiments shown in any of the preceding FIGS. 1-75 of this application. More specifically, anyone or more of the embodiments of FIGS. 1-75 of the present application may be fabricated using the method of the present invention described above.

The combinations of the many elements of the applicant's invention introduced in the preceding figures are shown because those embodiments are considered to be at least among the most useful. However, many other useful combinations embodiments are also clearly possible but are not shown simply because of the impossibility of showing them all while maintaining reasonable brevity and conciseness in what is already an unavoidably long description due to the highly interconnected nature of the features shown herein, each of which can operate independently or as part of a combination of others.

Figure 79:
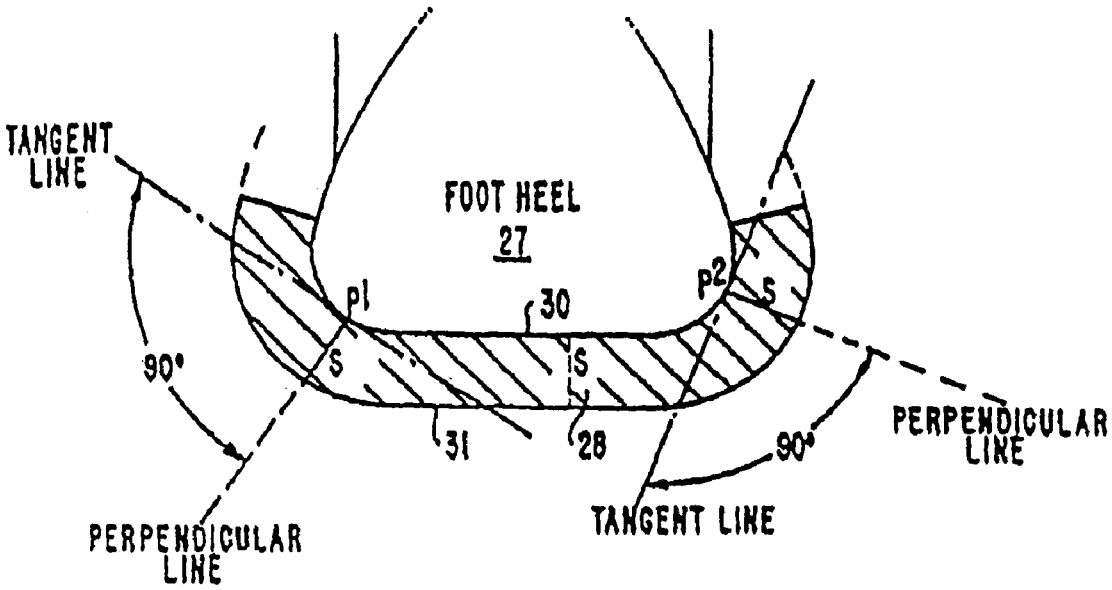

FIG. 79 shows a method of measuring shoe sole thickness which may, for example, be used to construct the theoretically ideal stability plane of the naturally contoured sole design. The shoe sole thickness may be measured at any point on the outer surface 31. The thickness is defined as the length of a line extending to the inner surface 30 from a selected point on the outer surface 31 in a direction perpendicular to a line tangent to the outer surface 31 at the selected point, as viewed in a frontal plane cross-section when the shoe sole 28 is in an upright, unloaded condition.

Figure 80:
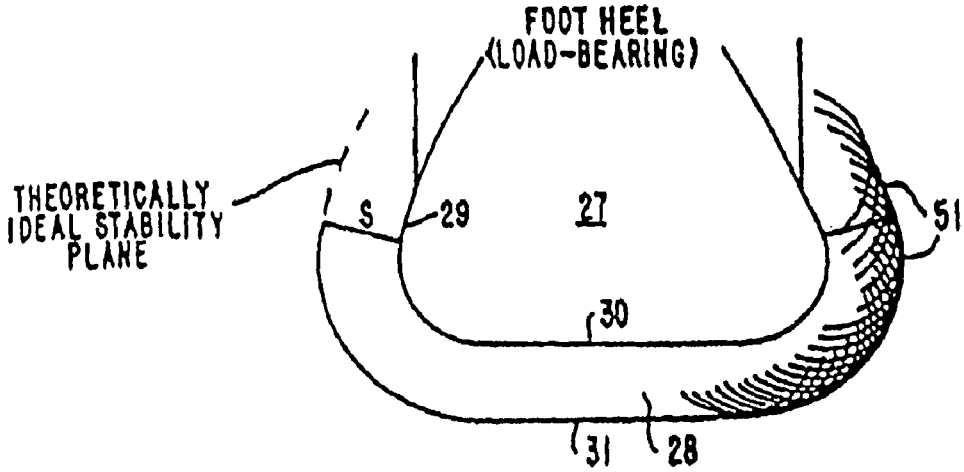

FIG. 80 illustrates another approach to constructing the theoretically ideal stability plane, and one that is easier to use, i.e., the circle radius method. Using the circle radius method, the pivot point or circle center of a compass is placed at the beginning of the foot sole's natural side contour, as viewed in a frontal plane cross-section. Then, up to a 90° arc of a circle having a radius (s) which is same as the shoe sole thickness (s), is drawn to proscribe the area farthest away from the foot sole contour, as viewed in a frontal plane cross-section when the shoe sole 28 is in an upright, unloaded condition. The process is repeated along the length of the foot sole's natural side contour at very small intervals; the smaller the interval, the more accurate the construction of the theoretically ideal stability plane. When all the circle sections have been drawn, the outer edge farthest from the foot sole contour, as viewed in a frontal plane cross-section, is established at a distance of (s) and the established outer edge coincides with the theoretically ideal stability plane. Both this method and that described in FIG. 79 may be used for both manual and CAD/CAM design applications.

Figure 81:
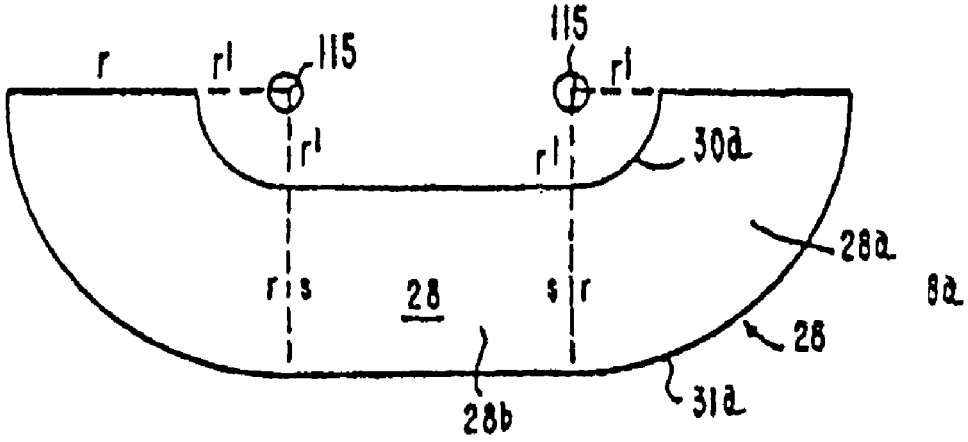

FIG. 81 illustrates an expanded explanation of a preferred approach for measuring shoe sole thickness according to the naturally contoured design, as described above in FIGS. 79-80. The tangent line described with reference to those figures is parallel to the ground when the shoe sole 28 is tilted out sideways, so that measuring shoe sole thickness along the perpendicular line, as described with reference to FIG. 79, will provide the least distance between the point on the inner surface 30 of the shoe sole 28 closest to the ground and the closest point on the outer surface 31 of the shoe sole 28, as viewed in a frontal plane cross-section when the shoe sole is in an upright, unloaded condition.

Figure 82:
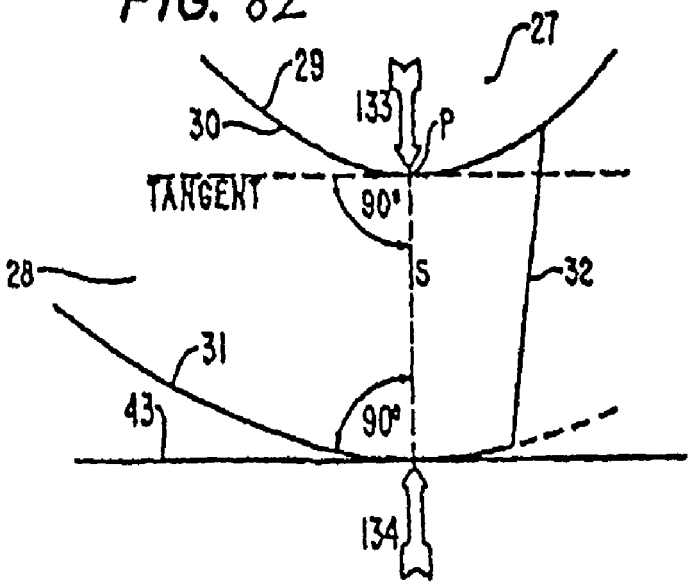

FIG. 82 shows a frontal plane cross-section of an alternate embodiment for the invention showing the shape of two component rounded stability sides 28*a* that may be determined in a mathematically precise manner to conform approximately to the shape of the sides of the foot 27. The component stability sides 28*a* form a quadrant of a circle of radius ($r+r^1$), where the distance (r) is equal to sole thickness (s). Consequently, the sub-quadrant ($r+r^1$) of radius ($r^1$) is removed from quadrant ($r+r^1$) as shown in FIG. 82 to create the inner surface contour. In geometric terms, the component stability side 28*a* is a section of a ring, such as a quarter of a ring. The center of rotation 115 of the quadrants is selected to achieve a sole side inner surface 30*a* that closely approximates the natural contour of the side of the human foot 27. This method may also be used for both manual and/or CAD/CAM design applications.

FIGS. 83-114 show the applicant's new inventions incorporating new forms of devices with one or more internal (or mostly internal) sipes, including slits or channels or grooves and other shape, including geometrically regular or non-regular shapes, such as anthropomorphic shapes, into a large variety of products, including footwear and orthotics, athletic, occupational and medical equipment and apparel, padding for equipment and furniture, balls, tires and any other structural or support elements in a mechanical, architectural or any other device.

FIGS. 83-97, 99, and 104-114 show, as numeral 510, examples of a device or flexible insert including siped compartments 161 or chambers 188 or bladders (another term used in the art) for use in any footwear soles, including conventional soles 22 or the applicant's prior inventions, including footwear/shoe soles 28 and midsole inserts 145, or for orthotics 145 as described in the applicant's WO 02/09547 WIPO publication, including for uppers for footwear or orthotics (or including uppers), or for other flexibility uses in athletic equipment like helmets and apparel including protective padding and guards, as well as medical protective equipment and apparel, and other uses, such as protective flooring, improved furniture cushioning, balls and tires for wheels, and other uses.

The device or flexible insert with siped compartments or chambers 510 include embodiments like two or more of either compartments 161 or chambers 188 or bladders (or a any mix including two or more of a compartment, a chamber, and a bladder) that are separated at least in part or in several parts or mostly or fully by an internal sipe 505. The flexible insert 510 can be inserted during assembly of an article by a maker or manufacturer or is insertable by a user or wearer (into an article like a shoe, for example, as part of a removable midsole insert 145 described above), or integrated into the construction of a device as one or more components.

Siped compartments or chambers 510 include example embodiments such as FIGS. 83-97, 99, and 104-114 which generally show at least one inner compartment 161 or chamber 188 inside at least one other outer compartment 161 or chamber 161; and the two compartments/chambers 161/188 being separated by an internal sipe 505.

One practical example embodiment of the invention is any prior commercial embodiment of Nike Air™ gas bladder or compartment (like typical examples in FIGS. 12-16 of U.S. Pat. No. 6,846,534, which is hereby incorporated by reference) that is installed unattached, as is, located within the space enclosed partially or fully by a new, slightly larger outer compartment of one additional layer of the same or similar material, with the same or a simpler or the simplest geometric shape; that is, not necessarily following indentations or reverse curves, but rather incorporating straighter or the straightest lines, as seen in cross-section: for example, following the outermost side curvature seen in FIGS. 12-16, but with upper and lower surfaces that are substantially flat and parallel (or curved and parallel), to facilitate ease of movement between the two surfaces of the sipe 505 formed, increasing the resulting flexibility.

The new additional, outer compartment thus thereby has created by its presence an internal sipe 505 between the two unconnected compartments. The new internal sipe 505 provides much greater flexibility to any footwear sole 22 or 28, since it allows an inner, otherwise relatively rigid Nike Air™ compartment structure to become an inner compartment 501 (instead of typically being fixed into the other materials such as EVA of the footwear sole) to move freely inside the new outer compartment 500, which becomes a new compartment that is fixed to the footwear sole, rather that the conventional Nike Air™ bladder. The flexibility improvement allows the shoe sole to deform under a body weight load like a wearer's bare foot sole, so that stability is improved also, especially lateral stability.

The result is that the conventional, inner Nike Air™ compartment now contained by a new outer compartment can move easily within the overall footwear sole, allowing the sole to bend or flex more easily in parallel with the wearer's bare foot sole to deform to flatten under a body weight load, including during locomotion or standing, so that footwear sole stability is improved also, especially lateral stability. The extent to which the inner Nike Air™ compartment is "free-floating" within the new outer compartment can be controlled or tuned, for example, by one or more attachments (permanent or adjustable) to the outer compartment or by the media in the internal sipe.

The internal sipe 505 includes at least two surfaces that can move relative to each other to provide a flexibility increase for a footwear sole so that the shape of the footwear sole can deform under a body weight load to better parallel to the shape of the barefoot sole of a wearer under a same body weight load. The relative motion between the two internal sipe 505 surfaces increases the capability of the footwear sole to bend during locomotion under a wearer's body weight load to better parallel the shape of said wearer's bare foot sole.

In an analogous way, especially to the thicker heel portion of a typical shoe sole, a thick urban area telephone book has in effect hundreds of "internal sipes", each page being in effect separated by a sipe from each adjacent page, each of which thereby is able to move freely relative to each other, resulting in a flexible telephone book that bends quite easily. In contrast, if the same wood fiber material with the same dimensions as a thick telephone book were formed instead into a single piece with no pages, like a solid particle board, it would be quite rigid.

Also, the sliding motion between internal support surfaces within the shoe sole 28 allowed by internal sipe 505 in response to torsional or shear forces between a wearer's foot and the ground assists in controlling and absorbing the impact of those forces, whether sudden and excessive or chronically repetitive, thereby helping to protect the wearer's joints from acute or chronic injury, especially to the ankles, knees, hips, lower back, and spine.

A benefit of the siped compartments/chambers 510 is that, as a single unitary component, it can be used in a conventional manner in constructing the footwear sole 28, generally like that used with a conventional single layer compartment such as used in Nike Air™; i.e. the outer surface of 510 can, as a useful embodiment, adhere to the adjacent materials like plastic such as PU (polyurethane) or EVA (ethyl vinyl acetate) or rubber of the footwear sole that contact the 510 component, just as would be the case with the outer surface of existing single compartment 161 or chamber 188 of commercial examples of Nike Air™. However, the internal sipe 505 formed by the use of an inner compartment/chamber 501 in the siped compartment/chamber 510 provides flexibility in a footwear sole 28 that is absent in the relatively rigid footwear sole 28 formed with a conventional, single layer compartment 161 or chamber 188 of the many Nike Air™ commercial examples.

The sipe surfaces can in one useful example embodiment be formed by the inner surface (or part or parts of it) of the outer compartment 500 and the outer surface (or part or parts of it) of the inner compartment 501. Such sipe surfaces can be substantially parallel and directly contact each other in one useful embodiment example, but the two surfaces are generally not attached to each other, so that the sipe surfaces can move relative to each other to facilitate a sliding motion between the two surfaces.

The sipe surfaces can be in other useful forms that allow portions of the surfaces to be proximate to each other in an unloaded condition, rather than contacting; such surfaces can make partial or full direct contact under a wearer's body weight load (which can vary from a fraction of a "g" to multiple "g" forces during locomotion) or remain somewhat separated; the amount of sipe surface area making direct contact can also vary with a wearer's body weight load. The sipes surfaces also may not be parallel or only partially parallel, such as the areas of direct surface contact or proximal surface contact.

To preclude the surfaces of the internal sipe 505 from directly contacting each other (whether loaded or unloaded), the sipe surfaces can include an internal sipe media 506 located between the surfaces to reduce friction by lubrication and increase relative motion and therefore flexibility. Useful example embodiments of the internal sipe media 506 include any useful material known in the art (or equivalent), such as a liquid like silicone as one example, a dry material like Teflon™ as another example, or a gas like that used in Nike Air™ as a further example. The media 506 can be located in all of the sipe 505 or only part or parts, as shown in FIGS. 83-88.

The media 506 can be used to decrease (or increase) sliding resistance between the inner surfaces of the sipe; for example, to lubricate with any suitable material known in the art. The internal sipe media 506 is an optional feature.

The siped compartments/chambers 510 can be located anywhere in the footwear sole or orthotic or upper and can be used in other applications, including non-footwear applications where flexibility increases are useful). The siped compartments/chambers 510 can be made, for example, with any methods and materials common in the footwear arts or similar arts or equivalents, like those in various Nike Air™ see for example U.S. Pat. Nos. 4,183,156 and 4,219,945 to Rudy (which show fluid-filled bladder manufacturing through a flat sheet bonding technique), 5,353,459 to Potter et al. (which shows fluid-filled bladders manufactured through a blow-molding process), as well as 6,837,951 and FIGS. 12-16 of 6,846,534, all of which patents are hereby incorporated by reference) or similar commercial examples like Reebok DMX™ compartments in its original form, as seen for example U.S. Pat. No. 6,845,573 (hereby incorporated by reference), column 5, line 41 to column 6, line 9), or New Balance N-ergy™ (see for example FIG. 1 of WIPO Pub. No. WO 00/70981 A1, but note that, as a example, at least the initial production versions of the N-ergy™ compartment should have less rigidity to allow desirable flexibility) or Asics Gel™ (many versions) compartments or future equivalents of any, or with less common materials, such as fibers described above incorporated into or on the surface of the material of the siped compartment/chambers 510, including either elastic fibers or inelastic fibers or a mix. The siped compartment/chambers 510 can be of any practical number in a footwear sole or any shape, of which useful example embodiments include regular geometric shapes or irregular shapes, including anthropomorphic shapes; and the 510 number or shape can be symmetrical or asymmetrical, including between right and left footwear soles.

Either of the compartments 161 or chambers 188 of the siped compartment/chambers 510 can include one or more structural elements 502 like those common in the footwear art such as in Nike Air™ as noted in the above cited Rudy and Nike patents, also including Tuned Air™ (See for example U.S. Pat. No. 5,976,451 to Skaja et al, which is hereby incorporated by reference and which shows manufacturing of fluid-filled bladders through a vacuum-forming process) or Zoom Air™ (See for example FIGS. 1-3 of U.S. App. No. 2005/0039346 A1, which is hereby incorporated by reference); a number of example embodiments of inner compartments 501 with structural elements 502 are shown in the FIGS. 83A, 91, 95, and 96. The structural elements 502 can be made of any useful material known in the art and constructed in any manner known in the art. FIGS. 107A and 108A show similar example embodiments wherein the structural elements 502 of the inner compartment 501 are formed with a specific shape and foamed plastic material such as PU or EVA like that of Nike Shox™ (See U.S. Pat. Nos. 5,353,523, 5,343,639, and 6,851,204, which are hereby incorporated by reference) and Nike Impax™ (U.S. D500,585 S, which is hereby incorporated by reference), respectively, and can be affixed to the inner compartment 501, which can be reinforced as necessary (instead of to rigid lower and/or upper plates); the lower surface of the outer compartment 500 can be attached to an outer sole, at least in part or an outer sole can be integrated into the outer compartment 500 by thickening, for example, or incorporating rubber or rubber substitute material. Other commercial existing examples that can be similarly modified as a device or flexible insert or component 510 are Adidas a$^3$™ Energy-Management Technology and Adidas™ Ground Control System (GPS)™, and Reebok DMX™ Shear Heel or other cushioning technologies.

Also, as shown in the example embodiments of FIGS. 108B and 107B, since foamed plastic material does not require containment (unlike a gas, liquid, or most gels), if the structural elements 502 are sufficiently interconnected, like for example Nike Impax™ in FIG. 108B, or if the separate support columns 32 and midsole wedge 40 of Nike Shox™ are modified to interconnect like the example shown in FIG. 107B, then those connected structural elements 502 can form an integral inner compartment 501, the outer surface of which can form an internal sipe 505 with the new outer compartment 500. The interconnection can be complete, with each structural elements 502 connected to at least the closest other elements 502, as shown, or mostly complete, or partial. The Shox™ support columns 32 can be any practical number, such as existing examples of four or five or six (both commercially available) or more in the heel and many more in the forefoot of the shoe sole 22 or 28, for a total of eleven in existing commercial examples.

Any of the compartments or chambers 161/188 of the siped compartment 510 can be permanently or temporarily attached one to another with at least one attachment 503 of any useful shape or size or number or position; embodiment examples are shown in FIGS. 83A, 84A, 85A, 86A, 87A, 88A, and 90. Anthropomorphic designs would include positioning attachments 503 on the internal sipe 505 closest to a wearer's foot sole, so that the remaining sipes 505 would have a U shape in cross-section, like the structure of human foot sole fat pads, which are analogous to the cushioning midsole and midsole components of footwear soles.

The attachments 503 can be simply passive (i.e. static) or actively controlled by electronic, mechanical, electromagnetic, or other useful means. The attachments 503 can, for example, be designed to break away as a failsafe feature to compensate for a predetermined extreme torsional load, for example, to reduce extreme stress on critical joints (in lieu of a wearer's cartilage, tendons, muscle, bone, or other body parts being damaged); the attachments 503 can then be reset or replaced (or, alternatively, return automatically to a normal position).

Example embodiments of the compartments and chambers 500/501 can include a media 504 such as a gas (like that used in Nike Air™ or ambient atmospheric air), a liquid or fluid, a gel, a foam (made of a plastic like PU or EVA, both of which are common in the footwear art, or equivalent, or of a rubber (natural or synthetic) or blown rubber or a rubber compound or equivalent or of another useful material or of a combination of two or more of the preceding foam plastic/rubber/etc.) or a useful combination of one or more gas, liquid, gel, foam, or other useful material.

Also, any inventive combination that is not explicitly described above in the example shown in FIG. 83 is implicit in the overall invention of this application and, consequently, any part of the example embodiments shown in preceding FIG. 83 and/or associated textual specification can be combined with any other part of any one or more other elements of the invention examples described in FIGS. 84-114 and/or associated textual specification and/or, in addition, can be combined with any one or more other elements of the inventive examples shown in earlier FIGS. 1-82 & 115-117 and/or associated textual specification of this application to make new and useful improvements over the existing art.

Figure 84A:
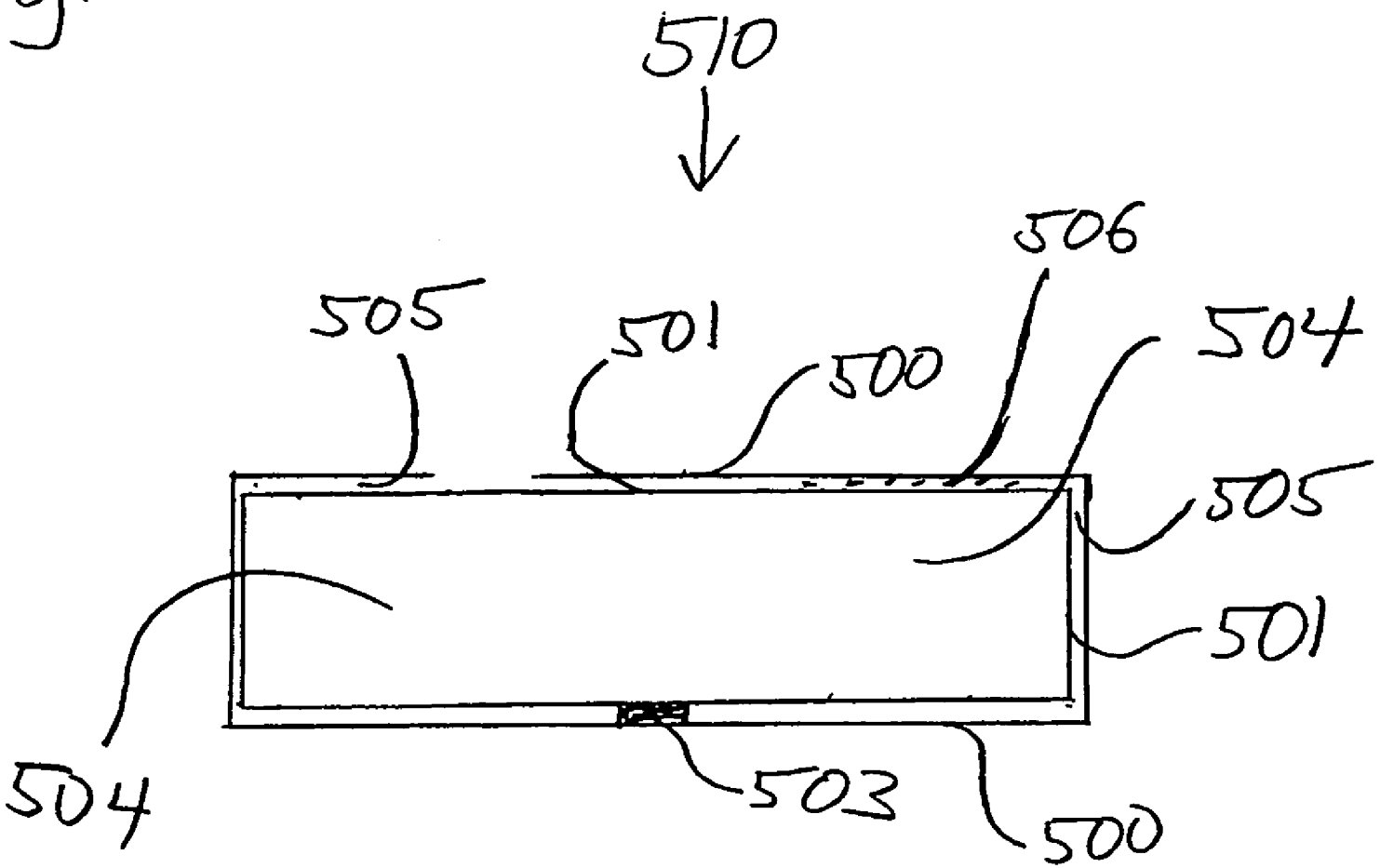
Figure 85A:
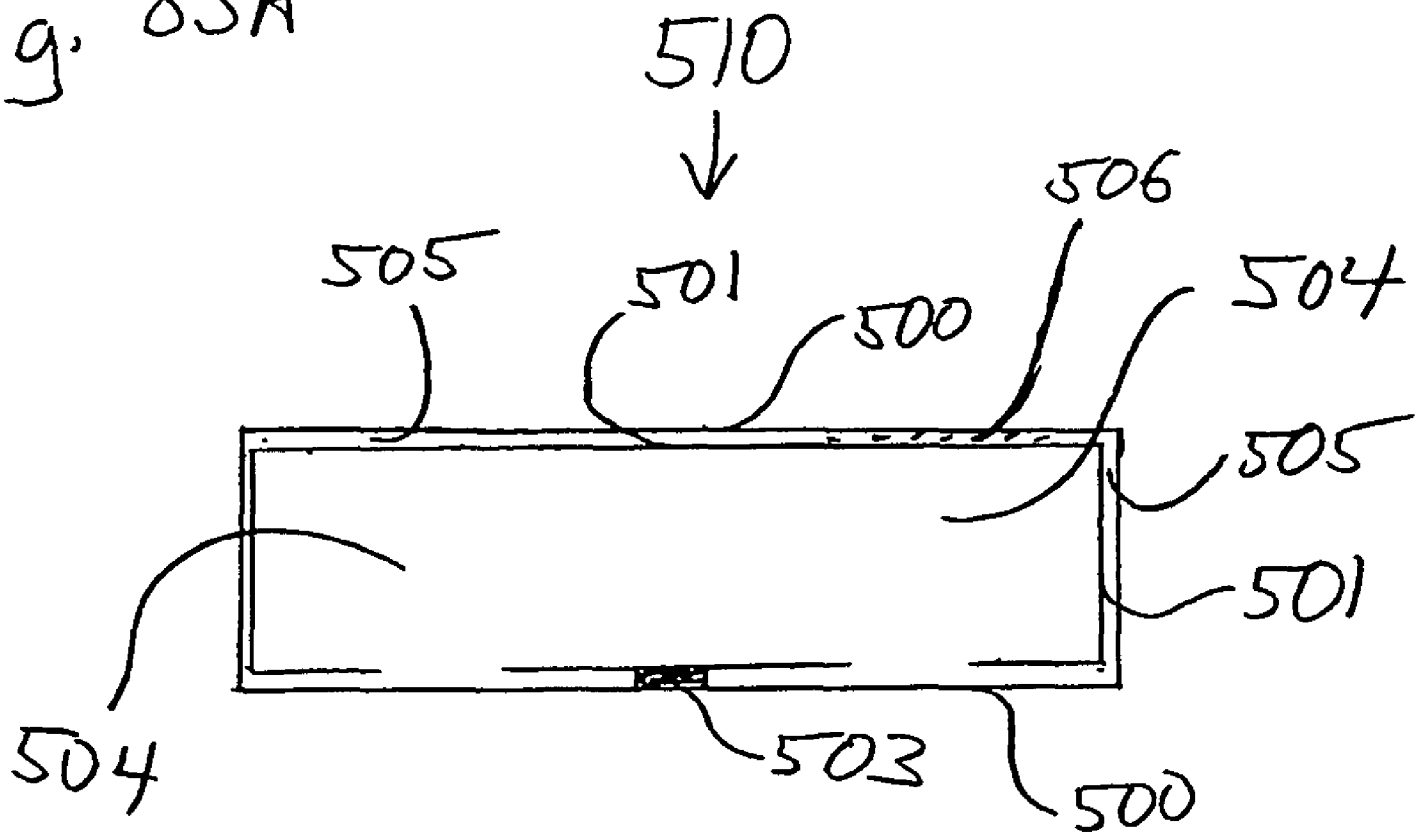
Figure 86A:
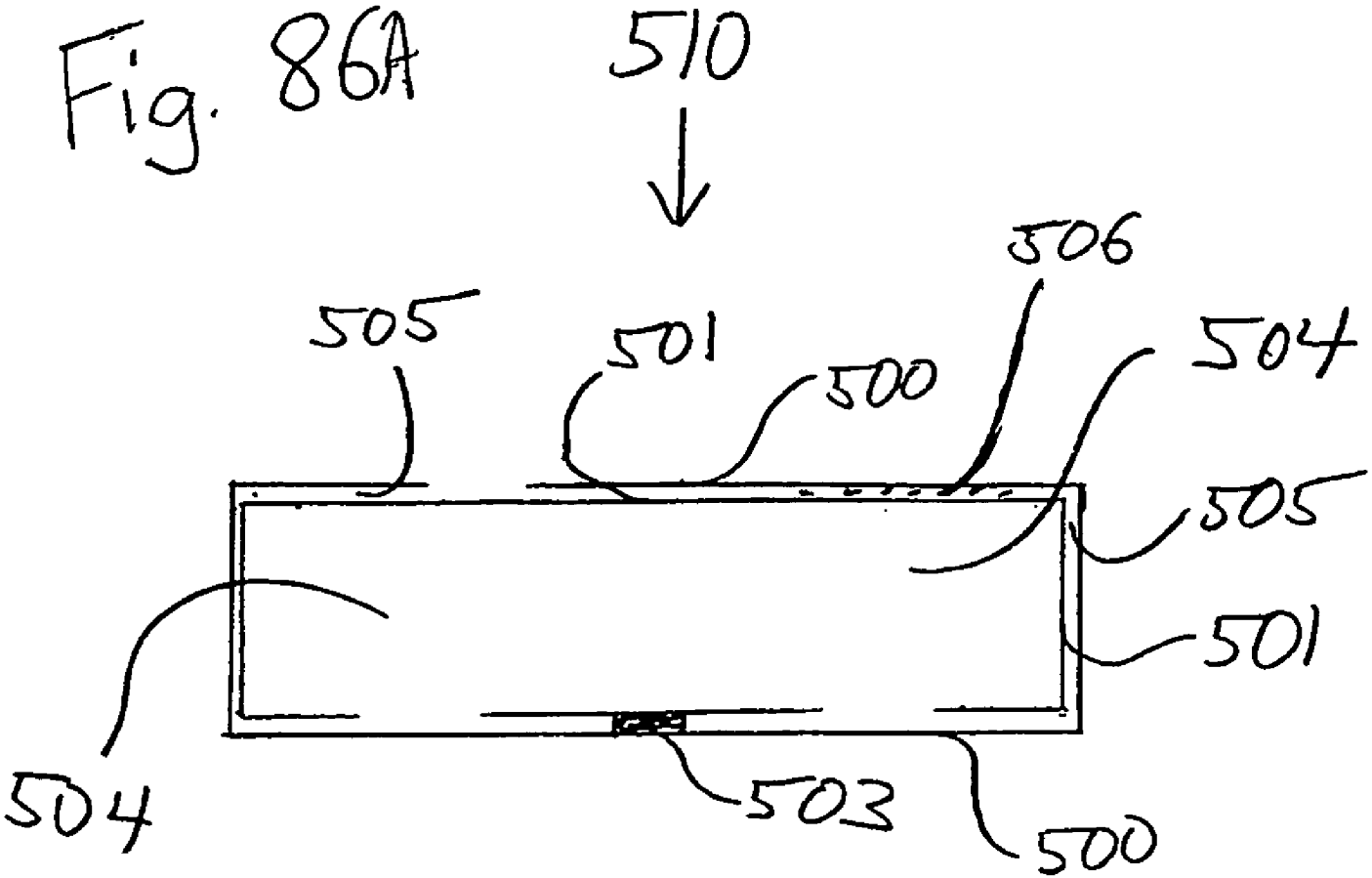

FIGS. 84A, 85A, and 86A show examples of embodiments of siped compartment/chambers 510 wherein either the inner compartment/chamber 501 or the outer compartment 500 can have one or more openings, for pressure equalization, assembly facilitation, or other purposes.

Also, any inventive combination that is not explicitly described above in the example shown in FIG. 84-86 is implicit in the overall invention of this application and, consequently, any part of the example embodiments shown in preceding FIG. 84-86 and/or associated textual specification can be combined with any other part of any one or more other elements of the invention examples described in FIGS. 83 and 87-114 and/or associated textual specification and/or, in addition, can be combined with any one or more other elements of the inventive examples shown in earlier FIGS. 1-82 & 115-117 and/or associated textual specification of this application to make new and useful improvements over the existing art.

Figure 87A:
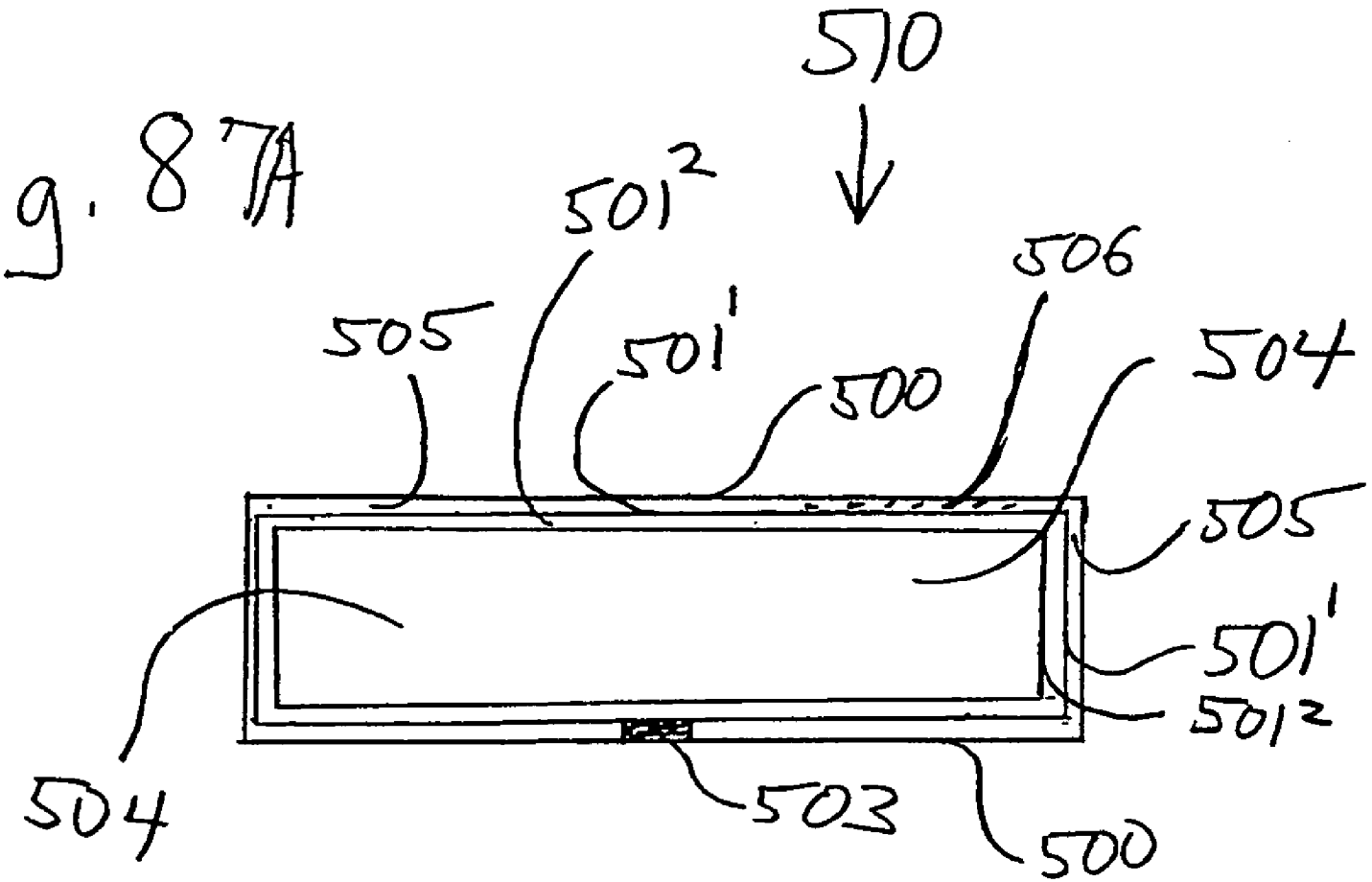

FIG. 87A shows an example embodiment with an inner compartment/chamber 501$^1$ having a smaller inner compartment/chamber 501$^2$; additional smaller inner compartments 501 are possible in a similar progression, either enclosed within the previous larger inner compartment 501 or within the same 501 or 500.

Figure 88A:
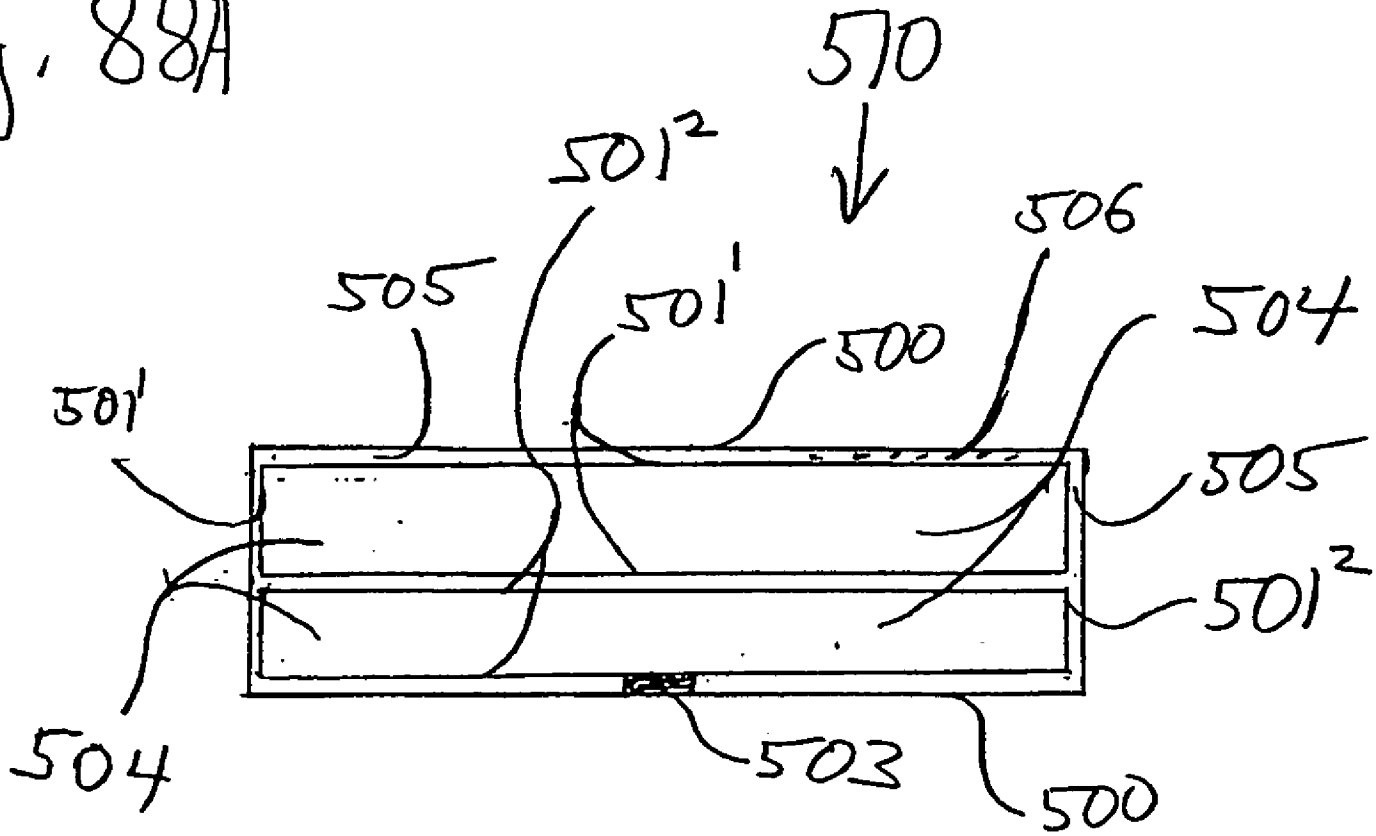

FIG. 88A shows an example embodiment with two inner compartment/chambers 501$^1$ and 501$^2$ which are layered within outer compartment/chamber 500; additional compartment/chamber 501 layers can be useful also.

Figure 83A:
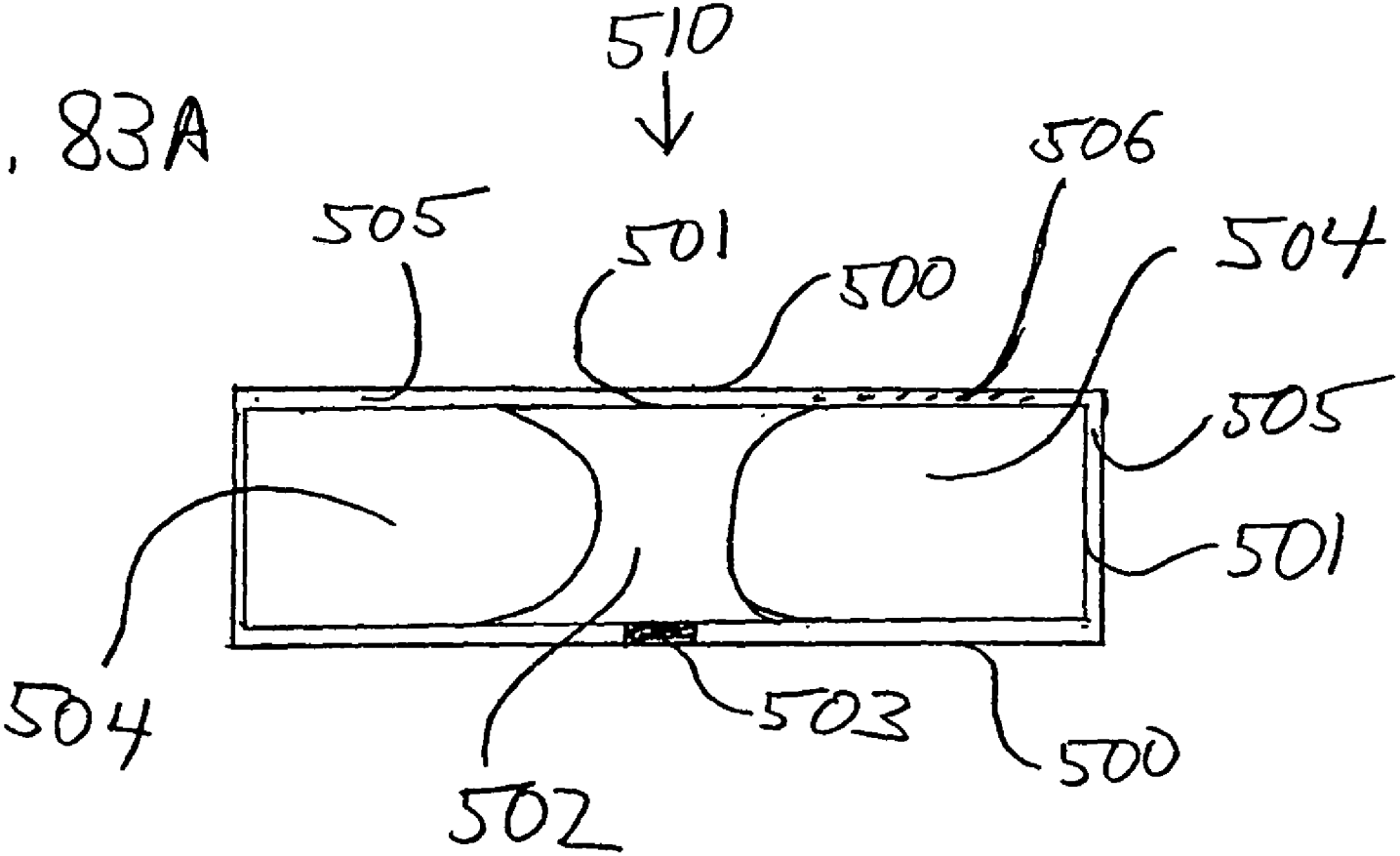
Figure 83B:
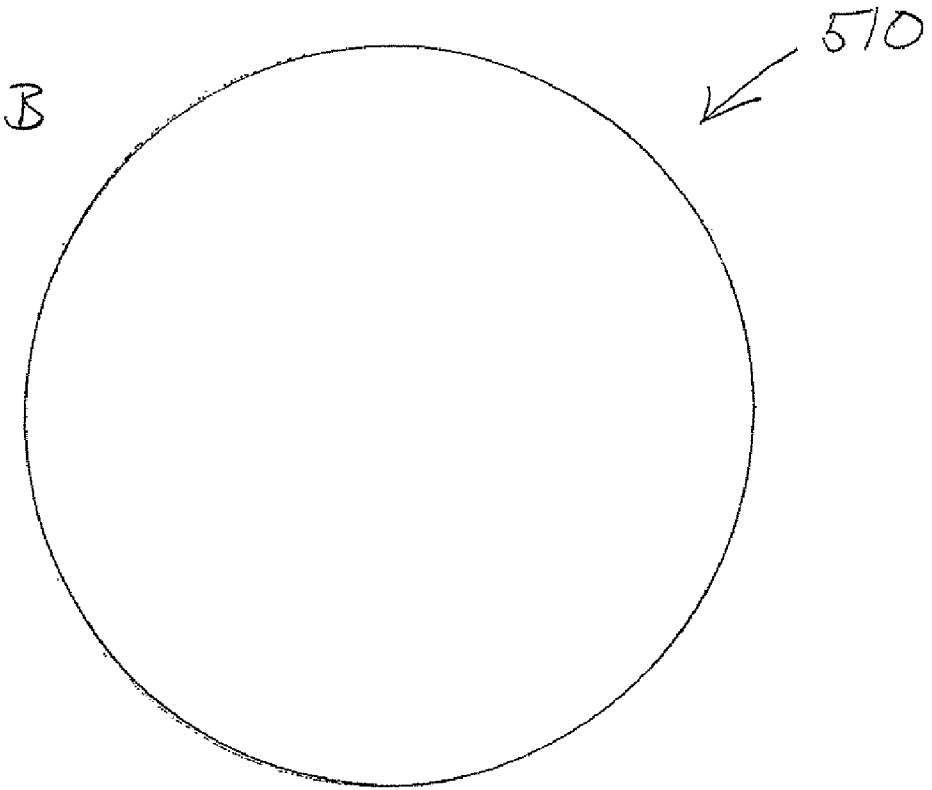

FIG. 83B shows an example embodiment of the device 510 in a horizontal plane view of FIGS. 83A, 84A, 85A, 86A, 87A, and 88A.

Also, any inventive combination that is not explicitly described above in the example shown in FIGS. 87-88 is implicit in the overall invention of this application and, consequently, any part of the example embodiments shown in preceding FIG. 87-88 and/or associated textual specification can be combined with any other part of any one or more other elements of the invention examples described in FIGS. 89-114 and/or associated textual specification and/or, in addition, can be combined with any one or more other elements of the inventive examples shown in earlier FIGS. 1-82 & 115-117 and/or associated textual specification of this application to make new and useful improvements over the existing art.

FIGS. 89-97 and 99 show, in frontal plane cross sections in the heel area, example footwear embodiments with siped compartment/chambers 510 located in footwear soles 28, which are shown with curved sides but which sides can also be planar in another embodiment; or which is shown with flattened inner and outer surfaces underneath the wearer's foot sole but which can be curved in a different embodiment.

FIG. 89 shows an example embodiment with single outer compartment 500 and a single inner compartment/chamber 501.

FIG. 90 shows a similar example embodiment with an attachment 503 between 500 and 501.

FIG. 91 is a similar example embodiment to that shown in FIG. 89 and includes also an inner compartment/chamber 501 with a number of structural elements 502.

FIG. 92 shows an example embodiment with more than one siped compartment/chambers 510, including outer compartment/chambers 500, each with an inner compartment/chamber 501; not shown is another example embodiment with more than one inner compartments/chambers 501 in each of more than one outer compartment/chamber 500, another among many useful variations.

Also, any inventive combination that is not explicitly described above in the examples shown in FIGS. 90-92 is implicit in the overall invention of this application and, consequently, any part of the example embodiments shown in preceding FIGS. 90-92 and/or associated textual specification can be combined with any other part of any one or more other elements of the invention examples described in FIGS. 83-89 and 93-114 and/or associated textual specification and/or, in addition, can be combined with any one or more other elements of the inventive examples shown in earlier FIGS. 1-82 & 115-117 and/or associated textual specification of this application to make new and useful improvements over the existing art.

FIG. 93 shows a similar example embodiment to FIG. 89 and including a number of inner compartments 501 within a single outer compartment/chamber 500, as does FIG. 94. Any practical number of inner compartments 501 can be a useful embodiment of the general invention.

Also, any inventive combination that is not explicitly described above in the examples shown in FIGS. 89 and 93-94 is implicit in the overall invention of this application and, consequently, any part of the example embodiments shown in preceding FIGS. 89 and 93-94 and/or associated textual specification can be combined with any other part of any one or more other elements of the invention examples described in FIGS. 83-88, 90-92, and 95-114 and/or associated textual specification and/or, in addition, can be combined with any one or more other elements of the inventive examples shown in earlier FIGS. 1-82 & 115-117 and/or associated textual specification of this application to make new and useful improvements over the existing art.

FIGS. 95 and 96 show example embodiments wherein the outer compartment/chamber/bladder 500 forms substantially all of the footwear sole, exclusive of the outer sole 149 in the example shown (but the insert 510 can form the outer surface of the footwear sole also). A heel cross-section is shown, but other sections of the sole, such as the forefoot or midfoot can employ this approach, either as separate components or each can be used alone or in combination with others or as substantially all of the sole 28. As shown, both FIGS. 95 and 96 example embodiments include multiple inner compartments 501 in layers.

Also, any inventive combination that is not explicitly described above in the examples shown in FIGS. 95-96 is implicit in the overall invention of this application and, consequently, any part of the example embodiments shown in preceding FIG. 95-96 and/or associated textual specification can be combined with any other part of any one or more other elements of the invention examples described in FIGS. 83-94 and 97-114 and/or associated textual specification and/or, in addition, can be combined with any one or more other elements of the inventive examples shown in earlier FIGS. 1-82 & 115-117 and/or associated textual specification of this application to make new and useful improvements over the existing art.

Additionally, FIG. 97 is an example embodiment similar to FIG. 11N, with the siped chamber 510 invention applied to it.

Also, any inventive combination that is not explicitly described above in the example shown in FIG. 97 is implicit in the overall invention of this application and, consequently, any part of the example embodiments shown in preceding FIG. 97 and/or associated textual specification can be combined with any other part of any one or more other elements of the invention examples described in FIGS. 83-96 and 98-114 and/or associated textual specification and/or, in addition, can be combined with any one or more other elements of the inventive examples shown in earlier FIGS. 1-82 & 115-117 and/or associated textual specification of this application to make new and useful improvements over the existing art.

FIG. 98 shows an example embodiment of chambers 188 for any footwear soles, including conventional, or other flexibility uses with an electromagnetic shock absorption system similar to, for example, the Cadillac™ "Magnetic Ride Control" system, wherein magnetically sensitive metal particles 507 suspended in a shock absorbing fluid 508 are made less fluid in effect by controlling, on for example a millisecond basis, an electromagnetic field-creating circuit 509 that aligns the metal particles 507 into a flow resistant structure. The fluid 508 is thus a magnetorheological fluid, that is, a fluid which generally solidifies into a pasty consistency when subject to a magnetic field.

FIG. 99A shows an example embodiment like FIG. 11N wherein the flow between chambers 188 is controlled by controlling the flow resistance of the fluid 508 by the circuit 509 located to affect the fluid 508 in one or more of the chambers 188; alternatively, the flow can be controlled by the circuit 509 being located between the chambers.

FIG. 99A shows a similar embodiment and view to that shown in FIG. 97, but including an electromagnetic shock absorption system. FIG. 99B is a close-up view of an embodiment like FIG. 89, but showing magnetorheological fluid 508 located within an internal sipe 505.

The FIG. 98-99 example embodiments can be located anywhere in the footwear sole (and can be used in other applications, including non-footwear applications where flexibility increases are useful). The FIG. 98-99 embodiments can be made with any materials common in the footwear art, like those in various Nike Air™ commercial examples, or future equivalents, or with less common materials, such as fibers described earlier, including either elastic fibers or inelastic fibers or a mix. The FIG. 98-99 example embodiments can be of any practical number in a footwear sole, or any shape, of which useful embodiments include regular geometric shapes or irregular shapes, including anthropomorphic shapes; and the number or shape can be symmetrical or asymmetrical, including between right and left footwear soles.

Also, any inventive combination that is not explicitly described above in the examples shown in FIGS. 98-99 is implicit in the overall invention of this application and, consequently, any part of the example embodiments shown in preceding FIG. 98-99 and/or associated textual specification can be combined with any other part of any one or more other elements of the invention examples described in FIGS. 83-97 and 100-114 and/or associated textual specification and/or, in addition, can be combined with any one or more other elements of the inventive examples shown in earlier FIGS. 1-82 & 115-117 and/or associated textual specification of this application to make new and useful improvements over the existing art.

FIG. 100 shows an example embodiment of a flexible insert or component 511 including a single compartment/chamber 161/188 or bladder with an associated internal sipe 505 component, again for any footwear sole, including conventional 22, or other flexibility uses (such as those described above relative to insert 510), to form a single unitary siped compartment or chamber; the sipe 505 can extend to part or all of one side of the single compartment 500, as shown, or the sipe 505 can extend around portions of the other sides of the single compartment 500, FIG. 100B shows an example embodiment in a horizontal plane view of 511. The flexible insert 511 can be inserted during assembly of an article by a maker or manufacturer or is insertable by a user or wearer (into an article like a shoe, for example, as part of a removable midsole insert described above), or integrated into the construction of an article as one or more components.

A benefit of the single siped compartment/chamber 511 is that, as a single unitary component like 510, it can be used in a conventional manner in constructing the footwear sole 28, like that used with a conventional single layer compartment in Nike Air™; i.e. the outer surface of 511 can, as a useful embodiment, adhere to the adjacent material of the footwear sole that contact the 511 component, just as would the outer surface of a single compartment 161 or chamber 188. However, the internal sipe 505 component of the siped compartment/chamber 511 provides flexibility in a footwear sole 28 that is absent in the relatively rigid footwear sole 28 formed with a conventional, single layer compartment 161 or chamber 188.

The siped compartments/chamber 511 can be located anywhere in the footwear sole (and can be used in other, non-footwear applications where flexibility increases are useful). The siped compartments/chambers 511 can be made with any materials common in the footwear art, like those in various Nike Air™ commercial examples, or future equivalents, or with less common materials, such as fibers described earlier, including either elastic fibers or inelastic fibers or a mix. The siped compartment/chambers 511 can be of any practical number in a footwear sole, or any shape, of which useful embodiments include regular geometric shapes or irregular shapes, including anthropomorphic shapes; and the number or shape can be symmetrical or asymmetrical, including between right and left footwear soles.

Also, any inventive combination that is not explicitly described above in the example shown in FIG. 100 is implicit in the overall invention of this application and, consequently, any part of the example embodiments shown in preceding FIG. 100 and/or associated textual specification can be combined with any other part of any one or more other elements of the invention examples described in FIGS. 83-99 and 101-114 and/or associated textual specification and/or, in addition, can be combined with any one or more other elements of the inventive examples shown in earlier FIGS. 1-82 & 115-117 and/or associated textual specification of this application to make new and useful improvements over the existing art.

FIG. 101A shows an example embodiment of a flexible insert or component 513 forming a unitary internal sipe for any footwear sole or orthotic or upper, including conventional sole 22, or other flexibility uses (such as those described above relative to insert 510), the embodiment shown employing a single internal flexibility sipe 505; FIG. 101B shows an example embodiment in a horizontal plane view of FIGS. 101A, 102A, and 103A. Multiple unitary internal sipes 513 can be used independently or synergistically anywhere in a footwear sole in other useful embodiments not shown; the sipes 513 can be stacked proximate to one another or apart, as viewed in a frontal or sagittal plane, for example; or the sipes 513 can overlap, as viewed in a horizontal plane, for example. The flexible insert 513 can be inserted during assembly of an article by a maker or manufacturer or is insertable by a user or wearer (into an article like a shoe, for example, as part of a removable midsole insert described above), or integrated into the construction of an article as one or more components.

In one useful example embodiment, the unitary internal sipe 513 can be made as a separate sole component like an extremely thin conventional gas compartment similar to a Nike Air™ compartment, but without the typical internal compartment structures (which in another useful embodiment can be present in some form if unattached to at least one inner surface so that relative motion between inner surfaces can occur to provide increased flexibility).

A benefit of the unitary internal sipe 513 is that, as a single unitary component like 510 and 511, it can be used in a conventional manner in constructing the footwear sole 28, roughly like that used with a conventional single layer compartment in Nike Air™; i.e. the outer surface of 513 can, as a useful embodiment, adhere to the other portions of the footwear sole that contact the 513 component, just as would the outer surface of a single compartment 161 or chamber 188.

The unitary internal sipe 513 can be located as a separate component anywhere in the footwear sole (and can be used in other applications, including non-footwear applications where flexibility increases are useful). The unitary internal sipe 513 can be made with any materials common in the footwear art, like those in various Nike Air™ commercial examples, or future equivalents, or with less common materials, such as fibers described earlier, including either elastic fibers or inelastic fibers or a mix. The unitary internal sipe 513 can be of any practical number in a footwear sole, or any shape, of which useful example embodiments include regular geometric shapes or irregular shapes, including anthropomorphic shapes; and the number or shape can be symmetrical or asymmetrical, including between right and left footwear soles.

FIG. 102A shows the FIG. 101A example embodiment of a unitary internal sipe 513 positioned as a separate component in an embodiment of a footwear sole 28; alternatively, in another example embodiment not shown, the unitary internal sipe 513 can be completely enclosed in conventional midsole material like PU or EVA or similar material.

FIG. 103A shows the unitary internal sipe 513 in an example embodiment including three separate internal flexibility sipes 505, which in one embodiment can be completely enclosed in conventional midsole material such as PU or EVA or similar material. Generally, unitary internal sipes 513 can thus be subdivided into any practical number of smaller unitary internal sipes that are aggregated together (or can be positioned alone, as described earlier).

Also, any inventive combination that is not explicitly described above in the examples shown in FIGS. 101-102 is implicit in the overall invention of this application and, consequently, any part of the example embodiments shown in preceding FIGS. 101-102 and/or associated textual specification can be combined with any other part of any one or more other elements of the invention examples described in FIGS. 83-100 and 103-114 and/or associated textual specification and/or, in addition, can be combined with any one or more other elements of the inventive examples shown in earlier FIGS. 1-82 & 115-117 and/or associated textual specification of this application to make new and useful improvements over the existing art.

FIG. 104 shows an example embodiment of a flexible insert or component 510 with siped compartments used in the footwear upper 21 for use in embodiments like the Reebok Pump™ and Pump 2.0™; the flexible insert or component 510 can be positioned anywhere in upper 21, including an orthotic; 511 and 513 can be used also.

FIG. 105 shows an example embodiment of a flexible insert or component 510 that is substantially forming the footwear upper 21 in part of the heel and which can be used anywhere else are in all of the upper 21. Note also that the flexible insert or component 510 shown as an example in FIG. 105 also shows the flexible insert or component 510 positions so that it is located in both the upper 21 and in the shoe sole or in both an orthotic and orthotic upper; 511 and 513 can be used also.

Also, any inventive combination that is not explicitly described above in the examples shown in FIGS. 104-105 is implicit in the overall invention of this application and, consequently, any part of the example embodiments shown in preceding FIGS. 104-105 and/or associated textual specification can be combined with any other part of any one or more other elements of the invention examples described in FIGS. 83-103 and 106-114 and/or associated textual specification and/or, in addition, can be combined with any one or more other elements of the inventive examples shown in earlier FIGS. 1-82 & 115-117 and/or associated textual specification of this application to make new and useful improvements over the existing art.

FIGS. 106A and 106B show, in frontal plane cross section, two example embodiments of any helmet 550 for any use with a cushioning helmet liner 551 including an inner flexible insert or component 510; any useful number of flexible inserts or components 510 can be used; flexible insert or components 511 and 513 can be used also. The invention includes any helmet 550 (or part or parts of the helmet) with a liner 551 with one or more internal sipes 505 of any form previously described in this application and any material known in the art located anywhere between the outer surface and inner surface of the helmet liner 551.

FIGS. 106C and 106D show, in frontal plane cross section, two example embodiments of any helmet 550 for any use including one or more internal sipes 505 of any form previously described in this application and any material known in the art located anywhere between the outer surface and inner surface of the helmet 550, and can include, for example, a shock and shear-absorbing media 504 as previously described in this application.

Also, any inventive combination that is not explicitly described above in the examples shown in FIGS. 106A-106D is implicit in the overall invention of this application and, consequently, any part of the example embodiments shown in preceding FIGS. 106A-106D and/or associated textual specification can be combined with any other part of any one or more other elements of the invention examples described in FIGS. 83-105 and 107-114 and/or associated textual specification and/or, in addition, can be combined with any one or more other elements of the inventive examples shown in earlier FIGS. 1-82 & 115-117 and/or associated textual specification of this application to make new and useful improvements over the existing art.

Also, any inventive combination that is not explicitly described above in the example shown in FIG. 106 is implicit in the overall invention of this application and, consequently, any part of the example embodiments shown in preceding FIG. 106 and/or associated textual specification can be combined with any other part of any one or more other elements of the invention examples described in FIGS. 83-105 and 107-114 and/or associated textual specification and/or, in addition, can be combined with any one or more other elements of the inventive examples shown in earlier FIGS. 1-82 & 115-117 and/or associated textual specification of this application to make new and useful improvements over the existing art.

FIGS. 107A and 107B, as well as FIGS. 108A and 108B, show a heel section of a footwear sole or orthotic with an example of a flexible insert or component 510 using specific examples of the structural elements 502 based on commercial examples of Nike Shox™ and Nike Impax™. FIGS. 107A and 108A show an example of those structural elements of foam material contained and affixed within an inner compartment 501. Since use of a foamed material as a media does not require containment to maintain its structure and function (in contrast to a gas, liquid, or most gels), a foamed material do not require a separate inner compartment 501 in order to form an internal sipe 505 with the new outer compartment 500, as noted under the section on compartment 500/501 media 504 below; thus, as shown in the examples of FIGS. 107B and 108B, suitably configured (in terms of interconnections and shape, for example) structural elements 502 of a foamed material can form an integral inner compartment 501 creating an internal sipe 505 with outer compartment 500.

FIG. 108C shows an example in a horizontal plane cross-section of a footwear sole 22 of a device or flexible insert or component 510 in which the inner compartment 501 includes a flexible shank 514 located in the media 504 in the general area of the instep of the shoe sole between the heel area and the forefoot area. The flexible shank 514 can be made of any rigid or semi-rigid material including plastic, metal, and composites including carbon-fiber common in the art and can have sipes 151, of which a vertical slit is one example among a very many well known in the art, that are generally oriented from the area of the heel to the area of the forefoot (including at an angle) so that the shoe sole 22 is flexible enough to flatten in following the deformation motion of a wearer's foot sole in a full range of pronation and supination motion, while remaining sufficiently rigid to support naturally the instep area of the shoe sole 22, a area that is relatively thin (often with tapered thickness) and therefore not ground-contacting in many common footwear soles popular in the art and therefore unstable without shank support, which is well known in the art but which is typically too narrow to support directly the base of a wearer's fifth metatarsal and too rigid in a frontal plane to follow a wearer's lateral pronation/supination motion.

FIG. 108D shows two different examples of versions of the flexible shank 514 in frontal plane cross section. The upper version shows on the left side vertical sipes 151 as slits that penetrate the shank fully and which can be held together, especially during assembly, by an attached fiber (or other material, like foam, for example) layer, while on the right side is another variation of sipes (among the vast number of possibilities discussed in the applicant's prior patents), which are slits 151' that do not fully penetrate the flexible shank 514. The lower version shows an example of inverted V shaped channels as another sipe variation, with the left side showing full or near full penetration (and again, a fiber or other layer can be attached) and the right side showing the channels connected by portions of the flexible shank 514.

Also, any inventive combination that is not explicitly described above in the example shown in FIGS. 107-108 is implicit in the overall invention of this application and, consequently, any part of the example embodiments shown in preceding FIGS. 107-108 and/or associated textual specification can be combined with any other part of any one or more other elements of the invention examples described in FIGS. 83-106 and 109-114 and/or associated textual specification and/or, in addition, can be combined with any one or more other elements of the inventive examples shown in earlier FIGS. 1-82 & 115-117 and/or associated textual specification of this application to make new and useful improvements over the existing art.

FIG. 109 shows an example of any ball 530 with one or more internal sipes 505 of any shape located between the outer surface of the ball and an inner surface. The ball includes a structure like the device or flexible insert 510 above, with an inner compartment 501 in a typical example having a media 504, which can be pressured gas like air that is sealed (like a tennis ball) or controlled by a valve (not shown) common in the commercial art, like a basketball, and with an outer compartment 500. Alternatively, the ball can be structured like a typical golf ball with a solid or relatively solid core (with one or more layers of material) as media 504, which would be separated from the tough outer layer by an internal sipe 505, which can be made to reduce the uncontrolled spin of an offcenter shot like a slice or hook, since any spin imparted to the compartments at the instant of club contact with the ball would become relatively disconnected after contact, with the outer compartment encountering air resistance to its spin, while the core of the inner compartment 501 would encounter friction from the internal sipe 505 surfaces. A similar design and construction approach involving and internal sipe 505 can be used with other devices like skis, bats, tool handles.

Also, any inventive combination that is not explicitly described above in the example shown in FIG. 109 is implicit in the overall invention of this application and, consequently, any part of the example embodiments shown in preceding FIG. 109 and/or associated textual specification can be combined with any other part of any one or more other elements of the invention examples described in FIGS. 83-108 and 110-114 and/or associated textual specification and/or, in addition, can be combined with any one or more other elements of the inventive examples shown in earlier FIGS. 1-82 & 115-117 and/or associated textual specification of this application to make new and useful improvements over the existing art.

FIG. 110A shows in cross-section an example of a tire 535, such as for a wheel of a transportation vehicle, with a device 510; the internal sipe 505 and/or inner compartment 501 can be pressured or not (valve not shown). As shown in the example, inner compartment 501 can have one or more direct attachments 503 to the wheel and the structural elements shown can be made of any useful material as is conventional in the art, including plastic and/or plastic composite and/or carbon fiber. The outer compartment 500 can be abbreviated to cover only part of inner compartment 501, as shown in FIG. 110, (possibly pressure-sealed to the wheel like a conventional automobile tire and wheel); the outer compartment 500 can also be abbreviated further to cover only a lesser portion, including at least a tread portion, which can include rubber (natural or synthetic, as can other or all parts of the outer compartment 500. FIG. 110B shows in a side view cross-section an example of shape of structural elements 502 of the inner compartment 501 (not shown for simplicity).

Also, any inventive combination that is not explicitly described above in the example shown in FIG. 110 is implicit in the overall invention of this application and, consequently, any part of the example embodiments shown in preceding FIG. 110 and/or associated textual specification can be combined with any other part of any one or more other elements of the invention examples described in FIGS. 83-109 and 111-114 and/or associated textual specification and/or, in addition, can be combined with any one or more other elements of the inventive examples shown in earlier FIGS. 1-82 & 115-117 and/or associated textual specification of this application to make new and useful improvements over the existing art.

Figure 111B:
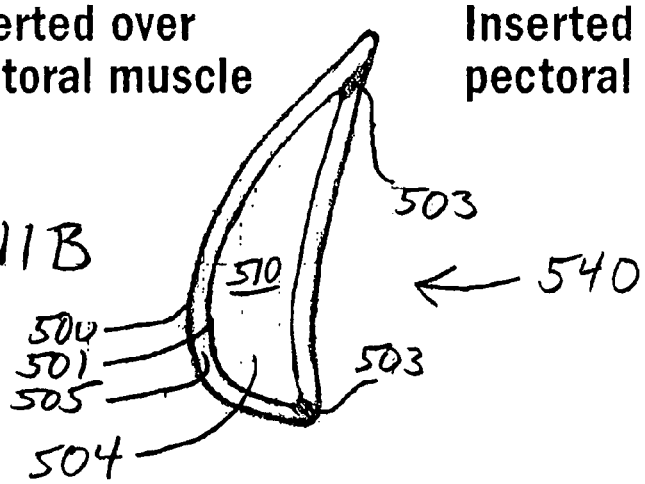

FIG. 111A shows, in sagittal plane cross sections, two examples of prior art human breast implants, the first inserted over pectoral muscle and the second inserted under pectoral muscle. FIG. 111B shows an example of a human breast implant 540 with a siped compartment or chamber 510 in any of the forms described earlier in this application. The breast implant 540 can be located like either of the prior art examples in FIG. 111A or in another position, or, alternatively, can be incorporated in a pad worn externally to the wearer's body. Similar implants 540 incorporating a siped compartment 510 including of anatomical or anatomically compatible shape can be used anywhere else in the human body or in the body of an animal, utilizing any material in the known implant or other art, including new equivalents, for both functional and/or cosmetic purposes. More generally, the implant 540 can be any pad incorporating one or more internal sipes 505 of any 510/511/513 form described earlier in this application located anywhere within the implant 540 (or connecting to the outer surface of 500).

FIGS. 112A-112C show cross sectional examples of any structural or support element 550 in any device, including mechanical, electromechanical, architectural, electronic, optical, or biological, including a beam or strut, or a tool or racquet handle or grip, shaft or body, or head, that incorporates a siped chamber 510 of any form described earlier in this application located anywhere within the structural or support element 550. More generally, the structural or support element 550 can be element incorporating one or more internal sipes 505 of any 510/511/513 form described earlier in this application located anywhere within the structural or support element 550 (or connecting to the outer surface of 500). The sipe or sipes 505 can include one or more sipe media 506 (or 508) the can lubricate the sipe so that 510/511/513 can recoil or rebound after a force impact or load with better flexibility, which can be tuned.

FIG. 113A shows examples of prior art golf clubs. FIG. 112B shows an example of a golf (or other) club head or racket (or tool head or body or handle/grip) 550 with one or more internal sipes 505 of any 510/511/512 form described previously in this application located anywhere within said club 550 (or connecting to the outer surface of 500).

FIG. 114A shows an example of a prior art artificial spinal or intervertebral disk. FIG. 114B shows an example of an artificial spinal or intervertebral disk 560, including any artificial joint disk or any other surgical or prosthetic device for human or animal with one or more internal sipes 505 of any 510/511/513 form previously described within this application located anywhere within the outer surface of disk 560 (or connecting to the outer surface of 500). The artificial disk 560 can be located between endplates 561, as in the example shown in FIG. 114B.

FIGS. 115-117 show examples of shoe soles 22 or 28 or midsole insert or orthotics 145 with several planar sides to approximate curvature from the applicant's WIPO publication No. WO 02,09547, which can be combined with the flexible insert or components 510, 511, or 513.

FIG. 118 shows background information from the automotive industry relating to FIGS. 98 and 99.

FIGS. 119-126 show prior art examples gas bladders of Nike Air™ (119-123), which are FIGS. 12-16 of U.S. Pat. No. 6,846,534 and Zoom Air™ (124-126), which are FIGS. 1-3 of published U.S. Patent Application 2005/0039346 A1.

FIG. 127 shows Adidas 1 shoe sole electronic or electromechanical cushioning system (pg. 96 Popular Science, December 2004).

Any example of a new invention shown in the preceding FIGS. 83-114 and/or associated textual specification can be combined with any other part of any one or more other of the prior art or the applicant's prior invention examples shown in FIGS. 1-3, 5-7, 9, 11-42, 44-52, 55-62, 64-82, and 115-117 and/or combined with any one or more other of subsequent new inventions shown in the examples described in FIGS. 83-114 and/or associated textual specification of this application to make new and useful improvements over the existing art.

The many preceding examples of embodiments of the applicant's inventions, devices or flexible inserts or components 510, 511, and 513, have many useful applications. Generally, the resilient inserts 510, 511, and 513 can be used for cushioning an object or a user, including cushioning equipment and apparel for athletic or non-athletic, occupational, recreational, medical, and other uses, including a footwear sole or upper or orthotic or orthotic upper, as well as over-the-counter footwear inserts, such as pads, insoles or arch supports.

The flexible inserts or components 510, 511, and 513 can be used in any protective clothing, like flexible insert 510 in the interior of the helmet shown in FIG. 106 that can be employed for any typical helmet applications, examples including sports like American football, biking, climbing or hockey and others; occupational, like construction or military or others; and transportation, like motorcycle or other; the flexible insert 510 (or 511 or 513 as useful alternatives) is shown as padding inside a relatively hard or semi-hard outer shell protective material including materials like plastic, carbon-fiber, ceramic, or other composites or metal or combinations thereof. The flexible inserts 510, 511, and 513 can be used in a similar shell construction for athletic or military protective equipment or armor like face masks (which can be attached or integrated into the helmet), neck, shoulder, chest, hip, knee or elbow, shin and forearm guards, thigh or biceps guards, groin, hand, foot, and other guards, pads, protectors, or armor.

Alternatively, flexible inserts or components 510, 511, and 513 can be used as padding alone or with a soft or relatively soft outer surface (without a hard shell) for medical uses (prescriptive or over the counter) like generally in the field of orthopaedics (like braces, such as back or leg or ankle braces and replacement spinal or other disks for spinal or other joint surgery or non-joint surgery), plastic surgery (including breast and other fatty deposit replacement/enhancement implants), prosthetics and pediatrics, and elderly or recuperative care to protect the above noted anatomical structures and for dental applications, like mouth guards (athletic teeth protectors and night guards and braces); in addition, similar padding can be used on artificial limbs and other prosthetic devices or braces and handles or grips, such as for crutches, walkers, canes; or in sports rackets or tools, like hammers, including powered, and handlebars, and guns and rifles and other devices with recoil shock; or for safety padding for crash protection, such padding for automobile dashboards or seat backs (including in airplanes, buses, and crash safety inflatable air bags.

Broadly, the flexible inserts or components 510, 511, and 513 can be usefully employed anywhere that cushioning already is being used, including bed and other furniture cushioning (including for special seating needs, like bicycle or other seats), packaging for shipping, luggage, playground and other flooring, protective padding or cases for equipment of any sort, including portable devices like PC laptops or video players and/or games, cell phones, personal digital assistants (PDA's), and personal digital music players like Apple Ipods™, as examples, such as the mounting of delicate electronic (or other) components like hard-drives or for vibration dampening, such as in automobile structural and body components and connections.

In addition, if not otherwise shown in this application, the example embodiments of the applicant's new inventions shown in the preceding new FIGS. 83-105 and 107-108 and associated textual specification can be usefully employed in combination, for example, with the applicant's previous inventive shoe soles and orthotics that: incorporate uppers that envelope the midsole and/or outsole and/or other features shown in FIGS. 5-7 and 13; incorporate anthropomorphic shapes and/or chambers and/or other features shown in FIGS. 9 and 10; incorporate integral or insertable orthotics or microprocessor-controlled variable pressure and/or other features shown in FIG. 11; incorporate sipes and/or other features shown in FIG. 12; use uniform thickness in rounded sole side or bottom portions and/or other features shown in FIGS. 14-16, 29-46 and 76-77; use increased or decreased (or variable) thickness in rounded sole side portions and/or other features shown in FIGS. 17-20, 24, and 27-28; use increased or decreased density or firmness in rounded sole side or bottom portions and/or other features shown in FIGS. 21-23 and 25-26; use rounding of the outer surface of the midsole on a sole side and/or other features shown in FIG. 43A; employ bent-in rounded sides and/or other features shown in FIG. 47; uses bulges with or without uniform thickness, at important support or propulsion areas and/or features shown in FIGS. 48 and 75; incorporates a flat heel (meaning no heel lift) and/or other features shown in FIGS. 51A-51E; incorporates negative heel embodiments and/or other features shown in FIGS. 49A-49D and 50A-50E; use rounded sides with variable thickness and firmness and/or other features shown in FIG. 52; employs sipes and/or other features shown in FIGS. 53-57, 70-71 and 73; incorporates fiber and/or multiple layers of chambers and/or other features shown in FIGS. 58-60; employ shoe soles or orthotics with sufficient width throughout or at specific portions to support a wearer's bone structures throughout a full range of motion and/or other features shown in FIGS. 61-65 and 72; uses relatively planar sides with rounded underfoot sole portions and/or other features shown in FIGS. 66 and 67; uses similarly shaped rounding on sole sides of different thickness at different parts of the sole and/or other features shown in FIG. 69; uses a variation of heel or forefoot lifts and/or other features shown in FIG. 74;

incorporates planar sections to approximate rounding and/or other features shown in FIGS. 115-117; and/or other features shown in FIGS. 78-82.

Any combination that is not explicitly described above is implicit in the overall invention of this application and, consequently, any part of the inventions shown in the examples shown in preceding FIGS. 83-114 and/or textual specification can be combined with any other part of any one or more other inventions shown in FIGS. 83-114 and/or associated textual specifications and also can be combined with any one or more other inventive examples of earlier FIGS. 1-82 & 114-117 and/or textual specification of this application to make new and useful improvements over the existing art.

New reference numerals used in the preceding FIGS. 83-114 are further defined as follows:

Ref. No 500: Outer compartment 161 or chamber 188 or bladder at least partially or mostly or entirely enclosing a space within the outer compartment/chamber/bladder 500, which can be located anywhere in a footwear sole or upper or both or other article described in this application. Construction and materials can be, as one embodiment example, simpler in shape but otherwise similar to those used in any commercial samples of Nike Air™.

Ref. No 501: Inner compartment 161 or chamber 188 or bladder is located inside the enclosed space of the outer compartment/chamber/bladder 500. Construction and materials of the inner compartment/chamber/bladder 501 can be, as one embodiment example, like those used in any commercial samples of gas bladders in Nike Air™.

Ref. No. 502: Structural element that is optional anywhere within either outer compartment/chamber/bladder 500 or inner compartment/chamber/bladder 501, of which a 501 embodiment is shown; any flexible, resilient material can be used, including structures molded into the shape of (and using the material of) the compartment/chamber/bladder 500 or 501, as is very common in the art, such as many commercial samples of gas bladders used in Nike Air™, as well as foamed plastic or plastic composite or other materials, like Nike Shox™ or Impax™. In addition, other materials can be used directly within a 501/500 compartment or can connected to or through a 501/500 compartment, as in the cushioning components of the shoe sole heel of commercial samples of Adidas 1™, including electromechanical, electronic, and other components. Some devices may benefit from the use of rigid or semi-rigid materials for part or all of a media within a compartment.

Ref. No. 503: Attachment of two compartment/chambers/bladders 500/501, including particularly attachment of outer 500 to inner 501; any practical number of attachments can be used.

Ref. No. 504: Media contained within all or part of compartment/chamber/bladder 500 or 501, particularly 501, can be any useful material, such as gas (including, as an example, gas used in Nike Air™ or ambient air, liquid or fluid, gel, or foam (such as a plastic like PU or EVA or equivalent or rubber (natural or synthetic) or combination of two or more; encapsulation of foam is optional); material particles or coatings, such as dry coatings like Teflon™ can also be used. An optional element in an outer compartment/chamber 500 (or an inner compartment/chamber 501 that itself contains an inner compartment/chamber, as in FIG. 87).

Ref. No. 505: Internal sipe or slit or channel or groove for flexibility, such as between inner and outer compartment/chamber 500/501 (or bladder) surfaces, as one embodiment example; such surfaces can be substantially parallel and directly contact in one useful embodiment example, but are not attached so that at least parts of the two surfaces can move relative to each other, such as to facilitate a sliding motion between surfaces; the surfaces can be in other useful forms that allow portions of the surfaces to be proximate to each other but not contacting in an unloaded condition or in a partially loaded condition or in a maximally loaded condition.

Ref. No. 506: Media of internal sipe 505; media 506 can be any useful material like those used in media 504; media 506 can be located in part or all of 505 to decrease (or increase) sliding resistance between 500/501 or 505 surfaces, for example, to lubricate the surfaces with any suitable material; silicone or Teflon™ can be used, for example; an optional element.

Ref. No. 507: Metal particles.

Ref. No. 508: Shock absorbing fluid containing 507; a magnetorheological fluid.

Ref. No. 509: Electromagnetic field-creating circuit.

Ref. No. 510: A flexible insert or component including siped compartments 161 or chambers 188 or bladders used for example as outer and inner compartments/chambers/bladders 500/501 for footwear soles or orthotics or uppers; a useful embodiment being two or more compartment or chambers (or bladders) 161/188 (or mix) that are separated at least in part by an internal sipe 505, including the example of at least one 501 (either 161/188 or bladder) inside at least one 500 (either 161/188 or bladder) and being separated by an internal sipe 505.

Ref. No. 511: A flexible insert or component including a single compartment 161 or chamber 188 or bladder with an associated internal sipe 505 component.

Ref. No. 512: A wall of flexible insert or component 511 or 513 that is not formed by a compartment 161 or chamber 188 or bladder and that is separated from another wall by an internal sipe 505.

Ref. No. 513: Any flexible insert or component including an internal sipe 505.

Ref. No. 514: A flexible shank located generally in an instep area of a shoe sole and incorporated in a 510/511/513 device described herein previously.

Ref. No. 530: Any ball with a device 510/511/513 described herein previously.

Ref. No. 535: A tire (for a wheel) with a device 510/511/513 described herein previously.

Ref. No. 540: A human breast implant with a device 510/511/513 described herein previously.

Ref. No. 550: Any structural or support element with a device 510/511/513 described herein previously, including a helmet or other apparel or equipment for humans or animals; or a tool, club, or racquet handle, grip, shaft, body, or head; a beam or strut or any other element in any device, including mechanical or architectural.

Ref. No. 560: An artificial spinal or intervertebral disk with a device 510/511/513 described herein previously.

FIGS. 1-82 (sheets 1-69) and pages 1-61 of the associated textual specification above are verbatim from the applicant's PCT application No. PCT/US01/13096, published by WIPO as WO 01/80678 A2 on 1 Nov. 2001; for completeness of disclosure, WO 01/80678 A2 in its entirety is hereby incorporated by reference into this application, as is PCT/US01/23865, published by WIPO as WO 02/09547 A2 on Feb. 7, 2002.

The latter '547 WIPO publication, titled "Shoe Sole Orthotic Structures and Computer Controlled Compartments", is incorporated herein by reference to provide additional information on the applicant's prior orthotic inventions, which can usefully be combined with the orthotic inventions described and claimed in this application. However, the applicant's insertable midsole orthotic 145 in the '547 Publication is very similar to the applicant's removable midsole insert 145 as described in this application and can generally be understood to be the same in structure and materials, although with a principal difference. Typically, an orthotic 145 is designed specifically for an individual wearer, unlike almost all footwear, which is mass-produced using lasts based on average foot shapes for specific populations; the only exception is custom footwear, which is relatively rare and simply cobbled more directly to the individual shape of the wearer's feet. The principal difference is that typically orthotics 145 are designed to be prescribed, for example, by a qualified expert like a health care professional such as a doctor or podiatrist in order to treat a wearer's diagnosed footwear-related problem; generally, orthotics 145 are for prescriptive, therapeutic, corrective, or prosthetic uses.

The applicant's U.S. Pat. Nos. 4,989,349; 5,317,819; 5,544,429; 5,909,948; 6,115,941; 6,115,945; 6,163,982; 6,308,439; 6,314,662; 6,295,744; 6,360,453; 6,487,795; 6,584,706; 6,591,519; 6,609,312; 6,629,376; 6,662,470; 6,675,498; 6,675,499; 6,708,424; 6,729,046; 6,748,674; 6,763,616; and 6,810,606 are hereby incorporated by reference in their entirety into this application for completeness of disclosure.

In the following claims, the term "chamber" means a compartment 161 or a chamber 188 or a bladder and the term "sipe" means a sipe 505 or a slit or a channel or a groove as described in the textual specification % above and associated figures of this application.

The foregoing shoe designs meet the objectives of this invention as stated above. However, it will clearly be understood by those skilled in the art that the foregoing description has been made in terms of the preferred embodiments and various changes and modifications may be made without departing from the scope of the present invention which is to be defined by the appended claims.

What is claimed is:

1. A footwear or orthotic sole comprising:

an outer sole; and a footwear or orthotic device, comprising:

at least one outer chamber, compartment or bladder having an uppermost surface, at least a portion of said uppermost surface being curved concavely relative to an intended wearer's foot location in the shoe, as viewed in a frontal plane cross-section when the shoe sole is upright and in an unloaded condition;

at least one inner chamber, compartment or bladder inside said outer chamber, compartment or bladder;

said at least one inner chamber, compartment or bladder includes:

at least one structural element being located inside the at least one inner chamber, compartment or bladder, said at least one structural element comprising at least a foamed plastic or a blown rubber, and said at least one structural element extending from at least a part of an upper inner surface of said at least one inner chamber, compartment or bladder to at least a part of a lower inner surface of said at least one inner chamber, compartment or bladder, as viewed in a frontal plane cross-section when said footwear or orthotic sole is in an upright, unloaded condition, and a gas located in at least a portion of said at least one inner chamber, compartment or bladder, the portion being outside of said at least one structural element;

said outer chamber compartment or bladder and said inner chamber, compartment or bladder being separated at least in part by an internal sipe;

wherein said internal sipe is formed by an inner surface of said outer chamber, compartment or bladder and an outer surface of said inner chamber, compartment or bladder; and the inner and outer surfaces forming the sipe oppose each other and can move relative to each other in a sliding motion; and at least a portion of said movable surfaces forming the sipe are proximate to each other in an unloaded condition.

2. The device according to claim 1, wherein at least one said chamber, compartment or bladder includes a gas, a foamed plastic or blown rubber and a combination of at least two media selected from a group of a liquid, a fluid, a gel, a foam, a plastic and a rubber.

3. The footwear or orthotic sole according to claim 1, wherein said outer chamber, compartment or bladder entirely encloses a space within said outer chamber, compartment or bladder; said inner chamber, compartment or bladder located inside said enclosed space of said outer chamber, compartment or bladder.

4. The footwear or orthotic sole according to claim 1, wherein at least a portion of said surfaces forming said sipe are separated by a liquid or dry material media when unloaded.

5. The footwear or orthotic sole according to claim 1, wherein at least a portion of said inner chamber, compartment or bladder is attached to an opposing portion of said outer chamber, compartment or bladder.

6. The footwear or orthotic sole according to claim 1, comprising at least two internal chambers, compartments or bladders.

7. The footwear or orthotic sole according to claim 1, wherein said at least one inner chamber, compartment or bladder comprises more than one said structural element.

8. The footwear or orthotic sole according to claim 1, wherein at least one said chamber, compartment or bladder comprises an additional media selected from a group of a liquid, a fluid, a gel, a foam, a foamed plastic and a rubber or blown rubber.

9. The footwear or orthotic sole according to claim 8, wherein at least a portion of said chamber, compartment or bladder media or a media located in said sipe comprises at least a magnetorheological fluid.

10. The footwear or orthotic sole according to claim 9, wherein the footwear or orthotic sole includes a lateral sidemost section located outside a straight vertical line extending through the footwear or orthotic sole at a lateral sidemost extent of the inner surface of the footwear or orthotic sole, as viewed in a frontal plane cross-section when the footwear or orthotic sole is upright and in an unloaded condition;

the footwear or orthotic sole having a medial sidemost section located outside a straight vertical line extending through the footwear or orthotic sole at a medial sidemost extent of the inner surface of the footwear or orthotic sole, as viewed in a frontal plane cross-section when the footwear or orthotic sole is upright and in an unloaded condition; and said outer compartment or chamber or bladder extends at least from said lateral sidemost section of said footwear or orthotic sole to said medial sidemost section of said footwear or orthotic sole, as viewed in a frontal plane cross-section when the footwear or orthotic sole is upright and in an unloaded condition.

11. The footwear or orthotic sole according to claim 10, wherein said outer compartment or chamber or bladder extends into said lateral or medial sidemost section of said footwear or orthotic sole to a height above a lowest point of said inner surface of said footwear or orthotic sole, as viewed in said frontal plane cross-section when the footwear or orthotic sole is upright and in an unloaded condition.

12. The footwear or orthotic sole according to claim 1, wherein at least one chamber, compartment or bladder comprises at least fiber.

13. The footwear or orthotic sole according to claim 1, wherein said at least one said inner chamber, compartment or bladder comprises at least three said structural elements including at least foamed plastic or blown rubber.

14. The footwear or orthotic sole according to claim 1, wherein at least one said inner chamber, compartment or bladder is located in an instep area of the footwear or orthotic sole between the heel area and the forefoot area; and comprises a flexible shank.

15. The footwear or orthotic sole according to claim 1, wherein at least a portion of the outer surface of a lateral or medial side of the outer chamber, compartment or bladder is the outer surface of the footwear or orthotic sole.

16. The footwear or orthotic sole according to claim 1, wherein at least one said inner chamber, compartment or bladder comprises at least one component selected from a group of mechanical, electromechanical, electronic, and microprocessor components.

17. The footwear or orthotic sole according to claim 1, wherein an outer surface of at least one said inner chamber, compartment or bladder is formed from a foamed plastic or a blown rubber.

18. The footwear or orthotic sole according to claim 1, wherein said at least one inner chamber, compartment or bladder has a thickness measured about vertically or horizontally that is nearly the same but less than said outer chamber, compartment or bladder.

19. The footwear or orthotic sole according to claim 1, wherein said footwear or orthotic sole has a thickness profile which is selected from a group of greater thickness in the heel area than in the forefoot area, and greater thickness in the forefoot area than in the heel area.

20. The footwear or orthotic sole according to claim 1, further comprising a midsole and an upper.

21. The footwear or orthotic sole as claimed in claim 20, wherein said footwear or orthotic device is attached to said midsole, said outer sole, or both said midsole and said outer sole.

22. The footwear or orthotic sole according to claim 1, wherein at least a portion of said sipe is a slit.

23. The footwear or orthotic sole according to claim 22, wherein said sipe is a slit.

24. The footwear or orthotic sole according to claim 1, wherein the surfaces forming said sipe are substantially parallel to one another when said footwear or orthotic device is in an unloaded condition.

25. The footwear or orthotic sole according to claim 1, wherein at least a portion of the surfaces forming the sipe are in direct contact with each other when said footwear or orthotic device is upright and in an unloaded condition.

26. The footwear or orthotic sole according to claim 1, wherein an inner surface of one of a medial or lateral side of the footwear or orthotic sole comprises a convexly rounded portion, as viewed in a frontal plane cross-section during an unloaded, upright condition of the footwear or orthotic sole, the convexly rounded portion of the inner surface existing with respect to a section of the footwear or orthotic sole directly adjacent to the convexly rounded portion of the inner surface of the footwear or orthotic sole; and an outer surface of one of the medial and lateral sides of the footwear or orthotic sole comprises a concavely rounded portion, as viewed in a frontal plane cross-section during an unloaded, upright condition of the footwear or orthotic sole, the concavely rounded portion of the outer surface existing with respect to a section of the footwear or orthotic sole directly adjacent to the concavely rounded portion of the outer surface of the footwear or orthotic sole.

27. The footwear or orthotic sole according to claim 26, wherein a rounded portion of at least one of said lateral or medial sides located between a convexly rounded portion of the inner surface of the footwear or orthotic sole and a concavely rounded portion of the outer surface of the footwear or orthotic sole, is uniformly thick between said inner and outer surfaces, said rounded portion having a uniform thickness extending from a ground-contacting portion of said outer surface to a sidemost extent of said outer surface, as viewed in said frontal plane cross-section during an unloaded, upright condition of the footwear or orthotic sole.

28. The footwear or orthotic sole according to claim 1, wherein said outer chamber compartment or bladder and said inner chamber, compartment or bladder are completely separated by said internal sipe.

29. The footwear or orthotic sole according to claim 1, wherein said footwear or orthotic sole has a uniform radial thickness between a lateral extent of each side, when measured in a frontal plane cross-section in an upright, unloaded condition, exclusive of insole or sockliner and upper.

30. The footwear or orthotic sole according to claim 1, wherein a midsole portion of said footwear or orthotic sole is removable or insertable.

31. The footwear or orthotic sole according to claim 1, wherein the footwear or orthotic sole includes a computer.

32. The footwear or orthotic sole according to claim 1, wherein said footwear or orthotic sole has a thickness that is about equal in both the forefoot and heel areas.

33. The footwear or orthotic sole according to claim 1, wherein at least one of said inner chamber, compartment or bladder, and said outer chamber, compartment or bladder has one or more openings therein.

34. The footwear or orthotic sole according to claim 1, wherein at least a portion of said inner chamber, compartment or bladder is attached to an opposite portion of said outer chamber, compartment or bladder at a location inside a sidemost extent of said outer chamber, compartment or bladder.

35. The footwear or orthotic sole as claimed in claim 34, wherein the surfaces forming the sipe move in a sliding motion relative to one another in a loaded condition.

36. A footwear or orthotic sole comprising:

an outer sole; and a footwear or orthotic device, comprising:

an outer chamber, compartment or bladder having an uppermost surface, at least a portion of said uppermost surface being curved concavely relative to an intended wearer's foot location in the shoe, as viewed in a frontal plane cross-section when the shoe sole is upright and in an unloaded condition;

at least one inner chamber, compartment or bladder inside said outer chamber, compartment or bladder, wherein said at least one inner chamber, compartment or bladder comprises at least three structural elements located inside said at least one inner chamber, compartment or bladder, said at least three structural elements comprising at least a foamed plastic or a blown rubber, and each structural element extending from at least a part of an upper inner surface of said at least one inner chamber, compartment or bladder to at least a part of a lower inner surface of said at least one inner chamber, compartment or bladder, as viewed in a frontal plane cross-section when said footwear or orthotic sole is in an upright, unloaded condition, said outer chamber compartment or bladder and said inner chamber, compartment or bladder being separated at least in part by an internal sipe;

wherein said internal sipe is formed by an inner surface of said outer chamber, compartment or bladder and an outer surface of said inner chamber, compartment or bladder; and the inner and outer surfaces forming the sipe oppose each other and can move relative to each other in a sliding motion; and at least a portion of said movable surfaces forming the sipe are proximate to each other in an unloaded condition.

37. An insert device removable from an orthotic or footwear, said orthotic or footwear being configured to be worn directly over an intended wearer's foot, comprising:

an outer chamber, compartment or bladder having an uppermost surface, at least a portion of said uppermost surface being curved concavely relative to an intended wearer's foot location in the shoe, as viewed in a frontal plane cross-section when the shoe sole is upright and in an unloaded condition;

at least one inner chamber, compartment or bladder inside said outer chamber, compartment or bladder, wherein said at least one inner chamber, compartment or bladder includes:

at least one structural element located inside said at least one inner chamber, compartment or bladder, each said structural element comprising at least a foamed plastic or a blown rubber, and said at least one structural element extending from at least a part of an upper inner surface of said at least one inner chamber, compartment or bladder to at least a part of a lower inner surface of said at least one inner chamber, compartment or bladder, and a gas located in at least a portion of said at least one inner chamber, compartment or bladder, the portion being outside said at least one structural element;

said outer chamber compartment or bladder and said inner chamber, compartment or bladder being separated at least in part by an internal sipe;

wherein said internal sipe is formed by an inner surface of said outer chamber, compartment or bladder and an outer surface of said inner chamber, compartment or bladder; and the inner and outer surfaces forming the sipe oppose each other and can move relative to each other in a sliding motion; and at least a portion of said movable surfaces forming the sipe are proximate to each other in an unloaded condition.

38. A removable insert device according to claim 37, wherein said at least one inner chamber, compartment or bladder includes at least one other media selected from a liquid, a gel, a foam, particles and a coating.

39. A removable insert device according to claim 37, wherein at least one said inner chamber, compartment or bladder comprises at least three said structural elements.

* * * * *